US012702906B2

(12) United States Patent
Yi et al.

(10) Patent No.: US 12,702,906 B2
(45) Date of Patent: Aug. 11, 2026

(54) MODULAR GOLF CLUB INCLUDING AN ADJUSTABLE WEIGHT ASSEMBLY

(71) Applicant: Acushnet Company, Fairhaven, MA (US)

(72) Inventors: Sang Yi, Carlsbad, CA (US); Richard L Cleghorn, Oceanside, CA (US); Kyle A. Carr, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 349 days.

(21) Appl. No.: 18/338,852

(22) Filed: Jun. 21, 2023

(65) Prior Publication Data

US 2023/0330499 A1 Oct. 19, 2023

Related U.S. Application Data

(63) Continuation-in-part of application No. 18/193,534, filed on Mar. 30, 2023, which is a continuation-in-part of application No. 17/556,154, filed on Dec. 20, 2021, which is a continuation-in-part of application No. 17/362,488, filed on Jun. 29, 2021, now Pat. No. 11,497,974, which is a continuation-in-part of application No.

(Continued)

(51) Int. Cl.

| | |
|---|---|
| ***A63B 53/06*** | (2015.01) |
| ***A63B 53/08*** | (2015.01) |
| *A63B 53/04* | (2015.01) |

(52) U.S. Cl.

CPC ..... *A63B 53/06* (2013.01); *A63B 53/08* (2013.01); *A63B 2053/0491* (2013.01)

(58) Field of Classification Search

CPC ..... A63B 2053/0491; A63B 53/04; A63B 53/0466; A63B 53/047

See application file for complete search history.

(56) References Cited

U.S. PATENT DOCUMENTS 645,942 A * 3/1900 Cran ..... A63B 53/047 473/336
1,213,382 A * 1/1917 Kent ..... A63B 60/00 403/381

(Continued)

FOREIGN PATENT DOCUMENTS

CN 113491863 A * 10/2021 ..... A63B 53/04
CN 215841488 U * 2/2022 ..... A63B 53/0466

(Continued)

OTHER PUBLICATIONS

European Search Report for EP Application 22166630.8 mailed Aug. 25, 2022 (12 pages).

*Primary Examiner* — Alvin A Hunter
(74) *Attorney, Agent, or Firm* — Mike S. Kim

(57) ABSTRACT

A modular golf club head with an improved adjustable weighting system for an iron and/or wedge type golf club head is disclosed herein. In accordance with the presently disclosed technology, the golf club head may include a body. The body may include a striking face and a back. The back may include a recessed channel. The golf club head may include a weight assembly. The weight assembly may include a movable weight installable within the recessed channel and movable therein, a slidable cover to engage at least part of the recessed channel, and a fastener.

19 Claims, 87 Drawing Sheets

Related U.S. Application Data

17/222,774, filed on Apr. 5, 2021, now Pat. No. 11,439,879, which is a continuation-in-part of application No. 17/122,887, filed on Dec. 15, 2020, now Pat. No. 11,229,827, which is a continuation-in-part of application No. 16/843,640, filed on Apr. 8, 2020, now Pat. No. 10,918,917.

(56) References Cited

U.S. PATENT DOCUMENTS 2,155,830 A * 4/1939 Howard ..... A63B 60/52 473/246
2,460,445 A * 2/1949 Bigler ..... A63B 53/08 473/336
3,199,874 A * 8/1965 Blasing ..... A63B 53/0466 473/335
3,610,630 A * 10/1971 Glover ..... A63B 53/08 473/338
4,085,934 A 4/1978 Churchward
4,340,230 A * 7/1982 Churchward ..... A63B 53/04 473/339
5,050,879 A 9/1991 Sun
5,916,042 A * 6/1999 Reimers ..... A63B 53/04 473/345
6,015,354 A * 1/2000 Ahn ..... A63B 53/04 473/341
6,277,032 B1 * 8/2001 Smith ..... A63B 53/047 473/336
6,409,612 B1 6/2002 Evans
6,592,468 B2 7/2003 Vincent
6,616,547 B2 * 9/2003 Vincent ..... A63B 53/047 473/345
6,663,505 B1 12/2003 Solari
6,811,496 B2 * 11/2004 Wahl ..... A63B 53/047 473/345
6,860,818 B2 3/2005 Mahaffey
6,923,734 B2 * 8/2005 Meyer ..... A63B 60/02 473/341
7,083,530 B2 * 8/2006 Wahl ..... A63B 53/047 337/350
7,108,609 B2 * 9/2006 Stites ..... A63B 53/06 473/335
7,121,956 B2 * 10/2006 Lo ..... A63B 53/047 473/335
7,166,041 B2 * 1/2007 Evans ..... A63B 53/0466 473/335
7,309,295 B2 * 12/2007 Solari ..... A63B 60/02 473/328
7,530,903 B2 * 5/2009 Imamoto ..... A63B 60/02 473/335
7,611,424 B2 * 11/2009 Nagai ..... A63B 60/02 473/335
7,704,163 B2 * 4/2010 Stites ..... A63B 53/047 473/334
7,758,451 B2 * 7/2010 Liang ..... A63B 53/0487 473/349
7,775,905 B2 * 8/2010 Beach ..... A63B 53/0466 473/256
7,806,782 B2 * 10/2010 Stites ..... A63B 53/0466 473/409
7,871,339 B2 * 1/2011 Sanchez ..... A63B 53/047 473/335
7,927,231 B2 * 4/2011 Sato ..... A63B 53/06 473/336
8,016,694 B2 * 9/2011 Llewellyn ..... A63B 53/04 473/335
8,043,167 B2 * 10/2011 Boyd ..... A63B 60/02 473/345
8,192,303 B2 * 6/2012 Ban ..... A63B 53/0466 473/335
8,202,175 B2 * 6/2012 Ban ..... A63B 53/0466 473/345
8,206,243 B2 * 6/2012 Stites ..... A63B 60/02 473/345
8,303,433 B2 * 11/2012 Roach ..... A63B 53/0466 473/335
8,337,325 B2 * 12/2012 Boyd ..... A63B 60/02 473/332
8,409,031 B2 * 4/2013 Stites ..... A63B 60/42 473/335
8,444,505 B2 * 5/2013 Beach ..... A63B 60/00 473/335
8,574,094 B2 * 11/2013 Nicolette ..... A63B 53/04 473/290
8,696,491 B1 * 4/2014 Myers ..... A63B 60/02 473/345
8,790,195 B1 * 7/2014 Myers ..... A63B 53/0466 473/335
8,894,506 B1 * 11/2014 Myers ..... A63B 60/52 473/335
8,968,116 B1 * 3/2015 Myers ..... A63B 60/00 473/335
9,079,080 B2 * 7/2015 Jertson ..... A63B 60/54
9,180,349 B1 * 11/2015 Seluga ..... A63B 53/0466
9,211,453 B1 * 12/2015 Foster ..... A63B 53/06
9,259,627 B1 * 2/2016 Myers ..... A63B 53/04
9,289,660 B1 * 3/2016 Myers ..... A63B 53/0466
9,364,728 B1 * 6/2016 Myers ..... A63B 60/52
9,421,438 B2 * 8/2016 Beno ..... A63B 53/06
9,440,123 B2 * 9/2016 Beno ..... A63B 60/42
9,440,126 B2 * 9/2016 Boyd ..... A63B 60/04
9,561,413 B2 * 2/2017 Nielson ..... A63B 60/00
9,597,561 B1 * 3/2017 Seluga ..... A63B 60/52
9,597,563 B2 * 3/2017 Voshall ..... A63B 53/06
9,616,301 B2 * 4/2017 Clausen ..... A63B 60/00
9,623,302 B1 * 4/2017 Myers ..... A63B 53/0466
9,636,553 B1 * 5/2017 Myers ..... A63B 60/52
9,636,556 B2 * 5/2017 Beck ..... A63B 53/06
9,682,296 B1 * 6/2017 Myers ..... A63B 53/0466
9,694,256 B2 * 7/2017 Myers ..... A63B 53/0466
9,694,261 B2 * 7/2017 Nunez ..... A63B 60/52
9,700,764 B2 * 7/2017 Carter ..... A63B 53/0466
9,707,459 B1 * 7/2017 Myers ..... A63B 60/52
9,731,175 B1 * 8/2017 Myers ..... A63B 60/04
9,757,630 B2 * 9/2017 Mata ..... A63B 53/0466
9,764,210 B2 * 9/2017 Curtis ..... A63B 53/0466
9,868,036 B1 * 1/2018 Kleinert ..... A63B 53/06
9,878,223 B2 * 1/2018 Foster ..... A63B 60/04
9,937,392 B2 * 4/2018 Myers ..... A63B 53/0487
9,993,703 B2 * 6/2018 Beck ..... A63B 60/42
10,004,956 B2 * 6/2018 Beck ..... A63B 71/0622
10,029,161 B2 * 7/2018 Knutson ..... A63B 53/06
10,065,094 B2 * 9/2018 Wallin ..... A63B 53/0466
10,071,293 B2 * 9/2018 Green ..... A63B 60/42
10,183,203 B1 1/2019 Yi
10,188,916 B2 * 1/2019 Harbert ..... A63B 60/00
10,213,665 B1 * 2/2019 Day ..... A63B 53/0466
10,258,839 B2 * 4/2019 Beck ..... A63B 71/0622
10,391,371 B2 * 8/2019 Luttrell ..... A63B 53/0466
10,398,952 B1 * 9/2019 Yi ..... A63B 53/0433
10,543,406 B2 * 1/2020 Carter ..... A63B 53/0466
10,556,161 B2 * 2/2020 Jertson ..... A63B 53/06
10,576,337 B2 * 3/2020 Soracco ..... A63B 60/52
10,596,428 B1 * 3/2020 Rumble ..... A63B 60/02
10,695,628 B1 * 6/2020 Yi ..... A63B 53/08
10,918,917 B2 * 2/2021 Northcutt ..... A63B 53/0466
10,926,143 B2 * 2/2021 Bennett ..... A63B 60/02
11,013,965 B2 * 5/2021 Story ..... A63B 60/00
11,052,294 B2 * 7/2021 Carter ..... A63B 60/00
11,090,536 B2 * 8/2021 Bennett ..... A63B 53/08
11,229,827 B2 * 1/2022 Yi ..... A63B 53/047
11,413,509 B2 * 8/2022 Carter ..... A63B 60/00
11,439,877 B2 * 9/2022 Northcutt ..... A63B 60/04
11,439,878 B2 * 9/2022 Bennett ..... A63B 53/047
11,439,879 B2 * 9/2022 Yi ..... A63B 60/52
11,497,974 B2 * 11/2022 Northcutt ..... A63B 53/0466
11,504,589 B2 * 11/2022 Tassistro ..... A63B 53/0475
11,684,830 B2 * 6/2023 Mizutani ..... A63B 53/0466 473/345

(56) References Cited

U.S. PATENT DOCUMENTS

| | | | | |
|---|---|---|---|---|
| 11,691,057 | B2 * | 7/2023 | Bennett | A63B 53/08 473/335 |
| 11,813,491 | B2 * | 11/2023 | Cleghorn | A63B 53/06 |
| 11,819,741 | B2 * | 11/2023 | Oldknow | A63B 53/06 |
| 11,911,672 | B1 * | 2/2024 | Hettinger | A63B 53/06 |
| 12,005,327 | B2 * | 6/2024 | Hettinger | A63B 60/02 |
| 12,070,666 | B2 * | 8/2024 | Nielson | A63B 53/06 |
| 12,090,377 | B2 * | 9/2024 | Beach | A63B 53/0466 |
| 12,102,895 | B2 * | 10/2024 | Funaki | A63B 53/0466 |
| 12,246,227 | B2 * | 3/2025 | Bennett | A63B 53/08 |
| 2005/0101408 | A1 * | 5/2005 | Sanchez | A63B 53/0466 473/345 |
| 2006/0122004 | A1 * | 6/2006 | Chen | A63B 53/0466 473/335 |
| 2006/0240908 | A1 * | 10/2006 | Adams | A63B 60/02 473/335 |
| 2007/0135231 | A1 * | 6/2007 | Lo | A63B 53/0466 473/336 |
| 2008/0020861 | A1 * | 1/2008 | Adams | A63B 60/00 473/336 |
| 2008/0039228 | A1 * | 2/2008 | Breier | A63B 60/00 473/345 |
| 2008/0261715 | A1 * | 10/2008 | Carter | A63B 53/047 473/335 |
| 2010/0075773 | A1 * | 3/2010 | Casati, Jr. | A63B 59/00 473/519 |
| 2013/0090185 | A1 * | 4/2013 | Boyd | A63B 60/02 473/337 |
| 2014/0038746 | A1 * | 2/2014 | Beach | A63B 53/0466 473/335 |
| 2015/0190687 | A1 * | 7/2015 | Clausen | A63B 53/0475 473/335 |
| 2015/0306473 | A1 * | 10/2015 | Breier | A63B 53/06 473/409 |
| 2015/0306475 | A1 * | 10/2015 | Curtis | A63B 53/06 473/345 |
| 2015/0321055 | A1 * | 11/2015 | Golden | A63B 60/42 473/334 |
| 2016/0129323 | A1 * | 5/2016 | Myers | A63B 53/0466 473/338 |
| 2016/0271464 | A1 * | 9/2016 | Murphy | A63B 53/06 |
| 2018/0056154 | A1 * | 3/2018 | Wallin | A63B 60/02 |
| 2018/0065005 | A1 * | 3/2018 | Cleghorn | A63B 53/0466 |
| 2019/0022481 | A1 * | 1/2019 | Mine | A63B 60/52 |
| 2019/0105544 | A1 | 4/2019 | Carter | |
| 2019/0192928 | A1 * | 6/2019 | Soracco | A63B 60/04 |
| 2019/0329106 | A1 * | 10/2019 | Luttrell | A63B 53/0466 |
| 2020/0330834 | A1 * | 10/2020 | Northcutt | A63B 53/045 |
| 2020/0330835 | A1 * | 10/2020 | Bennett | A63B 53/06 |
| 2020/0330836 | A1 * | 10/2020 | Bennett | A63B 60/02 |
| 2021/0128994 | A1 * | 5/2021 | Yi | A63B 53/047 |
| 2021/0138318 | A1 * | 5/2021 | Northcutt | A63B 53/0466 |
| 2021/0138319 | A1 * | 5/2021 | Bennett | A63B 53/047 |
| 2021/0299525 | A1 * | 9/2021 | Mizutani | A63B 53/04 |
| 2021/0402270 | A1 * | 12/2021 | Bennett | A63B 60/02 |
| 2022/0111263 | A1 * | 4/2022 | Yi | A63B 53/0433 |
| 2023/0271066 | A1 * | 8/2023 | Mizutani | A63B 53/0466 473/345 |
| 2023/0285817 | A1 * | 9/2023 | Bennett | A63B 60/02 |
| 2023/0330499 | A1 * | 10/2023 | Yi | A63B 60/52 |
| 2023/0338794 | A1 * | 10/2023 | Hettinger | A63B 53/047 |
| 2024/0066366 | A1 * | 2/2024 | Yi | A63B 53/047 |
| 2024/0066367 | A1 * | 2/2024 | Hettinger | A63B 60/02 |
| 2024/0066368 | A1 * | 2/2024 | Ines | A63B 53/08 |
| 2024/0157206 | A1 * | 5/2024 | Hettinger | A63B 53/047 |
| 2024/0226673 | A1 * | 7/2024 | Cleghorn | A63B 60/02 |
| 2024/0316420 | A1 * | 9/2024 | Yi | A63B 53/08 |
| 2024/0316422 | A1 * | 9/2024 | Yi | A63B 60/52 |
| 2024/0359064 | A1 * | 10/2024 | Hettinger | A63B 53/06 |
| 2025/0025755 | A1 * | 1/2025 | Yi | A63B 60/02 |

FOREIGN PATENT DOCUMENTS

| | | | | | |
|---|---|---|---|---|---|
| CN | 115245667 | A | * | 10/2022 | A63B 53/04 |
| CN | 118217607 | A | * | 6/2024 | A63B 53/06 |
| EP | 4070863 | A1 | * | 10/2022 | A63B 60/04 |
| EP | 4070863 | B1 | * | 6/2024 | A63B 53/04 |
| EP | 4400184 | A2 | * | 7/2024 | A63B 60/02 |
| GB | 2407781 | A | * | 5/2005 | A63B 53/047 |
| JP | 01043278 | | | 2/1989 | |
| JP | 2005296582 | | | 10/2005 | |
| JP | 2005296582 | A | * | 10/2005 | |
| JP | 2005323978 | | | 11/2005 | |
| JP | 2005323978 | A | * | 11/2005 | |
| JP | 2006320493 | | | 11/2006 | |
| JP | 2006320493 | A | * | 11/2006 | |
| JP | 2010069106 | | | 4/2010 | |
| JP | 2010069106 | A | * | 4/2010 | A63B 53/0466 |
| JP | 2010136772 | | | 6/2010 | |
| JP | 2010136772 | A | * | 6/2010 | A63B 60/02 |
| JP | 2010148702 | | | 7/2010 | |
| JP | 2010148702 | A | * | 7/2010 | A63B 53/04 |
| JP | 2010252964 | | | 11/2010 | |
| JP | 2010252964 | A | * | 11/2010 | |
| JP | 2012125291 | | | 7/2012 | |
| JP | 2012125291 | A | * | 7/2012 | |
| JP | 2012139450 | | | 7/2012 | |
| JP | 2012139450 | A | * | 7/2012 | |
| JP | 2014223548 | | | 12/2014 | |
| JP | 2014223548 | A | * | 12/2014 | A63B 60/02 |
| JP | 2016179061 | A | * | 10/2016 | A63B 53/0408 |
| JP | 2020175196 | A | * | 10/2020 | A63B 53/047 |
| JP | 2021151381 | | | 9/2021 | |
| JP | 2021151381 | A | * | 9/2021 | A63B 53/04 |
| JP | 2022160000 | A | * | 10/2022 | A63B 53/06 |
| JP | 2023091773 | A | * | 6/2023 | A63B 53/06 |
| JP | 2024035113 | A | * | 3/2024 | A63B 53/06 |
| JP | 7483475 | B2 | * | 5/2024 | A63B 60/02 |
| JP | 3246905 | U | * | 6/2024 | A63B 53/0475 |
| JP | 3249412 | U | * | 12/2024 | A63B 60/52 |
| KR | 20220138878 | A | * | 10/2022 | A63B 53/04 |
| KR | 20230094163 | A | * | 6/2023 | A63B 53/06 |
| KR | 20240001700 | U | * | 10/2024 | A63B 53/0475 |

* cited by examiner

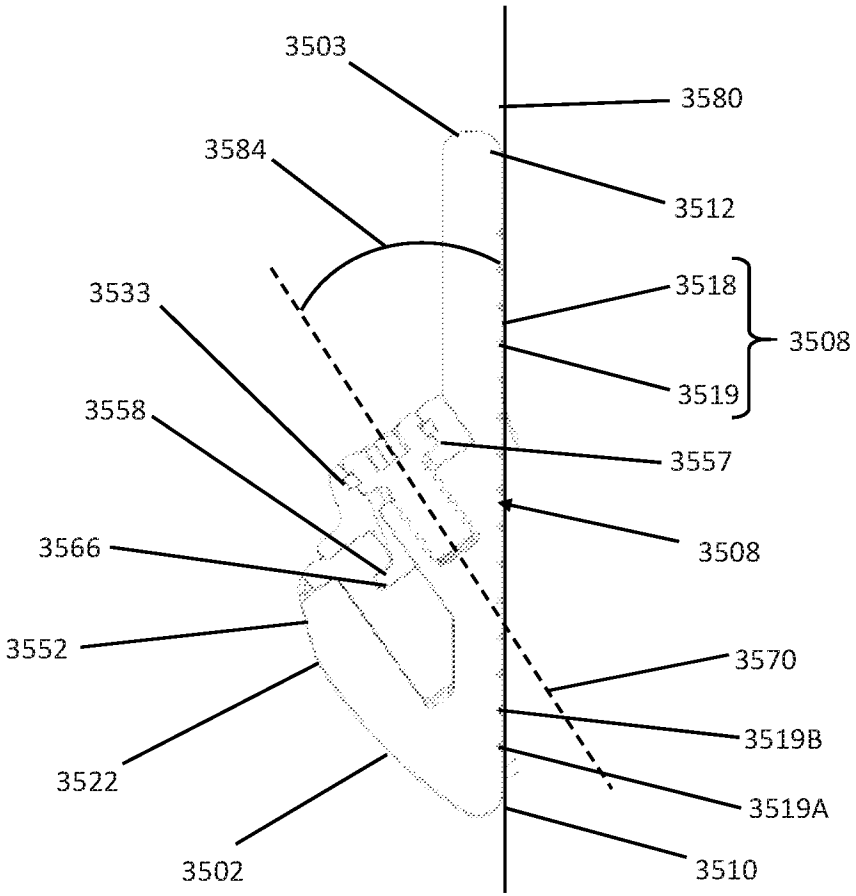
FIG. 7
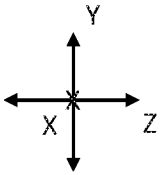

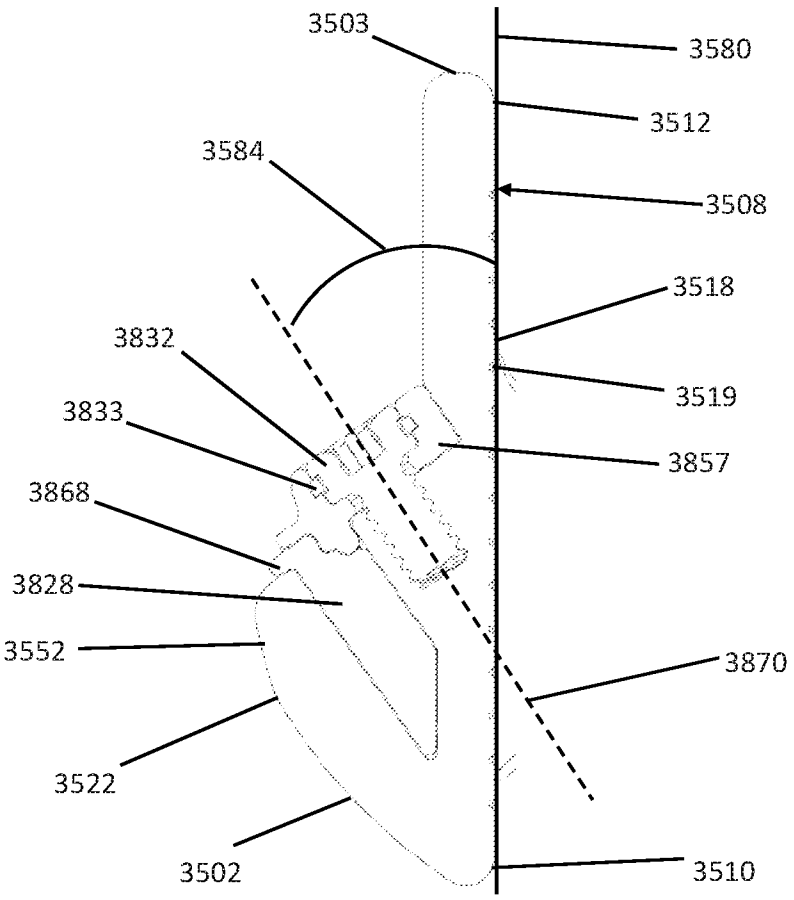
FIG. 15
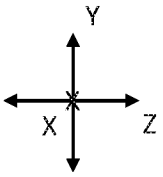

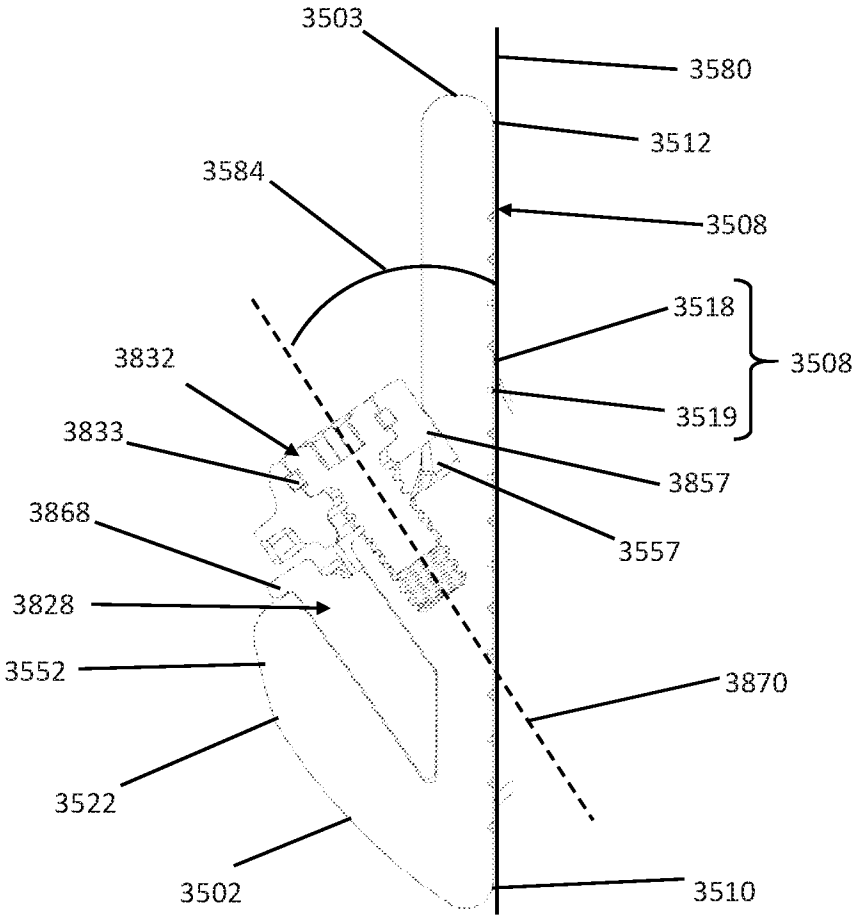
FIG. 16
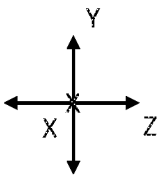

MODULAR GOLF CLUB INCLUDING AN ADJUSTABLE WEIGHT ASSEMBLY

CROSS-REFERENCE TO RELATED APPLICATIONS

This application is a continuation-in-part of U.S. patent application Ser. No. 18/193,534, filed on Mar. 30, 2023, which is a continuation-in-part of U.S. patent application Ser. No. 17/556,154, filed on Dec. 20, 2021, the disclosures of which are hereby incorporated by reference in their entireties.

BACKGROUND

The flight characteristics of a golf ball after being struck by a golf club are dependent not only on the swing of the golf club but also on the golf club itself. For example, flight characteristics of the golf ball, such as fades, draws, launch angles, ball spin, and speed are impacted by the design of the golf club. By adjusting one or more design properties of the golf club, the flight characteristics of the golf ball can be improved, thereby increasing golf club performance. In some examples, adjusting a center of gravity (CG) and/or a moment of inertia (MOI) of a head of the golf club through selective weight placement impacts the flight characteristics of the golf ball. However, these adjustable weights need to be both securely attached to the golf club head and selectively moveable. As such, improvements to adjustable weight assemblies for golf club heads are desired.

SUMMARY

Embodiments of the presently disclosed technology may include a modular golf club head. In accordance with some aspects of the presently disclosed technology, a modular golf club head may include a body. The body may include a striking face and a back extending rearward from at least a part of the striking face. The back may include a recessed channel and a weight assembly. The weight assembly may include a movable weight installable within the recessed channel and movable therein. The weight assembly may include a slidable cover to engage at least part of the recessed channel. The weight assembly may include a fastener to secure the slidable cover to the body.

In Embodiments, the Slidable Cover May Include a Cover Through Hole. The Cover Through Hole May be on a Toe End of the Cover.

In embodiments, an axis of the cover through hole may be substantially parallel to a toe-to-heel axis.

In embodiments, an axis of the cover through hole may be at an angle theta θ. The angle theta θ may be measured from a heel-to-toe axis toward a bottom-to-top axis.

In embodiments, the cover through hole may be substantially parallel to a back-to-front axis.

In embodiments, the slidable cover may slide in at an angle theta θ. The angle theta θ may be measured from a heel-to-toe axis toward a bottom-to-top axis.

In embodiments, the slidable cover may slide in horizontally.

In embodiments, installing the weight assembly may provide a uniform appearance to the modular golf club head.

In embodiments, the slidable cover may include a first cover portion and a second cover portion. The first cover portion may include a first material and a second cover portion may include a second material. The first material may be denser than the second material.

In embodiments, the movable weight may include a first weight portion and a second weight portion. The first weight portion may include a third material and a second weight portion may include a fourth material. The third material may be denser than the fourth material.

In accordance with some aspects of the presently disclosed technology, modular golf club head may include a body. The body may include a striking face and a back extending rearward from at least a part of the striking face. The back may include a recessed channel and a weight assembly. The weight assembly may include a movable weight installable within the recessed channel and movable therein. The weight assembly may include a slidable cover to engage at least part of the recessed channel. The slidable cover may include a cover through hole. The cover through hole may be on a toe end of the cover. An axis of the cover through hole may run substantially parallel to a heel-to-toe axis. The weight assembly may include a fastener to secure the slidable cover to the body. The fastener may be insertable into the cover through hole.

In embodiments, the cover may include a first cover portion and a second cover portion. The first cover portion may include a first material and a second cover portion may include a second material. The first material may be denser than the second material.

In embodiments, the movable weight may include a first weight portion and a second weight portion. The first weight portion may include a third material and a second weight portion may include a fourth material. The third material may be denser than the fourth material.

In accordance with some aspects of the presently disclosed technology, modular golf club head may include a body. The body may include a striking face and a back extending rearward from at least a part of the striking face. The back may include a recessed channel and an weight assembly. The weight assembly may include a movable weight installable within the recessed channel and movable therein. The weight assembly may include a slidable cover to engage at least part of the recessed channel. The slidable cover may at least partially cover the recessed channel and the movable weight. The slidable cover may include a cover through hole. The cover through hole may be on a toe end of the cover. The weight assembly may include a fastener to secure the slidable cover to the body. The fastener may be insertable into the cover through hole.

In embodiments, a vertical gap may be provided between a bottom of slidable cover and a top of the recessed channel in a locked configuration, providing a visual indication of a position of the movable weight along the recessed channel.

In embodiments, an axis of the cover through hole may be at an angle theta θ. The angle theta θ may be measured from a heel-to-toe axis toward a bottom-to-top axis.

In embodiments, an axis of the cover through hole may be substantially parallel to a back-to-front axis.

In embodiments, an axis of the cover through hole may be substantially perpendicular to the striking face.

In embodiments, the cover may include a first cover portion and a second cover portion. The first cover portion may include a first material and a second cover portion may include a second material. The first material may be denser than the second material.

In embodiments, the movable weight may include a first weight portion and a second weight portion. The first weight portion may include a third material and a second weight portion may include a fourth material. The third material may be denser than the fourth material.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

FIG. 7 is a cross-sectional view in the toe-to-heel direction of the golf club head of FIG. 1 taken along line 110*a*-110*a* in FIG. 6 and with the weight assembly in the locked configuration.

FIG. 15 is cross-sectional view in the toe-to-heel direction of the golf club head of FIG. 12 taken along line 116*a*-116*a* and when the weight assembly is in the locked configuration.

FIG. 16 is cross-sectional view in the toe-to-heel direction of the golf club head of FIG. 12 taken along line 116*a*-116*a* and when the weight assembly is in the unlocked configuration.

DETAILED DESCRIPTION

The disclosures of U.S. Pat. Nos. 11,497,974, 11, 439, 879, 11, 229, 827, 10, 918, 917. U.S. Pat. Nos. 11,090,536, 10, 926, 143, and 10,695,628 are also hereby incorporated by reference in their entireties.

The technologies described herein contemplate a golf club head, such as a fairway metal, driver, or other golf club head, that includes an adjustable weight assembly. Through the weight balance of the golf club head, the flight characteristics of the golf ball can be improved, thereby increasing golf club performance. In the examples described herein, the weight assembly enables for the CG and/or MOI of a head of the golf club to be adjusted through selective weight placement to impact the flight characteristics of the golf ball, such as fades, draws, launch angles, ball spin, and speed. Additionally or alternatively, the weight assembly enables for the swing weight of the golf club head to be adjustable (e.g., increasing or decreasing the weight of the club head).

In examples, the present technologies provide a golf club head with a recessed channel defined therein. A slidable weight is disposed at least partially within the channel and secured therein by a cover and a fastener. The cover is configured to retain the weight within the channel indirectly so that the fastener never engages with the weight. This configuration enables for the size, shape, and/or density of the weight to be defined so that the CG and MOI of the golf club head can be finely tuned. Additionally, the cover includes additional features that increase securement of the weight within the channel and reduce undesirable rattling or movement during the golf club swing. Furthermore, the weight assemblies described herein allow for the weight to be adjusted quickly and easily without requiring any component to be fully detached from the club head. Thereby reducing lost or misplaced components during club head adjustment. In an aspect, the weight is engaged with the cover so that the two components can move together with respect to the golf club head. Additionally, the weight is restricted from tilting relative to the cover so as to reduce or prevent binding of the weight within the channel.

Figure 1:
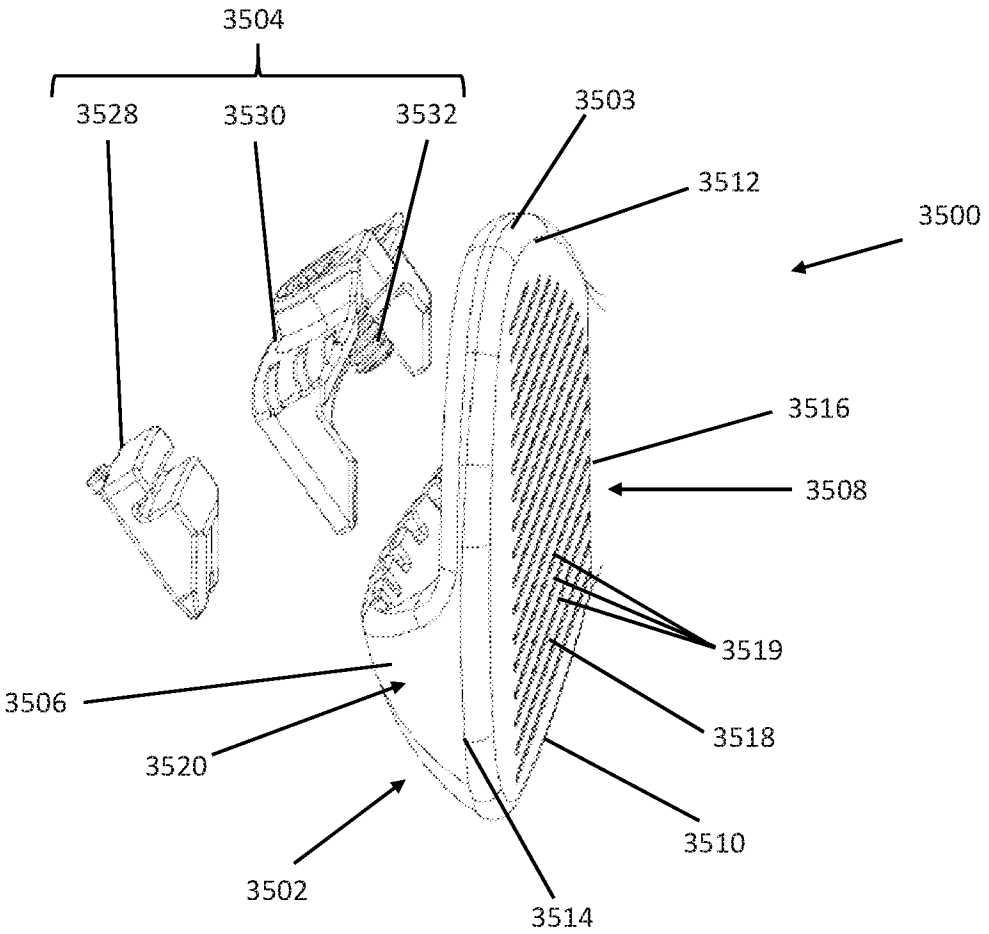
FIG. 1 is a partially exploded, perspective view of an iron-type golf club head with another weight assembly.
Figure 2:
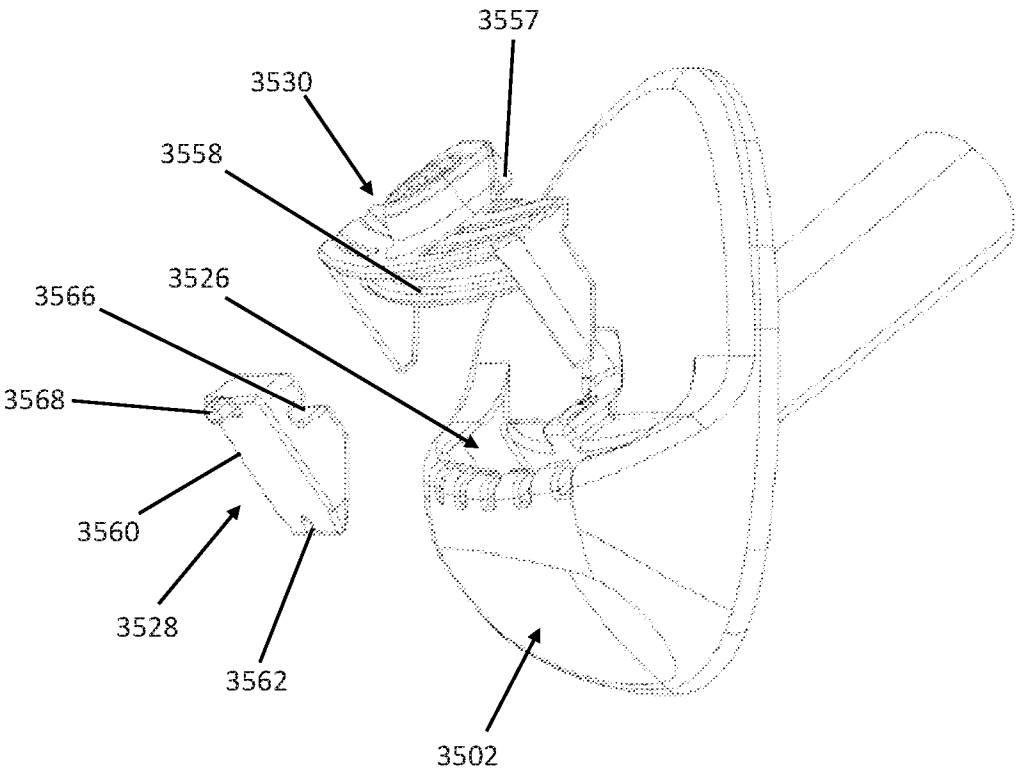
FIG. 2 is another partially exploded, perspective view of the golf club head of FIG. 1.
Figure 3:
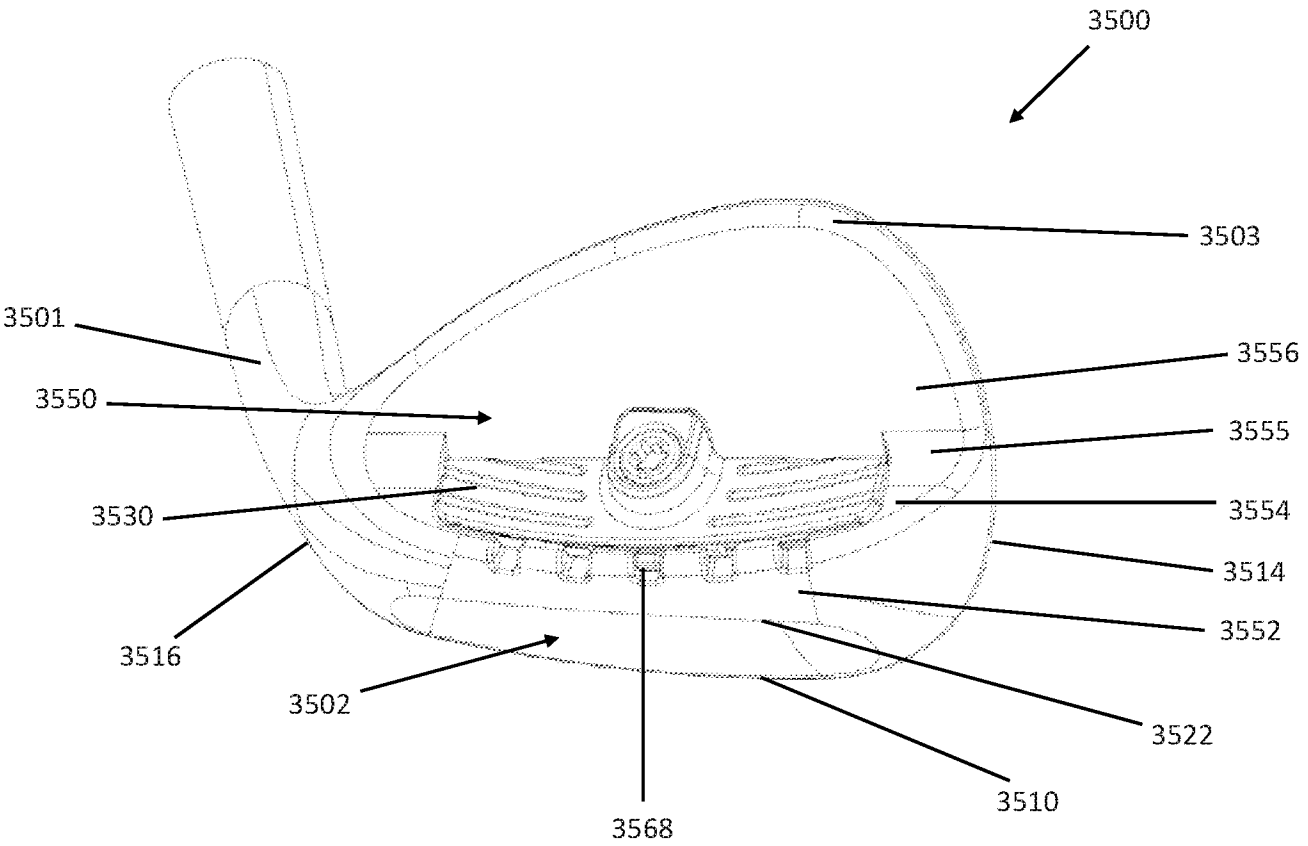
FIG. 3 is a back view of the golf club head of FIG. 1 with the weight assembly in a locked configuration.
Figure 4:
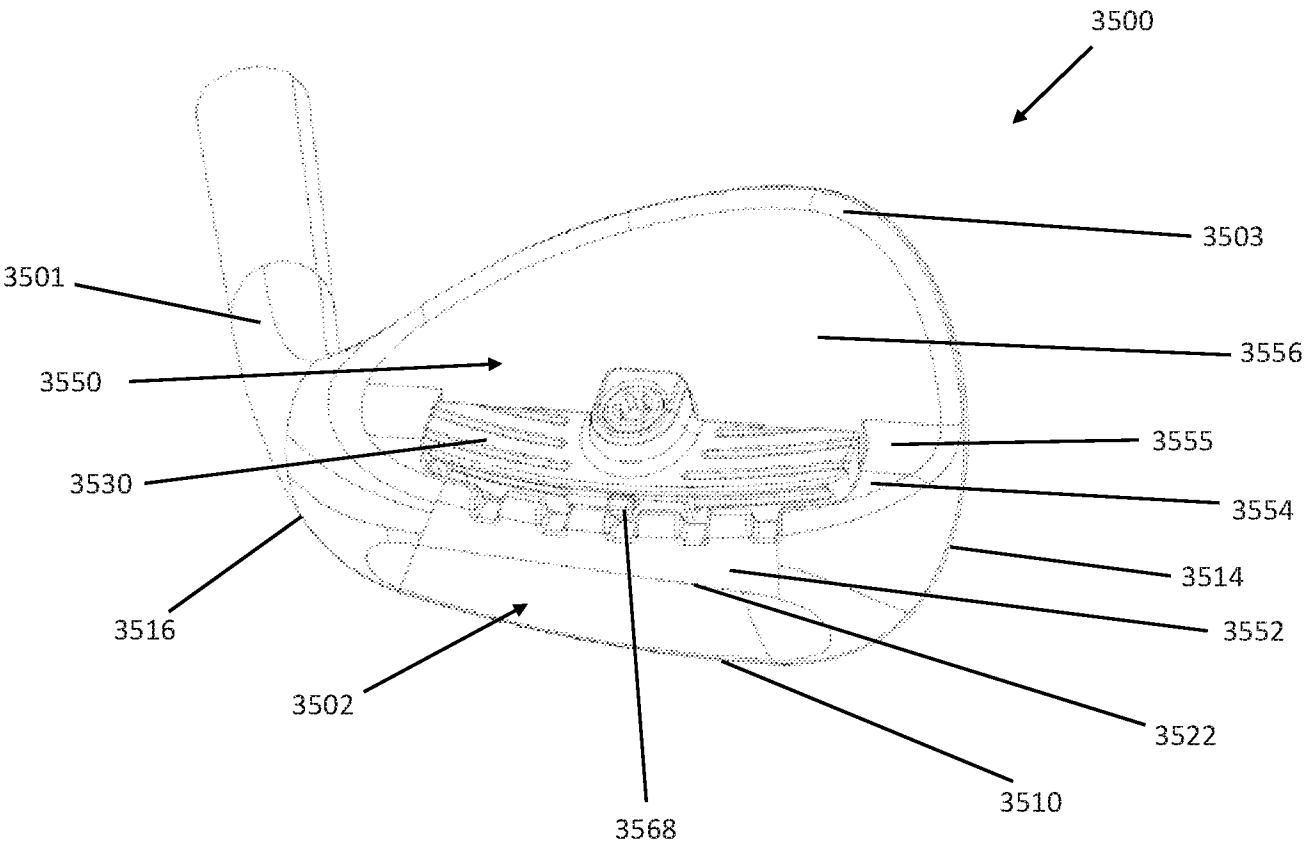
FIG. 4 is another back view of the golf club head of FIG. 1 with the weight assembly in an unlocked configuration.
Figure 5:
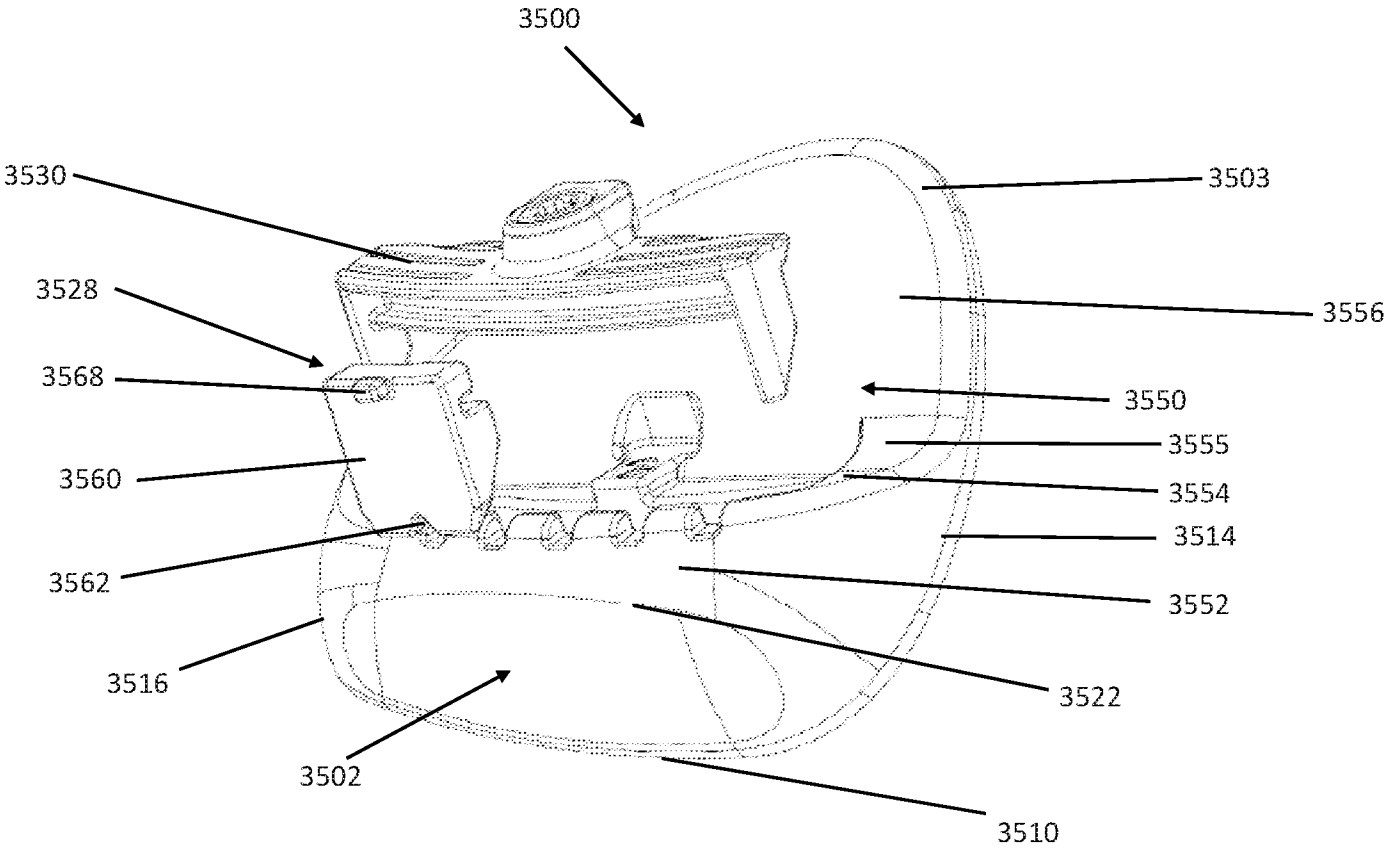
FIG. 5 is another partially exploded, perspective view of the golf club head of FIG. 1.
Figure 6:
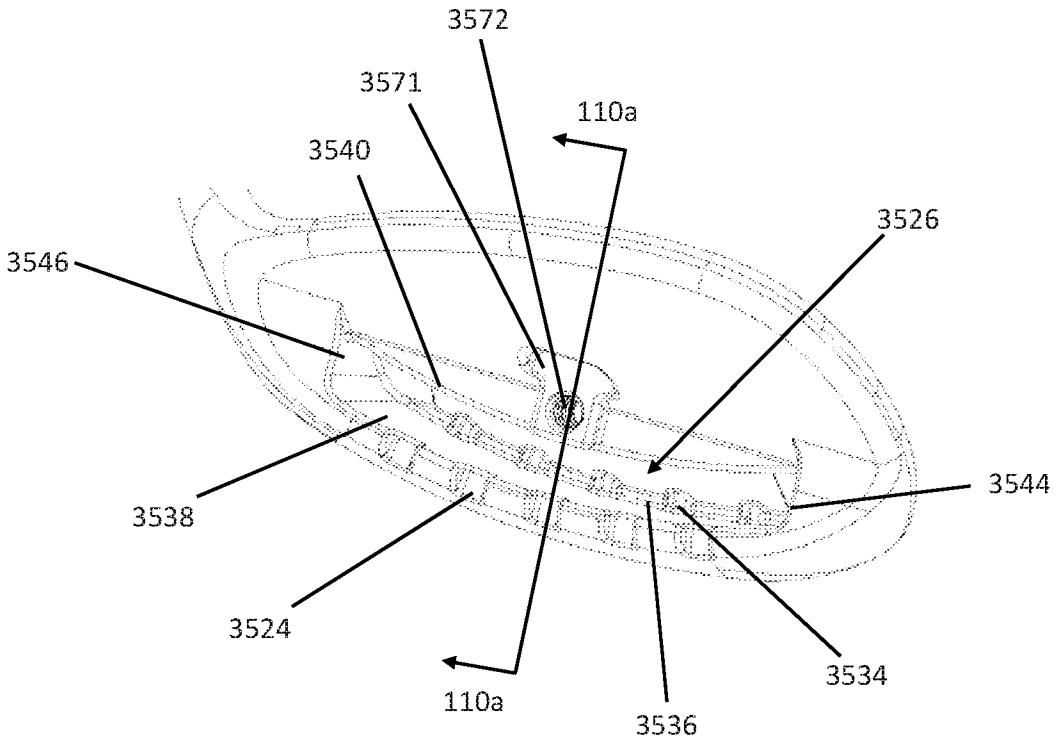
FIG. 6 is a top view of the golf club head of FIG. 1 without the weight assembly.
Figure 8:
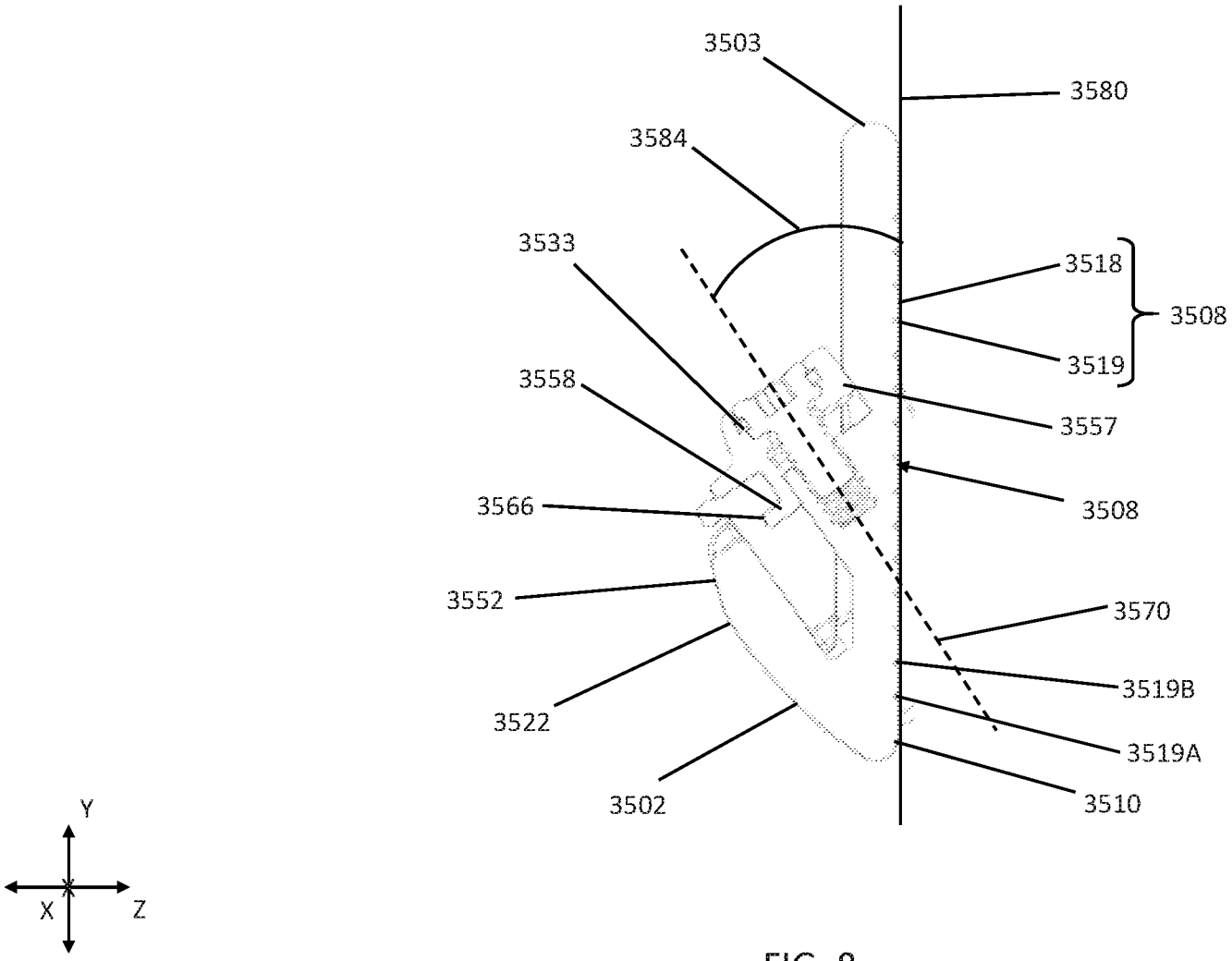
FIG. 8 is a cross-sectional view in the toe-to-heel direction of the golf club head of FIG. 1 taken along line 110*a*-110*a* in FIG. 6 and with the weight assembly in the unlocked configuration.

FIG. 1 is a partially exploded, perspective view of an iron-type golf club head 3500 with another weight assembly 3504. In particular, the golf club head 3500 is a wedge type golf club head. FIG. 2 is another partially exploded, perspective view of the golf club head 3500 of FIG. 1. FIG. 3 is a back view of the golf club head 3500 of FIG. 1 with the weight assembly 3504 in a locked configuration. FIG. 4 is another back view of the golf club head 3500 of FIG. 1 with the weight assembly 3504 in an unlocked configuration. FIG. 5 is another partially exploded, perspective view of the golf club head 3500 of FIG. 1. FIG. 6 is a top view of the golf club head 3500 of FIG. 1 without the weight assembly 3504. FIG. 7 is a cross-sectional view in the toe-to-heel direction of the golf club head 3500 of FIG. 1 taken along line 110*a*-110*a* in FIG. 6 and with the weight assembly 3504 in the locked configuration. FIG. 8 is a cross-sectional view in the toe-to-heel direction of the golf club head 3500 of FIG. 1 taken along line 110*a*-110*a* in FIG. 6 and with the weight assembly 3504 in the unlocked configuration. In FIG. 7 and FIG. 8, the golf club head is shown with the loft being perpendicular to the ground plane, which is different from the setup at an address position that usually has the shaft that is vertical to the ground plane. The address position, as defined by the current application, sets up the golf club head at an orientation that has a lie angle of60 degrees similar to the requirements of the USGA. Once the lie angle is set at 60 degrees, the face angle of the golf club head is set to be square, which is defined as having a face angle of 0 degrees.

Referring concurrently to FIGS. 1-8, the golf club head 3500 is an iron-type golf club head. The iron-type golf club head may be, for example, a wedge-type golf club head. The golf club head 3500 includes a body 3506 having a striking face 3508 with a lower leading edge 3510 and an opposite upper topline edge 3512 extending between a toe 3514 and a heel 3516. The striking face 3508 may have multiple grooves 3519 formed therein to help impart spin on a golf ball when struck by the striking face. The body 3506 has a sole 3502 extending from the lower leading edge 3510 on the bottom side of the golf club head 3500 to a rearward portion 3522 of the sole 3502. The rearward portion 3522 may be defined as an edge or corner on the body 3506. A back portion 3550 is between the rearward portion 3522 of the sole 3502 and the top portion 3503. The back portion 3550 comprises all surfaces of an outer surface 3520 of the body 3506 of the golf club head 3500 that are both between the rearward portion 3522 of the sole 3502 and the top portion 3503 and also between the toe 3514 and the heel 3516. Specific examples of the back portion 3550 will be described in more detail below. A top portion 3503 of the body 3506 is coupled between the upper topline edge 3512 and the back portion 3550. In some embodiments, the top portion 3503 is a thin surface. In some other embodiments, the top portion 3503 is not present, and the upper topline edge 3512 may be directly connected to the back portion 3550. The striking face 3508, the sole 3502, the back portion 3550, and the top portion 3503 are coupled together so as to define at least part of the outer surface 3520 of the body 3506. A hosel 3501 is disposed at the heel 3516 and is configured to couple to a shaft (not shown).

A recessed channel 3526 is defined in the outer surface 3520 of the body 3506, and in particular, in the back portion 3550. The channel 3526 extends along the toe 3514-heel 3516 direction so that the CG and the MOI of the golf club head 3500 can be adjusted for fade-draw bias. The weight assembly 3504 is adapted to be coupled to the body 3506 at the channel 3526. The weight assembly 3504 includes a weight 3528 disposed at least partially within the channel 3526 and configured to be movable along the toe 3514-heel 3516 direction within the channel 3526, a cover 3530 that extends at least partially over the channel 3526 and is adapted to releasably secure the weight 3528 in the channel 3526, and a fastener 3532 configured to couple the cover 3530 to the body 3506. The fastener 3532 retains the weight 3528 in the recessed channel 3526 only indirectly via the cover 3530. The fastener 3532 can therefore be used to secure the weight 3528 in the channel 3526 or to release the weight 3528 so that the weight 3528 can be moved at least along the toe 3514-heel 3516 direction in the channel 3526. As used herein, references to movement along the toe-heel direction includes along the heel-toe direction as well.

The weight assembly 3504 is configured to move between at least two positions via the fastener 3532, for example, a locked configuration as shown in FIGS. 3 and 7, and an unlocked configuration as shown in FIGS. 4 and 8. In some embodiments, the weight assembly 3504 may also be configured to move to a weight removable configuration in which the weight assembly 3504 may be removed entirely from channel 3526. In other embodiments, however, the fastener 3532 may be configured to not allow the weight assembly 3504 to be removed entirely from channel 3526, so as to prevent the weight 3528 from being accidentally lost, among other reasons. In the locked configuration, the cover 3530 is at least partially disposed within the recessed channel 3526 so that its movement is restricted. When the weight assembly 3504 is in the locked configuration, the weight 3528 is disposed in the channel 3526, and the position of the weight 3528 is secured by the cover 3530 so that it cannot move. The locked configuration may be used when a golf club including the golf club head 3500 is being swung so that the CG and the MOI of the golf club head 3500 is set during the swing. The fastener 3532 is selectively moveable along a fastener axis 3570 (see FIGS. 7 and 8). The fastener 3532 may be coupled to the cover 3530 with a retaining clip 3533 so that the fastener 3532 can rotate around the fastener axis 3570 and relative to the cover 3530. Accordingly, the fastener 3532 and the cover 3530 are coupled together so that the cover 3530 moves with the fastener 3532 along the fastener axis 3570.

In other embodiments, the retaining clip 3533 may not be present so that the cover 3530 does not necessarily move with the fastener 3532 when the fastener 3532 moves. However, in such embodiments, when the fastener 3532 is partially moved to a raised position to at least partially release the cover 3530, the cover 3530 may be moveable along the fastener axis 3570 to the extent that the fastener 3532 has been moved.

The weight assembly 3504 is moved from the locked configuration to the unlocked configuration by adjusting the position of the fastener 3532 to the raised position so that the weight 3528 is released and can move inside the channel 3526 at least along the toe 3514-heel 3516 direction and relative to the body 3506 and cover 3530. The unlocked configuration may be used to adjust the CG and MOI of the golf club head 3500 when a golf club including the golf club head 3500 is not being swung.

The weight assembly 3504 may be moved from the unlocked configuration to the weight removable configuration by further adjusting the position of the fastener 3532 to a position high enough so that the weight 3528 can be removed from the channel 3526 and/or decoupled from the cover 3530. In some embodiments, the weight assembly 3504 may be entirely decoupled from the body 3506 in the weight removable configuration. The weight removable configuration may be used to allow the weight 3528 to be replaced. For example, a plurality of weights having different masses may be usable with the weight assembly 3504, and the weights having different masses may be interchanged for greater control of the CG and MOI of the golf club head 3500.

In this nonexclusive example, and as shown for example in FIG. 3, the back portion 3550 includes a lower back surface 3552 coupled between the rearward portion 3522 of the sole 3502 and the top portion 3503, a first back surface 3554 coupled between the lower back surface 3552 and the top portion 3503, an intermediate surface 3555 coupled between the first back surface 3554 and the top portion 3503, and a second back surface 3556 coupled between the intermediate surface 3555 and the top portion 3503.

The lower back surface 3552 may be substantially flat in some embodiments. In some other embodiments, the lower back surface 3552 may be substantially flat except for a curve along the toc 3514-heel 3516 direction. A height (when viewed in the orientation of FIG. 1) of the lower back surface 3552 may be the lowest among heights of the lower back surface 3552, the first back surface 3554, the intermediate back surface 3555, and the second back surface 3556. In some embodiments, the lower back surface 3552 may not be present, and the first back surface 3554 may extend from the rearward portion 3522 of the sole 3502.

The first back surface 3554 may be substantially flat and may extend from an edge of the lower back surface 3552 distal to the rearward portion 3522 toward the intermediate surface 3555 along a direction such that at least part of a virtual extension of the first back surface 3554 intersects the striking face 3508. The first back surface 3554 may also extend towards (e.g., may extend along a direction to be closer to) the upper topline edge 3512 of the golf head club 3500.

The intermediate back surface 3555 may be a curved or substantially flat surface extending from an edge of the first back surface 3554 distal to the lower back surface 3552 to the second back surface 3556. In some embodiments, the intermediate back surface 3555 is not present, and the second back surface 3556 extends from the first back surface 3554.

The second back surface 3556 may be substantially flat and parallel to the striking face 3508. The second back surface 3556 extends from an edge of the intermediate back surface 3555 distal to the first back surface 3554 to the top portion 3503. The first and second surfaces 3554 and 3556 generally form an obtuse angle. For example, an obtuse angle may be formed where virtual extensions of the first and second surfaces 3554 and 3556 meet.

Although the back portion 3550 has been described as including the lower back surface 3552, the first back surface 3554, the intermediate back surface 3555, and the second back surface 3556, and the recessed channel 3526 has been described as being formed in the first back surface 3554, embodiments of the present disclosure are not limited thereto. The back portion 3550 may include any one or more of the lower back surface 3552, the first back surface 3554, the intermediate back surface 3555, and the second back surface 3556. Although lower back surface 3552, the first back surface 3554, the intermediate back surface 3555, and the second back surface 3556 have been illustrated and described as having certain features, the lower back surface 3552, the first back surface 3554, the intermediate back surface 3555, and the second back surface 3556 are not limited thereto. These features are provided for purpose of describing example embodiments, not for purpose of limitation. Furthermore, the recessed channel 3526 may be formed in any one or more surfaces included in the back portion 3550.

In this example, and as shown for example in FIG. 6, the recessed channel 3526 is formed in the back portion 3550, for example, in the first back surface 3554. A fastener receiver 3572 adapted to receive and engage with the fastener 3532 is also defined in the back portion 3550, for example, at a junction between the first and second surfaces 3554 and 3556 or at the intermediate back surface 3555. A fastener cutout 3571 is formed around the fastener receiver 3572 and is shallower than the fastener receiver 3572. The fastener cutout 3571 forms a hollow in the second back surface 3556. The cover 3530 includes a positioner protrusion 3557 having a shape and size corresponding to the fastener cutout 3571 so that the positioner protrusion 3557 can engage with the fastener cutout 3571 to at least partially define the position of the cover 3530 in the locked configuration and, in some embodiments, the unlocked configuration.

The channel 3526 has first and second opposing sidewalls 3538 and 3540 that extend along the toc 3514-heel 3516 direction. The second sidewall 3540 is adjacent to the fastener receiver 3572 and the first sidewall 3538 is adjacent to the rearward portion 3522 of the sole 3502. The channel 3526 also has toc and heel opposing end walls 3544 and 3546, where the toc end wall 3544 is adjacent to the toe 3514 and the heel end wall 3536 is adjacent to the heel 3516. The channel 3526 has a bottom track 3536 offset from the outer surface 3520 of the body 3506 and disposed both between the first and second sidewalls 3538 and 3540 and also between the toc and heel end walls 3544 and 3546.

The body 3506 includes multiple locating lugs 3534 on the bottom track 3536. The locating lugs 3534 protrude from the bottom track 3536 towards an opening of the recessed channel 3526. As shown in FIG. 5, the weight 3528 has a bottom indent 3562 shaped and sized to allow the weight 3528 to selectively engage with the locating lugs 3534 to thereby at least partially define the position of the weight 3528 in the recessed channel 3526. The first sidewall 3538 has multiple dimples 3524 at a top of the first sidewall 3524 at the opening of the recessed channel 3526. The dimples 3524 are cutouts or hollows in the first sidewall 3538 and have positions arranged along the toe 3514-heel 3516 direction that respectively correspond to the locating lugs 3534. The weight 3528 comprises a main body 3560 and a position indicator 3568 that protrudes from the main body 3560. The position indicator 3568 is shaped and sized to selectively engage with the dimples 3524 to visually indicate the position of the weight 3528 inside the channel 3526. In the locked configuration, the cover 3530 may cover and conceal the main body 3560 of the weight 3528, but the position indicator 3568 may extend from under the cover 3568 and be positioned at least partially in one of the dimples 3524. In the locked configuration, between 0% and 30% of an outer surface of the weight 3528 is visible.

As shown in FIGS. 111 and 112, the cover 3530 includes a flange 3558, and the weight 3528 has a groove 3566 shaped and sized to receive at least part of the flange 3558 to slidingly engage the weight 3528 with the cover 3530. Accordingly, when the weight assembly 3504 is in the unlocked configuration, the weight 3528 is able to slide back and forth inside the recessed channel 3526.

As shown in FIGS. 7 and 8, the striking face 3508 has an outermost surface 3518 and a plurality of grooves 3519, each having a longitudinal axis extending along the toe 3514-heel 3516 direction. The outermost surface 3518 may be substantially flat except for the grooves 3519. A striking face plane 3580 is tangential to the outermost surface 3518 and extends beyond the bounds of the striking face 3508 itself. In the example toe-to-heel cross-sectional views of FIG. 7 and FIG. 8, a Y coordinate is defined as extending up and down (generally top to bottom), a Z coordinate is defined as extending left and right (generally front to back), and an×coordinate is defined as extending into and out of the page (generally toe-to-heel). In the examples of FIG. 7 and FIG. 8, with the club head 3500 oriented as shown, the striking face plane 3580 is within the X-Y plane, and the Z axis is orthogonal to the striking face plane (the X-Y plane, as depicted). In examples, the fastener axis 3570, which includes a virtual extension of an axis along which the fastener 3532 moves between a locked and unlocked position, intersects the striking face plane 3580. In some examples, the intersection of the fastener axis 3570 and the striking face plane 3580 occurs at a point closer to the lower leading edge 3510 of the striking face 3508 than to the upper topline edge 3512 of the striking face 3508. In some embodiments, the fastener axis 3570 intersects the striking face 3508 itself. In some other embodiments, the fastener axis 3570 does not intersect the striking face 3508 but still intersects the striking face plane 3580 closer to the lower leading edge 3510 than the upper topline edge 3512, e.g., at a point below the lower leading edge 3510.

A fastener angle 3584 of the fastener axis 3570 may be measured in a cross-sectional plane. For example, as used herein, the cross-sectional plane is a plane that is orthogonal to the longitudinal axis of at least one groove 3519 (such as the groove 3519A nearest to the lower leading edge 3510, or the groove 3519B that is second-nearest to the lower leading edge 3510). That is, the longitudinal axis of the at least one groove 3519 may be normal to the cross-sectional plane. In the examples of FIGS. 7 and 8, the cross-sectional plane is depicted as the Y-Z plane. The fastener axis 3570 forms the fastener angle 3584 with the striking face plane 3580 in the cross-sectional plane. It is recognized that the fastener axis 3570 may not lie entirely within the cross-sectional plane (here, the Y-Z plane), and the vector of the fastener axis 3570 may include some component in the X direction (e.g., the fastener axis 3570 may tilt in a toe 3514-heel 3516 direction); however, as used herein, the fastener angle 3584 is measured only in the cross-sectional plane, ignoring any toe-to-heel (or "X") component of the vector defining the fastener axis 3570. The fastener angle 3584 is defined in the cross-sectional plane and is measured in a counter-clockwise direction from the striking face plane 3580 to the fastener axis 3570 when the cross-sectional plane is viewed in a toe-to-heel direction, as shown in FIGS. 7 and 8. The fastener angle 3584 may range from about 0 degrees to about 90 degrees. For example, the fastener angle 3584 of the fastener axis 3570 relative to the striking face plane 3580 may be from about 5 degrees to about 85 degrees, about 10 degrees to about 80 degrees, about 15 degrees to about 75 degrees, about 20 degrees to about 70 degrees, about 25 degrees to about 65 degrees, about 30 degrees to about 60 degrees, about 35 degrees to about 55 degrees, about 40 degrees to about 50 degrees, or about 45 degrees. In further examples, the fastener angle of the fastener axis 3570 relative to the striking face plane 3580 may be non-negative and may be less than about 80 degrees, less than about 70 degrees, less than about 60 degrees, less than about 50 degrees, less than about 45 degrees, less than about 40 degrees, less than about 30 degrees, less than about 20 degrees, less than about 10 degrees, less than about 5 degrees, or about zero degrees. In other examples, the fastener angle 3584 of the fastener axis 3570 relative to the striking face plane 3580 may even be negative, depending on the configuration of the back portion 3550 of the clubhead 3500, for example, about 0 degrees to about-5 degrees, about 0 degrees to about-10 degrees, about 0 degrees to about-20 degrees, about 0 degrees to about-30 degrees, or about 0 degrees to about-45 degrees. The foregoing recited ranges of the fastener angle 3584 are non-limiting example ranges, and the fastener angle 3584 may be within any range subsumed within the range of45 degrees to about 135 degrees, for example, about 28 degrees to about 63 degrees or about 85 degrees to about 115 degrees. By forming the recessed channel 3526, and disposing the weight assembly 3504, in the back portion 3550 of the iron-type golf club head 3500 instead of in the sole 3502, interaction between the weight assembly 3504 and the ground may be reduced when a golf club including the golf club head 3500 is swung. Accordingly, dirt and other materials may be substantially prevented from entering into the recessed channel 3526 and interfering with the weight assembly 3504.

In examples, the fastener 3532 may have a height that can be measured in the cross-sectional plane along the direction from the lower leading edge 3510 to the upper leading edge 3512. In examples, the height of the fastener 3532 increases when the weight assembly 3504 moves from the locked configuration to the unlocked configuration.

Figure 9:
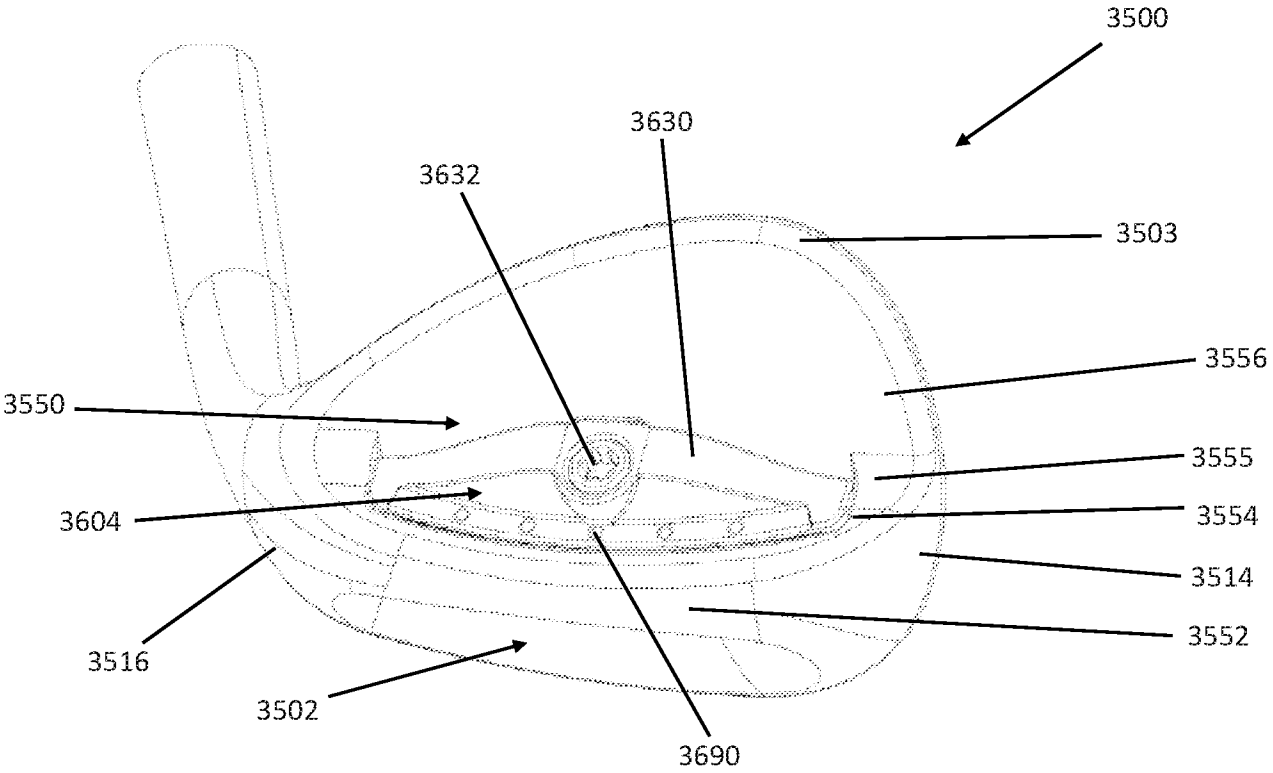
FIG. 9 is a back view of a golf club head with another weight assembly in the locked configuration.

FIG. 9 is a back view of a golf club head 3500 with another weight assembly 3604 in the locked configuration. The golf club head 3500 of the embodiment illustrated in FIG. 9 may include some features similar to, or the same as, features illustrated and described above with respect to the golf club head 3500 of FIGS. 1-8. Certain components are described above, and thus, are not necessarily described further. Referring to the example of FIG. 9, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel (not shown) is formed in the first back surface 3554, and the weight assembly 3604 is couplable to the body of the golf club head 3500 at the recessed channel. The weight assembly 3604 includes a weight (not shown), a cover 3630, and a fastener 3632.

In this example, the weight assembly 3604 is similar to weight assembly 3504, except that when the weight assembly 3604 is in the locked configuration, the cover 3630 entirely covers the weight and the recessed channel, including a bottom track (not shown) of the recessed channel. In examples, the cover 3630 may comprise one or more see-through openings 3690 to provide an indication of where the weight is located within the recessed channel. For example, the body of the golf club head 3500 may have a plurality of locating lugs (similar to the locating lugs 3534 shown in FIG. 6) at a bottom track of the recessed channel to engage with the weight and at least partially define the position of the weight when the weight assembly 3604 is in the locked configuration, and the cover 3630 may include a plurality of see-through openings 3690 at positions respectively corresponding to the plurality of locating lugs. In examples, the weight may be adapted to slidingly engage with a flange on the cover 3730 (e.g., similar to how the weight 3528 in the embodiment shown in FIG. 2 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover or the body. The weight assembly 3604 may include one or more of the weight assembly features described herein to enable the CG and the MOI of the golf club head 3500 to be adjustable for fade-draw bias, while securing the weight in the locked configuration indirectly by the cover 3630. In examples, faster 3632 forms a fastener angle measured in a cross-sectional plane with respect to a striking face and/or striking face plane of the golf club head 3500 in the manner described above with respect to weight assembly 3504.

Figure 10:
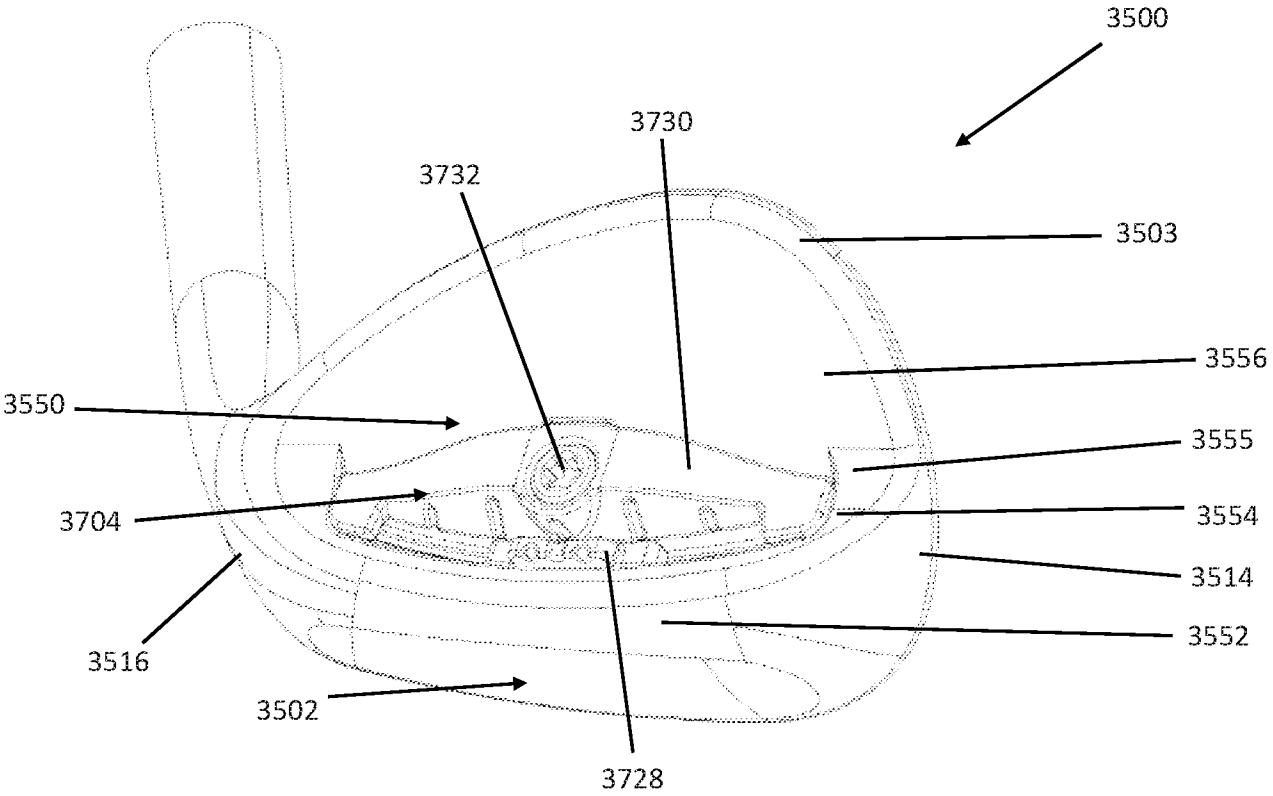
FIG. 10 is a back view of a golf club head with another weight assembly.
Figure 11:
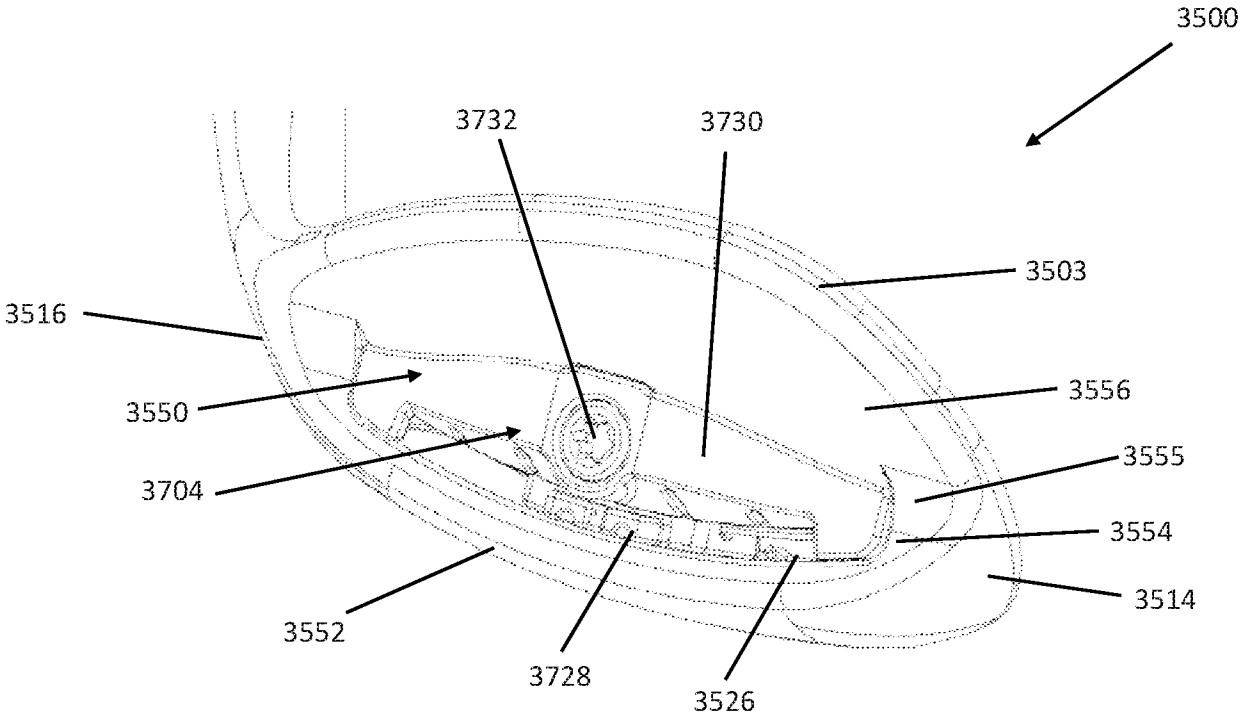
FIG. 11 is a top view of the golf club head of FIG. 10.

FIG. 10 is a back view of a golf club head 3500 with another weight assembly 3704, and FIG. 11 is a top view of the golf club head 3500 of FIG. 10. The golf club head 3500 of the embodiment illustrated in FIGS. 10 and 11 may include some features similar to, or the same as, features illustrated and described above with respect to the golf club head 3500 of FIGS. 1-8. Certain components are described above, and thus, are not necessarily described further. Referring to the example of FIGS. 10 and 11, the golf club head 3500 has a body including a toe 3514, a heel 3516, a top portion 3503, a striking face (not shown), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3604 is couplable to the body of the golf club head 3500 at the recessed channel 3526. The weight assembly 3704 includes a weight 3728, a cover 3730, and a fastener 3732.

In this example, when the weight assembly 3704 is in the locked configuration, the cover 3730 exposes at least part of the weight 3728 and at least part of the recessed channel (e.g., at least part of a bottom track of the recessed channel 3526). For example, the cover 3730 may have a cutout portion overlapping at least part of the recessed channel 3526 while still allowing the cover 3730 to releasably secure the weight 3728 in the recessed channel 3526. Accordingly, a position of the weight 3728 in the recessed channel 3526 when the weight assembly 3704 is in the locked configuration may be visible through the cutout portion of the cover 3730. In examples, the weight 3728 may be adapted to slidingly engage with a flange on the cover 3730 (e.g., similar to how the weight 3528 in the embodiment shown in FIG. 2 is adapted to slidingly engage with the flange 3558 of the cover 3530), may be adapted to slidingly engage with a rail on the body (e.g., a rail protruding from the bottom track or from a sidewall of the recessed channel), or may not be adapted to slidingly engage with either the cover 3730 or the body. The weight assembly 3704 may include one or more of the weight assembly features described herein to enable the CG and the MOI of the golf club head 3500 to be adjustable for fade-draw bias, while securing the weight 3728 in the locked configuration. In examples, the faster 3732 forms a fastener angle measured in a cross-sectional plane with respect to a striking face and/or striking face plane of the golf club head 3500 in the manner described above with respect to weight assembly 3504.

Figure 12:
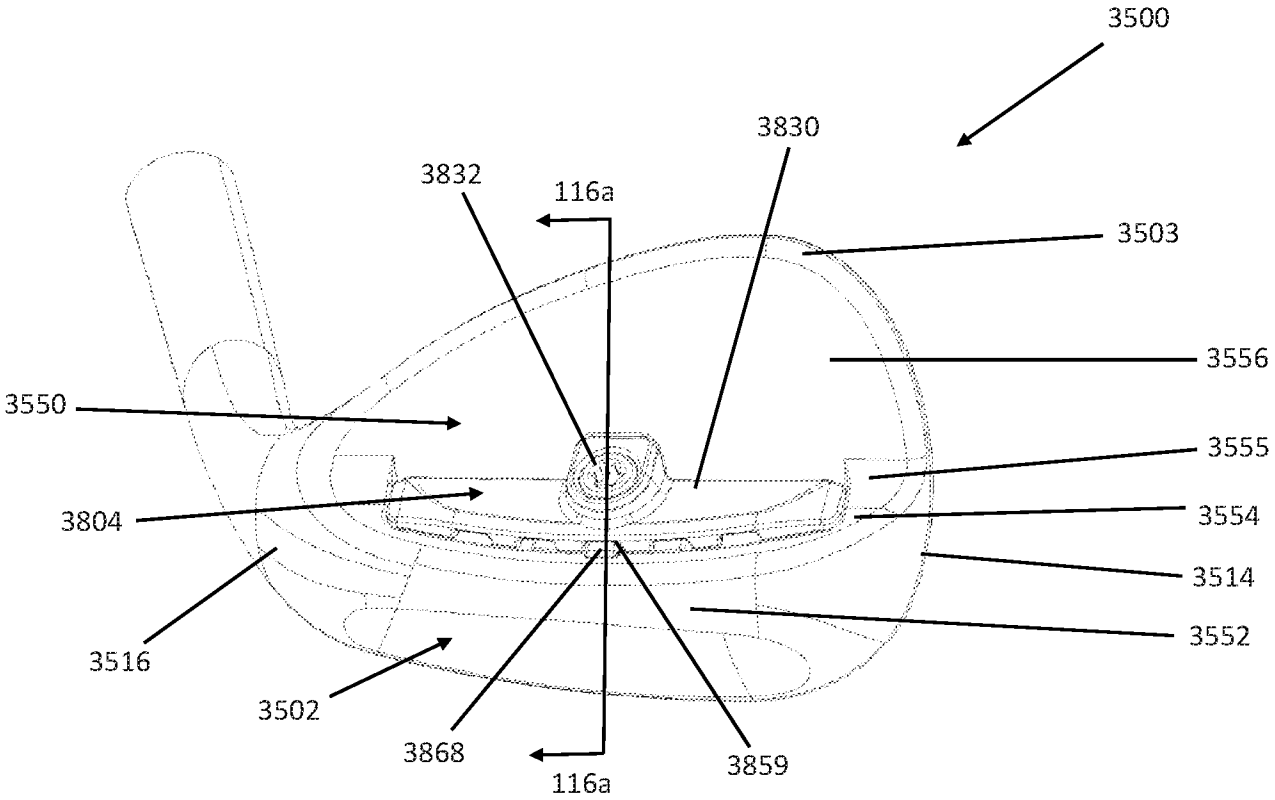
FIG. 12 is a back view of a golf club head with another weight assembly in the locked configuration.

FIG. 12 is a back view of the golf club head 3500 with another weight assembly 3804 in the locked configuration.

Figure 13:
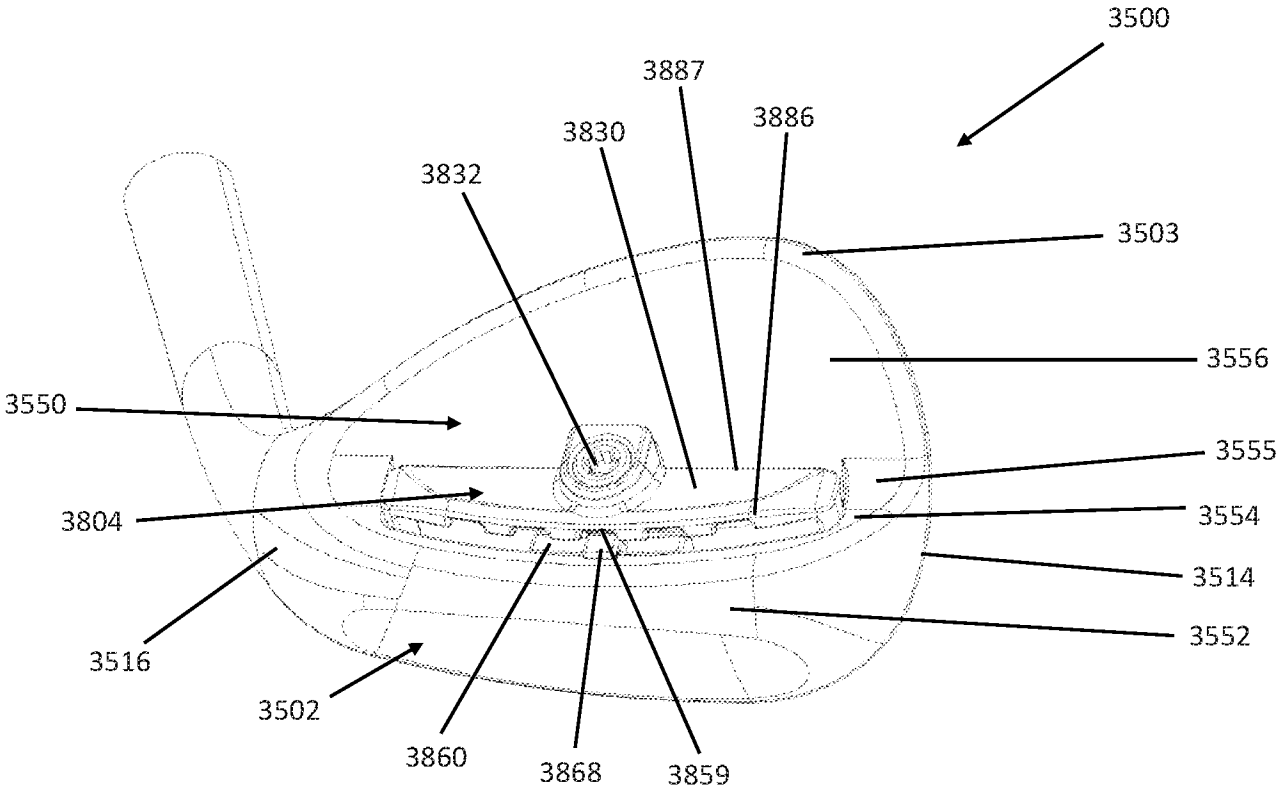
FIG. 13 is a back view of the golf club head of FIG. 12 when the weight assembly is in the unlocked configuration.
Figure 14:
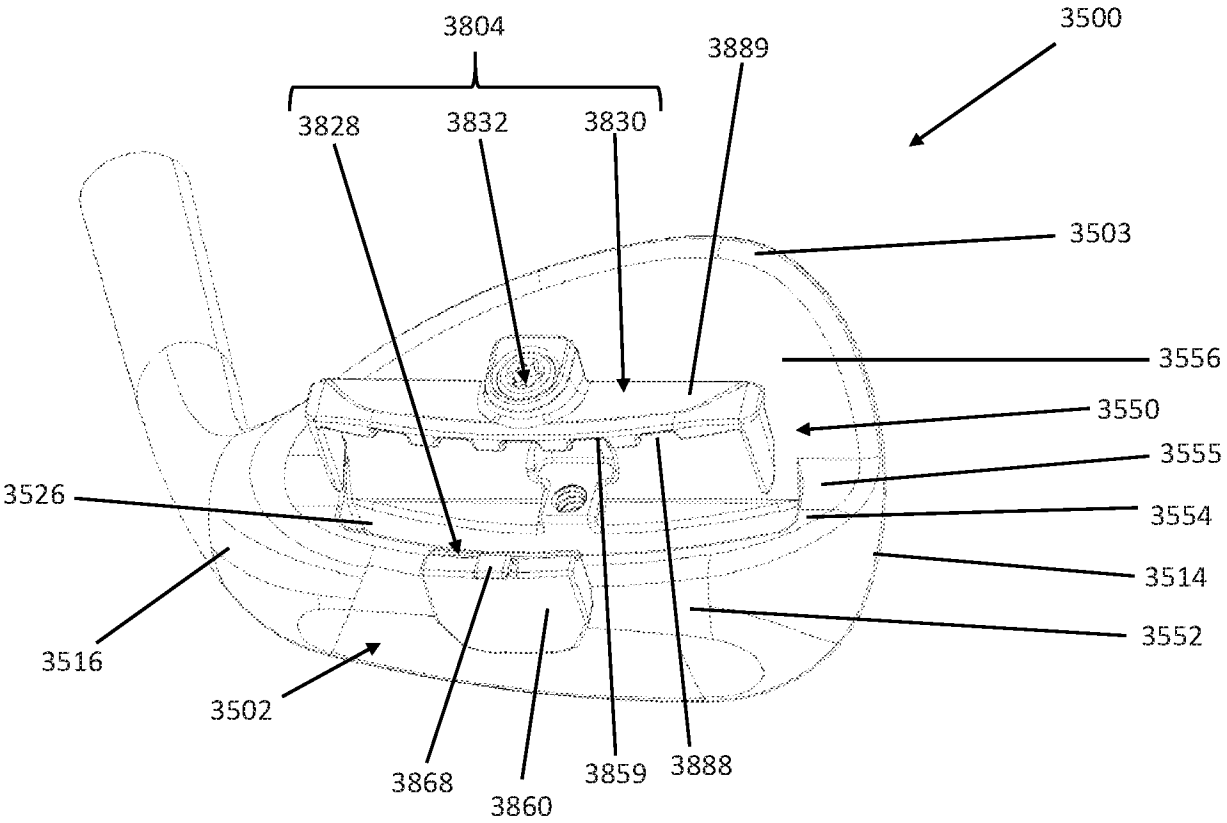
FIG. 14 is a partially exploded, back view of the golf club head of FIG. 12.

FIG. 13 is a back view of the golf club head 3500 of FIG. 10 when the weight assembly 3804 is in the unlocked configuration. FIG. 14 is a partially exploded, back view of the golf club head 3500 of FIG. 12. FIG. 15 is a cross-sectional view in the toc-to-heel direction of the golf club head 3500 of FIG. 12 taken along line 116*a*-116*a* when the weight assembly 3804 is in the locked configuration. FIG. 16 is a cross-sectional view in the toc-to-heel direction of the golf club head 3500 of FIG. 12 taken along line 116*a*-116*a* when the weight assembly 3804 is in the unlocked configuration. The golf club head 3500 of the embodiment illustrated in FIGS. 12-16 may include some features similar to, or the same as, features illustrated and described above with respect to the golf club head 3500 of FIGS. 1-8. Certain components are described above, and thus, are not necessarily described further. Referring to the example of FIGS. 12-16, the golf club head 3500 has a body including a toe 3514, a heel 3516, a top portion 3503, a striking face 3508 (see FIG. 15), a sole 3502, and a back portion 3550. The back portion 3550 includes a lower back surface 3552, a first back surface 3554, an intermediate back surface 3555, and a second back surface 3556. A recessed channel 3526 is formed in the first back surface 3554, and the weight assembly 3804 is coupled to the body of the golf club head 3500 at the recessed channel 3526.

The weight assembly 3804 includes a weight 3828, a cover 3830, and a fastener 3832. The fastener 3832 is coupled to the cover 3830 via a retaining clip 3533. In this example, the weight includes a main body 3860 and a protruding position indicator 3868 extending from an upper portion of the main body 3860. The upper portion of the main body 3860 refers to a portion of the main body 3860 closest to the cover 3830 and/or to the opening of the recessed channel 3526 when the weight assembly 3804 is in the locked configuration. A lower portion of the main body 3860 refers to a portion of the main body 3860 closest to a bottom of the recessed channel 3526 when the weight assembly 3804 is in the locked configuration. The recessed channel 3526 extends along a toe 3514-heel 3516 direction and the cover 3830 has two opposing long sides extending along the toe 3514-heel 3516 direction-a first long side 3886 distal to the striking face 3508 and a second long side 3887 proximal to the striking face 3508. The cover 3830 also has an interior surface 3888 facing the recessed channel 3526 when the weight assembly 3804 is in the locked configuration, and an exterior surface 3889 facing away from the recessed channel 3526 when the weight assembly 3804 is in the locked configuration. In some embodiments, when the weight assembly 3804 is in the locked configuration, at least part of the exterior surface 3889 may be level with the first back surface 3554, and at least part of the interior surface 3888 is offset from the first back surface 3554 and is inside the recessed channel 3526.

In the locked configuration, the cover 3830 covers and conceals at least part of the main body 3860, and at least part of the protruding position indicator 3868 extends from under the cover 3830 to be exposed. Accordingly, the protruding position indicator 3868 may indicate the position of the weight 3828 in the recessed channel 3526 when the weight assembly 3804 is in the locked configuration. The protruding position indicator 3868 may be on (e.g., in contact with) part of the outer surface (e.g., the first back surface 3554) of the body of the golf club head 3500 in the locked configuration. In this example, the weight 3828 is not adapted to slidingly engage with the cover 3830. When the cover 3830 is moved from the locked configuration to the unlocked configuration, the weight 3828 remains in the recessed channel 3526. In the unlocked configuration, the weight 3828 can be gripped by the protruding position indicator 3868 and moved along the toe 3514-heel 3516 direction. In some embodiments where the body includes locating lugs at a bottom track of the recessed channel 3526, the weight 3828 can be lifted up slightly by the protruding position indicator 3868 prior to being moved along the toe 3514-heel 3516 direction. The cover 3830 has at least one locating groove 3859 in the interior surface 3888 shaped and sized to receive at least part of the protruding position indicator 3868 and adapted to engage with the protruding position indicator 3868 to at least partially define the position of the weight 3828. The at least one locating groove 3859 may include a plurality (e.g., five) locating grooves, and the protruding position indicator 3868 can selectively engage with the locating grooves 3859. The locating grooves 3859 may extend from the first side 3886 toward (e.g., at least part way to) the second side 3887. The weight assembly 3804 may include one or more of the weight assembly features described herein to enable the CG and the MOI of the golf club head 3500 to be adjustable for fade-draw bias, while securing the weight in the lock configuration. In examples, the faster 3832 forms a fastener angle 3584 measured in a cross-sectional plane with respect to a striking face 3508 and/or striking face plane 3580 of the golf club head 3500 in the manner described above with respect to weight assembly 3504.

Figure 17:
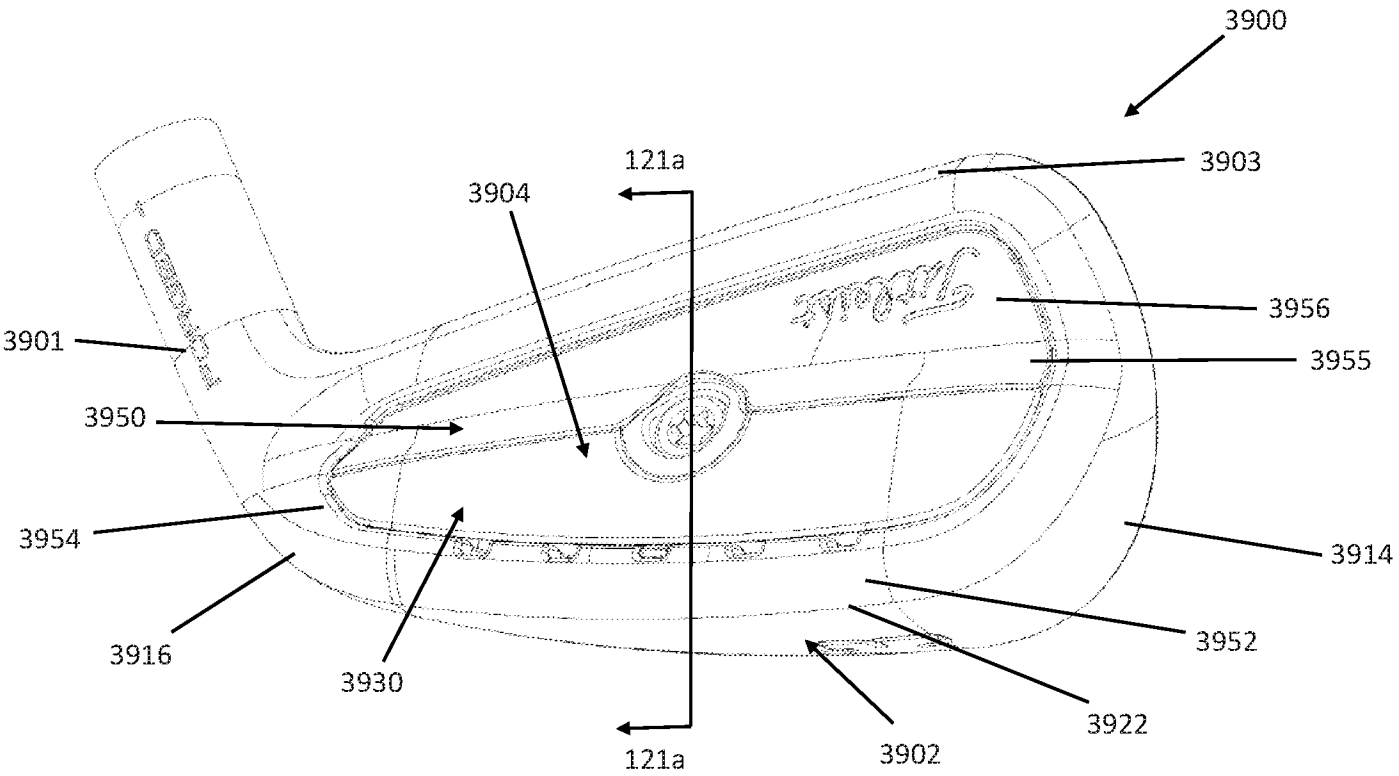
FIG. 17 is a back view of a golf club head with another weight assembly in the locked configuration.
Figure 18:
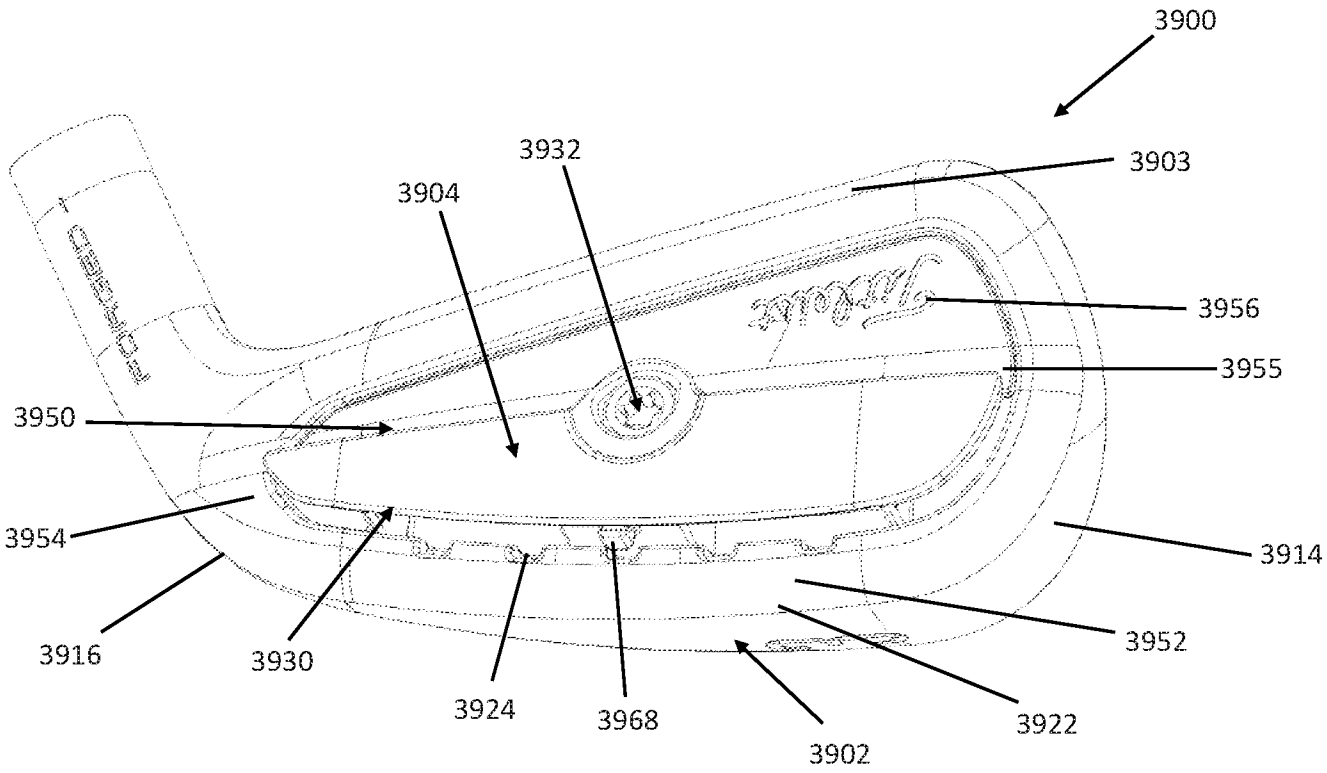
FIG. 18 is another back view of the golf club head of FIG. 17 when the weight assembly is in the unlocked configuration.
Figure 19:
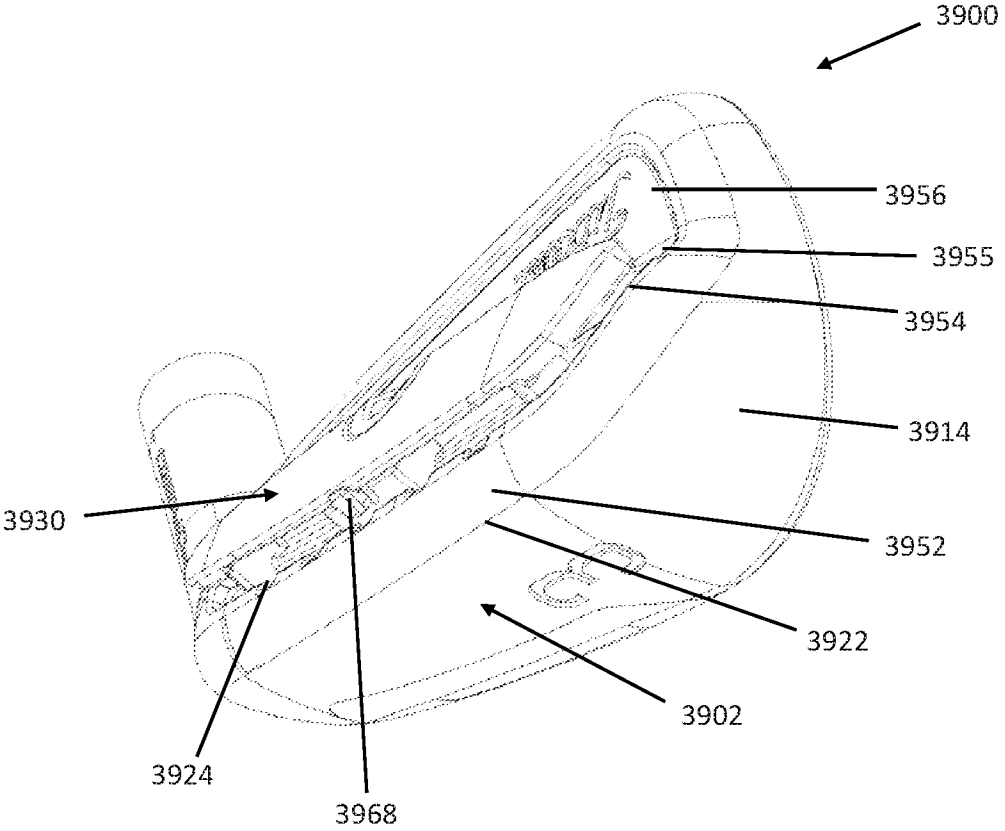
FIG. 19 is a perspective view of the golf club head of FIG. 17 when the weight assembly is in the unlocked configuration.
Figure 20:
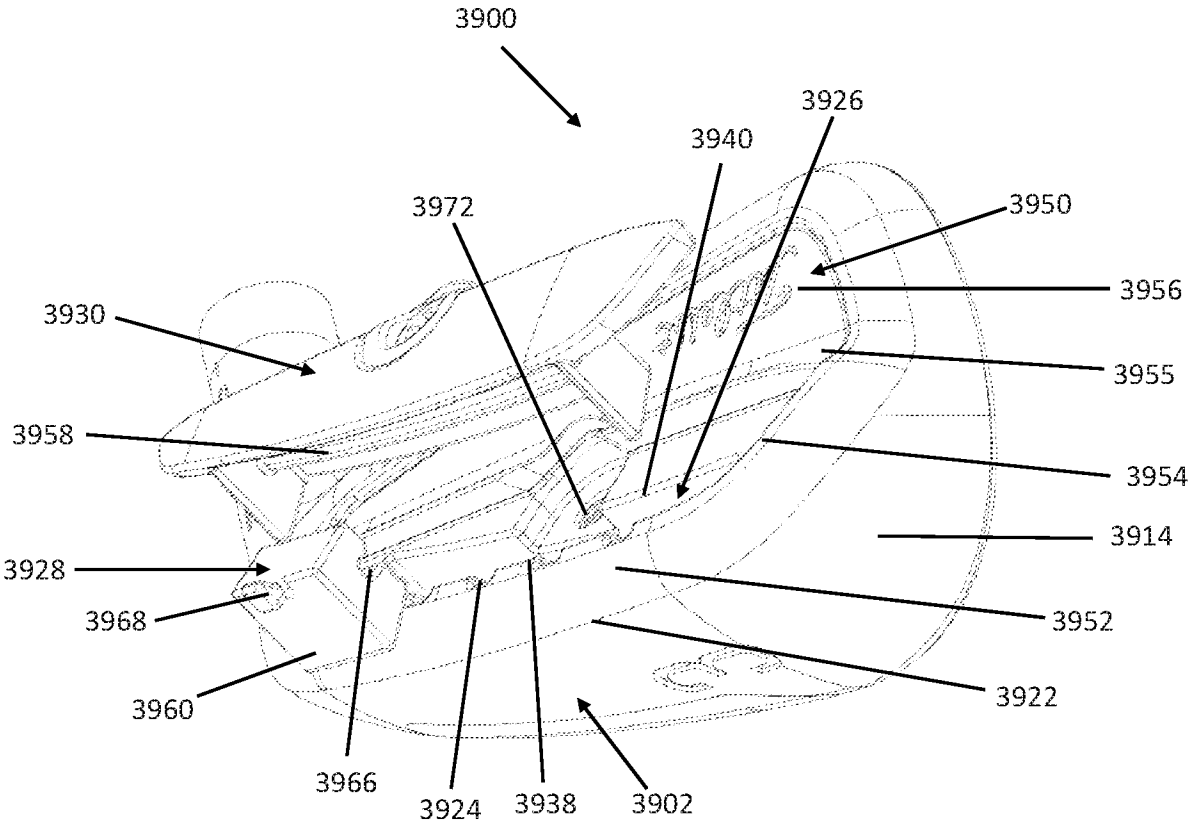
FIG. 20 is a partially exploded, perspective view of the golf club head of FIG. 17.
Figure 21:
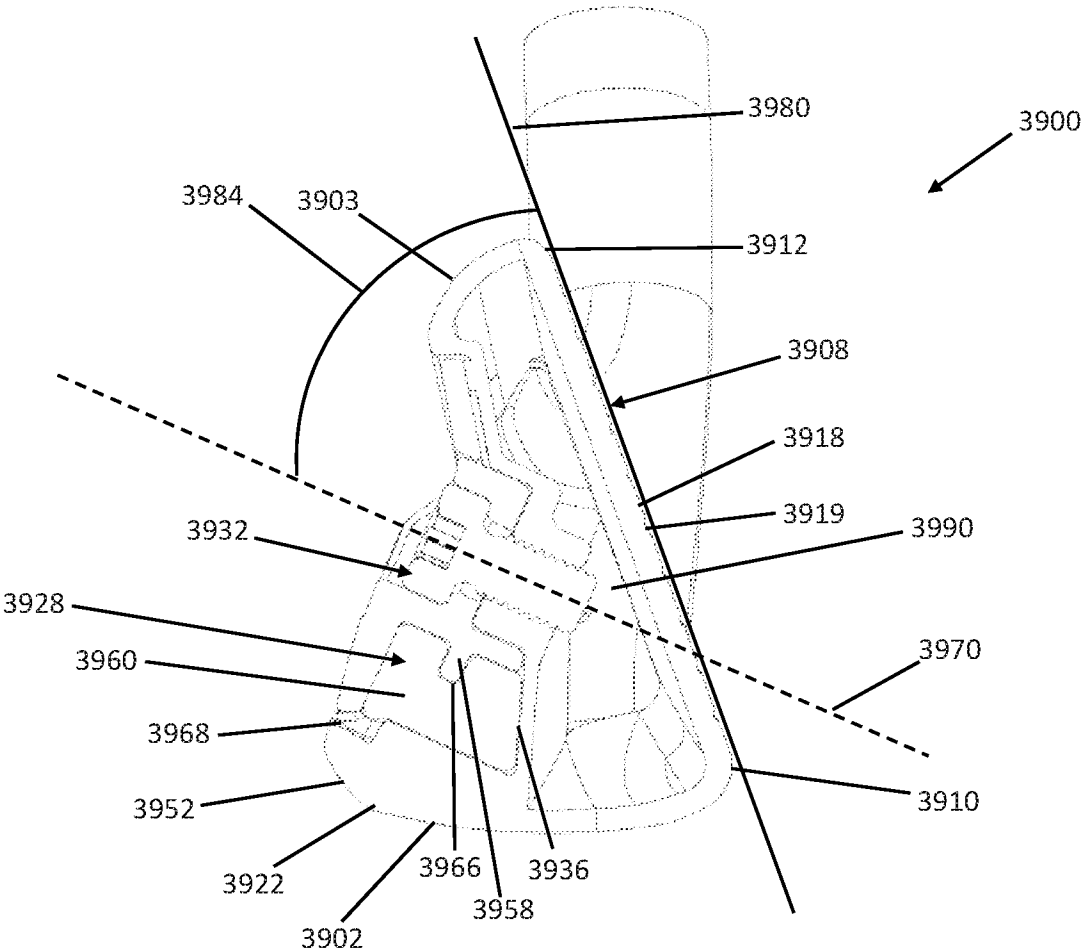
FIG. 21 is a cross-sectional view in the toe-to-heel direction of the golf club head of FIG. 17 along line 121*a*-121*a* and when the weight configuration is in the locked configuration.
Figure 22:
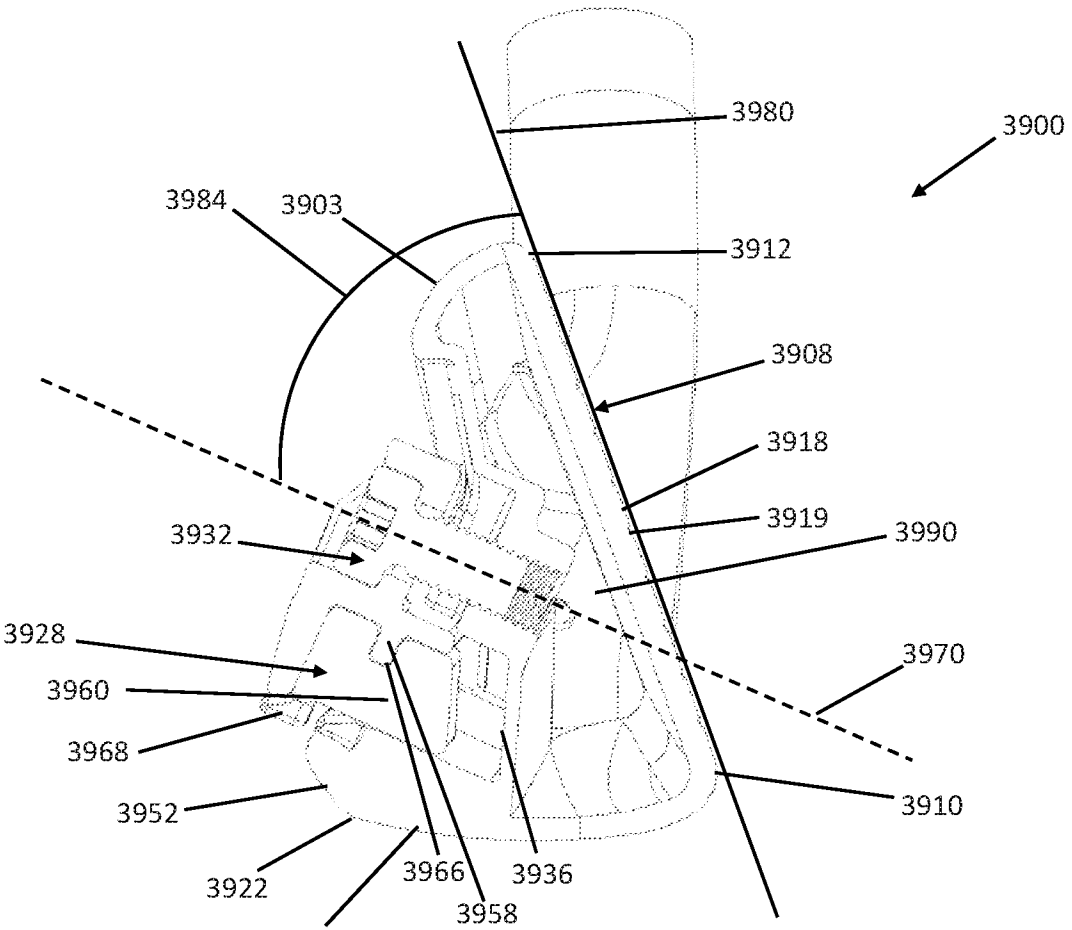
FIG. 22 is a cross-sectional view of the golf club head of FIG. 17 along line 121*a*-121*a* and when the weight configuration is in the unlocked configuration.

FIG. 17 is a back view of a golf club head 3900 with another weight assembly 3904 in the locked configuration. In this example, the golf club head 3900 is an iron-type golf club head, but not a wedge-type golf club head. In particular, the golf club head 3900 is illustrated as a 3-iron, Titleist® (Trademark of Acushnet) golf club head, but the embodiment is not limited thereto. FIG. 18 is a back view of the golf club head 3900 of FIG. 17 when the weight assembly 3904 is in the unlocked configuration. FIG. 19 is a perspective view of the golf club head 3900 of FIG. 17 when the weight assembly 3904 is in the unlocked configuration. FIG. 20 is a partially exploded, perspective view of the golf club head 3900 of FIG. 17. FIG. 21 is a cross-sectional view in the toe-to-heel direction of the golf club head 3900 of FIG. 17 along line 121*a*-121*a* when the weight configuration 3904 is in the locked configuration. FIG. 22 is a cross-sectional view of the golf club head 3900 of FIG. 17 along line 121*a*-121*a* when the weight configuration 3904 is in the unlocked configuration. The golf club head 3900 of the embodiment illustrated in FIGS. 17-22 may include some features similar to, or the same as, features illustrated and described above with respect to the golf club head 3500 of FIGS. 1-8.

Referring to FIGS. 17-22, the golf club head 3900 has a body including a toe 3914, a heel 3916, a top portion 3903, a striking face 3908, a sole 3902, and a back portion 3950. A hosel 3901 is disposed at the heel 3916 and is configured to couple to a shaft (not shown). The striking face 3908 has an upper topline edge 3912 and an opposite lower leading edge 3910. As shown in FIGS. 21 and 22, the striking face 3908 also has an outermost surface 3918 and grooves 3919 extending along the toe 3914-heel 3916 direction. The sole 3902 extends from the lower leading edge 3910 and has a rearward portion 3922 distal to the lower leading edge 3910.

The back portion 3950 is positioned between the rearward portion 3922 of the sole 3902 and the top portion 3903 and includes all surfaces of an outer surface of the body of the golf club head 3900 that are both between the rearward portion 3922 of the sole 3902 and the top portion 3903 and also between the toe 3914 and the heel 3916. In this example, the back portion 3950 includes a lower back surface 3952, a first back surface 3954, an intermediate back surface 3955, and a second back surface 3956. In examples, the second back surface 3956, along with the cover 3930, acts to conceal the cavity formed in the rear of the club head 3900; however, second back surface 3956 stays stationary, while the cover 3930 moves between a locked and unlocked position.

A recessed channel 3926 is formed in the first back surface 3954, and the weight assembly 3904 is couplable to the body of the golf club head 3900 at the recessed channel 3926. The recessed channel 3926 has bottom track 3936 offset from the outer surface of the body of the golf club head 3900. The recessed channel 3926 also has opposing first and second sidewalls 3938 and 3940 extending along the toe 3914-heel 3916 direction, the first sidewall 3938 being proximal or adjacent to the lower back surface 3952 and the second sidewall 3940 being distal to the lower back surface 3952. At least one dimple 3924 may be formed in the first sidewall 3938 at an upper end of the first sidewall 3938 where an opening of the recessed channel 3926 is formed in the outer surface of the body.

The weight assembly 3904 includes a weight 3928, a cover 3930, and a fastener 3932. A fastener receiver 3972 is formed in the body of the golf club head 3900 and is adapted to receive at least part of the fastener 3932 and to engage with the fastener 3932. The cover 3930 includes a flange 3958, and the weight 3928 has a groove 3966 shaped and sized to receive at least part of the flange 3958 and to slidingly engage the weight 3928 with the cover 3930. The weight 3928 has a main body 3960 and a protruding position indicator 3968 protruding from the main body 3960. The at least one dimple 3924 are shaped and sized to receive at least part of the protruding position indicator 3968. In the locked configuration of the weight assembly 3904, the cover 3930 may cover and conceal the main body 3960 of the weight 3928, and the protruding position indicator 3968 may at least partially protrude from under the cover 3930 and engage with a dimple of the at least one dimple 3924 to visibly indicate the position of the weight 3928 in the locked configuration. The weight assembly 3904 may include one or more of the weight assembly features described herein to enable the CG and the MOI of the golf club head 3900 to be adjustable for fade-draw bias, while securing the weight in the lock configuration.

In examples, the fastener 3932 forms a fastener angle 3984 measured in a cross-sectional plane with respect to a striking face 3908 and/or a striking face plane 3980 of the golf club head 3900 in the manner described above with respect to weight assembly 3504.

Figure 23:
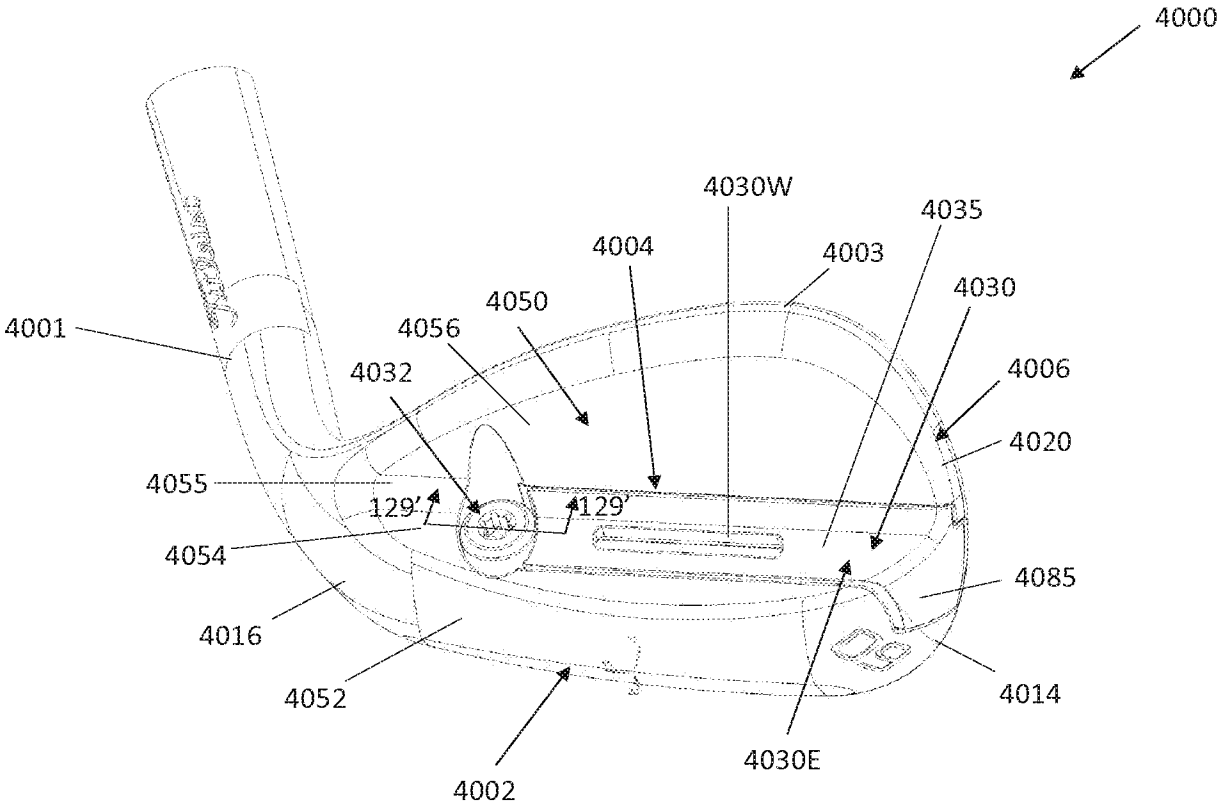
FIG. 23 is a back view of a golf club head with another weight assembly in a locked configuration.
Figure 24:
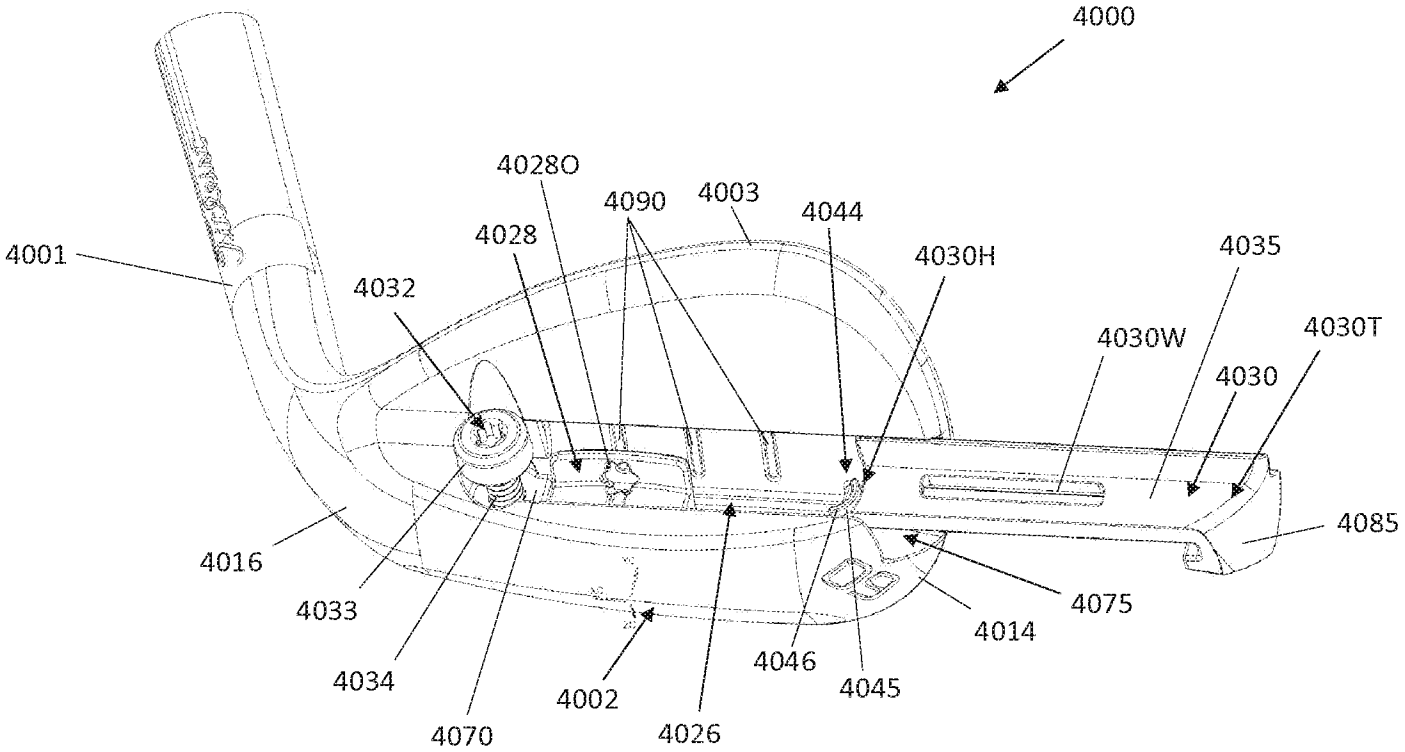
FIG. 24 Is another back view of the golf club head of FIG. 23 when the weight assembly is in an unlocked configuration.
Figure 25B:
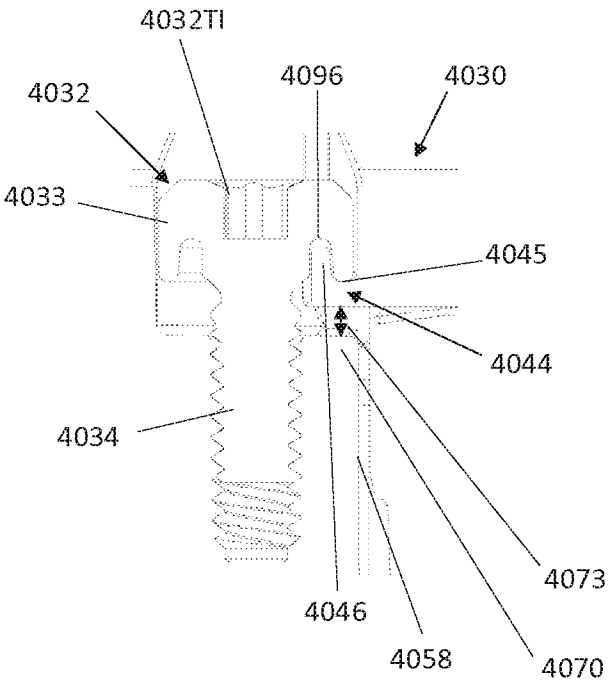
FIG. 25B is another cross-sectional view of the golf club head of FIG. 23 along the line 129'-129' in FIG. 23 when the fastener of the weight assembly is lockingly engaged with the cover of the weight assembly.
Figure 25A:
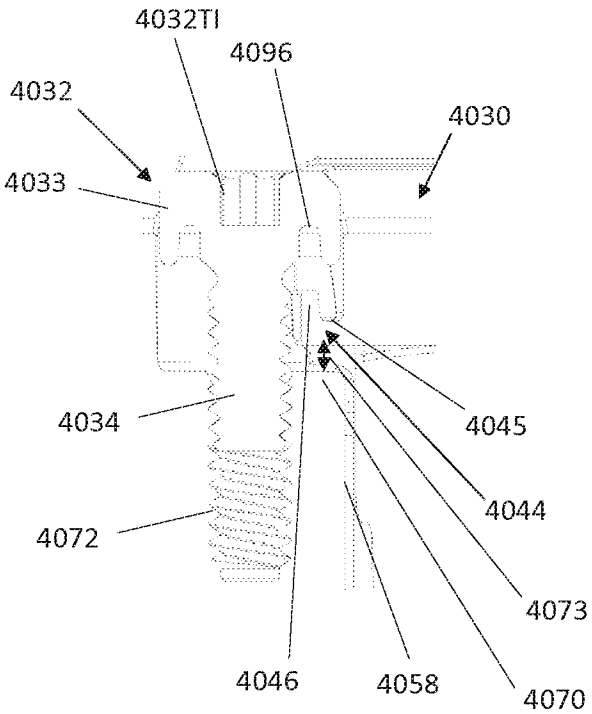
FIG. 25A is a cross-sectional view of the golf club head of FIG. 23 along the line 129'-129' in FIG. 127 when the fastener of the weight assembly is lockingly disengaged from the cover of the weight assembly.
Figure 26B:
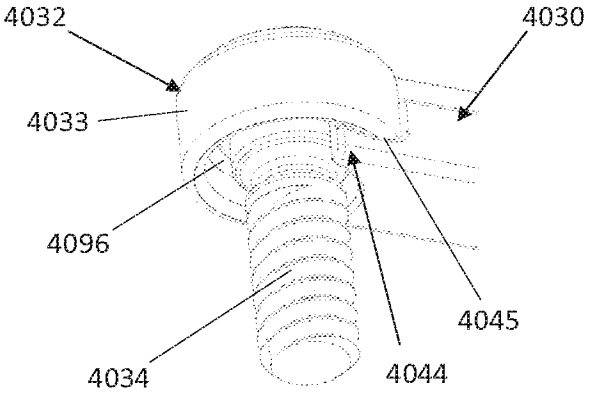
FIG. 26B is a bottom perspective view of the end of the cover of the weight assembly of the golf club head of FIG. 23 when the fastener of the weight assembly is lockingly engaged with the cover of the weight assembly.
Figure 26A:
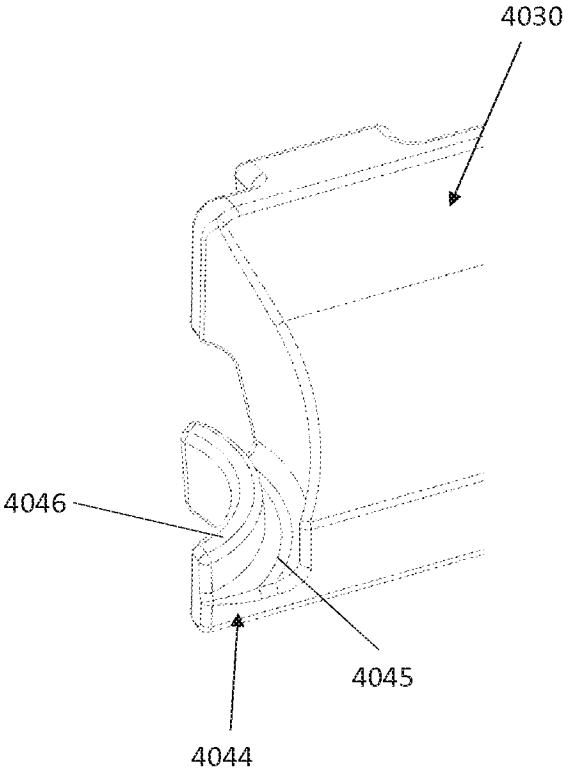
FIG. 26A is a top perspective view of an end of the cover of the weight assembly of the golf club head of FIG. 23.
Figure 27:
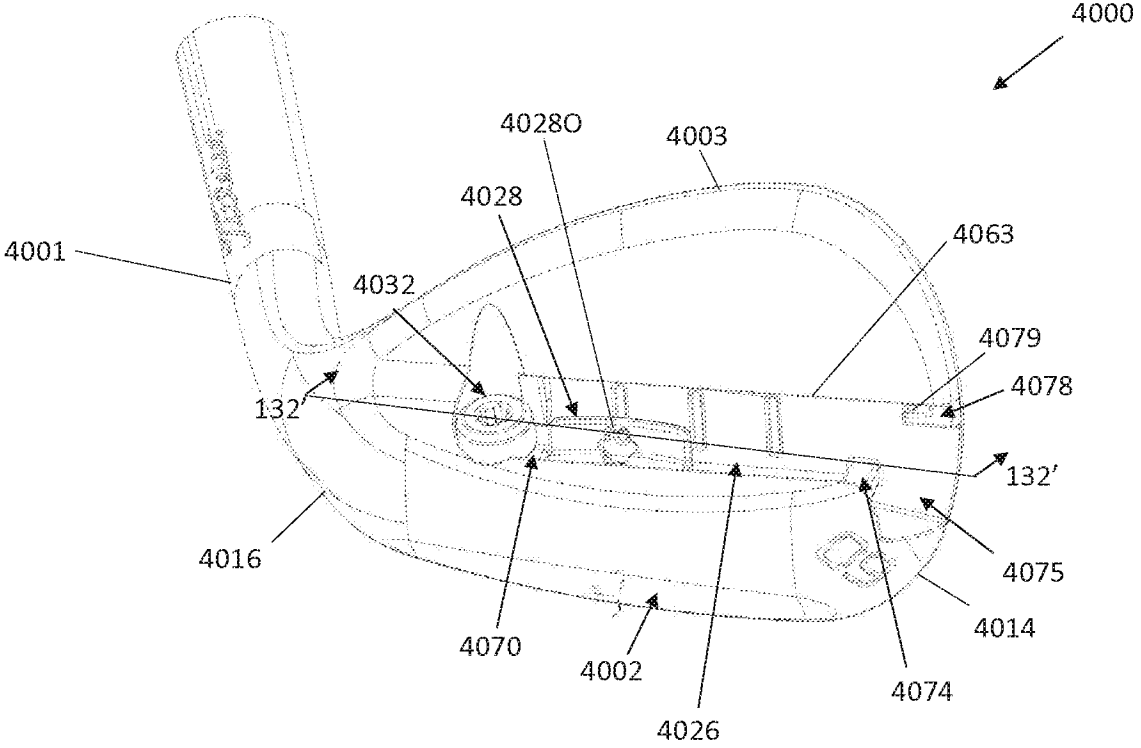
FIG. 27 is another back view of the golf club head of FIG. 23 without the cover of the weight assembly.
Figure 28A:
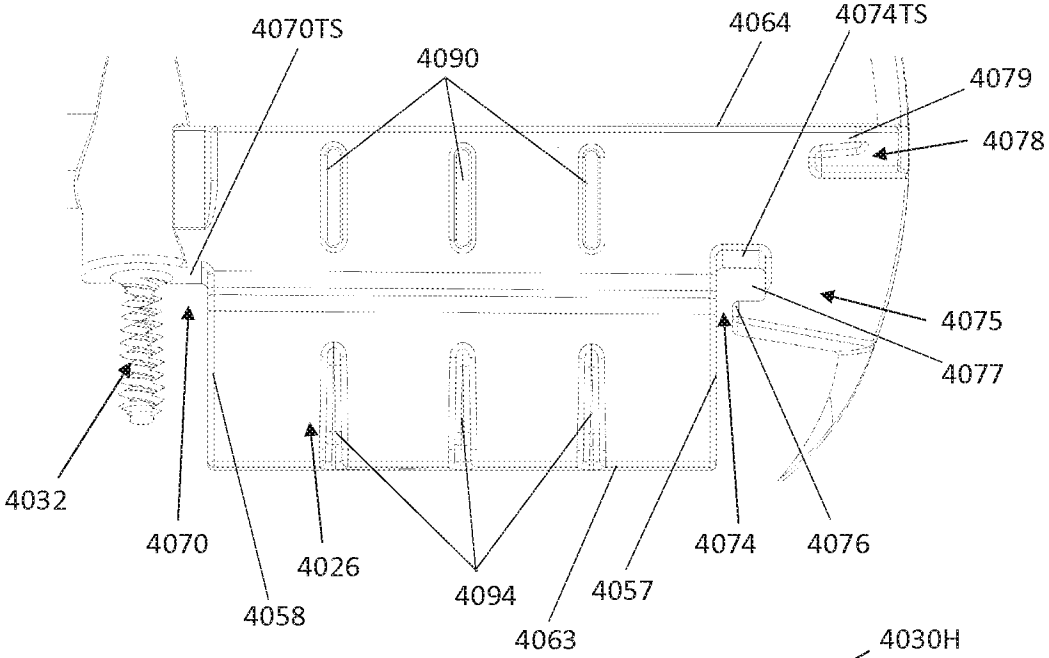
FIG. 28A is a cross-sectional view of the golf club head of FIG. 23 along the line 132'-132' in FIG. 27.
Figure 28B:
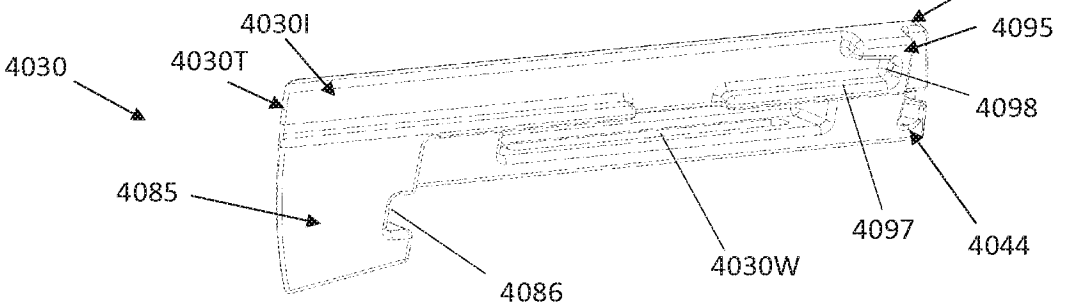
FIG. 28B is a perspective view of an interior side of the cover of the weight assembly of the golf club head of FIG. 23.
Figure 29:
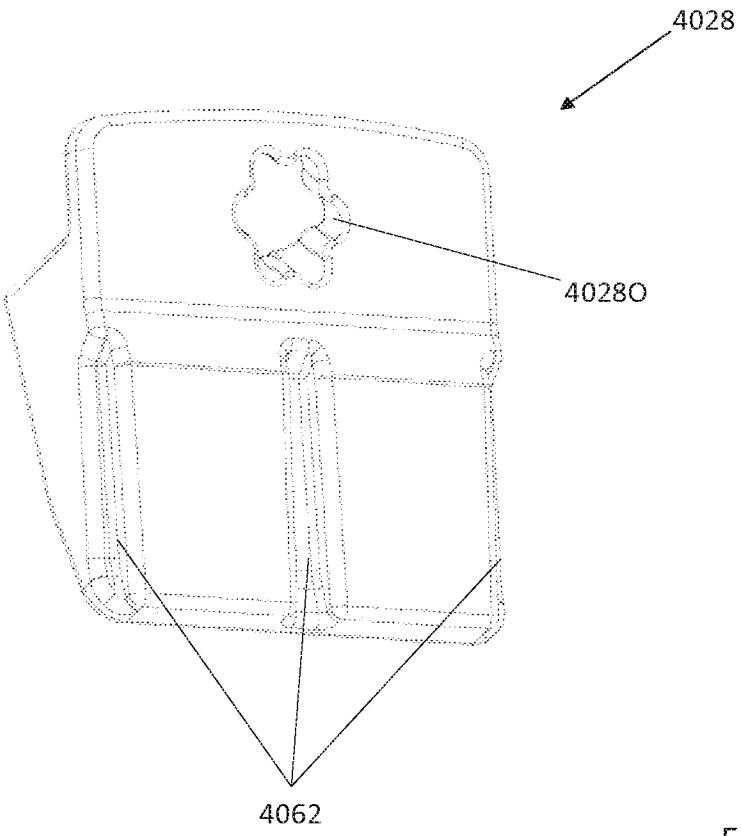
FIG. 29 is a perspective view of the weight of the weight assembly of the golf club head of FIG. 23.

FIG. 23 is a back view of a golf club head 4000 with another weight assembly 4004 in a locked configuration. In this illustrated example, the golf club head 4000 is a wedge-type golf club head. In particular, the golf club head 4000 is illustrated as a 60 degree, Titleist® (Trademark of Acushnet) golf club head, but the embodiment is not limited thereto. In some other examples, the golf club head may be an iron-type golf club head, a metalwood type golf club head, or a hybrid type golf club head. FIG. 24. Is another back view of the golf club head 4000 of FIG. 23 when the weight assembly 4004 is in an unlocked configuration. FIG. 25A is a cross-sectional view of the golf club head 4000 of FIG. 23 along the line 129'-129' in FIG. 23 when the fastener 4032 of the weight assembly 4004 is lockingly disengaged from the cover 4030 of the weight assembly 4004. FIG. 25B is another cross-sectional view of the golf club head 4000 of FIG. 23 along the line 129'-129' in FIG. 23 when the fastener 4032 of the weight assembly 4004 is lockingly engaged with the cover 4030 of the weight assembly 4004. FIG. 26A is a top perspective view of an end of the cover 4030 of the weight assembly 4004 of the golf club head 4000 of FIG. 23. FIG. 26B is a bottom perspective view of the end of the cover 4030 of the weight assembly 4004 of the golf club head 4000 of FIG. 23 when the fastener 4032 of the weight assembly 4004 is lockingly engaged with the cover 4030 of the weight assembly 4004. FIG. 27 is another back view of the golf club head 4000 of FIG. 23 without the cover 4030 of the weight assembly 4004. FIG. 28A is a cross-sectional view of the golf club head 4000 of FIG. 23 along the line 132'-132' in FIG. 27. FIG. 28B is a perspective view of an interior side of the cover 4030 of the weight assembly 4004 of the golf club head 4000 of FIG. 23. FIG. 29 is a perspective view of the weight 4028 of the weight assembly 4004 of the golf club head 4000 of FIG. 23. The golf club head 4000 may include some features similar to, or the same as, features illustrated and described above with respect to other golf club heads, including, without limitation, the golf club heads 3500 and 3900.

Referring to FIGS. 23-29, the golf club head 4000 may include a body 4006 including a toe 4014, a heel 4016, a top portion 4003, a striking face, a sole 4002, and a back portion 4050. The toe 4014, the heel 4016, the top portion 4003, the striking face, the sole 4002, and the back portion 4050 may define at least part of an outer surface 4020 of the body 4006. A hosel 4001 may be disposed at the heel 4016 and be configured to couple to a shaft (not shown). The striking face may have a lower leading edge and an upper topline edge, the sole 4002 may extend rearward from the lower leading edge of the striking face to a rearward portion, and the back portion 4050 may be positioned rearward from the striking face and may be coupled between a rearward portion of the sole 4002 and the upper topline edge of the striking face (e.g., between the rearward portion of the sole 4002 and the top portion 4003). The back portion 4050 may include all surfaces of the outer surface 4020 of the body 4006 that are both between the rearward portion of the sole 4002 and the top portion 4003 and also between the toc 4014 and the heel 4016. In this example, the back portion 4050 includes a lower back surface 4052, a first back surface 4054, an intermediate back surface 4055, and a second back surface 4056.

A recessed channel 4026 may be formed in the outer surface 4020, and the weight assembly 4004 may be couplable to the body 4006 at the recessed channel 4026. In some examples, the recessed channel 4026 is formed at least partially in the back portion 4050 of the golf club head 4000, for example, at least partially in the first back surface 4054. The recessed channel 4026 may have a bottom 4063 (e.g., a bottom track) offset from the outer surface 4020, a heel-side end 4058 (e.g., heel-side end wall), a toe-side end 4057 (e.g., toe-side end wall) opposite to the toe-side end 4057 along a toe 4014-heel 4016 direction of the golf club head 4000, and first and second opposite sidewalls generally extending along the toe-heel direction between the toe-side end 4057 and the heel-side end 4058. As used herein, the toe-heel direction may include both the toe-to-heel direction and the heel-to-toe direction. In some examples, the recessed channel 4026 may have a top wall 4064 opposite to the bottom 4063. A first portion 4070 of the body 4006 may be positioned adjacent to, and define at least part of, the heel-side end 4058 of the recessed channel 4026, and a second portion 4074 of the body 4006 may be positioned adjacent to, and define at least part of, the toe-side end 4057 of the recessed channel 4026.

The weight assembly 4004 may include a weight 4028, a cover 4030, and a fastener 4032. The weight assembly 4004 may have some features similar to, or the same as, features of other weight assemblies disclosed herein.

The weight 4028 may be selectively movable within the recessed channel 4026 along the toe-heel direction in order to enable a player to controllably adjust a center of gravity (CG) of the golf club head 4000 along the toe-heel direction. In some examples, the weight 4028 has a weight opening 40280 shaped and sized to receive a tool configured to engage the weight 4028 via the weight opening 40280 so that the weight 4028 can be controllably moved within the recessed channel 4026. In some examples, the body 4006 includes one or more locating lugs 4094 protruding into the recessed channel 4026 (e.g., at least partially from one of the two opposing sidewalls of the recessed channel 4026, such as one of the two opposing sidewalls closest to the striking face). The weight 4028 may have at least one indent 4062 shaped and sized to receive at least part of the one or more locating lugs 4094 so that the weight 4028 can selectively engage with the one or more locating lugs 4094.

The cover 4030 may include a cover main body 4035 configured to cover at least part of the recessed channel 4026 and to releasably secure the weight 4028 within the recessed channel 4026. In some examples, the cover 4030 is slidingly engaged with the body 4006 such that the cover 4030 (e.g., the cover main body 4035) is slidable over at least part of the recessed channel 4026 along a sliding direction, for example, the toe-heel direction. The weight 4028 and the cover 4030 may be respectively shaped and sized such that the cover 4030 can slide past the weight 4028 positioned in the recessed channel 4026. In some examples, the position of the weight 4028 within the recessed channel 4026 is secured (e.g., fixed) when the weight 4028 is engaged with the one or more locating lugs 4094 and the cover 4030 at least partially covers the weight 4028, and the weight 4028 and the cover 4030 are shaped and sized such that the cover 4030 is slidable past the weight 4028 when the weight 4028 is engaged with the one or more locating lugs 4094.

A player may controllably adjust the center of gravity of the golf club head 4000 along the toc-heel direction by sliding the cover 4030 from a first position in which the cover 4030 covers at least part of the weight 4028, and secures the weight 4028 in the recessed channel 4026, to a second position in which the weight 4028 is exposed inside, and unsecured within, the recessed channel 4026. The player may then use a tool to move (e.g., lift) the weight 4028 upward inside the recessed channel 4026 (e.g., via the weight opening 40280) to disengage the weight 4028 from one of the locating lugs 4094, move the weight 4028 along the toe-heel direction inside the recessed channel 4026, and move (e.g., lower or drop) the weight 4028 downward into the recessed channel 4026 to cause the weight 4028 to engage with another one of the locating lugs 4094. The player may then slide the cover 4030 along the toe-heel direction from the second position to the first position in order to cover at least part of the weight 4028 with the recessed channel 4026, and secure the weight 4028 in its new position within the recessed channel 4026.

In some examples, movement of the cover 4030 may be confined to the sliding direction (e.g., the toe-heel direction) when the cover 4030 is slidingly engaged with the body 4006. For example, the cover 4030 may be slidingly engaged with the body 4006 such that it is blocked from moving in any direction substantially perpendicular to the sliding direction. In some examples, the cover 4030 is positioned at least partially inside the recessed channel 4026, and is shaped and sized such that its movement is confined to the sliding direction. For example, the cover 4030 may be shaped and sized such that it is blocked from moving out from the recessed channel 4026 along a direction perpendicular to the sliding direction.

The cover main body 4035 may have a heel end 4030H and a toe end 4030T opposite to the heel end 4030H along the toe-heel direction, and a locking arm 4044 may extend from the heel end 4030H or the toe end 4030T. In the illustrated example, the locking arm 4044 extends from the heel end 4030H of the cover main body 4035. The locking arm 4044 may include a protrusion 4046 defining at least part of a locking arm undercut 4045 (or indent), for example, together with a part of the cover main body 4035. The protrusion 4046 may protrude from the other part of the locking arm 4044 in a direction substantially perpendicular to the sliding direction and/or along a direction substantially parallel to a fastener axis that the fastener 4032 is selectively movable along. In examples described herein, "substantially parallel" may be defined as within one degree, within two degrees, within three degrees, within four degrees, within five degrees, or within ten degrees of exactly parallel. In examples described herein, "substantially perpendicular" may be defined as within one degree, within two degrees, within three degrees, within four degrees, within five degrees, or within ten degrees of exactly perpendicular. In some examples, each of the protrusion 4046 and the locking arm undercut 4045 may respectively have a curved shape extending partially along a circular path.

The fastener 4032 may be configured to lockingly engage with the cover 4030 (e.g., with the locking arm 4044) such that movement of the cover 4030 along the sliding direction is restrained (e.g., prevented or blocked). The fastener 4032 may lockingly engage with the cover 4030 when the cover 4030 at least partially covers the recessed channel 4026 and secures the weight 4028 within the recessed channel. Lockingly engaging the fastener 4032 with the cover 4030 can prevent the cover 4030 from unintentionally sliding relative to the body 4006 during a golf swing, which can cause the weight 4028 to become unsecured within, and thus to move within or to fall out from, the recessed channel 4026.

In some examples, the fastener 4032 is disposed adjacent to the heel end 4058 of the recessed channel 4026, for example, in the first portion 4070 of the body 4006. The fastener 4032 may have a head 4033 and a threaded portion 4034 extending from the head 4033. The head 4033 may be larger in breadth (e.g., diameter, width in a direction perpendicular to the fastener axis, etc.) than the threaded portion 4034. In some examples, the head 4033 has a tool indent 4032 TI (e.g., a Torx indent) shaped and sized to receive at least part of a tool (e.g., a screwdriver or a Torx) configured to controllably move the fastener 4032 along the fastener axis via the tool indent 4032 TI. In some examples, a shape and size of the tool indent 4032 TI is similar to, or the same as, a shape of the weight opening 40280 so that a single tool may be configured to controllably move the fastener 4032 along the fastener axis and to controllably move the weight 4028 within the recessed channel 4026. The head 4033 may have a fastener undercut 4096 (or indent) shaped and sized such that the head 4033 can lockingly engage with the locking arm 4044 to restrain movement of the cover 4030 along the sliding direction. For example, the fastener 4032 may be lockingly engaged with the locking arm 4044 when the fastener undercut 4096 receives at least part of the locking arm protrusion 4046 and/or when the locking arm undercut 4045 receives at least part of the head 4033 of the fastener 4032.

The fastener 4032 may be positionable along the fastener axis in a raised position (as shown in FIG. 25A) and in a lowered position (As shown in FIG. 25B). In the raised position, the fastener 4032 may be disengaged from the cover 4030, and the cover 4030 may be slidable relative to the body 4006 and positionable with the locking arm 4044 under part of the head 4033 (e.g., between the part of the head 4033 and the first portion 4070) such that the fastener 4032 is able to lockingly engage with the cover 4030 by being moved from the raised position to the lowered position. In the lowered position, the fastener 4032 may be lockingly engaged with the cover 4030 if the cover 4030 is positioned with the locking arm 4044 under the part of the head 4033. The weight assembly 4004 may be in a locked configuration, whereby the fastener 4032 is lockingly engaged with the cover 4030, and an unlocked configuration, whereby the fastener 4032 is disengaged from the cover 4030.

The body 4006 may be configured (e.g., shaped and sized) such that, when the cover 4030 is positioned with the locking arm 4044 under the part of the head 4033, there is a gap 4073 between the locking arm 4044 and the first portion 4070. Part of the cover 4030 at or near the toe end 4030T of the cover 4030 may contact (e.g., rest on, or be held up by) the second portion 4074 of the body 4006 such that the cover 4030 extends from the second portion 4074 over the recessed channel 4026 and the first portion 4070 in a cantilevered manner. A top surface 4074 TS of the second portion 4074 (e.g., a surface of the second portion 4074 farthest from the bottom 4063 of the recessed channel 4026 and/or from the sole 4002) may be positioned higher (e.g., positioned farther from the bottom 4063 of the recessed channel 4026 and/or from the sole 4002) than a top surface 4070 TS of the first portion 4070 (e.g., a surface of the first portion 4070 farthest from the bottom 4063 of the recessed channel 4026 and/or from the sole 4002) such that the cover 4030 extends from the second portion 4074 over at least part of the recessed channel 4026 and the first portion 4070 in the cantilevered manner.

The fastener 4032 (e.g., the head 4033) may be configured to deflect, or push, the locking arm 4044 into the gap 4073 when moved from the raised position to the lowered position. In some examples, the fastener 4032 is lockingly engaged with the cover 4030 when the fastener 4032 both contacts the locking arm 4044 and deflects the locking arm 4044 into the gap 4073. In some other examples, the fastener 4032 is lockingly engaged with the cover 4030 when the fastener 4032 contacts the locking arm 4044 (e.g., when the locking arm undercut 4045 receives part of the head 4033 of the fastener 4032). A size of the gap 4073 may be smaller when the fastener 4032 is in the lowered position than when the fastener 4032 is in the raised position. For example, a minimum distance between the first portion 4070 and the locking arm 4044 may be smaller when the fastener 4032 is in the lowered position compared to when the fastener 4032 is in the raised position. In some examples, the gap 4073 may still be present when the fastener 4032 is in the lowered position. In some other examples, the gap 4073 may be eliminated when the fastener 4032 is in the lowered position such that the locking arm 4044 contacts the first portion 4070. By deflecting or pressing the locking arm 4044 into the gap 4073, the cover 4030 may be placed in a strained state such that movability of the cover 4030 is reduced. Reducing the movability of the cover 4030 can reduce or prevent rattling of the cover 4030 during a golf swing, which some players can find distracting, and thus improve the player's focus, performance, and enjoyment of the game of golf.

The body 4006 may be configured (e.g., shape and sized) to block sliding movement of the cover 4030 in the toe-to-heel direction beyond a first set point, whereat the locking arm 4044 is positioned under part of the head 4033 such that the fastener 4032 can lockingly engage with the cover 4030 when moved from the raised position to the lowered position. Thus, a player can easily position the cover 4030 in a position to be lockingly engageable with the fastener 4032 by sliding the cover 4030 in the toe-to-heel direction until movement of the cover 4030 in the toe-to-heel direction is blocked by the body 4006. The player can then move the fastener 4032 from the raised position to the lowered position to lockingly engage the fastener 4032 with the cover 4030.

In some examples, the cover 4030 has a toe-side protrusion 4085 positioned at the toc end 4030T of the cover main body 4035 and protruding from the cover main body 4035 in a direction substantially perpendicular the sliding direction of the cover 4030. The outer surface 4020 of the body 4006 may have a toe-side recess 4075 positioned adjacent to the second portion 4074 of the body 4006 such that the second portion 4074 is positioned between the recessed channel 4026 and the toe-side recess 4075 along the sliding direction (e.g., the toe-heel direction). The toe-side recess 4075 may be shaped and sized to receive at least part of the toc-side protrusion 4085. The toe-side protrusion 4085 may contact the second portion 4074 of the body 4006 when the cover 4030 is slid to the first set point in the toe-to-heel direction such that the second portion 4074 of the body 4006 blocks movement of the cover 4030 in the toe-to-heel direction beyond the first set point.

In some examples, the second portion 4074 has an indent 4076 connected to the toc-side recess 4075, and the second portion 4074 includes a protrusion 4077 that defines at least part of the indent 4076 and protrudes from another part of the second portion 4074 in a direction substantially parallel to the sliding direction of the cover 4030. The toe-side protrusion 4085 of the cover 4030 may have an indent 4086 shaped and sized to receive at least part of the protrusion 4077 of the second portion 4074. When the cover 4030 is slid in the toe-to-heel direction to the first set point, the indent 4086 of the toe-side protrusion 4085 may receive at least part of the protrusion 4077 of the second portion 4074 and/or the indent 4076 of the second portion 4074 may receive part of the toe-side protrusion 4085. As explained above, the cover 4030 may extend from the second portion 4074 over the recessed channel 4026 and the first portion 4070 in a cantilever manner. In some examples, the cover 4030 may be blocked from falling into the gap 4073 and/or into the recessed channel 4026 when at least part of the protrusion 4077 of the second portion 4074 is fitted into the indent 4086 of the toe-side protrusion 4085 and/or part of the toe-side protrusion 4085 is fitted into the indent 4076 of the second portion 4074. For example, when part of the toe-side protrusion 4085 is fitted into the indent 4076 of the second portion 4074, the second portion 4074 may provide a counter torque to the cover 4030 that opposes a torque provided by gravity on the portion of the cover 4030 that extends from the second portion 4074.

In some examples, the body 4006 is configured (e.g., shape and sized) to block sliding movement of the cover 4030 in the heel-to-toe direction beyond a second set point to prevent the cover from decoupling from the body 4006. Thus, a player can slide the cover 4030 in the heel-to-toe direction to enable the player to controllably move the weight 4028 within the recessed channel 4026 without needing to worry about the cover 4030 falling off from the golf club head 4000.

In some examples, the body 4006 may include a hook protrusion 4078 that protrudes from one of the two opposing sidewalls (e.g., one of the two opposing sidewalls closest to the striking face) of the recessed channel 4026, and that is positioned at the toe 4014 of the body 4006. The hook protrusion 4078 may be joined to the top wall 4064, for example, above the toc-side recess 4075, and may at least partially define an indent 4079, for example, together with part of the top wall 4064. The cover 4030 may have an exterior surface 4030E configured to face outwardly from the golf club head 4000, and an interior surface 4030I opposite to the exterior surface 4030E and configured to face inwardly into the golf club head 4000 when the cover 4030 is lockingly engaged with the fastener 4032. The cover 4030 may include a hook protrusion 4095 protruding from the interior surface 4030I of the cover 4030 and positioned at the heel end 4030H of the cover main body 4035. The cover 4030 may be configured such that, when the cover 4030 is slid in the heel-to-toe direction to the second set point, the hook protrusion 4095 of the cover 4030 engages with the hook protrusion 4078 of the body 4006 such the movement of the cover 4030 in the heel-to-toe direction is blocked by the hook protrusion 4078 of the body 4006.

In some examples, a rail 4097 protrudes from the interior surface 4030I of the cover 4030 and is joined to the hook protrusion 4095 of the cover 4030 such that an indent 4098 is defined at least in part by the hook protrusion 4095 and the rail 4097. When the hook protrusion 4095 of the cover 4030 engages with the hook protrusion 4078 of the body 4006, the indent 4079 in the body 4006 may receive at least part of the hook protrusion 4095 of the cover 4030, and the indent 4098 of the cover 4030 may receive at least part of the hook protrusion 4078 of the body 4006.

Figure 30:
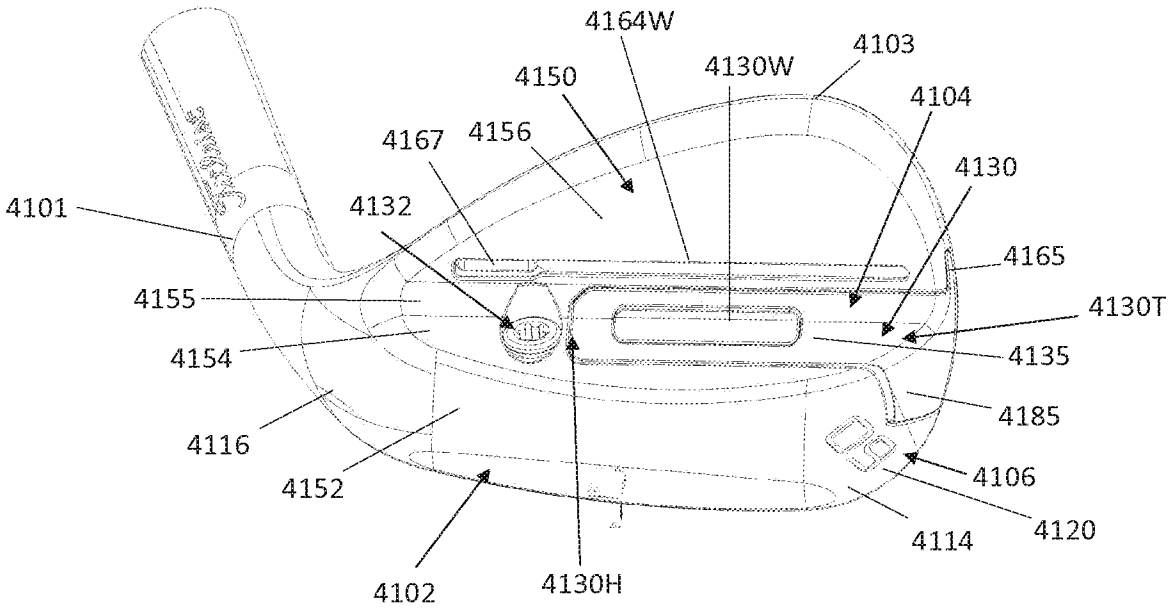
FIG. 30 is a back view of a golf club head with another weight assembly in a locked configuration.
Figure 31:
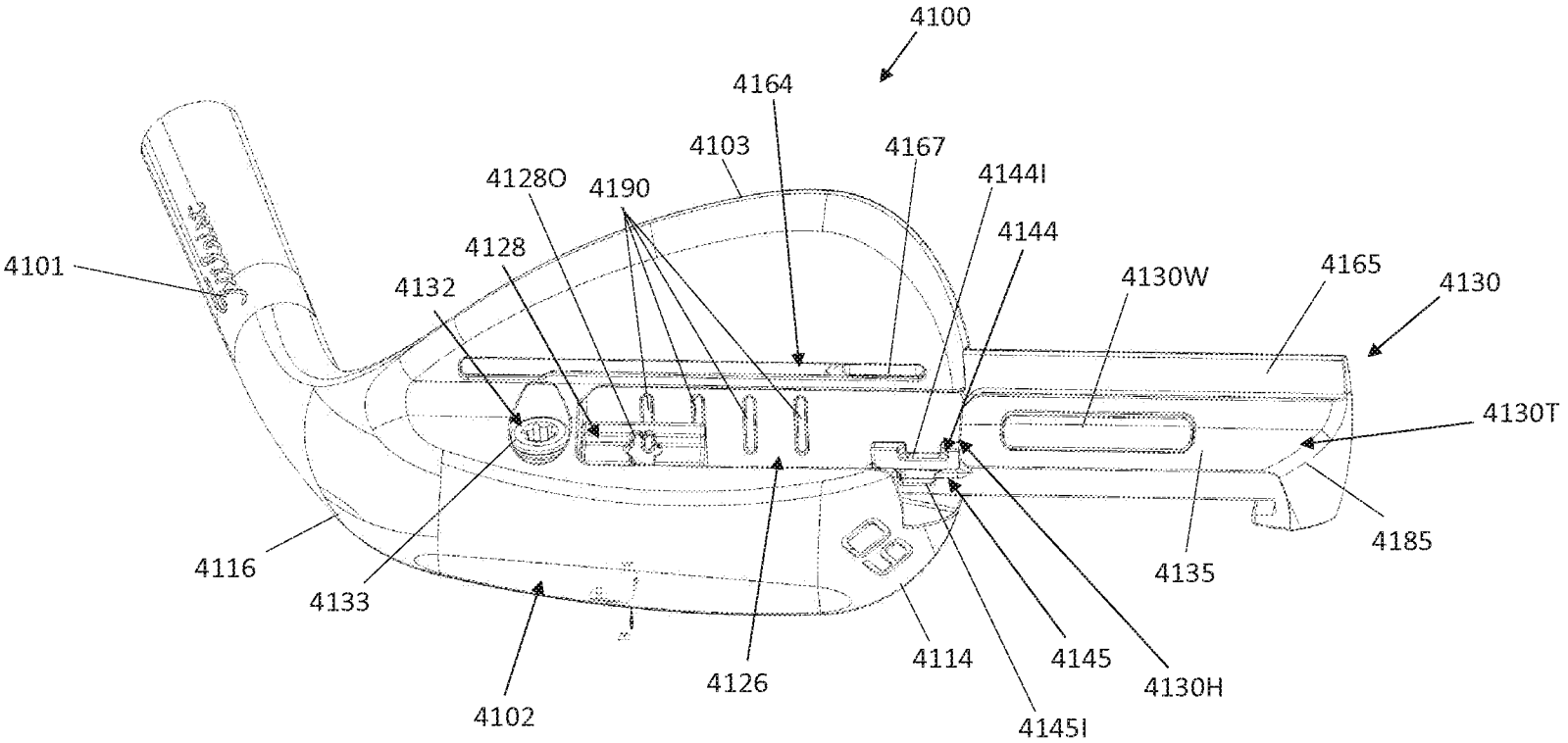
FIG. 31 is another back view of the golf club head of FIG. 30 when the weight assembly is in an unlocked configuration.
Figure 32B:
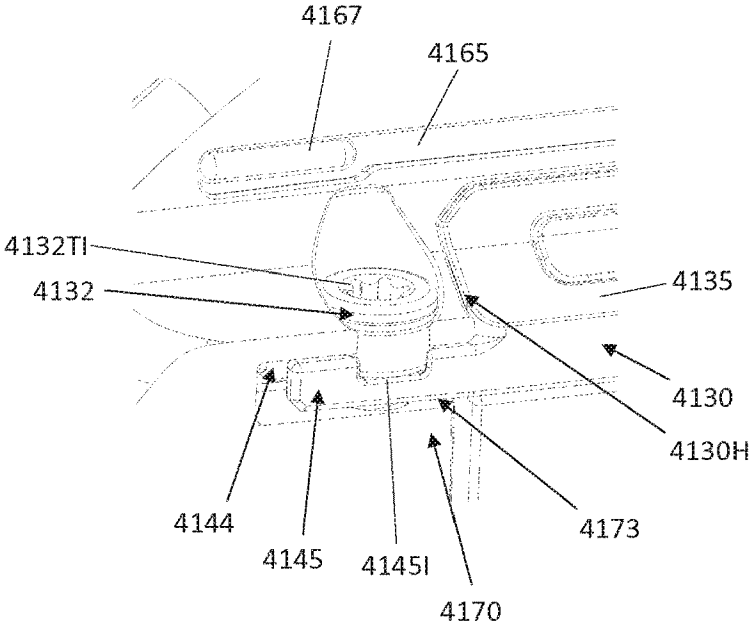
FIG. 32B is another partially transparent back view of part of the golf club head of FIG. 30 when the fastener of the weight assembly is lockingly engaged with the cover of the weight assembly.
Figure 32A:
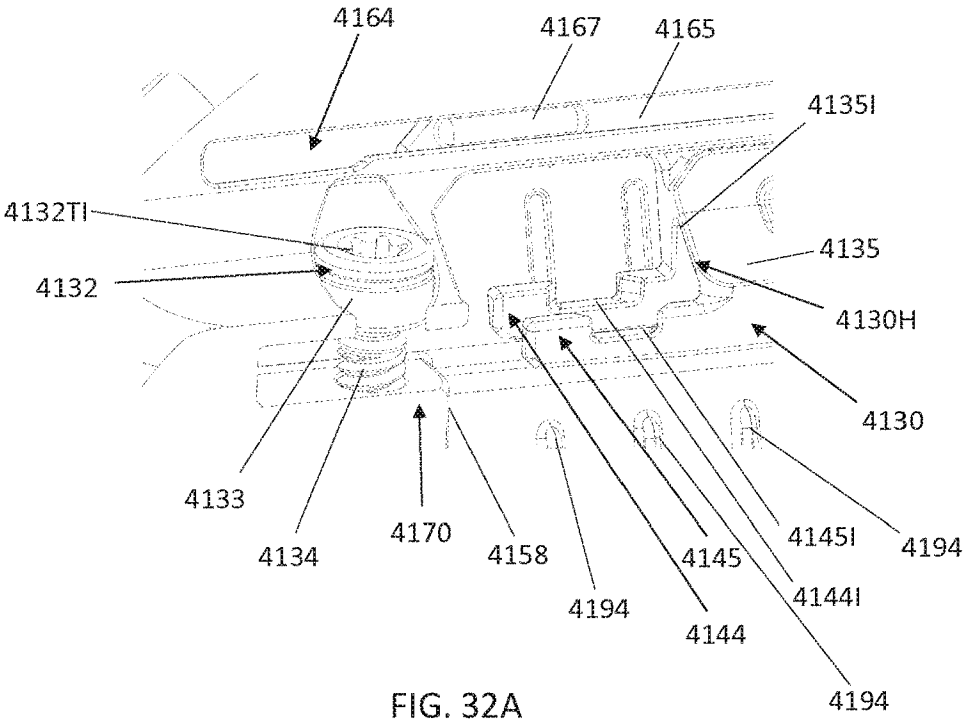
FIG. 32A is a partially transparent back view of part of the golf club head of FIG. 30 when the fastener of the weight assembly is lockingly disengaged from the cover of the weight assembly.
Figure 33B:
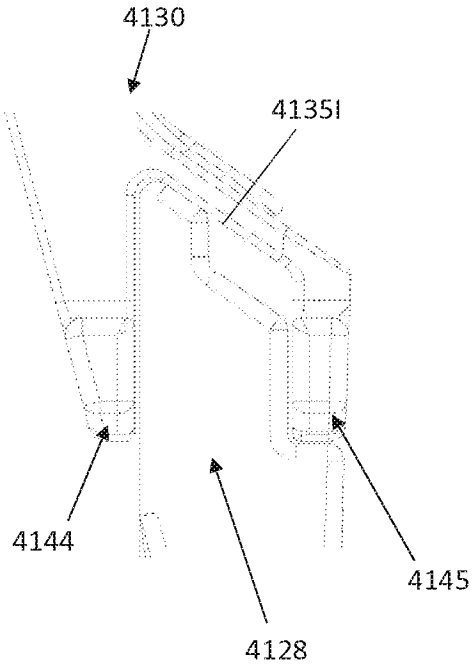
FIG. 33B is a heel-to-toe side view of the cover and the weight of the weight assembly of the golf club head of FIG. 30.
Figure 33A:
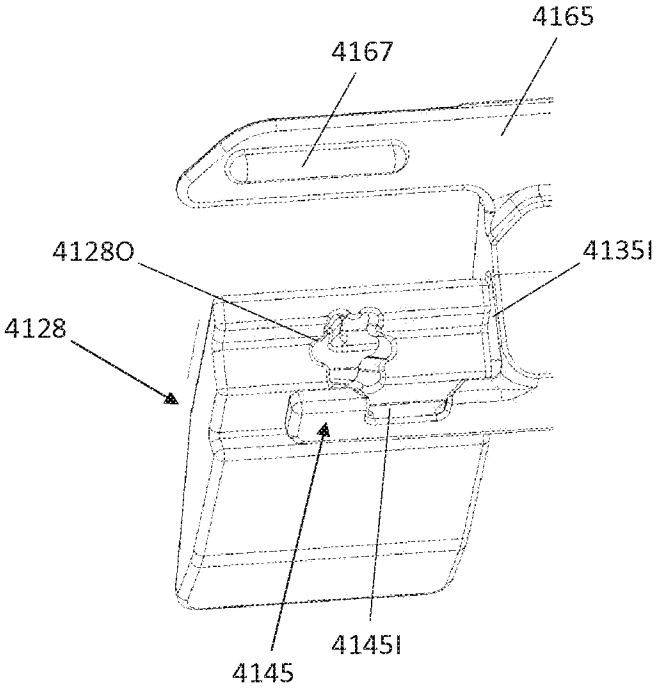
FIG. 33A is a perspective view of the cover and the weight of the weight assembly of the golf club head of FIG. 30.
Figure 34:
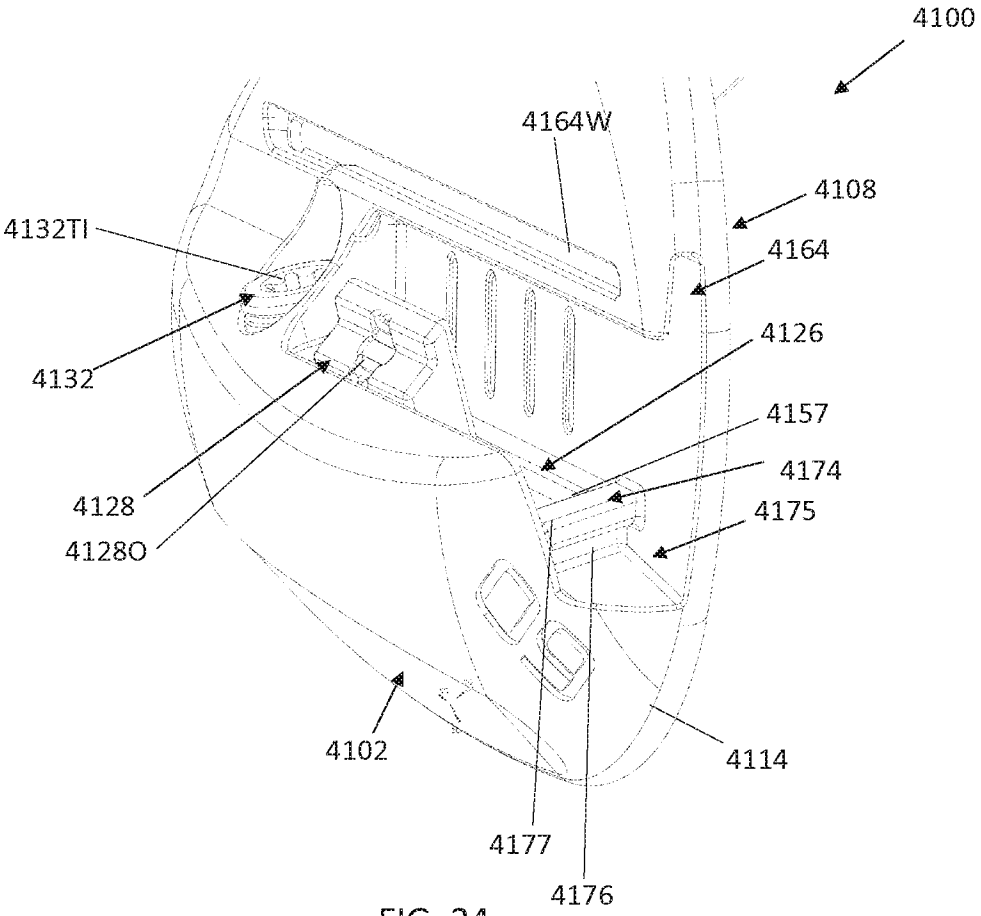
FIG. 34 is a toe-side perspective view of the golf club head of FIG. 30 without the cover of the golf club head.
Figure 35B:
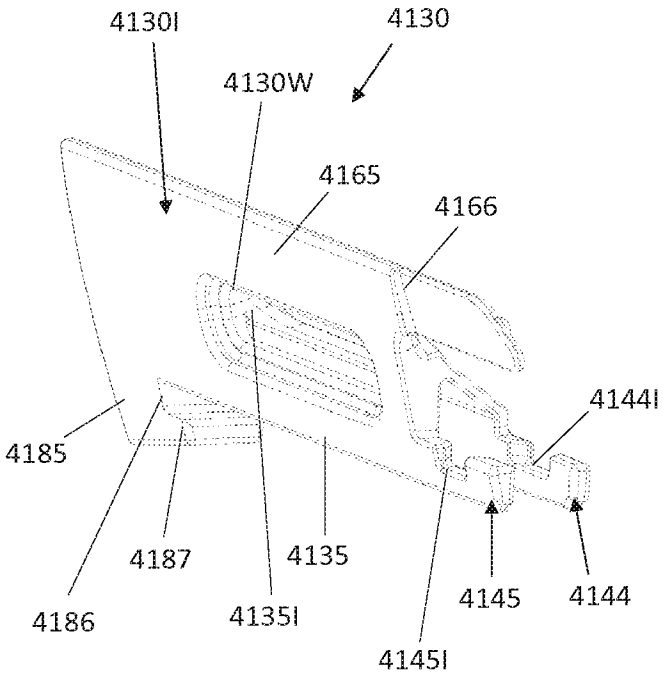
FIG. 35B is another perspective view of the cover of an interior side of the cover of the weight assembly of the golf club head of FIG. 30.
Figure 35A:
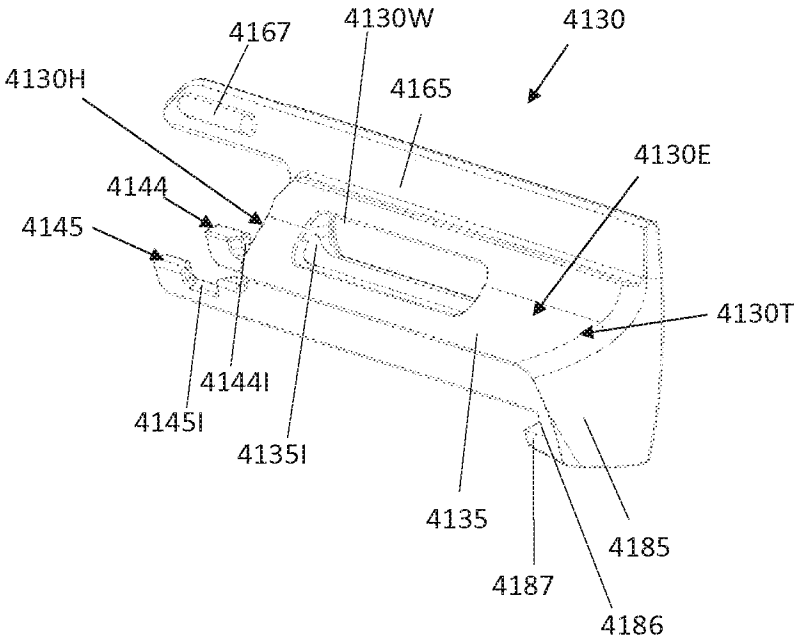
FIG. 35A is a perspective view of an exterior side of the cover of the weight assembly of the golf club head of FIG. 30.

FIG. 30 is a back view of a golf club head 4100 with another weight assembly 4104 in a locked configuration. In this illustrated example, the golf club head 4100 is wedge-type golf club head. In particular, the golf club head 4100 is illustrated as a 60 degree, Titleist® (Trademark of Acushnet) golf club head, but the embodiment is not limited thereto. In some other examples, the golf club head may be an iron-type golf club head, a metalwood-type golf club head, or a hybrid-type golf club head. FIG. 31 is another back view of the golf club head 4100 of FIG. 30 when the weight assembly 4104 is in an unlocked configuration. FIG. 32A is a partially transparent back view of part of the golf club head 4100 of FIG. 30 when the fastener 4132 of the weight assembly 4104 is lockingly disengaged from the cover 4130 of the weight assembly 4104. FIG. 32B is another partially transparent back view of part of the golf club head 4100 of FIG. 30 when the fastener 4132 of the weight assembly 4104 is lockingly engaged with the cover 4130 of the weight assembly 4104. FIG. 33A is a perspective view of the cover 4130 and the weight 4128 of the weight assembly 4104 of the golf club head 4100 of FIG. 30. FIG. 33B is a heel-to-toe side view of the cover 4130 and the weight 4128 of the weight assembly 4104 of the golf club head 4100 of FIG. 30. FIG. 34 is a toe-side perspective view of the golf club head 4100 of FIG. 30 without the cover 4130 of the golf club head 4100. FIG. 35A is a perspective view of an exterior side of the cover 4130 of the weight assembly 4104 of the golf club head 4100 of FIG. 30. FIG. 35B is another perspective view of an interior side of the cover 4130 of the weight assembly 4104 of the golf club head 4100 of FIG. 30. The golf club head 4100 may include some features similar to, or the same as, features illustrated and described above with respect to other golf club heads, including, without limitation, the golf club head 4000.

Referring to FIGS. 30-35B, the golf club head 4100 may include a body 4106 including a toe 4114, a heel 4116, a top portion 4103, a striking face 4108, a sole 4102, and a back portion 4150. The toe 4114, the heel 4116, the top portion 4103, the striking face 4108, the sole 4102, and the back portion 4150 may define at least part of an outer surface 4120 of the body 4106. A hosel 4101 may be disposed at the heel 4116 and be configured to couple to a shaft (not shown). The striking face 4108 may have a lower leading edge and an upper topline edge, the sole 4102 may extend rearward from the lower leading edge of the striking face 4108 to a rearward portion, and the back portion 4150 may be positioned rearward from the striking face 4108 and may be coupled between a rearward portion of the sole 4102 and the upper topline edge of the striking face 4108. The back portion 4150 may include all surfaces of the outer surface 4120 of the body 4106 that are both between the rearward portion of the sole 4102 and the top portion 4103 and also between the toe 4114 and the heel 4116. In this example, the back portion 4150 includes a lower back surface 4152, a first back surface 4154, an intermediate back surface 4155, and a second back surface 4156.

A recessed channel 4126 may be formed in the outer surface 4120, and the weight assembly 4104 may be couplable to the body 4106 of the golf club head 4100 at the recessed channel 4126. In some examples, the recessed channel 4126 is formed at least partially in the back portion 4150 of the golf club head 4100, for example, at least partially in the first surface 4154. The recessed channel 4126 may have a bottom (e.g., a bottom track) offset from the outer surface 4120, a heel-side end 4158 (e.g., heel-side end wall), a toe-side end 4157 (e.g., toe-side end wall) opposite to the toe-side end 4157 along a toe 4114-heel 4116 direction of the golf club head 4100, and first and second opposite sidewalls generally extending along the toe-heel direction between the toe-side end 4157 and the heel-side end 4158. In some examples, a top chamber 4164 may be connected to the recessed channel 4126 and positioned opposite to the bottom 4163 of the recessed channel 4126. The top chamber 4164 may be at least partially positioned between the striking face 4108 and the second back surface 4156, and may have a chamber window 4164W exposing at least part of the top chamber 4164, for example, through the second back surface 4156. The top chamber 4164 may be exposed to outside of the golf club head 4100 at the toe 4114 of the body 4106. A first portion 4170 of the body 4106 may be positioned adjacent to, and define at least part of, the heel-side end 4158 of the recessed channel 4126, and a second portion 4174 of the body 4106 may be positioned adjacent to, and define at least part of, the toe-side end 4157 of the recessed channel 4126.

The weight assembly 4104 may include a weight 4128, a cover 4130, and a fastener 4132. The weight assembly 4104 may have some features similar to, or the same as, features of other weight assemblies disclosed herein, including, without limitation, the weight assembly 4004 of the golf club head 4000.

The weight 4128 may be selectively movable within the recessed channel 4126 along the toe-heel direction in order to enable a player to controllably adjust a center of gravity (CG) of the golf club head 4100 along the toe-heel direction. In some examples, the weight 4128 has a weight opening 41280 shaped and sized to receive a tool configured to engage the weight 4128 via the weight opening 41280 so that the weight 4128 can be controllably moved within the recessed channel 4126. In some examples, the body 4106 includes one or more locating lugs 4194 protruding into the recessed channel 4126 (e.g., at least partially from one of the two opposing sidewalls of the recessed channel 4126, such as one of the two opposing sidewalls closest to the striking face 4108). The weight 4128 may have at least one indent shaped and sized to receive at least part of the one or more locating lugs 4194 so that the weight 4128 can selectively engage with the one or more locating lugs 4194.

The cover 4130 may include a cover main body 4135 configured to cover at least part of the recessed channel 4126 and to releasably secure the weight 4128 within the recessed channel 4126. In some examples, the cover 4130 is slidingly engaged with the body 4106 such that the cover 4130 (e.g., the cover main body 4135) is slidable over at least part of the recessed channel 4126 along a sliding direction, for example, the toe-heel direction. The cover 4130 may be configured such that movement of the cover 4130 is confined to the sliding direction when the cover 4130 is slidingly engaged with the body 4106, for example, in a similar or same manner as the cover 4030 of the golf club head 4000 may be configured such that movement of the cover 4030 is confined to the sliding direction.

The weight 4128 and the cover 4130 may be respectively shaped and sized such that the cover 4130 can slide past the weight 4128 positioned in the recessed channel 4126. For example, as shown in FIGS. 33A and 33B, the cover main body 4135 may have an indent 41351 shaped and sized to provide clearance for the weight 4128 as the cover 4130 slides over the weight 4128. In some examples, the position of the weight 4128 within the recessed channel 4126 is secured (e.g., fixed) when the weight 4128 is engaged with the one or more locating lugs 4194 and the cover 4130 at least partially covers the weight 4128, and the weight 4128 and the cover 4130 are shaped and sized such that the cover 4130 is slidable past the weight 4128 when the weight 4128 is engaged with the one or more locating lugs 4194.

A player may controllably adjust the center of gravity of the golf club head 4100 along the toe-heel direction by sliding the cover 4130 from a first position in which the cover 4130 covers at least part of the weight 4128, and secures the weight 4128 in the recessed channel 4126, to a second position in which the weight 4128 is exposed inside, and unsecured within, the recessed channel 4126. The player may then use a tool to move (e.g., lift) the weight 4128 upward inside the recessed channel 4126 (e.g., via the weight opening 41280) to disengage the weight 4128 from one of the locating lugs 4194, move the weight 4128 along the toc-heel direction inside the recessed channel 4126, and move (e.g., lower or drop) the weight 4128 downward into the recessed channel 4126 to cause the weight 4128 to engage with another one of the locating lugs 4194. The player may then slide the cover 4130 along the toe-heel direction from the second position to the first position in order to cover at least part of the weight 4128 with the recessed channel 4126, and secure the weight 4128 in its new position within the recessed channel 4126.

The cover main body 4135 may have a heel end 4130H and a toe end 4130T opposite to the heel end 4130H along the toe-heel direction. The cover 4130 may include a first locking arm 4144 and/or a second locking arm 4145 that respectively extend from the heel end 4130H or the toe end 4130T. In the illustrated example, the cover 4130 includes both the first and second locking arms 4144 and 4145, which extend from the heel end 4130H. The first locking arm 4144 may have a first indent 4144I, and the second locking arm 4145 may have a second indent 4145I.

The fastener 4132 may be configured to lockingly engage with the cover 4130 (e.g., with the first locking arm 4144 and/or with the second locking arm 4145) such that movement of the cover 4130 along the sliding direction is restrained (e.g., prevented or blocked). The fastener 4132 may be configured to lockingly engage with the cover 4130 when the cover 4130 at least partially covers the recessed channel 4126 and secures the weight 4128 within the recessed channel 4126.

In some examples, the fastener 4132 is disposed adjacent to the heel-side end 4158 of the recessed channel 4126, for example in the first portion 4170 of the body 4106. The fastener 4132 may have a head 4133 and a threaded portion 4134 extending from the head 4133. The head 4133 may be larger in breadth than the threaded portion 4134. In some examples, the head 4133 has a tool indent 4132 TI shaped and sized to receive at least part of a tool configured to controllably move the fastener 4132 along the fastener axis via the tool indent 4132 TI. In some examples, a shape and size of the tool indent 4132 TI is similar to, or the same as, a shape and size of the weight opening 41280 of the weight 4128.

The fastener 4132 may be positionable in a raised position (e.g., as shown in FIG. 32A) and a lowered position (e.g., as shown in FIG. 32B), such that the head 4133 is positioned farther from the first portion 4170 when the fastener 4132 is in the raised position compared to when the fastener 4132 is in the lowered position. The cover 4130 may be positionable (when the fastener 4132 is in the raised position) such that the first and second locking arms 4144 and 4145 may be slid past the fastener 4132 along the toe-heel direction, and are at least partially positioned between the head 4133 and the first portion 4170. The first and second indents 4144I and 4145I may be respectively in surfaces of the first and second locking arms 4144 and 4145 configured to face the head 4133 and/or away from the first portion 4170 when the cover 4130 is positioned with the first and second locking arms 4144 and 4145 between the head 4133 and the first portion 4170, and the first and second indents 4144I and 4145I may respectively be shaped and sized to receive part of the head 4133.

When the first and second locking arms 4144 and 4145 are positioned between the head 4133 and the first portion 4170, the fastener 4132 may be moved from the raised position to the lowered position to lockingly engage the fastener 4132 with the cover 4130 by moving part of the head 4133 into the first and second indents 4144I and 4145I. When the part of the head 4133 is positioned in the first and second indents 4144I and 4145I, the first and second locking arms 4144 and 4145 may be blocked by the head 4133 from moving along the toe-heel direction.

The body 4106 may be configured (e.g., shaped and sized) such that, when the cover 4130 is positioned with the first and second locking arms 4144 and 4145 extending over the first portion 4170, there are gaps 4173 between the first locking arm 4144 and the first portion 4170, and between the second locking arm 4145 and the first portion 4170. Part of the cover 4130 at or near the toe end 4130T of the cover 4130 may contact (e.g., be held up by) the second portion 4174 such that the cover 4130 extends from the second portion 4174 over the recessed channel 4126 and the first portion 4170 in a cantilevered manner in a similar or same manner as the cover 4030 of the golf club head 4000 may extend from the second portion 4074 in a cantilever manner.

In some examples, the fastener 4132 (e.g., the head 4133) may be configured to deflect, or push, the first and second locking arms 4144 and 4145 into their respective gaps 4173 when the fastener 4132 is moved from the raised position to the lowered position in a similar or same manner as the fastener 4032 of the golf club head 4000 may be configured to deflect, or push, the locking arm 4044 into the gap 4073.

The body 4106 may be configured (e.g., shape and sized) to block sliding movement of the cover 4130 in the toe-to-heel direction beyond a first set point, whereat the first and second locking arms 4144 and 4145 are positioned at least partially under the head 4033 such that the fastener 4132 can lockingly engage with the cover 4130 when moved from the raised position to the lowered position in a similar or same manner as the body 4006 of the golf club head 4000 may be configured to block the sliding movement of the cover 4030 in the toe-to-heel direction beyond the first set point. For example, the cover 4130 may have a toe-side protrusion 4185 positioned at the toe end 4130T of the cover main body 4135, the outer surface 4120 of the body 4106 may have a toe-side recess 4175 positioned adjacent to the second portion 4174 and shaped and sized to receive at least part of the toe-side protrusion 4185, and the second portion 4174 may block movement of the cover 4130 in the toe-to-heel direction beyond the first set point when the toe-side protrusion 4185 contacts the second portion 4174. In some examples, the second portion 4174 has an indent 4176 connected to the toe-side recess 4175, the second portion 4174 includes a protrusion 4177 that defines at least part of the indent 4176, and the toe-side protrusion 4185 of the cover 4130 has an indent 4186. When the cover 4130 is slid in the toe-to-heel direction to the first set point, the indent 4176 of the second portion 4174 may receive part of the toe-side protrusion 4185 of the cover 4130, and the indent 4186 of the toe-side protrusion 4185 may receive at least part of the protrusion 4177 of the second portion 4174.

In some examples, the body 4106 is configured (e.g., shape and sized) to block sliding movement of the cover 4130 in the heel-to-toe direction beyond a second set point to prevent the cover 4130 from decoupling from the body 4106. Thus, a player can slide the cover 4130 in the heel-to-toe direction to enable the player to controllably move the weight 4128 within the recessed channel 4126 without needing to worry about the cover 4130 falling off from the golf club head 4100.

In some examples, the cover 4130 has a cover wall 4165 joined to the cover main body 4135 and shaped and sized to fit at least partially into the top chamber 4164. The cover wall 4165 may be elongated along the sliding direction (e.g., the toe-heel direction) between a first end of the cover wall 4165 and a second end of the cover wall 4165. The first end of the cover wall 4165 may be at the toe end 4130T of the cover main body 4135, and the second end of the cover wall 4165 may be beyond the heel end 4130H of the cover main body 4135, for example, in the toe-to-heel direction. A locking bump 4167 may protrude from the cover wall 4165 at or near the second end of the cover wall 4165, for example, from a first portion of the cover wall 4165 that extends past the heel end 4130H of the cover main body 4135 in the toe-to-heel direction. The locking bump 4167 may be shaped and sized to extend at least partially through the chamber window 4164W. The chamber window 4164W may be elongated along the sliding direction (e.g., the toe-heel direction) so that the locking bump 4167 that extends at least partially through the chamber window 4164W has room to move along the sliding direction as the cover 4130 slides along the sliding direction. However, the chamber window 4164W may be enclosed by the body 4106 along the toe-heel direction at a toe-side end of the chamber window 4164W proximal to the toe 4114 such that a portion of the body 4106 enclosing the toe-side end of the chamber window 4164W blocks movement of the locking bump 4167, and of the cover 4130, in the heel-to-toe direction beyond the second set point.

In some examples, a thickness of the first portion of the cover wall 4165 may be thinner than a second portion of the cover wall 4165 (e.g., a remainder of the cover wall 4165 other than the first portion of the cover wall 4165). For example, the cover 4130 may have an exterior surface 4130E configured to face outwardly from the golf club head 4100 and an interior surface 4130I opposite to the exterior surface 4130E and configured to face inwardly into the golf club head 4100 when the cover 4130 is lockingly engaged with the fastener 4132. The interior surface 4130I may have a stepped recess 4166 between the first and second portions of the cover wall 4165 such that the thickness of the first portion of the cover wall 4165 is less than a thickness of the second portion of the cover wall 4165. The locking bump 4167 may protrude from a part of the exterior surface 4130E of the cover 4130 corresponding to the first portion of the cover wall 4165. The thickness of the first portion of the cover wall 4165 may be set to be less than the thickness of the second portion of the cover wall 4165 to more easily enable the combination of the first portion of the cover wall 4165 and the locking bump 4167 to be moved into (e.g., forced into) the top chamber 4164 past the portion of the body 4106 that encloses the toe-end side of the chamber window 4164W so that the cover 4130 can be engaged with the body 4106.

Figure 36:
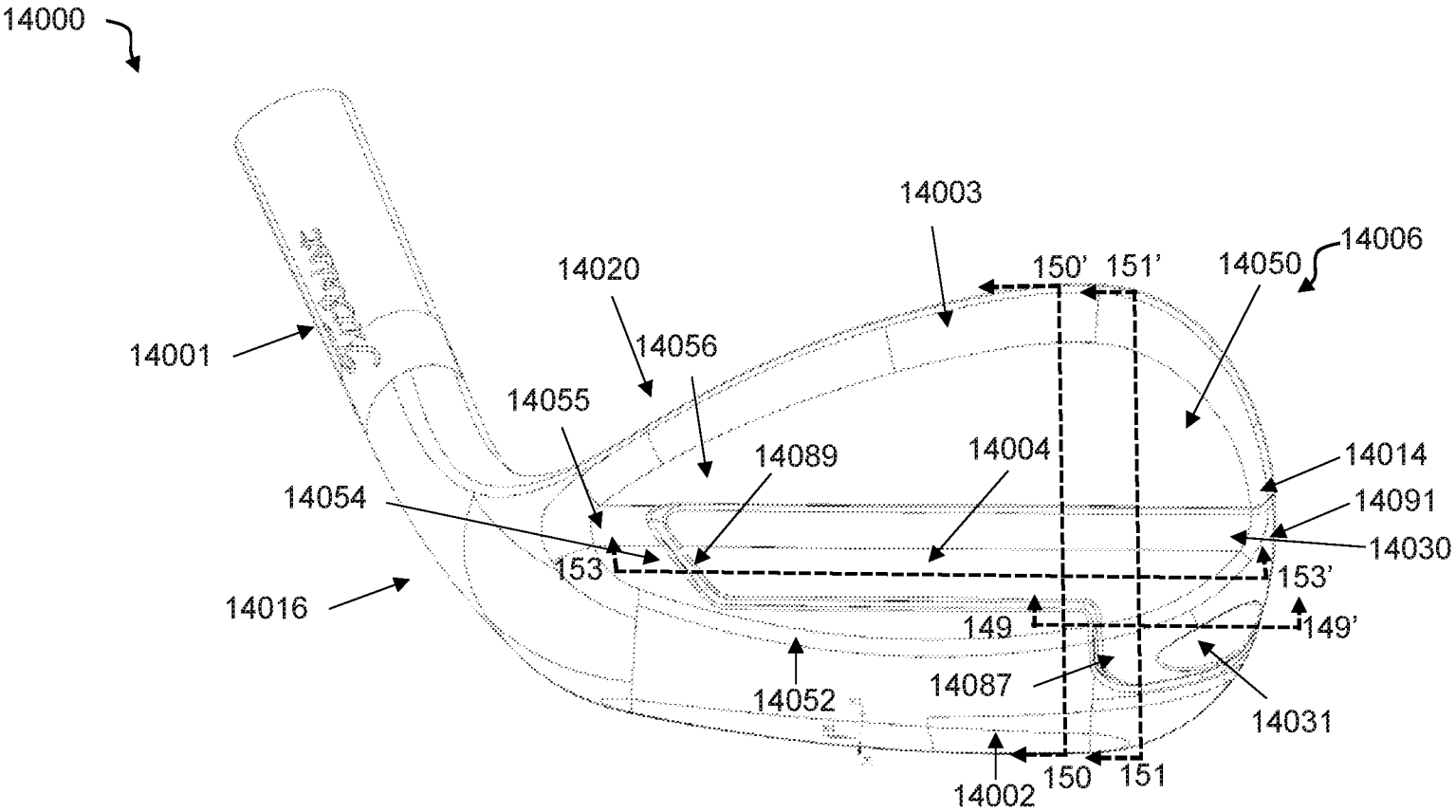
FIG. 36 illustrates a perspective view of a golf club head, in accordance with one or more embodiments of the presently disclosed technology.

FIG. 36 illustrates a perspective view of a golf club head, in accordance with one or more embodiments of the presently disclosed technology. Golf club head 14000 may include weight assembly 14004 and body 14006. In some embodiments, golf club head 14000 may be referred to herein as a modular golf club head. Weight assembly 14004 may include weight (at least shown as movable weight 14328 in FIG. 39), slidable cover 14030, cover through hole 14031, and fastener (at least shown as fastener 14132 in FIG. 37). Weight assembly 14004 may have some features similar to, or the same as, features of other weight assemblies disclosed herein.

Slidable cover 14030 may include cover through hole 14031, fastener (at least shown as fastener 14132 in FIG. 37), first cover surface 14087, second cover surface 14089, third cover surface 14091, a top end, a bottom end, a heel end, and a toe end opposite to the heel end along the toe-to-heel direction. Cover through hole 14031 may be partially threaded. In some embodiments, cover through hole 14031 may be fully threaded. Cover through hole 14031 may be substantially parallel to the toe-to-heel direction. In some embodiments, cover through hole 14031 may be substantially parallel to the sliding direction of slidable cover 14030. The sliding direction may be a direction that slidable cover 14030 slides to be in a locked configuration and/or to be taken out of a locked configuration. Cover through hole 14031 may be the same circumference throughout a cover length of cover through hole 14031. The cover length may refer to a dimension of slidable cover 14030 along the toe-to-heel direction. Slidable cover 14030 may also have a cover height and a cover width corresponding to a bottom-to-top direction and a back-to-front direction, respectively. In some embodiments, cover through hole 14031 may have different circumferences throughout the cover length of cover through hole 14031. The different circumferences may be stepped and/or tapered. A toe-most circumference may be larger or smaller than the circumference of a head of fastener (at least shown as fastener 14132 in FIG. 37). In some embodiments, the cover through hole circumference of cover through hole 14031 may be the fastener head circumference of the head of fastener (at least shown as fastener 14132 in FIG. 37). In embodiments, a cap may be placed toe-ward of fastener (at least shown as fastener 14132 in FIG. 37) that is shaped, sized, and/or dimensioned to match the curves and edges of golf club head 14000 across cover through hole 14031. For example, a cap may make golf club head 14000 visually appear as though there is no cover through hole 14031. This may help improve aerodynamics and or any unwanted effects caused by a gap in material of golf club head 14000. In some embodiments, the cap may be weighted which may affect CG, MOI, and/or other effects. For example, a weighted cap may move the CG toward the toc.

First cover surface 14087 may correspond to at least a part of first back surface 14054 and/or at least a part of lower back surface 14052. First cover surface 14087 may be defined based on at least a part of first back surface 14054 and at least a part of lower back surface 14052. In embodiments, first cover surface 14087, first back surface 14054, and lower back surface 14052 may be shaped, sized, and/or dimensioned to fit together. First cover surface 14087 may wrap onto parts of upper back surface 14056, sole 14002, lower back surface 14052, and toe 14014. As illustrated, first cover surface 14087 may include linear edges and curved edges. The linear edges may run along a toe-to-heel direction and a bottom-to-top direction. The curved edge may correspond to an edge of lower back surface 14052. As illustrated, first cover surface 14087 may vertically drop down from a linear horizontal part of an edge of slidable cover 14030. First cover surface 14087 may curve toward a horizontal linear part of slidable cover 14030 above which cover through hole 14031 may be located. First cover surface 14087 may drop from a top of sole 14002 to a back of sole 14002 and curve toward toe 14014. As illustrated, first cover surface 14087 may provide a uniform appearance to golf club head 14000 in a locked configuration. A uniform appearance may mean that the natural aesthetic of golf club head 14000 is preserved such that golf club head 14000 may be virtually indistinguishable, at least from a visual perspective, from a traditional golf club head, including a traditional golf club head without a removable weight assembly. In some embodiments, a uniform appearance may refer to not interfering with a user's intended interaction with golf club head 14000. In embodiments, a uniform appearance may mean edges and parts of outer surface 14020 of golf club head 14000 may be substantially continuous throughout golf club head 14000, including between body 14006 and weight assembly 14004. For example, edges and parts of outer surface 14020 between at least part of first back surface 14054 closest to first cover surface 14087 and first cover surface 14087. Here, substantially continuous may mean that the curves or lines of golf club head 14000 are preserved between slidable cover 14030 and body 14006 to retain the natural aesthetic of a traditional golf club head. That is, there may be a substantially continuous shape between components of golf club head 14000, including between body 14006 and weight assembly 14004. While there may be gaps between slidable cover 14030 and body 14006, the curves and/or lines from body 14006 continue on to slidable cover 14030 as if there was no gap and/or as if the gap was interpolated between the curves and/or lines from body 14006 and slidable cover 14030. It should be appreciated that slidable cover 14030 and first cover surface 14087 may be differently shaped, sized, and/or dimensioned to provide a uniform appearance to golf club head 14000 in a locked configuration (e.g., slidable cover 14030 is fully fastened to body 14006). For example, in some embodiments, first cover surface 14087 may extend from a current position toward the heel end of slidable cover 14030 and continue the back-to-front line near second cover surface 14089 providing a rectangular look to slidable cover 14030. The corresponding parts of first back surface 14054 and/or lower back surface 14052 may be shaped, sized, and/or dimensioned to receive at least part of slidable cover 14030 corresponding to first cover surface 14087. It should be appreciated that a uniform appearance may significantly impact gameplay for a user looking down on golf club head 14000.

Second cover surface 14089 may correspond to at least a part of first back surface 14054 and/or at least a part of second back surface 14055. Second cover surface 14089 may be defined based on at least a part of first back surface 14054 and at least a part of second back surface 14055. In embodiments, second cover surface 14089, first back surface 14054, and second back surface 14055 may be shaped, sized, and/or dimensioned to fit together. As illustrated, a first part of second cover surface 14089 may include linear edges and curved edges. The linear edges may run along at least parts of upper back surface 14056, second back surface 14055, and first back surface 14054. The curved edges may run along at least parts of first back surface 14054 and second back surface 14055. As illustrated, second cover surface 14089 may include a horizontal linear part, a curved part from the horizontal linear part, a curved part from the back-to-front linear part to a horizontal linear part, and a horizontal linear part. As illustrated, a first part of back-to-front part may correspond to first back surface 14054. The first part may extend to an edge of where sole 14002 might end on a traditional golf club head. A second part of back-to-front part may correspond to second back surface 14055. The second part may extend toward a top of sole 14002. The first part and the second part may be sloped and/or curved. Second cover surface 14089 may go across a bottom of upper back surface 14056, and drop down onto a top of sole 14002 and cut back across a top of sole 14002. Second cover surface 14089 may provide a uniform appearance to golf club head 14000 in a locked configuration, as described herein with respect to other components. For example, golf club head 14000 may be substantially continuous between at least part of first back surface 14054 closest to second cover surface 14089, part of second back surface 14055 closest to second cover surface 14089, part of upper back surface 14056 closest to second cover surface 14089, and second cover surface 14089. It should be appreciated that slidable cover 14030 and second cover surface 14089 may be differently shaped, sized, and/or dimensioned to provide a uniform appearance to golf club head 14000 in a locked configuration (e.g., slidable cover 14030 is fully fastened to body 14006). For example, in some embodiments, second cover surface 14089 may run along the entire surfaces of first back surface 14054 and second back surface 14055, essentially covering a top of sole 14002, and drop down as slidable cover 14030 currently does. The corresponding parts of first back surface 14054 and/or second back surface 14055 may be shaped, sized, and/or dimensioned to receive at least part of slidable cover 14030 corresponding to second cover surface 14089.

Third cover surface 14091 may correspond to at least a part of back 14050 and a part of toe 14014. Third cover surface 14091 may be defined based on at least a part of back 14050 and a part of toe 14014. In some embodiments, third cover surface 14091 may be defined based on at least parts of toe 14014, lower back surface 14052, and upper back surface 14056. In embodiments, third cover surface 14091, toe 14014, lower back surface 14052, and upper back surface 14056 may be shaped, sized, and/or dimensioned to fit together. As illustrated, third cover surface 14091 may include linear edges and curved edges. The linear edges may run along at least parts of upper back surface 14056, and lower back surface 14052. The curved edges may run along at least parts of lower back surface 14052, toe 14014, and upper back surface 14056. As illustrated, third cover surface 14091 may include a horizontal linear back-to-front part, a vertical curved top-to-bottom part, a curved part from the vertical linear top-to-bottom part, and a curved part from horizontal linear back-to-front part, matching up on the other end of slidable cover 14030 with first back surface 14054 and second back surface 14055. Third cover surface 14091 may go across a middle of a back of sole 14002 and wrap around toe 14014, go up toe 14014, and cut back across a bottom of upper back surface 14056. As illustrated, third cover surface 14091 may provide a uniform appearance to golf club head 14000 in a locked configuration. For example, golf club head 14000 may be substantially continuous between at least part of toe 14014 closest to third cover surface 14091, part of lower back surface 14052 closest to third cover surface 14091, part of upper back surface 14056 closest to third cover surface 14091, and third cover surface 14091. It should be appreciated that slidable cover 14030 and third cover surface 14091 may be differently shaped, sized, and/or dimensioned to provide a uniform appearance to golf club head 14000 in a locked configuration. For example, in some embodiments, third cover surface 14091 may cut across at a top of sole 14002, providing a rectangular look to slidable cover 14030. The corresponding parts of back 14050 and/or toc 14014 may be shaped, sized, and/or dimensioned to receive at least part of slidable cover 14030 corresponding to third cover surface 14091. In embodiments, slidable cover 14030 may have some features similar to, or the same as, features of other covers disclosed herein.

A top end of slidable cover 14030 may be near a bottom of upper back surface 14056. The bottom end of slidable cover 14030 may be near first cover surface 14087 and lower back surface 14052. The heel end of slidable cover 14030 may be near second cover surface 14089, first back surface 14054, and second back surface 14055. The toe end of slidable cover 14030 may be near third cover surface 14091 and toc 14014.

Figure 39:
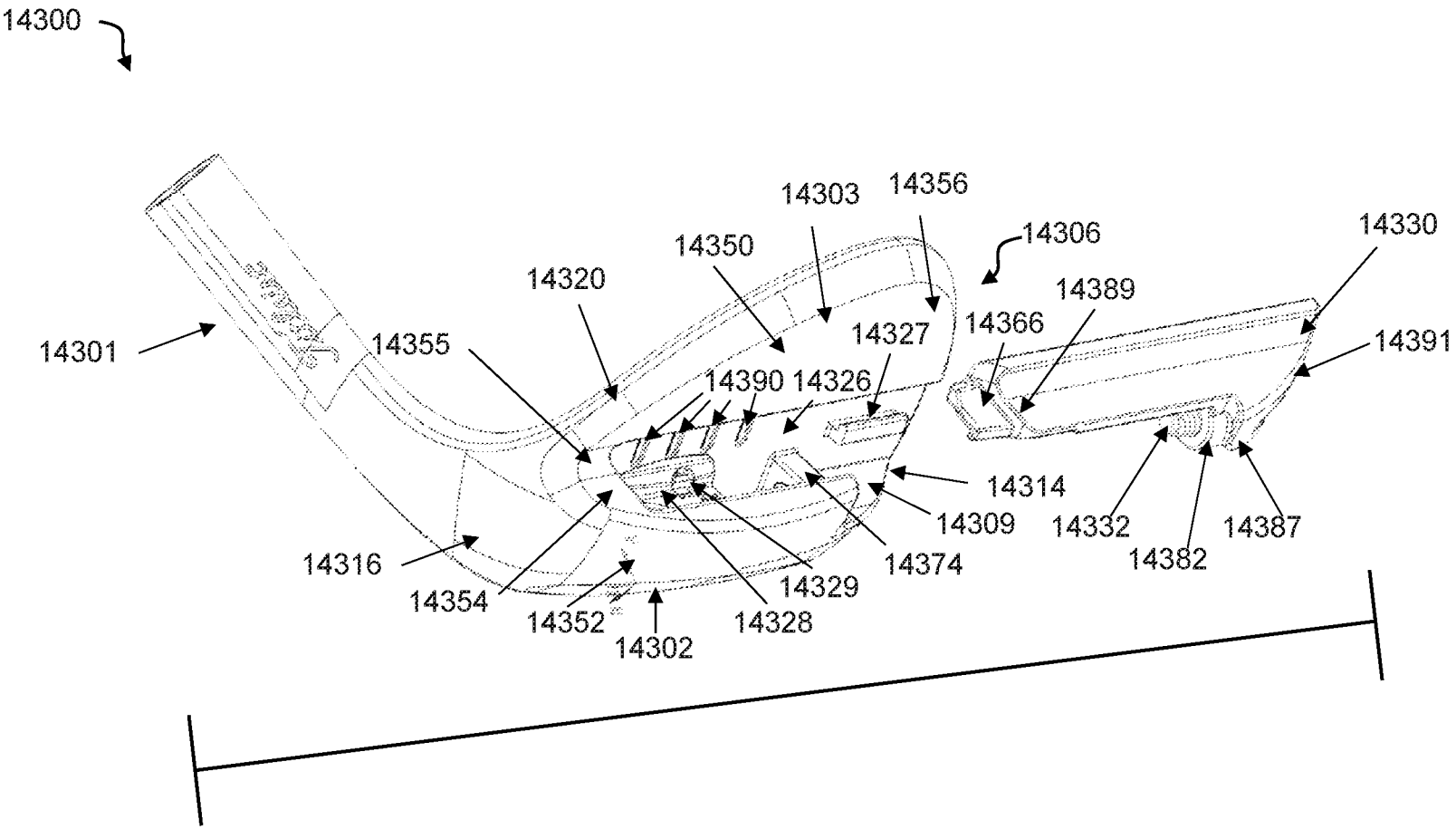
FIG. 39 illustrates an exploded perspective view of a golf club head, in accordance with one or more embodiments of the presently disclosed technology.

Slidable cover 14030 may cover at least part of recessed channel (at least shown as recessed channel 14326 in FIG. 39). Slidable cover 14030 may releasably secure weight (at least shown as movable weight 14328 in FIG. 39) within recessed channel (at least shown as recessed channel 14326 in FIG. 39). In some examples, slidable cover 14030 may be slidingly engaged with body 14006 such that slidable cover 14030 is slidable over at least part of the recessed channel (at least shown as recessed channel 14326 in FIG. 39) along a sliding direction. The sliding direction may include a toe-to-heel direction, a bottom-to-top direction, and/or somewhere in between (e.g., 30 degrees from the toe-to-heel axis, 45 degrees from the toe-to-heel axis, and so on). In some embodiments, the sliding direction may include a toe-to-heel direction and a bottom-to-top direction, which may indicate that the sliding direction is diagonal. Weight (at least shown as movable weight 14328 in FIG. 39) and slidable cover 14030 may be respectively shaped and sized such that slidable cover 14030 can slide past weight (at least shown as movable weight 14328 in FIG. 39) positioned in recessed channel (at least shown as recessed channel 14326 in FIG. 39). In some examples, the position of weight (at least shown as movable weight 14328 in FIG. 39) within recessed channel (at least shown as recessed channel 14326 in FIG. 39) may be secured (e.g., fixed, or sometimes referred to herein as installed) when weight (at least shown as movable weight 14328 in FIG. 39) is engaged with notches (at least shown as notches 14390 in FIG. 39) and slidable cover 14030 at least partially covers weight (at least shown as movable weight 14328 in FIG. 39). Weight (at least shown as movable weight 14328 in FIG. 39) and slidable cover 14030 may be shaped, sized, and/or dimensioned such that slidable cover 14030 is slidable past the weight (at least shown as movable weight 14328 in FIG. 39) when the weight (at least shown as movable weight 14328 in FIG. 39) is engaged with notches (at least shown as notches 14390 in FIG. 39).

In some examples, movement of slidable cover 14030 may be confined to the sliding direction (e.g., the toe-to-heel direction) when slidable cover 14030 is slidingly engaged with body 14006. For example, slidable cover 14030 may be slidingly engaged with body 14006 such that it is blocked from moving in any direction substantially perpendicular to the sliding direction. In some examples, parts of slidable cover 14030 may be positioned at least partially inside recessed channel (at least shown as recessed channel 14326 in FIG. 39), and is shaped, sized, and/or dimensioned such that movement of slidable cover 14030 is confined to the sliding direction. For example, slidable cover 14030 may be shaped, sized, and/or dimensioned such that it is blocked from moving out from recessed channel (at least shown as recessed channel 14326 in FIG. 39) along a direction perpendicular to the sliding direction.

In some embodiments, slidable cover 14030 may be metal, composite, or plastic. The metal may include tungsten, steel, titanium, aluminum, scandium, zinc, nickel, copper, iron, alloys, and/or other metals without departing from the spirit and scope of the presently disclosed technology. The composite may include a variety of materials known to those skilled in the art, including for example, graphite, carbon fiber, resins, ceramics, boron fiber, polymers, forms, and/or other composite materials. The plastic may include thermosets, thermoplastics, and/or other plastics. In some embodiments, slidable cover 14030 may include one or more materials. For example, slidable cover 14030 may include a first material and a second material. The first material may be denser than the second material. It should be appreciated that slidable cover 14030 may be a unitary piece that includes multiple materials. Slidable cover 14030 may include a first cover portion and a second cover portion. The first cover portion may include the first material, and the second cover portion may include the second material. The first material may be substantially on the first cover portion, and the second material may be substantially on the second cover portion. As used here, substantially may mean the material or the material's weight distribution is at or greater than about fifty percent toward the identified direction. In some embodiments, substantially may mean at or greater than about seventy-five percent, about ninety percent, or higher, or anywhere in between without departing from the spirit and scope of the presently disclosed technology. In embodiments, substantially may mean it is more in the identified location than elsewhere on the component. In some embodiments, the second cover portion may be on an opposite end of first cover portion. A location of the first material and the second material along slidable cover 14030 may affect the CG of golf club head 14000 when slidable cover 14030 is installed. Based on a location of the first material and the second material, the CG may be affected in an x, y, or z direction. In some embodiments, the first material may be metal, composite, and/or plastic. The second material may be metal, composite, and/or plastic. In one example, the first material may be metal, and the second material may be composite or plastic. In another example, the first material may be a denser metal and the second material may be a less dense metal. In some embodiments, each of the first material and the second material may be the same, substantially similar, or different. The first cover portion may be on a left end of slidable cover 14030, and the second cover portion may be on a right end of slidable cover 14030. In embodiments, the first cover portion may be on a top, a bottom, a left, a right, a front, and/or a back of slidable cover 14030, as well as anywhere in between those positions. The second cover portion may be on a bottom, a top, a right, a left, a back, and/or a front of slidable cover 14030, as well as anywhere in between those positions. A top and bottom of slidable cover 14030 may be shaped, sized, and/or dimensioned to help prevent rattling while in use. For example, a top of slidable cover 14030 may be wider than the rest of slidable cover 14030. The top may fit within a tapered recessed channel.

Body 14006 may include hosel 14001, sole 14002, top 14003, striking face (at least shown as striking face 14208 in FIG. 38) toe 14014, heel 14016, back 14050, lower back surface 14052, first back surface 14054, second back surface 14055, and upper back surface 14056. Toc 14014, heel 14016, top 14003, striking face (at least shown as striking face 14208 in FIG. 38), sole 14002, and back 14050 may define at least part of outer surface 14020 of the body 14006. Hosel 14001 may be disposed at heel 14016 and be coupled to a shaft (not shown). Striking face (at least shown as striking face 14208 in FIG. 38) may have a lower leading edge and an upper topline edge. Sole 14002 may extend rearward from the lower leading edge of striking face (at least shown as striking face 14208 in FIG. 38) to a rearward portion. Back 14050 may be positioned rearward from striking face (at least shown as striking face 14208 in FIG. 38) and may be coupled between a rearward portion of sole 14002 and the upper topline edge of striking face (at least shown as striking face 14208 in FIG. 38; e.g., between the rearward portion of sole 14002 and top 14003). Back 14050 may include all surfaces of outer surface 14020 of body 14006 that are both between the rearward portion of sole 14002 and top 14003 and also between toc 14014 and heel 14016. In this example, back 14050 may include lower back surface 14052, first back surface 14054, second back surface 14055, and upper back surface 14056. Body 14006 may have some features similar to, or the same as, features of other bodies disclosed herein.

Figure 37:
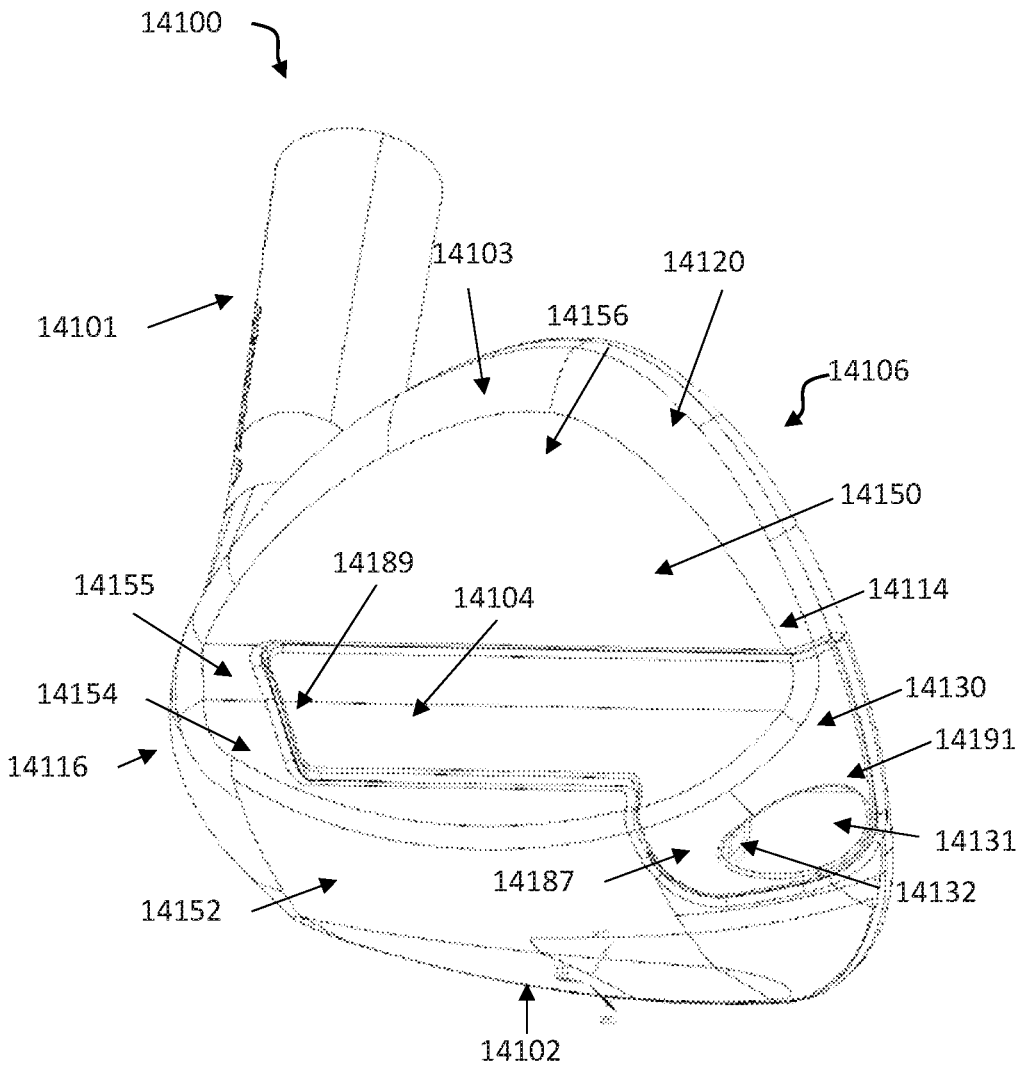
FIG. 37 illustrates a perspective view of a golf club head, in accordance with one or more embodiments of the presently disclosed technology.

FIG. 37 illustrates a perspective view of a golf club head, in accordance with one or more embodiments of the presently disclosed technology. FIG. 37 illustrates components that may be the same or substantially similar to components illustrated in FIG. 36. For example, golf club head 14000, hosel 14001, sole 14002, top 14003, weight assembly 14004, body 14006, toc 14014, heel 14016, outer surface 14020, slidable cover 14030, cover through hole 14031, back 14050, lower back surface 14052, first back surface 14054, second back surface 14055, upper back surface 14056, first cover surface 14087, second cover surface 14089, and/or third cover surface 14091 may be the same as or substantially similar to modular golf club head 14100, hosel 14101, sole 14102, top 14103, weight assembly 14104, body 14106, toe 14114, heel 14116, outer surface 14120, slidable cover 14130, cover through hole 14131, back 14150, lower back surface 14152, first back surface 14154, second back surface 14155, upper back surface 14156, first cover surface 14187, second cover surface 14189, and/or third cover surface 14191. As illustrated, cover through hole 14131 may reveal fastener 14132. Fastener 14132 may include one or more materials, as discussed herein with respect to other components. Fastener 14132 may lockingly engage with slidable cover 14130 such that movement of slidable cover 14130 along the sliding direction is restrained (e.g., prevented, blocked, or reduced). In a locked configuration, slidable cover 14130 may at least partially cover recessed channel (at least shown as recessed channel 14326 in FIG. 39) and secure weight (at least shown as movable weight 14328 in FIG. 39) within recessed channel (at least shown as recessed channel 14326 in FIG. 39). In a locked configuration, fastener 14132 may press slidable cover 14130 into a fixed position. Slidable cover 14130 may be fixed by fastener 14132 and second cover surface 14189 pushing against parts of first back surface 14154 and second back surface 14155 by the force of fastener 14132 against slidable cover 14130. Lockingly engaging fastener 14132 with slidable cover 14130 can prevent slidable cover 14130 from unintentionally sliding relative to body 14106 during a golf swing, or other movements, which can cause weight (at least shown as movable weight 14328 in FIG. 39) to become unsecured within recessed channel (at least shown as recessed channel 14326 in FIG. 39). Unsecured weight (at least shown as movable weight 14328 in FIG. 39) may be able to move within or fall out from recessed channel (at least shown as recessed channel 14326 in FIG. 39).

In some embodiments, fastener 14132 may be fastened in a position adjacent to toe 14114. Fastener 14132 may have a head and a threaded portion extending from the head. The head may be larger in diameter than a diameter of the threaded portion. In some examples, a shape and size of the screw head may be similar to, or the same as, a shape of the weight through hole (at least shown as weight through hole 14329 in FIG. 39) so that a single tool may fasten fastener 14132 and controllably move weight (at least shown as movable weight 14328 in FIG. 39) along a heel-to-toe direction within recessed channel (at least shown as recessed channel 14326 in FIG. 39). As used herein, the heel-to-toe direction may include both the toe-to-heel direction and the heel-to-toe direction; the bottom-to-top direction may include both the bottom-to-top direction and the top-to-bottom direction; and the back-to-front direction may include both the back-to-front direction and the front-to-back direction. The fastener axis may be a heel-to-toe axis or the same as the sliding direction. In some embodiments, the fastener axis may be along a back-to-front axis, along a bottom-to-top axis, and/or anywhere in between. The head may have a fastener undercut (or indent) shaped and sized such that the head can lockingly engage with body 14106 to restrain movement of the slidable cover 14130 along the sliding direction. For example, fastener 14132 may be lockingly engaged with second member (at least shown as second member 14374 in FIG. 39) when the fastener undercut receives at least part of protruded bore (at least shown as protruded bore 14382 in FIG. 39). Fastener 14132 may have some features similar to, or the same as, features of other fasteners disclosed herein.

Third cover surface 14191 may be more clearly illustrated in FIG. 37. Third cover surface 14191 may wrap around toe

14114. Third cover surface 14191 may not extend beyond striking surface (at least shown as striking face 14208 in FIG. 38). The substantially continuous curvature along toe 14114 and slidable cover 14130 may be clearer in FIG. 37 than in FIG. 36.

Figure 38:
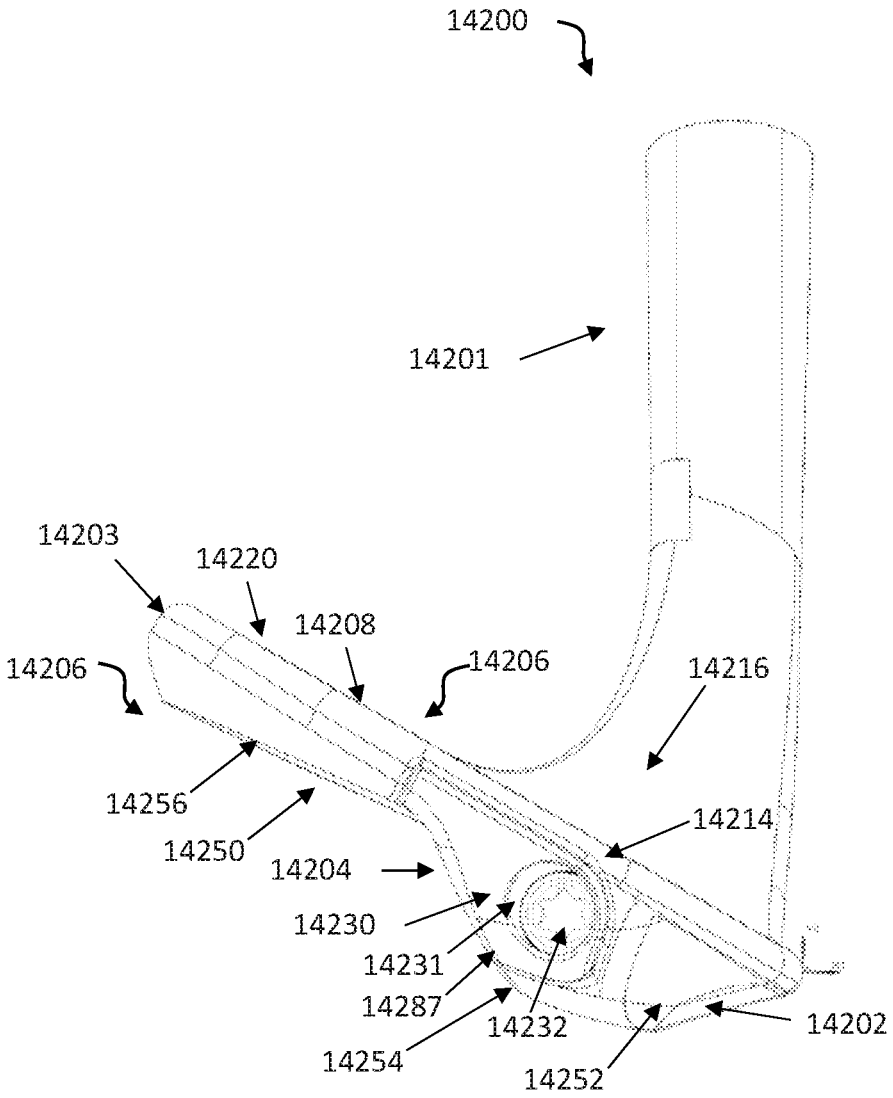
FIG. 38 illustrates a side view of a golf club head, in accordance with one or more embodiments of the presently disclosed technology.

FIG. 38 illustrates a side view of a golf club head, in accordance with one or more embodiments of the presently disclosed technology. FIG. 38 illustrates components that may be the same or substantially similar to components illustrated in FIGS. 36 and 37. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, first back surface 14054, upper back surface 14056, first cover surface 14087, and/or fastener 14132 may be the same as or substantially similar to modular golf club head 14200, hosel 14201, sole 14202, top 14203, weight assembly 14204, body 14206, toe 14214, heel 14216, outer surface 14220, slidable cover 14230, cover through hole 14231, back 14250, lower back surface 14252, first back surface 14254, upper back surface 14256, first cover surface 14287, and/or fastener 14232. As illustrated, striking face 14208 is opposite of back 14250. A fastener axis of fastener 14232 may be more clearly illustrated as being along the toe-to-heel axis in this view. Fastener 14232 may include a screw head type. The screw head type may be a star-style head, a torx-style head, a Phillips-style head, a slotted-style head, a hexagonal-style head, a square-style head, and/or other screw head types without departing from the spirit and scope of the presently disclosed technology.

FIG. 39 illustrates an exploded perspective view of a golf club head, in accordance with one or more embodiments of the presently disclosed technology. FIG. 39 illustrates components that may be the same or substantially similar to components illustrated in FIGS. 36 and 37. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, first back surface 14054, second back surface 14055, upper back surface 14056, first cover surface 14087, second cover surface 14089 third cover surface 14091, and/or fastener 14132 may be the same as or substantially similar to modular golf club head 14300, hosel 14301, sole 14302, top 14303, weight assembly, body 14306, toe 14314, heel 14316, outer surface 14320, slidable cover 14330, cover through hole, back 14350, lower back surface 14352, first back surface 14354, second back surface 14355, upper back surface 14356, first cover surface 14387, second cover surface 14389, third cover surface 14391, and/or fastener 14332. As illustrated, modular golf club head 14300 may be in an unlocked configuration. Body 14306 may include recessed channel 14326. In some embodiments, back 14350 may include recessed channel 14326. Recessed channel 14326 may include first recessed channel surface 14309, cover securing element 14327, second member 14374, and notches 14390. Recessed channel 14326 may not be part of outer surface 14320. Weight assembly may be removably couplable to body 14306 at recessed channel 14326. In some embodiments, recessed channel 14326 may be formed at least partially in back 14350 of modular golf club head 14300, for example, at least partially in lower back surface 14352. In some embodiments, recessed channel 14326 may be the cavity created from removing material in modular golf club head 14300. In embodiments, recessed channel 14326 may be machined, forged, and/or otherwise manufactured. Recessed channel 14326 may be a channel or cavity between a striking face and back 14350.

Recessed channel 14326 may include a bottom, a top, a heel-side end, a toe-side end opposite to the heel-side end along a toe-to-heel direction of modular golf club head 14300, a back wall nearest to back 14350 of modular golf club head 14300, and a front wall nearest to the striking face of modular golf club head 14300. The bottom of recessed channel 14326 may include components that help secure movable weight 14328 into a fixed position, as will be discussed herein. The bottom of recessed channel 14326 may end at second member 14374. In this embodiment, the distance movable weight 14328 can travel is the distance from a heel-end of the bottom of recessed channel 14326 to second member 14374. In some embodiments, the bottom of recessed channel 14326 may include second member 14374 and/or first recessed channel surface 14309. Second member 14374 may include second member through hole (at least shown as second member through hole 14479 in FIG. 40) to allow fastener 14332 to fasten slidable cover 14330 to body 14306. While illustrated as rectangular, it should be appreciated that second member 14374 may be any shape, including, for example, circular, triangular, asymmetrical, and/or other shapes, which allow for second member through hole (at least shown as second member through second member through hole 14479 in FIG. 40). It should also be appreciated that second member 14374 may be variously shaped, sized, and/or dimensioned to fit with movable weight 14328 and slidable cover 14330. The bottom of recessed channel 14326 may be closer to a bottom of modular golf club head 14300 than first recessed channel surface 14309. In embodiments, the bottom of recessed channel 14326 and first recessed channel surface 14309 may be the same height or different heights. The bottom of recessed channel 14326 may be differently shaped, sized, and/or dimensioned to securely interface with movable weight 14328 and slidable cover 14330. Slidable cover 14330 may sit on first recessed channel surface 14309. This may provide structural support for slidable cover 14330 in a locked configuration.

The top of recessed channel 14326 may partially cover the bottom of recessed channel 14326. As illustrated, the top may only cover a small percentage of the bottom of recessed channel 14326. For example, the top may cover a front side of the bottom of recessed channel 14326 adjacent to parts of upper back surface 14356, a heel side of the bottom of recessed channel 14326 under heel-ward parts of first back surface 14354 and second back surface 14355, and a back side of the bottom of recessed channel 14326 adjacent to back-ward parts of second back surface 14355 and lower back surface 14352. In some embodiments, the top may fully cover the bottom of recessed channel 14326. In embodiments, the top of recessed channel 14326 may include a cavity region between upper back surface 14356 and the striking face. In some embodiments, an edge of outer surface 14320 adjacent to recessed channel 14326 may not be flush. That is, the edge of recessed channel 14326 may not vertically drop from an edge of outer surface 14320 and there may be additional recessed space in front of lower back surface 14352 and underneath first back surface 14354 and second back surface 14355. The top of recessed channel 14326 may be differently shaped, sized, and/or dimensioned to securely interface with slidable cover 14330. The heel-side end of recessed channel 14326 may be differently shaped, sized, and/or dimensioned to fit with movable weight 14328 and slidable cover 14330. The heel-side end may be recessed, sloped (e.g., as the wall goes toward the bottom, the wall moves toward the heel, or vice versa), curved, and/or flush (e.g., straight up and down). The toe-side end of recessed channel 14326 may be differently shaped, sized, and/or dimensioned to fit with movable weight 14328 and slidable cover 14330. The toe-side end may end at second member 14374 or the toe-ward edge of first recessed channel surface 14309. Second member 14374 may provide a distance that movable weight 14328 may travel along recessed channel 14326 from the heel-side end to the toe-side end. This distance may be up to 150 mm, depending on a size of modular golf club head 14300. The distance that movable weight 14328 travels may allow a CG of modular golf club head 14300 to change up to about 10 mm based on movement of movable weight 14328 along an x-axis, or a heel-to-toe direction. Movable weight 14328 may also have an impact on CG along a y- and/or z-axis due to movable weight 14328 including a weight height and a weight width. Second member 14374 may also provide a connection point for protruded bore 14382 and fastener 14332 via second member through hole (at least shown as second member through hole 14479 in FIG. 40). Second member 14374 may help secure slidable cover 14330 to body 14306 via fastener 14332. The back wall of recessed channel 14326 may be recessed, sloped, curved, and/or flush. In some embodiments, the back wall may include notches (not shown) to help secure movable weight 14328 into a fixed position along recessed channel 14326. The back wall may be differently shaped, sized, and/or dimensioned to fit with movable weight 14328 and/or slidable cover 14330. The front wall may be differently shaped, sized, and/or dimensioned to fit with movable weight 14328 and/or slidable cover 14330. The front wall of recessed channel 14326 may be recessed, sloped, curved, and/or flush, as discussed herein. The front wall may include cover securing element 14327 and notches 14390.

Cover securing element 14327 may help secure slidable cover 14330 into a locked configuration. Cover securing element 14327 may help align slidable cover 14330 into a proper position. Cover securing element 14327 may prevent slidable cover 14330 from falling off of body 14306 in a partially unlocked configuration, as will be described in greater detail herein. Cover securing element 14327 may be illustrated as L-shaped, but it should be appreciated that cover securing element 14327 may be any shape, including, for example, T-shaped, triangular-shaped, U-shaped, Y-shaped, rectangular-shaped, and so on without departing from the spirit and scope of the presently disclosed technology. Cover securing element 14327 may be differently shaped, sized, and/or dimensioned to fit with slidable cover 14330. Notches 14390 may be recessed sections within recessed channel 14326. Notches 14390 may help align movable weight 14328 into one of multiple fixed positions along recessed channel 14326. Movable weight 14328 may have corresponding protrusions or bumps (not shown) to fit within or selectively engage notches 14390 to align and slide into a fixed position. Recessed channel 14326 may have some features similar to, or the same as, features of other recessed channels disclosed herein. In some embodiments, notches 14390 may be protrusions (not shown) and notches or grooves may be on movable weight 14328. It should be appreciated that other mechanisms may be used to help secure and/or align movable weight 14328 into multiple fixed positions. With the extra weight provided by recessed channel 14326, additional weight may be added to other parts of modular golf club head 14300 in the form of at least movable weight 14328.

Weight assembly may include movable weight 14328. Movable weight 14328 may include weight through hole 14329. Movable weight 14328 may be metal, composite, or plastic. In some embodiments, movable weight 14328 may include one or more materials. For example, movable weight 14328 may include a third material and a fourth material. The third material may be denser than the fourth material. It should be appreciated that movable weight 14328 may be a unitary piece that includes multiple materials. Movable weight 14328 may include a third weight portion and a fourth weight portion. The third weight portion may include the third material, and the fourth weight portion may include the fourth material. The third material may be substantially on the third weight portion, and the fourth material may be substantially on the fourth weight portion. As used here, substantially may mean the material or the material's weight distribution is at or greater than fifty percent toward the identified direction. In some embodiments, substantially may mean at or greater than seventy-five percent, ninety percent, or higher, or anywhere in between without departing from the spirit and scope of the presently disclosed technology. In embodiments, substantially may mean it is more in the identified location than elsewhere on the component. In some embodiments, the fourth weight portion may be on an opposite end of third weight portion. A location of the third material and the fourth material along movable weight 14328 may affect the CG of modular golf club head 14300 along different axes when movable weight 14328 is installed. In some embodiments, the third material may be metal, composite, and/or plastic. The fourth material may be metal, composite, and/or plastic. In one example, the third material may be metal, and the fourth material may be composite or plastic. In another example, the third material may be a denser metal and the fourth material may be a less dense metal. In some embodiments, each of the first material, the second material, the third material, and the fourth material may be the same, substantially similar, or different. The third weight portion may be on a left end of movable weight 14328, and the fourth weight portion may be on a right end of movable weight 14328. In embodiments, the third weight portion may be on a top, a bottom, a left, a right, a front, and/or a back of movable weight 14328, as well as anywhere in between these positions. The fourth weight portion may be on a bottom, a top, a right, a left, a back, and/or a front of movable weight 14328, as well as anywhere in between these positions. Movable weight 14328 may have some features similar to, or the same as, features of other weights disclosed herein. A top and bottom of weight may be differently shaped, sized, and/or dimensioned. For example, a top portion of movable weight 14328 may be narrower than a lower portion of movable weight 14328. The top portion may fit within a channel (at least shown as channel 14739B in FIG. 43B) at the bottom of slidable cover 14330. The shape, size, and/or dimension of the top of movable weight 14328 that allows for contact, or near contact, with slidable cover 14330 may prevent rattling or other unwanted movement when modular golf club head 14300 is in a locked configuration. Similarly, a bottom of movable weight 14328 may fit with grooves and/or protrusions in the bottom of recessed channel 14326 to help fix a position of movable weight 14328 and to prevent unwanted movement while in a locked configuration. In some embodiments, there may be multiple movable weights 14328. This may allow for additional customization and adjustability of modular golf club head 14300. For example, a heavier weight may be placed heel-ward and a less dense weight may be placed toe-ward. A heavier weight may be placed one position to the right of the middle, and a lighter weight may be placed one position to the left of the middle. Each of these configurations may significantly impact the ball flight upon impact.

Movable weight 14328 may be selectively movable within the recessed channel 14326 along the toe-to-heel direction in order to enable a player to controllably adjust a CG of modular golf club head 14300 along the toe-to-heel direction. Weight through hole 14329 may be shaped, sized, and/or dimensioned to receive a tool to engage movable weight 14328 via weight through hole 14329 to controllably move movable weight 14328 within recessed channel 14326.

A user may controllably adjust the center of gravity of modular golf club head 14300 along the toe-to-heel direction by sliding movable weight 14328 from a first weight position to a second weight position in recessed channel 14326. This may be accomplished by sliding slidable cover 14330 from a first cover position in which cover 4030 covers at least part of movable weight 14328 and secures movable weight 14328 in recessed channel 14326 (e.g., the locked configuration), to a second cover position in which movable weight 14328 is exposed inside, and unsecured within, recessed channel 14326 (e.g., partially unlocked configuration). The user may then use a tool to move movable weight 14328 upward inside recessed channel 14326 (e.g., via weight through hole 14329) to disengage movable weight 14328, move movable weight 14328 along the toe-to-heel direction inside recessed channel 14326, and move movable weight 14328 downward into recessed channel 14326 to cause movable weight 14328 to engage with body 14306. In some embodiments, movable weight 14328 may be moved by sliding movable weight 14328 heel-ward or toe-ward along recessed channel 14326. The user may slide slidable cover 14330 along the toe-to-heel direction from the second position (e.g., partially unlocked configuration) to the first position (e.g., locked configuration) in order to cover at least part of movable weight 14328 with slidable cover 14330, and secure movable weight 14328 in its new position within recessed channel 14326.

Slidable cover 14330 may include stepped protrusion 14366 and protruded bore 14382. Stepped protrusion 14366 may be on a heel end of slidable cover 14330. Stepped protrusion 14366 may have smaller dimensions than the part of slidable cover 14330 adjacent to stepped protrusion 14366. For example, stepped protrusion 14366 may have a smaller height and a smaller width. Stepped protrusion 14366 may fit with a top of recessed channel 14326 under parts of first back surface 14354 and second back surface 14355. For example, the top of recessed channel 14326 under parts of first back surface 14354 and second back surface 14355 may be shaped, sized, and/or dimensioned to fit the shape, size, and/or dimension of stepped protrusion 14366. Stepped protrusion 14366 may help secure slidable cover 14330 to body 14306 and prevent or virtually prevent rattling or movement of movable weight 14328 and slidable cover 14330 in a locked configuration. Stepped protrusion 14366 may prevent movement in a vertical direction, both upward and downward, in a locked configuration. First recessed channel surface 14309 may also prevent movement in a vertical direction in a locked configuration. In embodiments, stepped protrusion 14366 may help prevent movement in an upward direction of slidable cover 14330 in a locked configuration and first recessed channel surface 14309 may help prevent movement in a downward direction of slidable cover 14330 in a locked configuration. Stepped protrusion 14366 may not be visible or be virtually invisible in a locked configuration. In some embodiments, stepped protrusion 14366 may be longer or otherwise bigger to help secure slidable cover 14330 to body 14306.

Protruded bore 14382 may be on a toe end of slidable cover 14330. Protruded bore 14382 may be an extension of the cover through hole. In some embodiments, protruded bore 14382 may be threaded. In embodiments, protruded bore 14382 may be variously shaped, sized, and/or dimensioned without departing from the spirit and scope of the presently disclosed technology. For example, protruded bore 14382 may be longer, protruding further heel-ward, to provide additional grip for fastener 14332 to fasten slidable cover 14330 to body 14306. In embodiments, protruded bore 14382 may protrude further toe-ward. In some embodiments, protruded bore 14382 may be flush with an end of first cover surface 14387. Protruded bore 14382 may have a smaller length than fastener 14332. Protruded bore 14382 may be flush against second member 14374 in a locked configuration. In some embodiments, a gap may be between protruded bore 14382 and second member 14374 in a locked configuration. It should be appreciated that changing shapes, sizes, and/or dimensions of certain components of slidable cover 14330 may require changing shapes, sizes, and/or dimensions of other components. For example, changing a length of protruded bore 14382 may require shortening, lengthening, or changing, for example, recessed channel 14326, slidable cover 14330, stepped protrusion 14366, and/or second member 14374.

Figure 40:
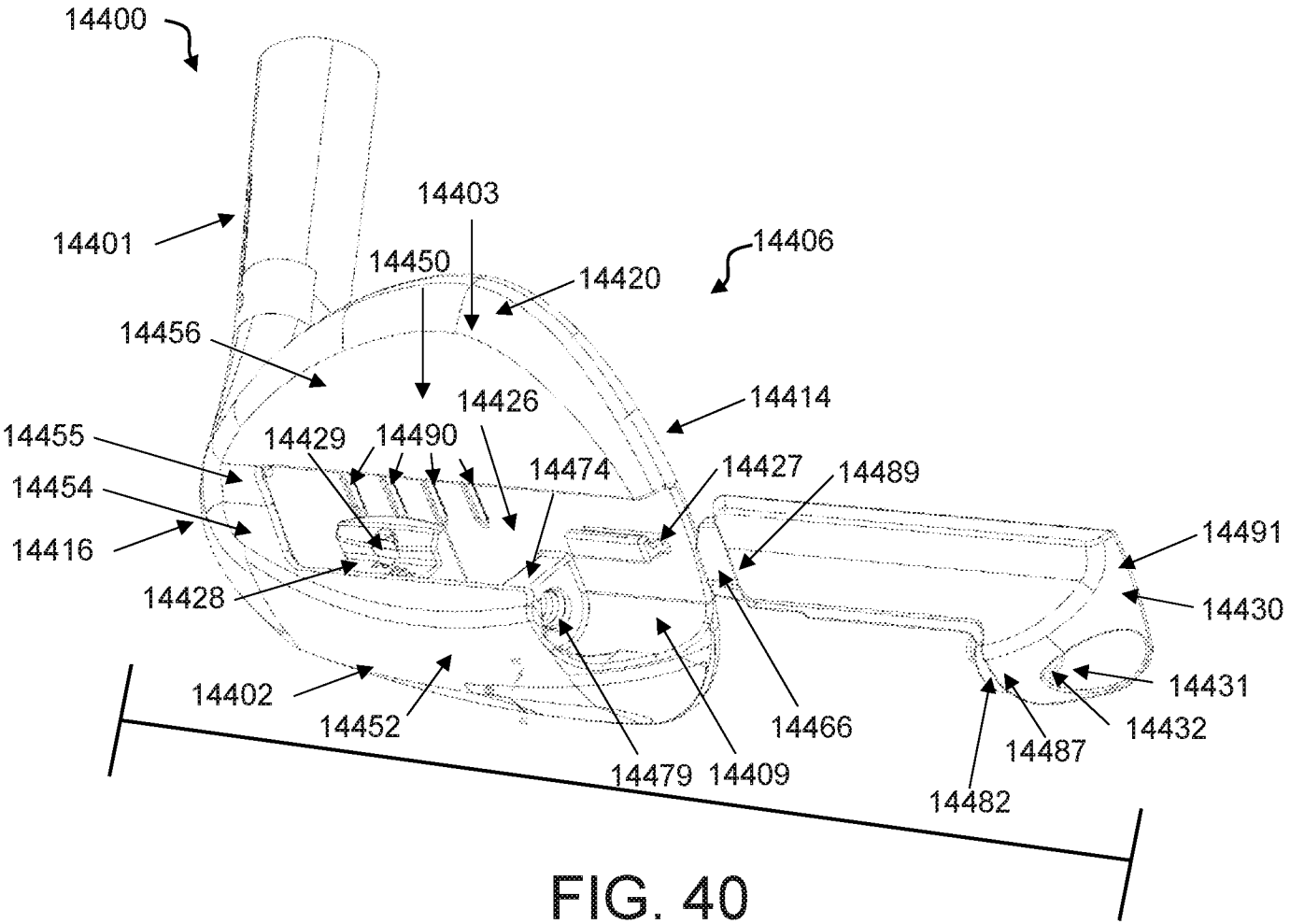
FIG. 40 illustrates an exploded perspective view of a golf club head, in accordance with one or more embodiments of the presently disclosed technology.

FIG. 40 illustrates an exploded perspective view of a golf club head, in accordance with one or more embodiments of the presently disclosed technology. FIG. 40 illustrates components that may be the same or substantially similar to components illustrated in FIGS. 36, 37, and 39. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, first back surface 14054, second back surface 14055, upper back surface 14056, first cover surface 14087, second cover surface 14089, third cover surface 14091, fastener 14132, first recessed channel surface 14309, recessed channel 14326, cover securing element 14327, movable weight 14328, weight through hole 14329, stepped protrusion 14366, second member 14374, protruded bore 14382, and/or notches 14390 may be the same as or substantially similar to modular golf club head 14400, hosel 14401, sole 14402, top 14403, weight assembly, body 14406, toe 14414, heel 14416, outer surface 14420, slidable cover 14430, cover through hole 14431, back 14450, lower back surface 14452, first back surface 14454, second back surface 14455, upper back surface 14456, first cover surface 14487, second cover surface 14489, third cover surface 14491, fastener 14432, first recessed channel surface 14409, recessed channel 14426, cover securing element 14427, movable weight 14428, weight through hole 14429, stepped protrusion 14466, second member 14474, protruded bore 14482, and/or notches 14490. Second member through hole 14479 and first recessed channel surface 14409 may be easier to see in this view. In some embodiments, second member through hole 14479 may be a blind hole, that is, the second member through hole 14479 may not go through the entirety of second member 14474. In such embodiments, second member 14474 may be differently shaped, sized, and/or dimensioned to provide enough grip to fastener 14432. In these embodiments, fastener 14432 may be differently shaped, sized, and/or dimensioned to provide enough grip, including, for example, more threads, different types of threads, larger bottom end of fastener 14432, more surface area to engage the blind hole, and so on. As illustrated, a bottom of second member 14474 may be curved to conform with the shape of the bottom of slidable cover 14430 that fits with second member 14474 in a locked configuration. The bottom of first recessed channel surface 14409 may also be curved to conform with the shape of the bottom of slidable cover 14430 in a locked configuration. In embodiments, there may be undercuts in slidable cover 14430 and/or body 14406 to help secure slidable cover 14430 to body 14406. While movable weight 14428 may be illustrated with 21 g, it should be appreciated that movable weight 14428 may be about 1 g, about 5 g, about 10 g. about 15 g, about 20 g, about 25 g, and so on, including any values in between, without departing from the spirit and scope of the presently disclosed technology. The weight of movable weight 14428 may be based on an amount of discretionary weight gained by recessed channel and/or materials used on modular golf club head 14400. As discussed herein, movable weight 14428 may include multiple materials with different densities in different location, though movable weight 14428 may have a single density throughout.

Figure 41:
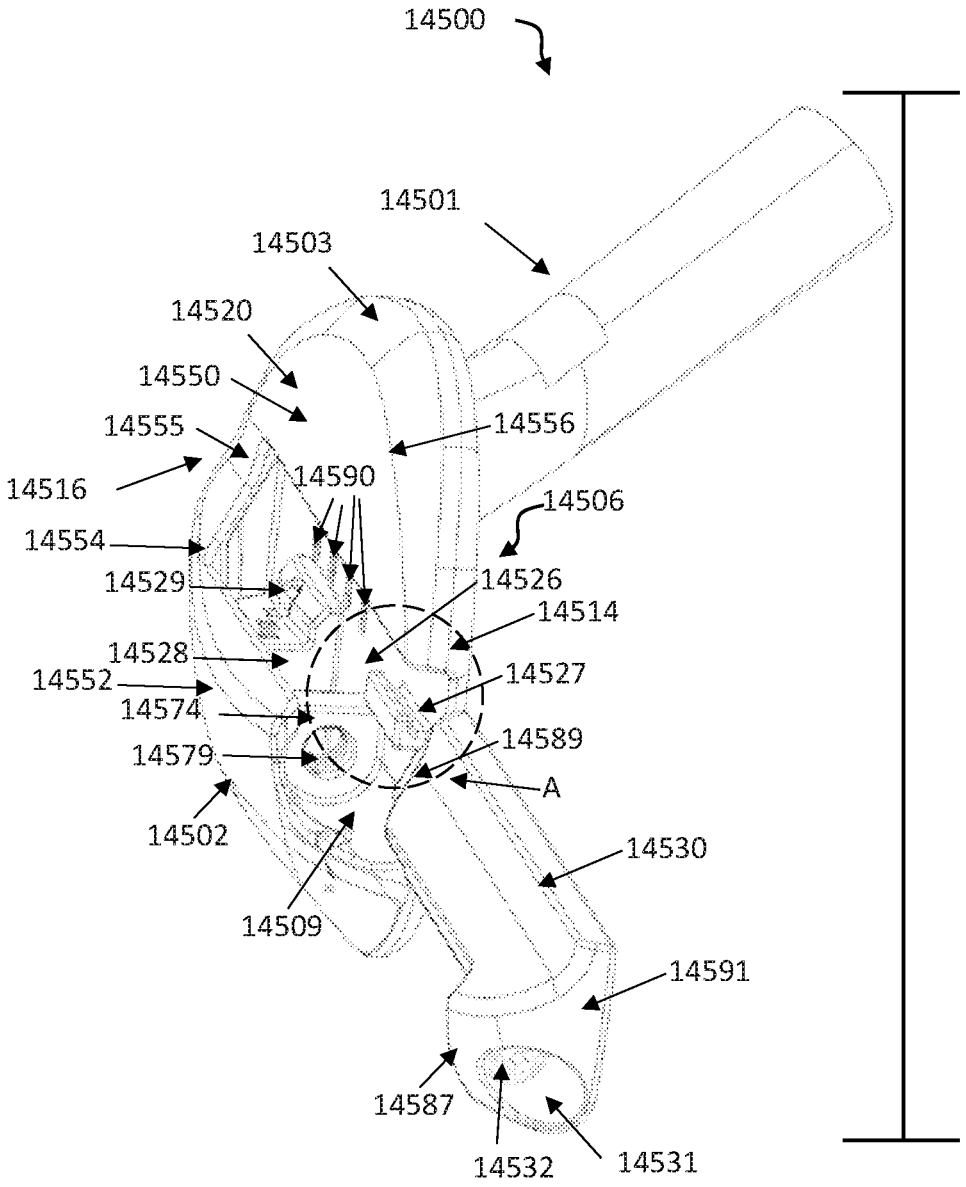
FIG. 41 illustrates an exploded perspective view of a golf club head, in accordance with one or more embodiments of the presently disclosed technology.

FIG. 41 illustrates an exploded perspective view of a golf club head, in accordance with one or more embodiments of the presently disclosed technology. FIG. 145 illustrates components that may be the same or substantially similar to components illustrated in FIGS. 36, 37, 39, and 40. For example, golf club head 14000, hosel 14001, sole 14002, top 14003, weight assembly 14004, body 14006, toc 14014, heel 14016, outer surface 14020, slidable cover 14030, cover through hole 14031, back 14050, lower back surface 14052, first back surface 14054, second back surface 14055, upper back surface 14056, first cover surface 14087, second cover surface 14089, third cover surface 14091, fastener 14132, first recessed channel surface 14309, recessed channel 14326, cover securing element 14327, movable weight 14328, weight through hole 14329, second member 14374, protruded bore 14382, notches 14390, and/or second member through hole 14479 may be the same as or substantially similar to modular golf club head 14500, hosel 14501, sole 14502, top 14503, weight assembly, body 14506, toe 14514, heel 14516, outer surface 14520, slidable cover 14530, cover through hole 14531, back 14550, lower back surface 14552, first back surface 14554, second back surface 14555, upper back surface 14556, first cover surface 14587, second cover surface 14589, third cover surface 14591, fastener 14532, first recessed channel surface 14509, recessed channel 14526, cover securing element 14527, movable weight 14528, weight through hole 14529, second member 14574, protruded bore, notches 14590, and/or second member through hole 14579. An axis of second member through hole 14579 may be easier to see in FIG. 41. As illustrated, the axis of second member through hole 14579 may be along a toe-to-heel direction, which may be the same as the axis of cover through hole 14531 and fastening fastener 14532.

Figure 42:
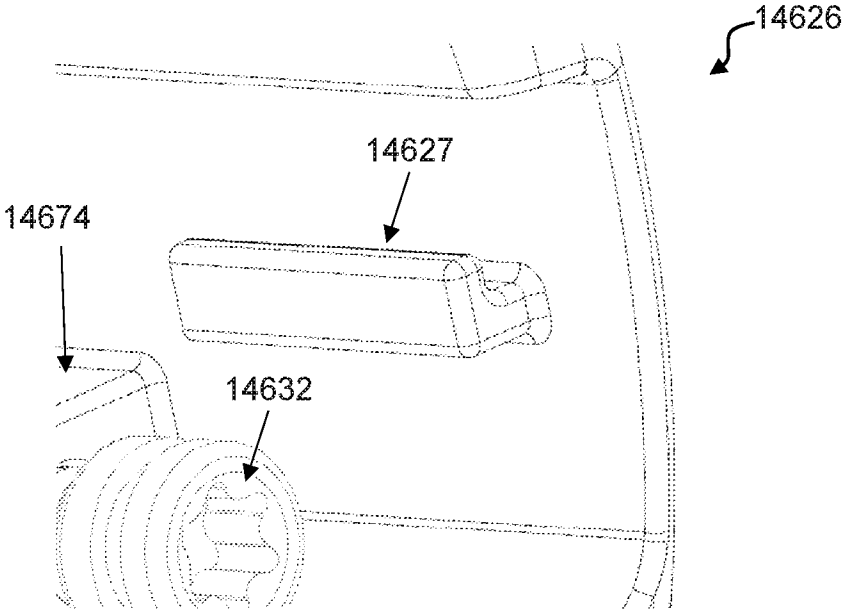
FIG. 42 illustrates an enlarged partial perspective view of circular region A shown in FIG. 41, allowing securing element 14527 within the recessed channel to be shown in more detail, in accordance with one or more embodiments of the presently disclosed technology.

FIG. 42 illustrates an enlarged partial perspective view of circular region A shown in FIG. 41, allowing securing element 14527 within the recessed channel to be shown in more detail, in accordance with one or more embodiments of the presently disclosed technology. FIG. 42 illustrates components that may be the same or substantially similar to components illustrated in FIGS. 36, 37, 39, and 40. For example, golf club head 14000, hosel 14001, sole 14002, top 14003, weight assembly 14004, body 14006, toe 14014, heel 14016, outer surface 14020, back 14050, lower back surface 14052, first back surface 14054, second back surface 14055, upper back surface 14056, fastener 14132, cover securing element 14327, movable weight 14328, weight through hole 14329, second member 14374, and/or second member through hole 14479 may be the same as or substantially similar to modular golf club head, hosel, sole, top, weight assembly, body, toe, heel, outer surface, back, lower back surface, first back surface, second back surface, upper back surface, fastener 14632, cover securing element 14627, second member 14674, and/or second member through hole. Cover securing element 14627 may be easier to see in FIG. 42. As illustrated, cover securing element 14627 may be L-shaped. As discussed herein, it should be appreciated that cover securing element 14627 may be differently shaped, sized, and/or dimensioned without departing from the spirit and scope of the presently disclosed technology. In some embodiments, cover securing element 14627 may be placed elsewhere on body. In embodiments, cover securing element 14627 may not exist.

Figure 43A:
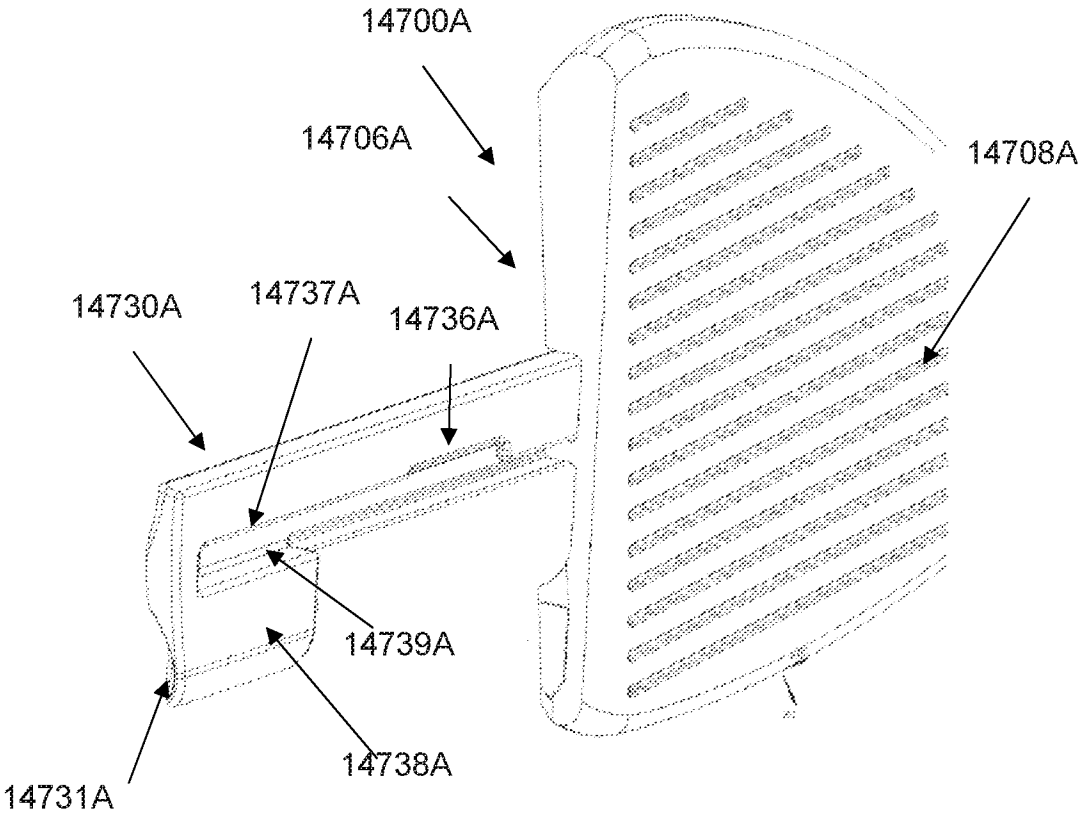
FIG. 43A illustrates a perspective view of a partially cut away golf club head, in accordance with one or more embodiments of the presently disclosed technology.

FIG. 43A illustrates a perspective view of a partially cut away golf club head with a toc portion of the golf club head removed to allow the internals of a cover to be illustrated via an enlarged perspective view. The cover shown here is in accordance with one or more embodiments of the presently disclosed technology. FIG. 43A illustrates components that may be the same or substantially similar to components illustrated in FIG. 36. For example, slidable cover 14030 and/or cover through hole 14031 may be the same as or substantially similar to slidable cover 14730A and/or cover through hole 14731A. As illustrated, a front perspective view of golf club head 14700A shows slidable cover 14730A slid out from behind striking face 14708A.

Figure 43B:
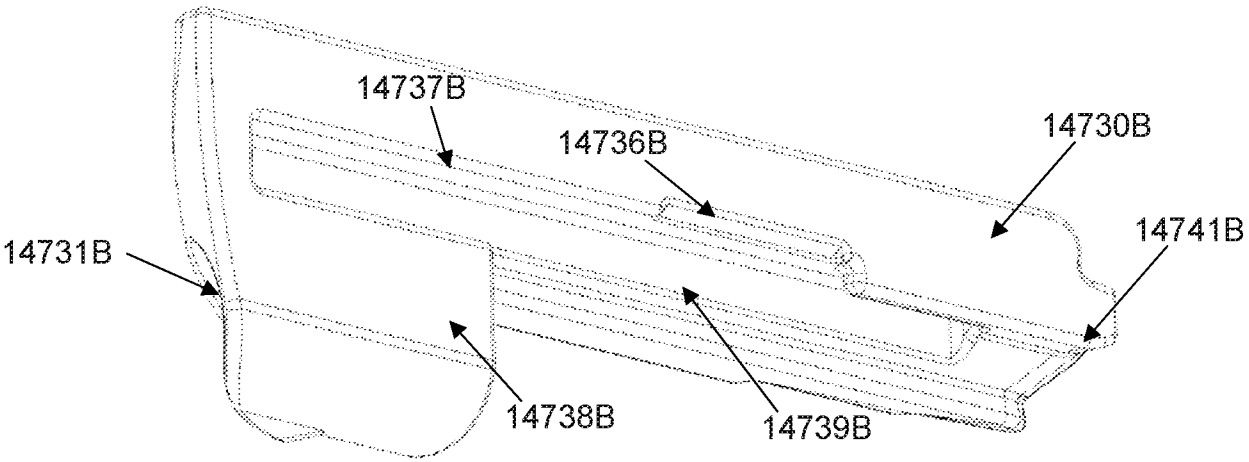
FIG. 43B illustrates a perspective view of a cover, in accordance with one or more embodiments of the presently disclosed technology.

FIG. 43B illustrates a perspective view of a cover, in accordance with one or more embodiments of the presently disclosed technology. FIG. 43B illustrates components that may be the same or substantially similar to components illustrated in FIG. 36. For example, slidable cover 14030 and/or cover through hole 14031 may be the same as or substantially similar to slidable cover 14730B and/or cover through hole 14731B. Slidable cover 14730B may be magnified in a bottom left of FIG. 43B fully removed from body 14706A. Slidable cover 14730B may include notched cover recess 14736B, cover recess 14737B, first cover component 14738B, and channel 14739B. Notched cover recess 14736B may be higher than the a heel-ward portion of slidable cover 14730B. Notched cover recess height may be high enough to allow slidable cover 14730B to be removable in this position. Notched cover recess 14736B may be where slidable cover 14730B engages cover securing element (at least shown as cover securing element 14627 in FIG. 42) to insert slidable cover 14730B. In some embodiments, slidable cover 14730B may be rotated (e.g., toward striking face (at least shown as striking face 14208 in FIG. 38)) to be inserted or installed when notched cover recess 14736B is aligned with cover securing element (at least shown as cover securing element 14627 in FIG. 42). Notched cover recess 14736B may be shaped, sized, and/or dimensioned corresponding to cover securing element (at least shown as cover securing element 14627 in FIG. 42). Once slidable cover 14730B is inserted, slidable cover 14730B may be secured to body (at least shown as body 14506 in FIG. 41) via cover recess 14737B and cover securing element (at least shown as cover securing element 14627 in FIG. 42). That is, slidable cover 14730B may be prevented from moving or being removed based on at least cover recess 14737B and cover securing element (at least shown as cover securing element 14627 in FIG. 42) once inserted. Cover recess 14737B may be lower in height than notched cover recess 14736B. This may prevent slidable cover 14730B from falling and/or not being aligned once slidable cover 14730B is inserted. Cover recess 14737B may be low enough or have enough material to engage cover securing element (at least shown as cover securing element 14627 in FIG. 42). In some embodiments, cover recess 14737B may be differently shaped, sized, and/or dimensioned based on at least cover securing element (at least shown as cover securing element 14627 in FIG. 42).

First cover component 14738B may help secure slidable cover 14730B to body (at least shown as body 14506 in FIG. 41). First cover component 14738B may be flush with the surface above notched cover recess 14736B and cover recess 14737B. This may help provide additional surface area between slidable cover 14730B and body (at least shown as body 14506 in FIG. 41) to prevent unwanted movement and/or rattling in a locked configuration. For example, this may prevent unwanted movement in a back-to-front direction. In some embodiments, first cover component 14738B may be differently shaped, sized, and/or dimensioned to provide additional security without departing from the spirit and scope of the presently disclosed technology. The shape, size, and/or dimension of slidable cover 14730B may provide structural integrity to slidable cover 14730B.

Channel 14739B may receive part of weight (at least shown as movable weight 14528 in FIG. 41). For example, channel 14739B may receive a top of weight (at least shown as movable weight 14528 in FIG. 41). Channel 14739B may be shaped, sized, and/or dimensioned to a top of weight (at least shown as movable weight 14528 in FIG. 41). A length of channel 14739B may correspond to at least part of a bottom of recessed channel (at least shown as recessed channel 14626 in FIG. 42). The length may be the distance that weight (at least shown as movable weight 14528 in FIG. 41) can travel and affect the CG of the golf club head along an x direction or a heel-to-toe axis. It should be appreciated that channel 14739B may be differently shaped, sized, and/or dimensioned without departing from the spirit and scope of the presently disclosed technology. For example, top of weight (at least shown as movable weight 14528 in FIG. 41) may be shaped, sized, and/or dimensioned differently or the distance that weight (at least shown as movable weight 14528 in FIG. 41) travels may be reduced or lengthened. In some embodiments, channel 14739B may retain cover securing element (at least shown as cover securing element 14627 in FIG. 42) after slidable cover 14730B is inserted.

Cover rail 14741B may be an extension of slidable cover 14730B. Cover rail height may be low enough to prevent slidable cover 14730B from falling off of the body via cover securing element (at least shown as cover securing element 14627 in FIG. 42) in a partially unlocked configuration. In a partially unlocked configuration, slidable cover 14730B may be secured to the body by cover securing element and cover rail 14741B. Cover rail 14741B may be shaped, sized, and/or dimensioned to prevent slidable cover 14730B from being detached from the body of the golf club head in a partially unlocked configuration. For example, cover rail 14741B may prevent detachment from a back-to-front direction and stepped protrusion may prevent detachment from a heel-to-toe direction. This may allow slidable cover 14730B to slide away from the weight to allow a quick adjustment of the weight without completely removing slidable cover 14730B from the body. This may also prevent loss of slidable cover 14730B, the fastener, the weight, and/or other components.

Figure 44:
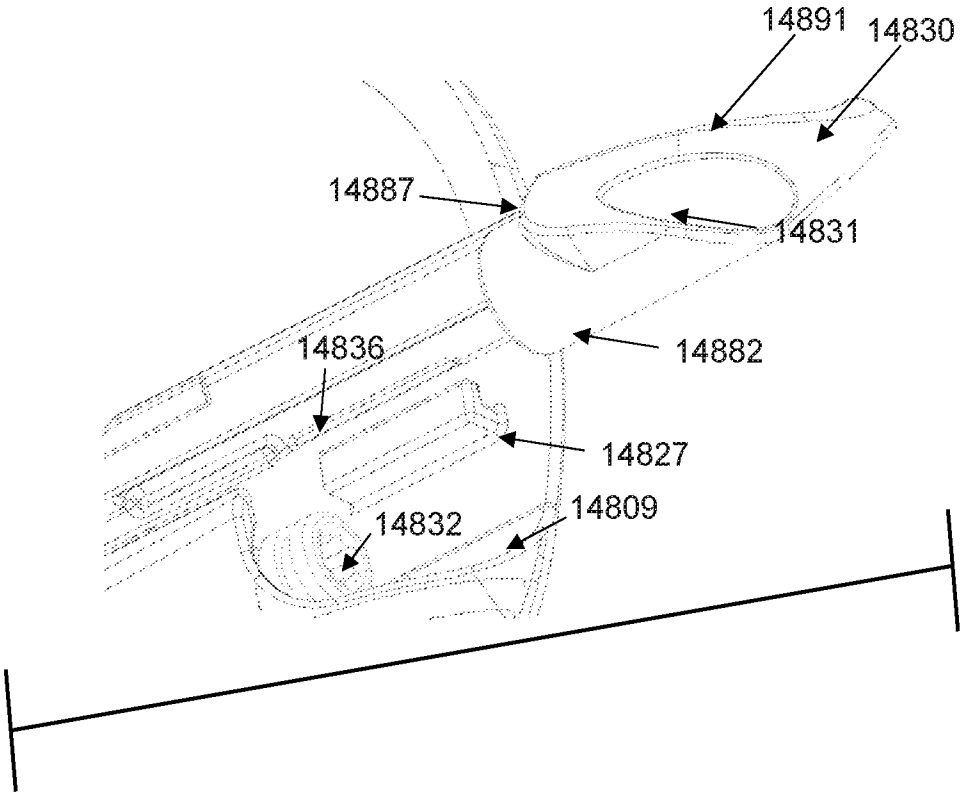
FIG. 44 illustrates a partial exploded perspective view of a golf club head, in accordance with one or more embodiments of the presently disclosed technology.

FIG. 44 illustrates a partial exploded perspective view of a golf club head, in accordance with one or more embodiments of the presently disclosed technology. FIG. 44 illustrates components that may be the same or substantially similar to components illustrated in FIGS. 36, 37, 39, and 43B. For example, slidable cover 14030, cover through hole 14031, first cover surface 14087, third cover surface 14091, fastener 14132, first recessed channel surface 14309, cover securing element 14327, protruded bore 14382, and/or notched cover recess 14736B may be the same as or substantially similar to slidable cover 14830, cover through hole 14831, first cover surface 14887, third cover surface 14891, fastener 14832, first recessed channel surface 14809, cover securing element 14827, protruded bore 14882, and/or notched cover recess 14836. Protruded bore 14882 may extend beyond first cover surface 14887. Protruded bore 14882 may be an extension of cover through hole 14831. The shape of cover through hole 14831 may be the same as or substantially similar to shape of protruded bore 14882. As illustrated, first cover surface 14887 may be easier to view another perspective of first cover surface 14887. Cover securing element 14827 may be substantially aligned with notched cover recess 14836 to insert slidable cover 14830. Slidable cover 14830 may be rotated toward the striking face to be inserted in this aligned position.

Figure 45:
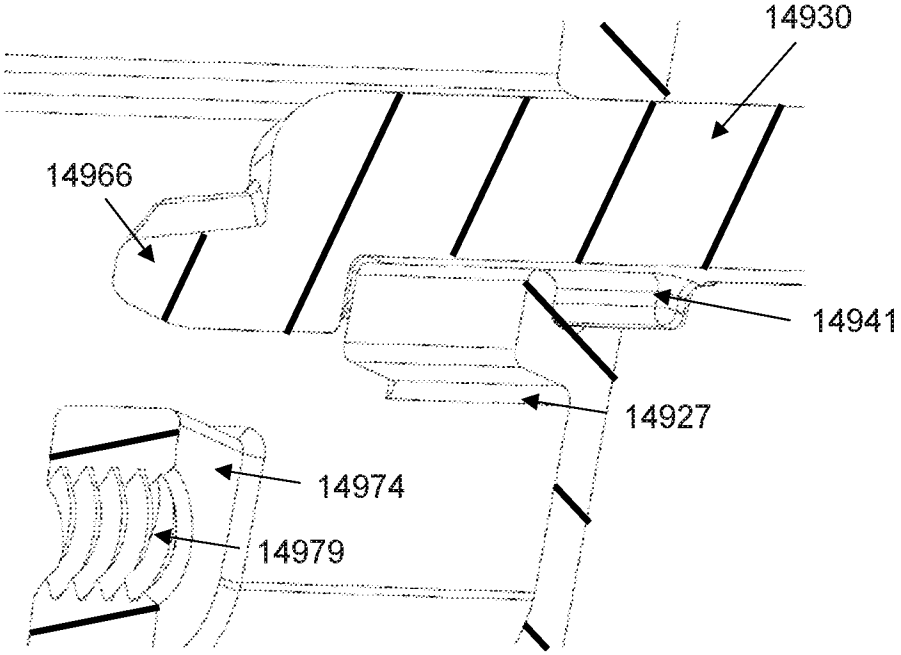
FIG. 45 illustrates a partial cross-sectional view of a golf club head taken substantially along line 149-149' in FIG. 36 in a partially unlocked configuration, in accordance with one or more embodiments of the presently disclosed technology.

FIG. 45 illustrates a partial cross-sectional view of a golf club head taken substantially along line 149-149' in FIG. 36 in a partially unlocked configuration, in accordance with one or more embodiments of the presently disclosed technology. FIG. 45 illustrates components that may be the same or substantially similar to components illustrated in FIGS. 36, 39, 40, 43B. For example, slidable cover 14030, cover securing element 14327, stepped protrusion 14366, second member 14374, second member through hole 14479, and/or cover rail 14741B may be the same as or substantially similar to slidable cover 14930, cover securing element 14927, stepped protrusion 14966, second member 14974, second member through hole 14979, and/or cover rail 14941. As alluded to herein, in a partially unlocked configuration, slidable cover 14930 may be secured to the body by cover securing element 14927 and cover rail 14941. Cover rail 14941 may be shaped, sized, and/or dimensioned to prevent slidable cover 14930 from being detached from the body of the golf club head. Securing element 14927 may have the same length as cover rail 14941. In some embodiments, securing element 14927 may be longer or shorter than cover rail 14941. As illustrated, second member through hole 14979 may be threaded.

Figure 46:
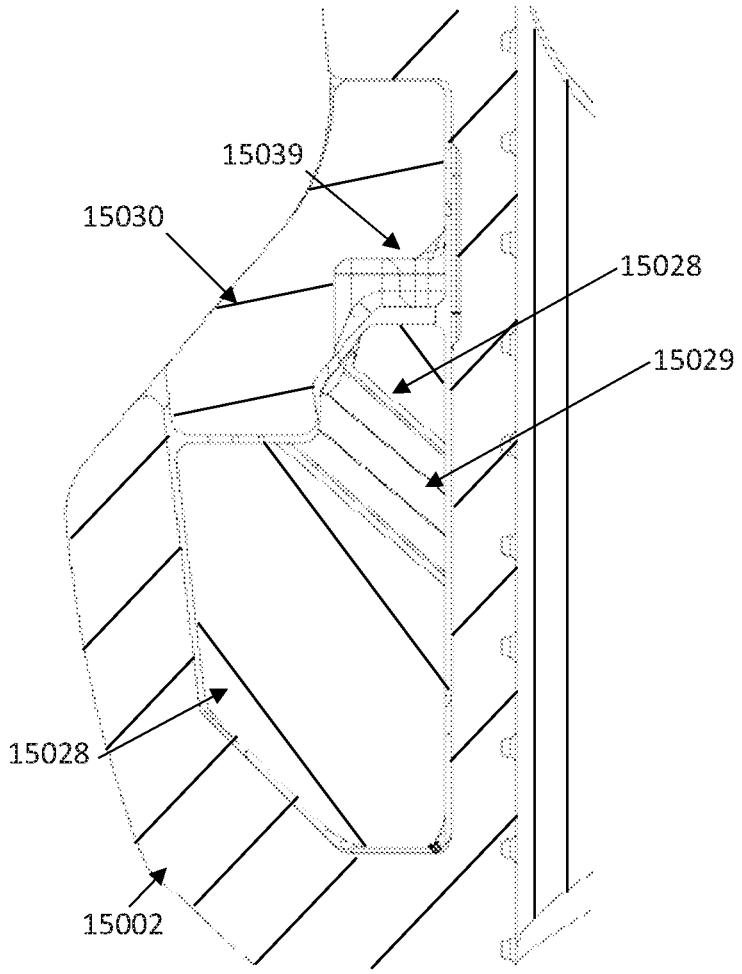
FIG. 46 illustrates a partial cross-sectional view of a golf club head taken substantially along line 150-150' in FIG. 36, in accordance with one or more embodiments of the presently disclosed technology.

FIG. 46 illustrates a partial cross-sectional view of a golf club head taken substantially along line 150-150' in FIG. 36, in accordance with one or more embodiments of the presently disclosed technology. FIG. 46 illustrates components that may be the same or substantially similar to components illustrated in FIGS. 36, 39, and 43B. For example, golf club head 14000, sole 14002, weight assembly 14004, body 14006, slidable cover 14030, movable weight 14328, weight through hole 14329, and/or channel 14739B may be the same as or substantially similar to modular golf club head, sole 15002, top, weight assembly, body, slidable cover 15030, movable weight 15028, weight through hole 15029, and/or channel 15039. In a locked configuration, slidable cover 15030 may be in contact, or near contact, with movable weight 15028. In this cross-sectional view, slidable cover 15030 may appear L-shaped. As illustrated, the uniform appearance provided by the weight assembly and slidable cover 15030 may be more apparent in this view. The curves and lines of the golf club head may be substantially the same, thereby preserving the natural aesthetic of the golf club head while providing modularity with the adjustable weighting system. Movable weight 15028 may fit within the channel of slidable cover 15030. In some embodiments, the recessed channel may be shaped, sized, and/or dimensioned such that slidable cover 15030 is in contact with, or nearly in contact with, movable weight 15028. A part of movable weight 15028 and/or other component may be more apparent in this view. In this view the recessed channel may be more apparent with a vertical wall nearest to the striking face, a horizontal bottom wall, and a multi-sloped back wall with a first back wall closer to the bottom wall and a second back wall further from the bottom wall. The first back wall may have a greater slope than the second back wall where the first back wall covers a greater width over the same height compared to the second back wall.

Figure 47:
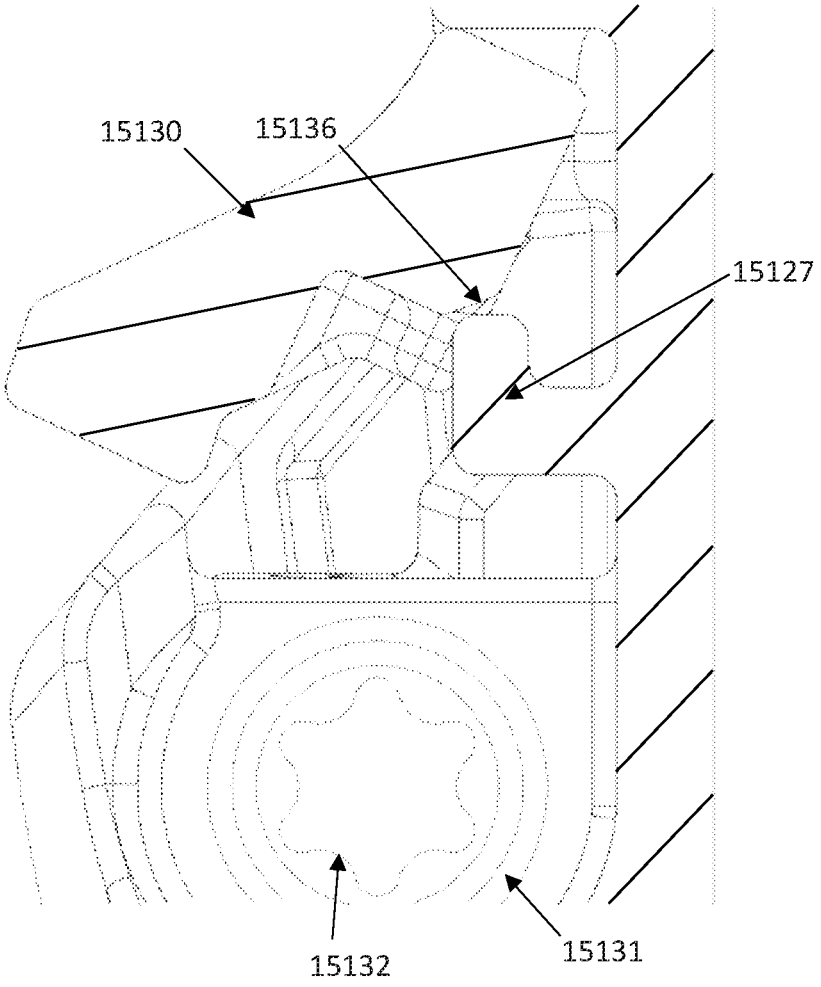
FIG. 47 illustrates a partial cross-sectional view of a golf club head taken substantially along line 151-151' in FIG. 36, in accordance with one or more embodiments of the presently disclosed technology.

FIG. 47 illustrates a partial cross-sectional view of a golf club head taken substantially along line 151-151' in FIG. 36, in accordance with one or more embodiments of the presently disclosed technology. FIG. 151 illustrates components that may be the same or substantially similar to components illustrated in FIGS. 36, 37, 39, and 43B. For example, golf club head 14000, top 14003, weight assembly 14004, body 14006, slidable cover 14030, cover through hole 14031, back 14050, fastener 14132, cover securing element 14327, and/or notched cover recess 14736B may be the same as or substantially similar to modular golf club head, top, weight assembly, body, slidable cover 15130, cover through hole 15131, back 15150, fastener 15132, cover securing element 15127, and/or notched cover recess 15136. As discussed herein, in an aligned configuration, slidable cover 15130 may be rotated to be inserted into a partially unlocked configuration. Notched cover recess 15136 may be aligned with cover securing element 15127.

Figure 48:
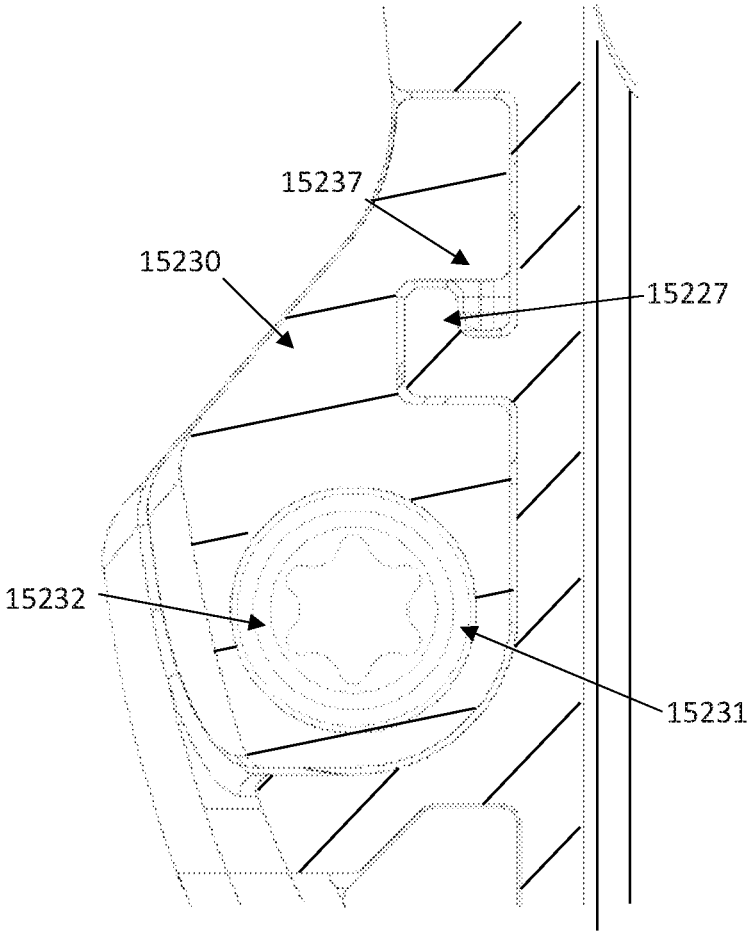
FIG. 48 illustrates a partial cross-sectional view of a golf club head taken substantially along line 151-151' in FIG. 36, in accordance with one or more embodiments of the presently disclosed technology.

FIG. 48 illustrates a partial cross-sectional view of a golf club head taken substantially along line 151-151' in FIG. 36, in accordance with one or more embodiments of the presently disclosed technology. FIG. 48 illustrates components that may be the same or substantially similar to components illustrated in FIGS. 36, 37, 39, and 43B. For example, golf club head 14000, top 14003, weight assembly 14004, body 14006, slidable cover 14030, cover through hole 14031, back 14050, fastener 14132, cover securing element 14327, and/or cover recess 14737B may be the same as or substantially similar to modular golf club head, top, weight assembly, body, slidable cover 15230, cover through hole 15231, back 15250, fastener 15232, cover securing element 15227, and/or cover recess 15237. In a locked configuration, slidable cover 15230 may be in contact with, or substantially touching, the body. In some embodiments, cover recess 15237 may rest above cover securing element 15227.

Figure 49:
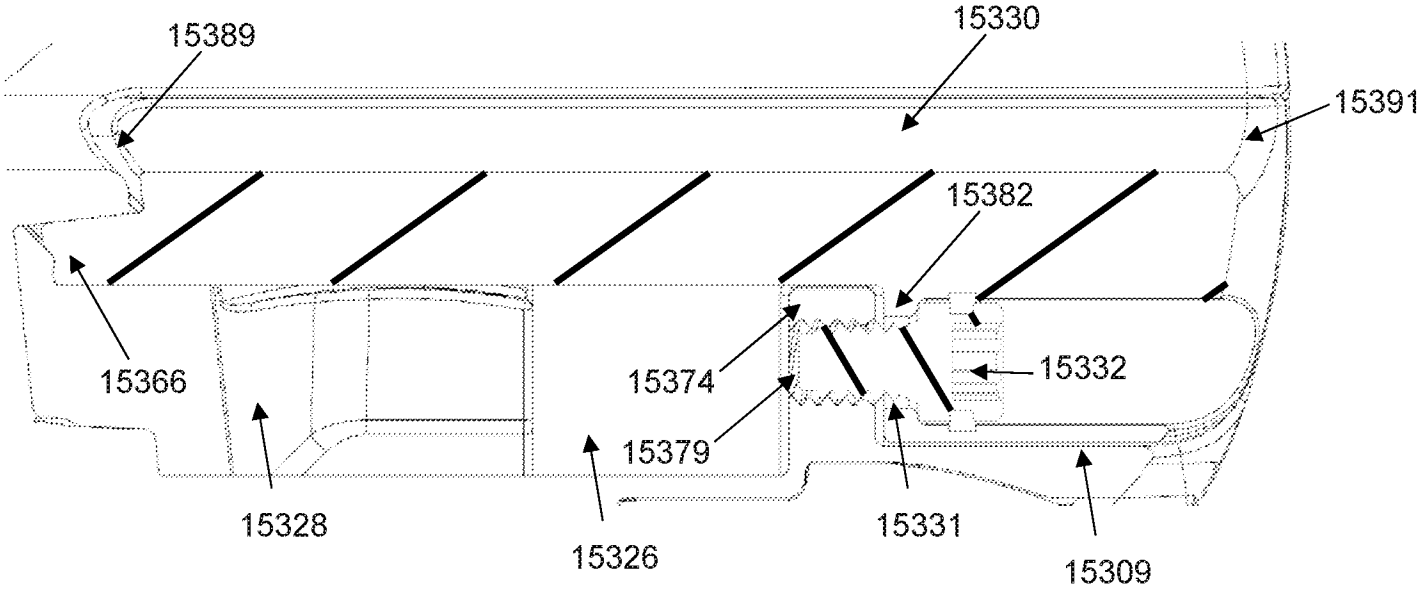
FIG. 49 illustrates a partial cross-sectional view of a golf club head taken substantially along line 153-153' in FIG. 36, in accordance with one or more embodiments of the presently disclosed technology.

FIG. 49 illustrates a partial cross-sectional view of a golf club head taken substantially along line 153-153' in FIG. 36, in accordance with one or more embodiments of the presently disclosed technology. FIG. 49 illustrates components that may be the same or substantially similar to components illustrated in FIGS. 36, 37, 39, and 40. For example, golf club head 14000, hosel 14001, sole 14002, top 14003, weight assembly 14004, body 14006, toc 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, third cover surface 14091, fastener 14132, first recessed channel surface 14309, recessed channel 14326, stepped protrusion 14366, second member 14374, protruded bore 14382, and/or second member through hole 14479 may be the same as or substantially similar to modular golf club head, hosel, sole, top, weight assembly, body, toe, heel, outer surface, slidable cover 15330, cover through hole 15331, back, lower back surface, upper back surface, first back surface, second back surface, first cover surface, second cover surface 15389, third cover surface 15391, fastener 15332, first recessed channel surface 15309, recessed channel 15326, stepped protrusion 15366, second member 15374, protruded bore 15382, and/or second member through hole 15379. Parts of movable weight 15328 may be shaped to minimize contact with slidable cover 15330 in a locked configuration. A part of movable weight 15328 may be curved such that an amount of movable weight 15328 in contact with a bottom of slidable cover 15330 in a locked configuration. In some embodiments, the surface area of movable weight 15328 may be greater. For example, movable weight 15328 may be flat, making the entire surface in contact with the bottom of slidable cover 15330, or curved in a U-shape, which may provide at least two points of contact with a bottom of slidable cover 15330.

As illustrated, the uniform appearance provided by slidable cover 15330 may be more apparent in this view. A part of recessed channel 15326 and/or other components may be more apparent in this view. In embodiments, cover through hole 15331 may include a stepped circumference, as discussed herein. For example, a first circumference may be shaped, sized, and/or dimensioned to a body of fastener 15332. In some embodiments, the first circumference may be threaded. In embodiments, the first circumference may not be threaded. The threaded circumference may match the threads of second member through hole 15379. A second circumference may be shaped, sized, and/or dimensioned to a head of fastener 15332. The second circumference may be larger than the first circumference. In some embodiments, head protrusions may extend inward from cover through hole 15331 to keep the head of fastener 15332 in a fixed position in cover through hole 15331. The head of fastener may include corresponding grooves to receive the protrusions. This may allow fastener 15332 to be fastened in a fixed position relative to cover 15330. The head protrusions may only extend partially through the head of fastener 15332, allowing fastener 15332 to be fastened to the body.

Figure 50:
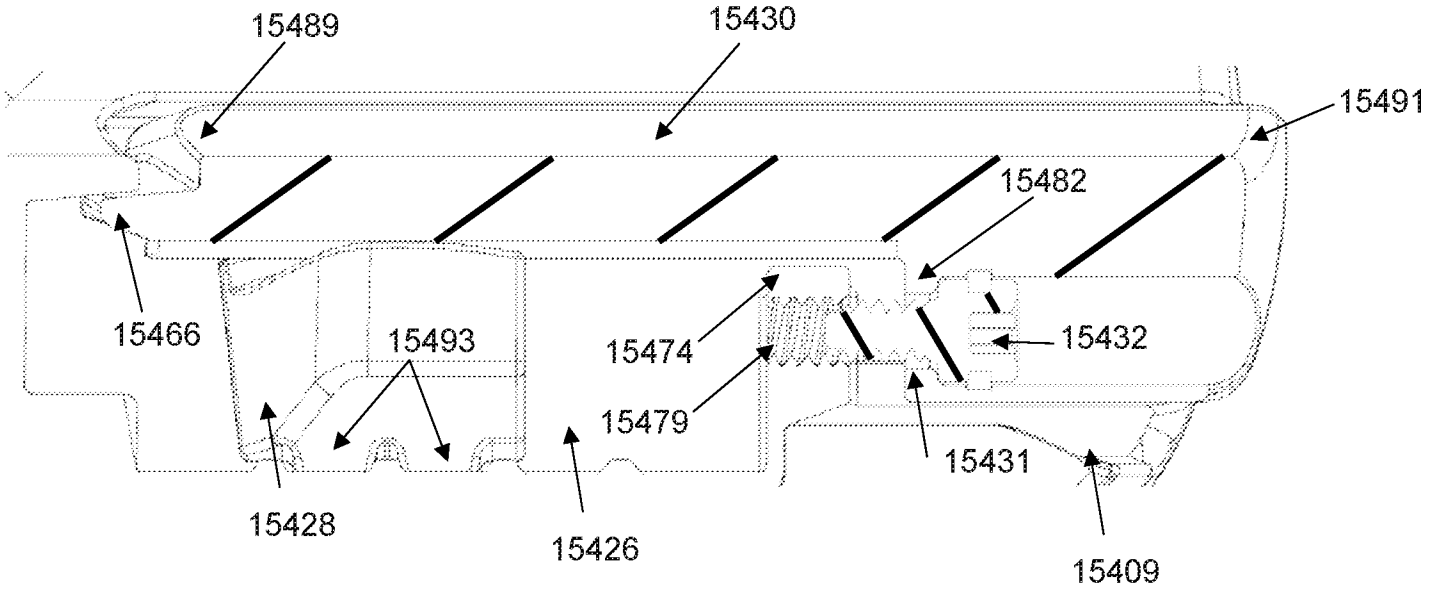
FIG. 50 illustrates a partial cross-sectional view of a golf club head taken substantially along line 153-153' in FIG. 36, in accordance with one or more embodiments of the presently disclosed technology.

FIG. 50 illustrates a partial cross-sectional view of a golf club head taken substantially along line 153-153' in FIG. 36, in accordance with one or more embodiments of the presently disclosed technology. FIG. 50 illustrates components that may be the same or substantially similar to components illustrated in FIGS. 36, 37, 39, and 40. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, third cover surface 14091, fastener 14132, first recessed channel surface 14309, recessed channel 14326, movable weight 14328, stepped protrusion 14366, second member 14374, protruded bore 14382, and/or second member through hole 14479 may be the same as or substantially similar to modular golf club head, hosel, sole, top, weight assembly, body, toe, heel, outer surface, slidable cover 15430, cover through hole 15431, back, lower back surface, upper back surface, first back surface, second back surface, first cover surface, second cover surface 15489, third cover surface 15491, fastener 15432, first recessed channel surface 15409, recessed channel 15426, movable weight 15428, stepped protrusion 15466, second member 15474, protruded bore 15482, and/or second member through hole 15479. Movable weight 15428 may include weight protrusions 15493. Weight protrusions 15493 may help movable weight 15428 engage with recessed channel 15426. Fastener 15432 may be in a partially unfastened configuration.

Figure 51:
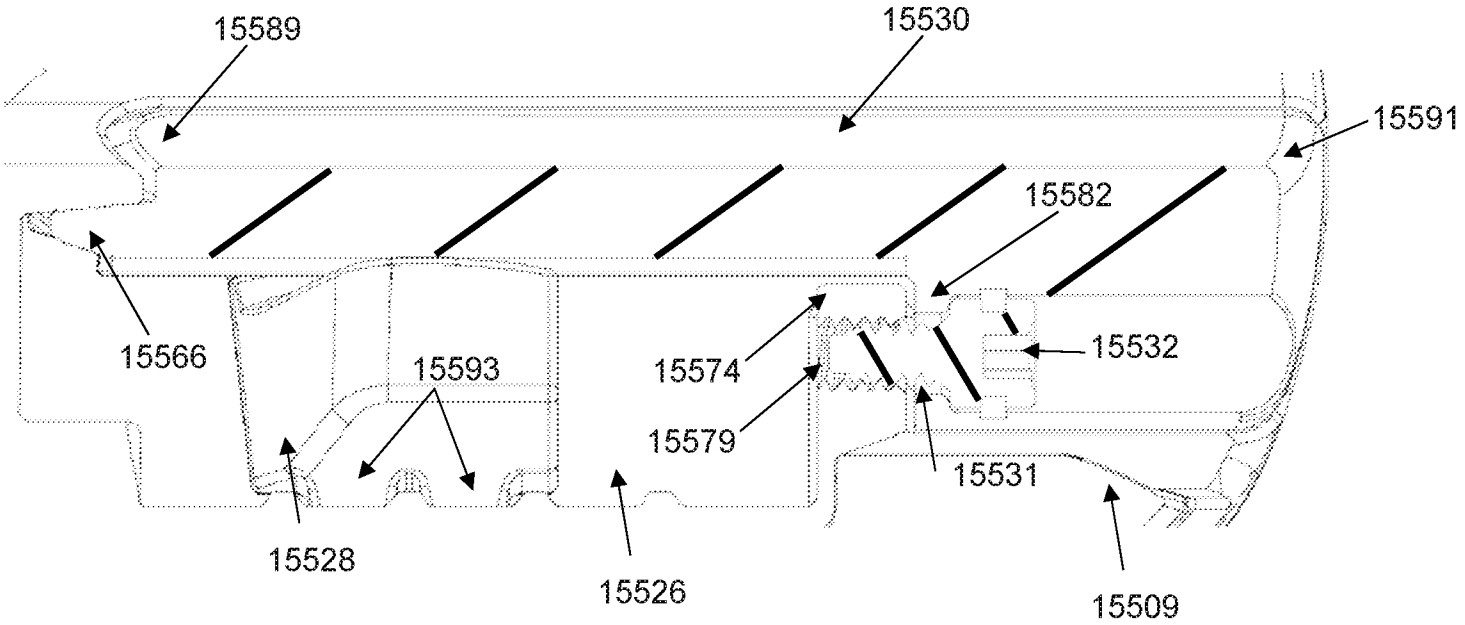
FIG. 51 llustrates a partial cross-sectional view of a golf club head taken substantially along line 153-153' in FIG. 36, in accordance with one or more embodiments of the presently disclosed technology.

FIG. 51 illustrates a partial cross-sectional view of a golf club head taken substantially along line 153-153' in FIG. 36, in accordance with one or more embodiments of the presently disclosed technology. FIG. 51 illustrates components that may be the same or substantially similar to components illustrated in FIGS. 36, 37, 39, 40, and 50. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, third cover surface 14091, fastener 14132, first recessed channel surface 14309, recessed channel 14326, movable weight 14328, stepped protrusion 14366, second member 14374, protruded bore 14382, second member through hole 14479, and/or weight protrusions 15493 may be the same as or substantially similar to modular golf club head, hosel, sole, top, weight assembly, body, toe, heel, outer surface, cover 15530, cover through hole 15531, back, lower back surface, upper back surface, first back surface, second back surface, first cover surface, second cover surface 15589, third cover surface 15591, fastener 15532, first recessed channel surface 15509, recessed channel 15526, movable weight 15528, stepped protrusion 15566, second member 15574, protruded bore 15582, second member through hole 15579, and/or weight protrusions 15593. The top wall of recessed channel 15526 on a heel-end may press down on stepped protrusion 15566 in a locked configuration, which may help secure movable weight 15528 into a fixed position. This may prevent rattling and unwanted movement from movable weight 15528. In some embodiments, fastener 15532 may be tapered. For example, the threaded portion may have a smaller circumference moving heel-ward from the fastener head.

Figure 52:
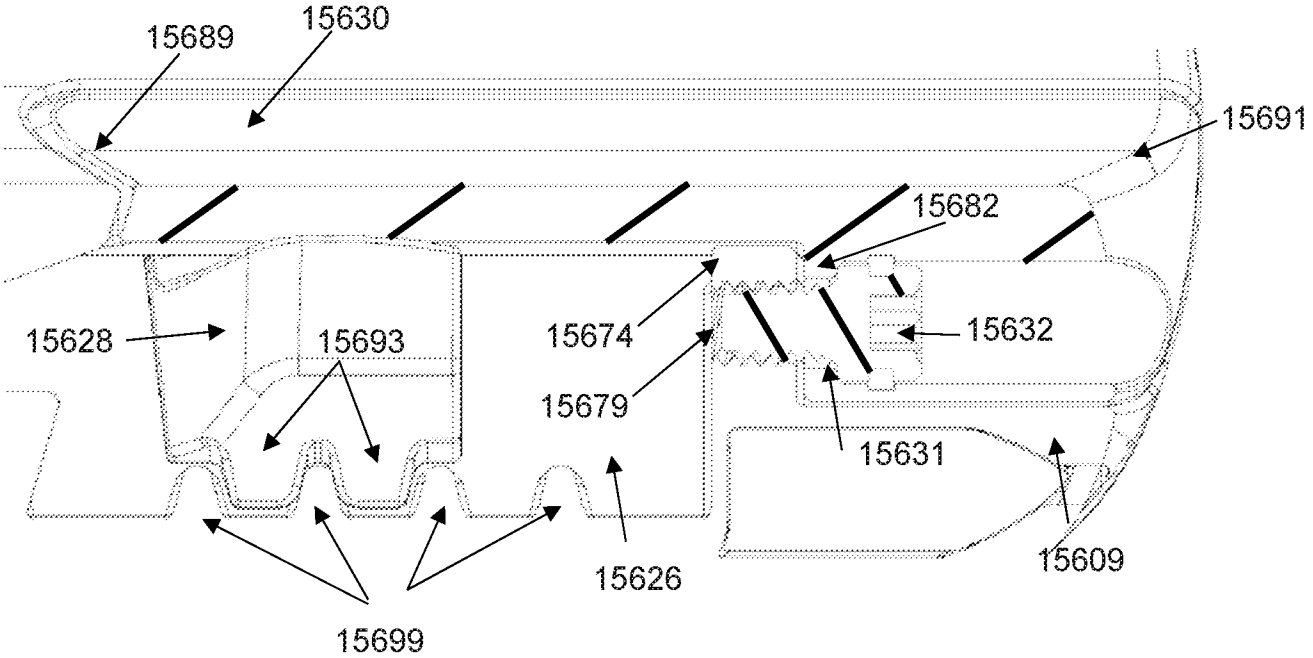
FIG. 52 illustrates a partial cross-sectional view of a golf club head taken substantially along line 153-153' in FIG. 36, in accordance with one or more embodiments of the presently disclosed technology.

FIG. 52 illustrates a partial cross-sectional view of a golf club head taken substantially along line 153-153' in FIG. 36, in accordance with one or more embodiments of the presently disclosed technology. FIG. 52 illustrates components that may be the same or substantially similar to components illustrated in FIGS. 36, 37, 39, 40, and 50. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, third cover surface 14091, fastener 14132, first recessed channel surface 14309, recessed channel 14326, movable weight 14328, stepped protrusion 14366, second member 14374, protruded bore 14382, second member through hole 14479, and/or weight protrusions 15493 may be the same as or substantially similar to modular golf club head, hosel, sole, top, weight assembly, body, toe, heel, outer surface, cover 15630, cover through hole 15631, back, lower back surface, upper back surface, first back surface, second back surface, first cover surface, second cover surface 15689, third cover surface 15691, fastener 15632, first recessed channel surface 15609, recessed channel 15626, movable weight 15628, stepped protrusion, second member 15674, protruded bore 15682, second member through hole 15679, and/or weight protrusions 15693. Recessed channel 15626 may include recessed channel protrusions 15699. Recessed channel protrusions 15699 may engage with weight protrusions 15693 to fix movable weight 15628 into a fixed position. As illustrated, there may be four recessed channel protrusions 15699 corresponding to four fixed positions for movable weight 15628; however, it should be appreciated that there may be more or fewer recessed channel protrusions 15699 without departing from the spirit and scope of the presently disclosed technology. Recessed channel protrusions 15699 and weight protrusions 15693 may be differently shaped, sized, and/or dimensioned without departing from the spirit and scope of the presently disclosed technology. For example, half-circular shapes may be used, more right-angle shaped triangles may be used, where a toe-end or heel-end of each recessed channel protrusion 15699 is vertical, and/or other shapes. In some embodiments, another mechanism may be used to fix movable weight 15628 into a fixed position without departing from the spirit and scope of the presently disclosed technology. For example, grooves and protrusions may be on one or more side walls of movable weight 15628 and a corresponding wall of recessed channel 15626 on an opposite side, blind holes may be placed on a side wall or a bottom of recessed channel 15626 and a fastener may be fastened through the weight through hole to fasten movable weight 15628 to the body of the golf club head, and/or other mechanisms. A part of recessed channel 15626 and/or other components may be more apparent in this view.

Figure 53:
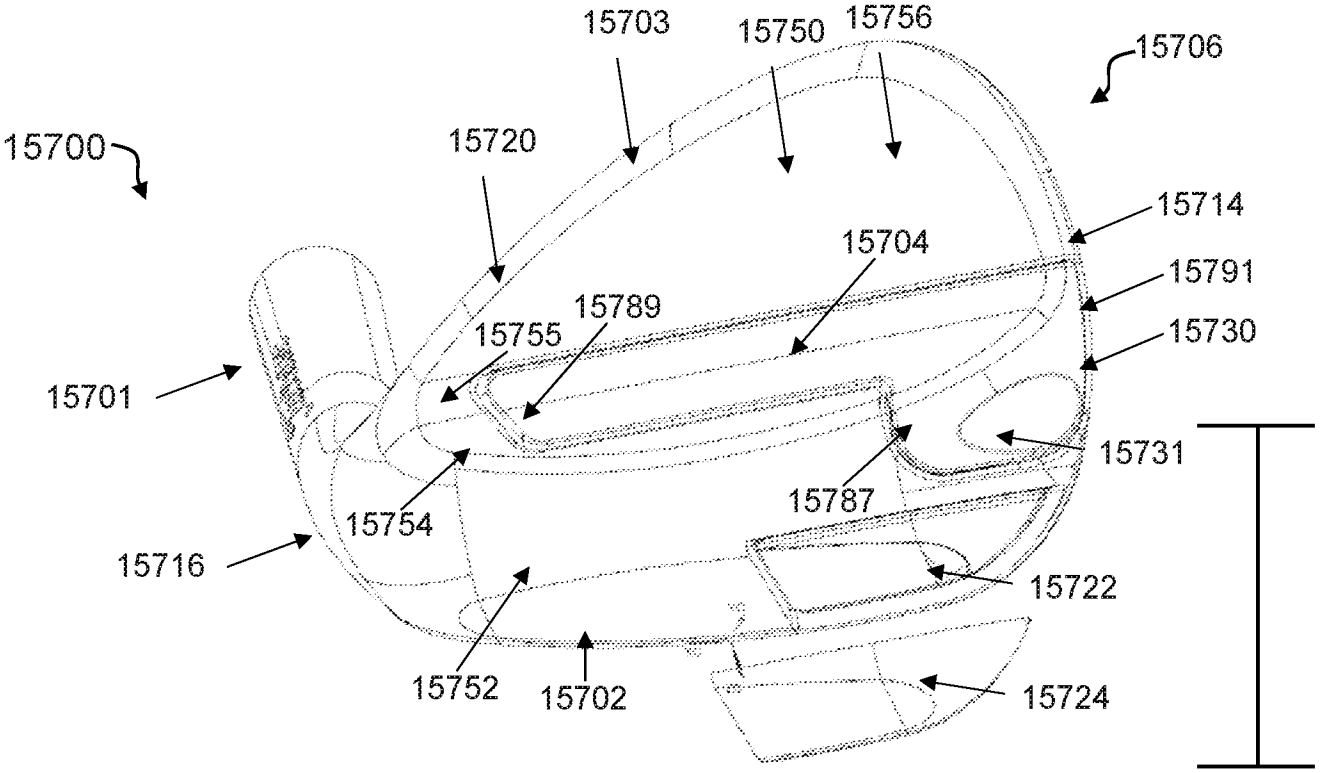
FIG. 53 illustrates a partially exploded perspective view of a golf club head, in accordance with one or more embodiments of the presently disclosed technology.

FIG. 53 illustrates a partially exploded perspective view of a golf club head, in accordance with one or more embodiments of the presently disclosed technology. FIG. 157 illustrates components that may be the same or substantially similar to components illustrated in FIGS. 36 and 37. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, and/or third cover surface 14091 may be the same as or substantially similar to modular golf club head 15700, hosel 15701, sole 15702, top 15703, weight assembly 15704, body 15706, toe 15714, heel 15716, outer surface 15720, slidable cover 15730, cover through hole 15731, fastener, back 15750, lower back surface 15752, upper back surface 15756, first back surface 15754, second back surface 15755, first cover surface 15787, second cover surface 15789, and/or third cover surface 15791. Modular golf club head 15700 may include cavity 15722 and body weight 15724. Cavity 15722 may be shaped, sized, and/or dimensioned to receive body weight 15724. As discussed herein with respect to other components, body weight 15724 may be metal, composite, and/or plastic. In embodiments, body weight 15724 may be tungsten. In some embodiments, body weight 15724 may be less than 50 g. In some embodiments, body weight 15724 may be less than 15 g. In embodiments, body weight 15724 may be less than 5 g. In some embodiments, body weight 15724 may be denser than rest of body 15706. Body weight 15724 may affect the CG of modular golf club head 15700. For example, as illustrated, the CG of modular golf club head 15700 may be more toe-ward and sole-ward than without body weight 15724. In some embodiments, body weight 15724 may be located elsewhere on modular golf club head 15700. It should be appreciated that body weight 15724 may be shaped, sized, and/or dimensioned to preserve a natural aesthetic of modular golf club head 15700. That is with body weight 15724 installed, modular golf club head 15700 may have a uniform appearance such that a user would not visually notice body weight 15724. In some embodiments, body weight 15724 may be permanently installed. For example, body weight 15724 may be welded into position. Body weight 15724 may be grinded and polished to provide a uniform appearance. In some embodiments, body weight 15724 may be installed, and a cover may be welded into position. The cover may be grinded and polished to provide a uniform appearance. It should be appreciated that grinding, polishing, and/or other techniques may be used on other components to help provide a uniform appearance to golf club head 15700. In embodiments, body weight 15724 may be installed within body 15706. That is cavity 15722 and body weight 15724 may not be open or exposed to outer surface 15720. In some embodiments, body weight 15724 may be removable.

Figure 54:
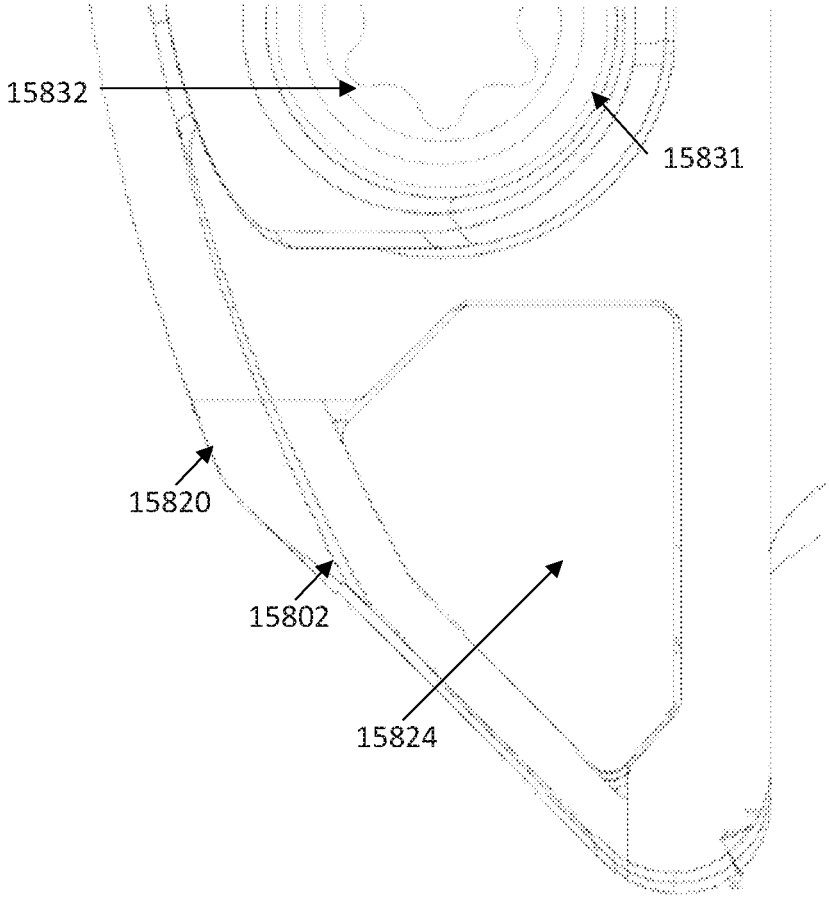
FIG. 54 illustrates a partial side view of a golf club head, in accordance with one or more embodiments of the presently disclosed technology.

FIG. 54 illustrates a partial side view of a golf club head, in accordance with one or more embodiments of the presently disclosed technology. FIG. 54 illustrates components that may be the same or substantially similar to components illustrated in FIGS. 36, 37, and 53. For example, golf club head 14000, hosel 14001, sole 14002, top 14003, weight assembly 14004, body 14006, toe 14014, heel 14016, outer surface 14020, slidable cover 14030, cover through hole 14031, back 14050, lower back surface 14052, upper back surface 14056, first back surface 14054, second back surface 14055, first cover surface 14087, second cover surface 14089, third cover surface 14091, fastener 14132, cavity 15722, and/or body weight 15724 may be the same as or substantially similar to modular golf club head, hosel, sole 15802, top, weight assembly, body, toe, heel, outer surface 15820, slidable cover, cover through hole 15831, back, lower back surface, upper back surface, first back surface, second back surface, first cover surface, second cover surface, third cover surface, fastener 15832, cavity, and/or body weight 15824. A part of body weight 15824 and/or other components be more apparent in this view. In some embodiments, body weight 15824 may slide into an installed configuration from the toc.

Figure 55:
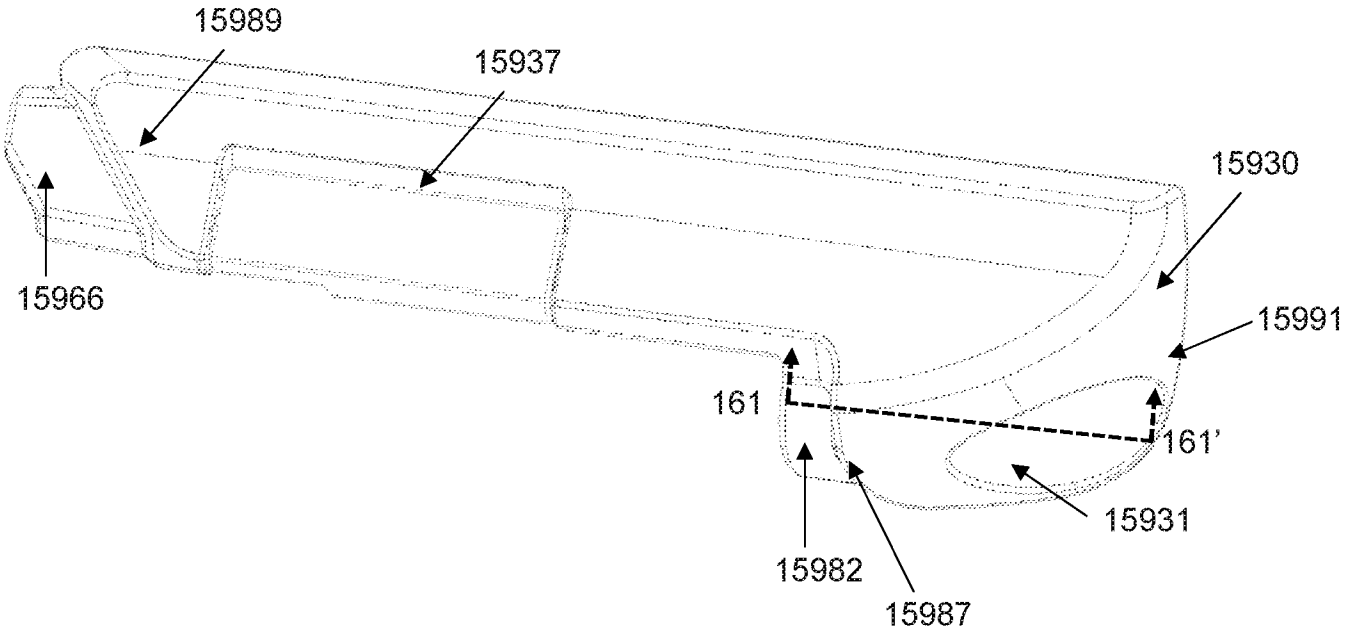
FIG. 55 illustrates a perspective view of a cover, in accordance with one or more embodiments of the presently disclosed technology.

FIG. 55 illustrates a perspective view of a cover, in accordance with one or more embodiments of the presently disclosed technology. FIG. 55 illustrates components that may be the same or substantially similar to components illustrated in FIGS. 36, 37, and 39. For example, slidable cover 14030, cover through hole 14031, first cover surface 14087, second cover surface 14089, third cover surface 14091, fastener 14132, stepped protrusion 14366, and/or protruded bore 14382 may be the same as or substantially similar to slidable cover 15930, cover through hole 15931, first cover surface 15987, second cover surface 15989, third cover surface 15991, fastener, stepped protrusion 15966, and/or protruded bore 15982. Slidable cover 15930 may include window 15937. Window 15937 may allow a user to view a position of the weight in a locked configuration. Window 15937 may be transparent or partially transparent. In some embodiments, window 15937 may be a slot that is open through to the recessed channel. In these embodiments, there may be multiple slots or openings corresponding to the number of positions in the bottom of the recessed channel. The slots or openings may be covered with a transparent or partially transparent material. In embodiments, window 15937 may be differently shaped, sized, and/or dimensioned without departing from the spirit and scope of the presently disclosed technology. For example, a length of window 15937 may be longer to view more of the recessed channel. The length of window 15937 may correspond to a distance that the weight can travel. In some embodiments, slidable cover 15930 may be partially transparent to allow a user to view a position of the weight without window 15937. In embodiments, window 15937 may be removably couplable.

Figure 56:
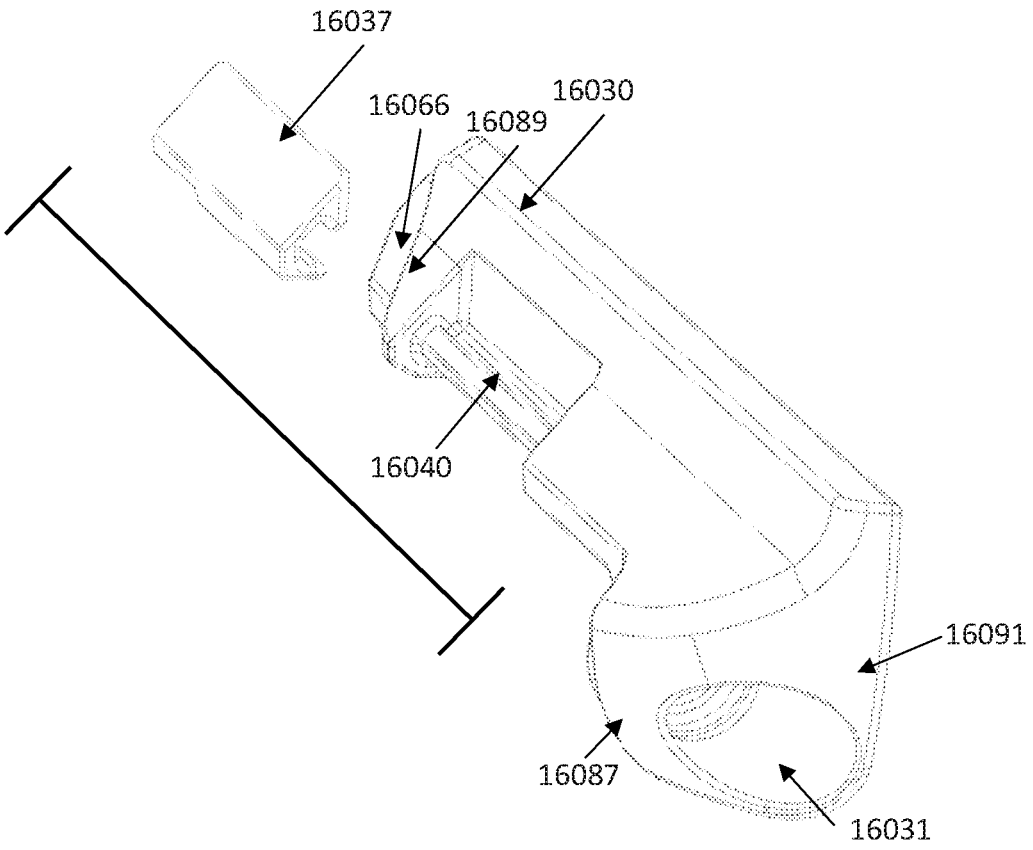
FIG. 56 illustrates an exploded perspective view of a cover, in accordance with one or more embodiments of the presently disclosed technology.

FIG. 56 illustrates an exploded perspective view of a cover, in accordance with one or more embodiments of the presently disclosed technology. FIG. 56 illustrates components that may be the same or substantially similar to components illustrated in FIGS. 36, 37, 39, and 55. For example, slidable cover 14030, cover through hole 14031, first cover surface 14087, second cover surface 14089, third cover surface 14091, fastener 14132, stepped protrusion 14366, protruded bore 14382, and/or window 15937 may be the same as or substantially similar to slidable cover 16030, cover through hole 16031, first cover surface 16087, second cover surface 16089, third cover surface 16091, fastener, stepped protrusion 16066, protruded bore, and/or window 16037. Window 16037 may snap onto window rail 16040. In some embodiments, window rail 16040 may not exist. Window 16037 may be attachable with another mechanism to slidable cover 16030. For example, window 16037 may be permanently fixed to slidable cover 16030. Window 16037 may be a part of slidable cover 16030. In embodiments, window rail 16040 may be differently shaped, sized, and/or dimensioned without departing from the spirit and scope of the presently disclosed technology. For example, window rail 16040 may be thinner and more of the recessed channel may be viewable. Window rail 16040 may be longer or shorter. Window rail 16040 may be cut-out such that a portion between a heel end and toe end of window rail 16040 is removed. This may provide greater visibility into the recessed channel. In some embodiments, window rail 16040 may be transparent or partially transparent to allow a user to view into the recessed channel. In such an embodiment, window 16037 may not be needed and may be removed.

Figure 57:
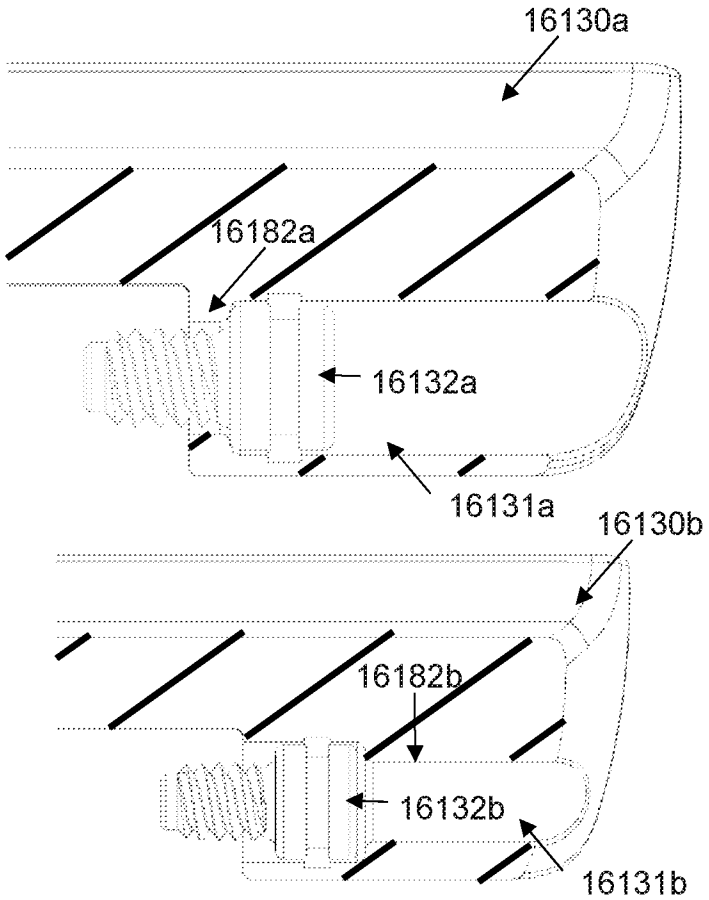
FIG. 57 illustrates a partial cross-sectional view of a cover taken substantially along line 161-161' in FIG. 55, in accordance with one or more embodiments of the presently disclosed technology.

FIG. 57 illustrates a partial cross-sectional view of a cover taken substantially along line 161-161' in FIG. 55, in accordance with one or more embodiments of the presently disclosed technology. FIG. 57 illustrates components that may be the same or substantially similar to components illustrated in FIGS. 36, 37, and 39. For example, slidable cover 14030, cover through hole 14031, fastener 14132, and/or protruded bore 14382 may be the same as or substantially similar to slidable covers 16130*a*, 16130*b*, cover through holes 16131*a*, 16131*b*, fasteners 16132*a*, 16132*b*, and/or protruded bores 16182*a*, 16182*b*. A part of slidable cover 16130*a*, 16130*b* and/or other components may be more apparent in this view. With respect to slidable cover 16130*a*, there may be two circumferences of cover through hole 16131*a*, a first circumference on a left side and a second circumference on the right side. The first circumference of cover through hole 16131*a* may be smaller than the second circumference of cover through hole 16131*a*. The first circumference of cover through hole 16131*a* may be shaped, sized, and/or dimensioned to fit the threaded portion of fastener 16132*a*. The first circumference of cover through hole 16131*a* may prevent fastener 16132*a* from going into the recessed channel. The second circumference of cover through hole 16131*a* may be shaped, sized, and/or dimensioned to fit the head of fastener 16132*a*. The second circumference of cover through hole 16131*a* may extend along a longer length than the first circumference of cover through hole 16131*a*. In embodiments, there may be a third circumference. It should be appreciated that different types of through holes and/or protruded bores may be used, including counterbored holes, which may include a first circumference and a second circumference to the right of the first circumference with a larger diameter than the first circumference; countersunk holes, which may include a first circumference and a conical circumference to the right of the first circumference with a starting circumference of the first circumference and growing in diameter from the first circumference; a counter drilled hole, which may include a countersunk hole including a second circumference to the right of the conical circumference, and so on without departing from the spirit and scope of the presently disclosed technology.

With respect to cover 16130*b*, there may be two circumferences of cover through hole 16131*b*, a first circumference on a left side and a second circumference on the right side. The first circumference of cover through hole 16131*b* may be larger than the second circumference of cover through hole 16131*b*. The first circumference of cover through hole 16131*b* may be shaped, sized, and/or dimensioned to fit the head of fastener 16132*b*. The first circumference of cover through hole 16131*b* may prevent fastener 16132*b* from falling out of a toe end of slidable cover 16130*b*. The second circumference of cover through hole 16131*b* may be shaped, sized, and/or dimensioned to fit a tool to tighten or loosen fastener 16132*b* and/or adjust the weight. The second circumference of cover through hole 16131*b* may extend along a longer length than the first circumference of cover through hole 16131*b*. In embodiments, there may be a third circumference.

Figure 58:
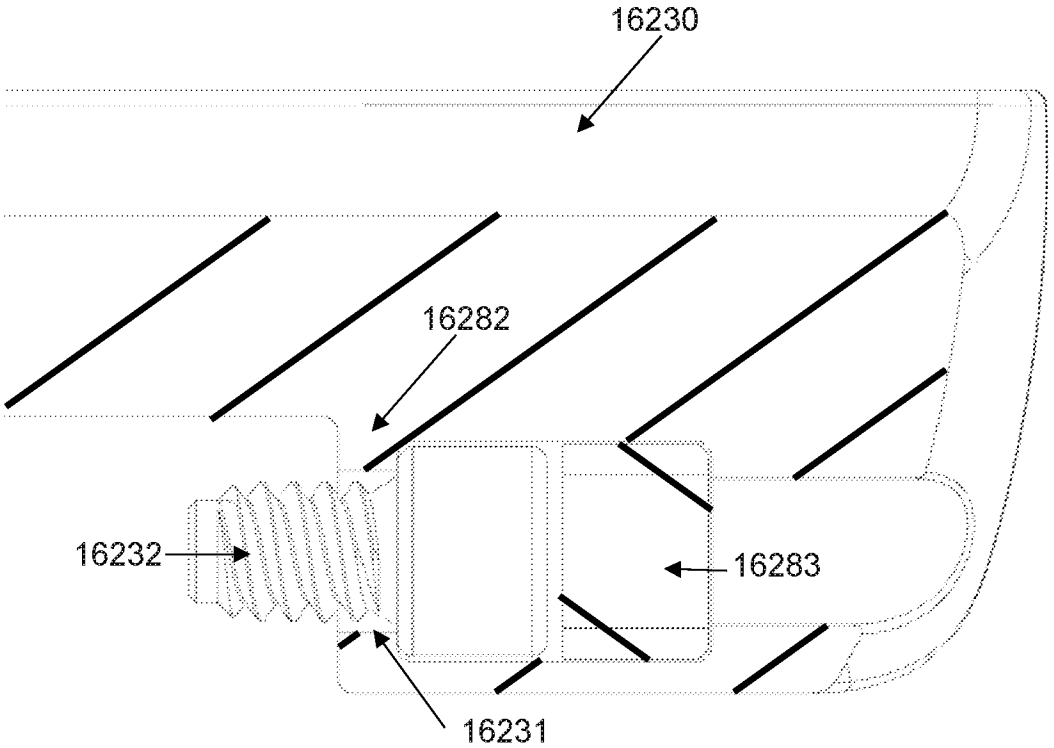
FIG. 58 illustrates a partial cross-sectional view of a cover taken substantially along line 161-161' in FIG. 55, in accordance with one or more embodiments of the presently disclosed technology.

FIG. 58 illustrates a partial cross-sectional view of a cover taken substantially along line 161-161' in FIG. 55, in accordance with one or more embodiments of the presently disclosed technology. FIG. 58 illustrates components that may be the same or substantially similar to components illustrated in FIGS. 36 and 39. For example, slidable cover 14030, cover through hole 14031, fastener 14332, and/or protruded bore 14382 may be the same as or substantially similar to slidable cover 16230, cover through hole 16231, fastener 16232, and/or protruded bore 16282. A part of slidable cover 16230 and/or other components may be more apparent in this view. Slidable cover 16230 may include cap 16283. Cap 16283 may be welded or otherwise secured or fixed in place relative to slidable cover 16230. Cap 16283 may include a through hole (not shown) to access a head of fastener 16232 with a tool. Cap 16283 may be metal, composite, and/or plastic, as discussed herein with respect to other components. In some embodiments, cap 16283 may include one or more materials, as discussed herein with respect to other components. There may be three circumferences of cover through hole 16231, a first circumference on a left side, a second circumference in the middle, and a third circumference on the right side. The first circumference may be smaller than the second circumference. The first circumference may be shaped, sized, and/or dimensioned to fit the threaded portion of fastener 16232. The first circumference may prevent fasteners 16232 from going into the recessed channel. The second circumference may be shaped, sized, and/or dimensioned to fit the head of fastener 16232 and cap 16283. The second circumference may extend along a longer length than the first circumference. The third circumference may be shaped, sized, and/or dimensioned to fit a tool to tighten or loosen fastener 16232. The third circumference may prevent fastener 16232 and cap 16283 from falling out of a toe end of slidable cover 16230. In some embodiments, cap 16283 may be removed and the second circumference may be shaped, sized, and/or dimensioned to fit the head of fastener 16232. Cover through hole 16231 may be shaped, sized, and/or dimensioned as illustrated to prevent the loss of fastener 16232.

Figure 59:
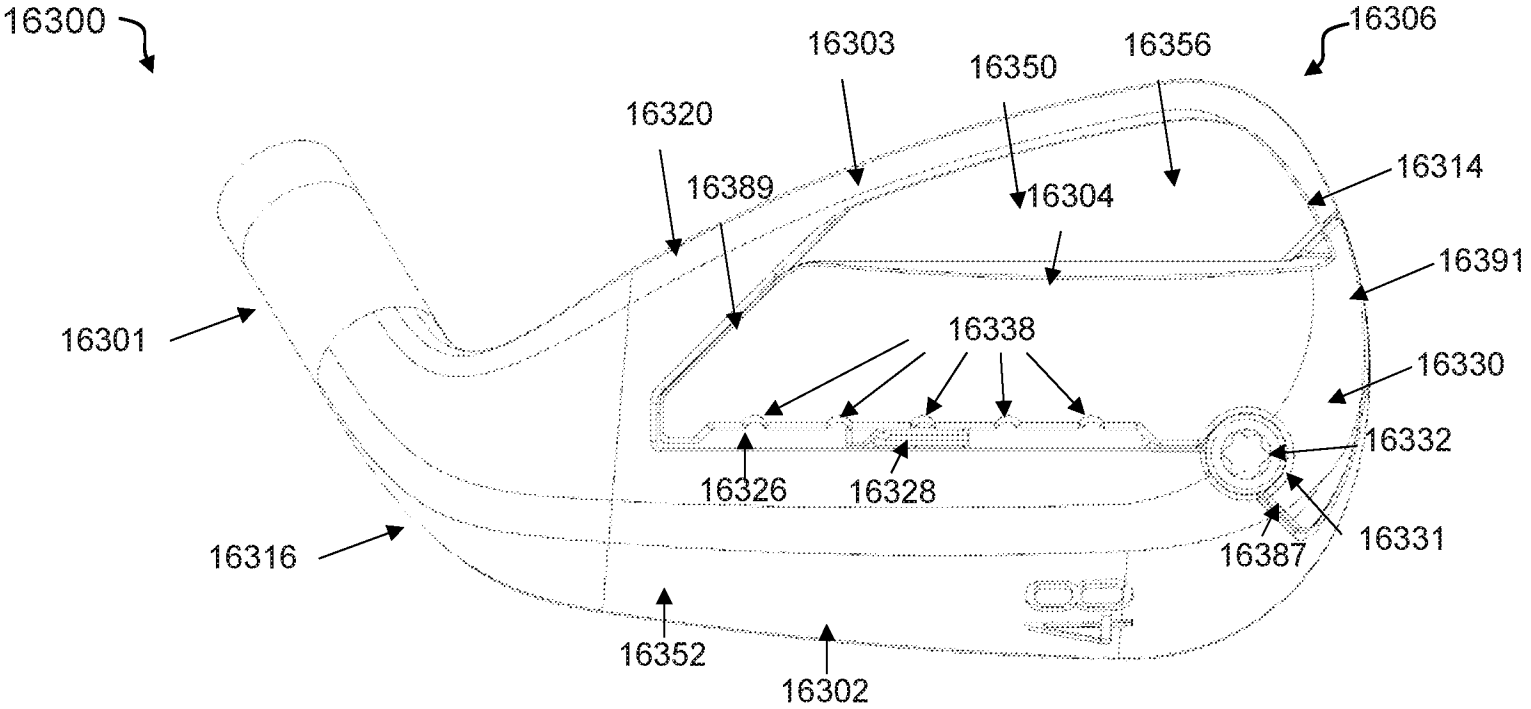
FIG. 59 illustrates a back view of a golf club head, in accordance with one or more embodiments of the presently disclosed technology.

FIG. 59 illustrates a back view of a golf club head, in accordance with one or more embodiments of the presently disclosed technology. FIG. 59 illustrates components that may be the same or substantially similar to components illustrated in FIG. 36. For example, golf club head 14000, hosel 14001, sole 14002, top 14003, body 14006, heel 14016, slidable cover 14030, and/or third cover surface 14091 may be the same as or substantially similar to modular golf club head 16300, hosel 16301, sole 16302, top 16303, body 16306, heel 16316, slidable cover 16330, and/or third cover surface 16391. In this example, modular golf club head 16300 may be an iron-type golf club head illustrated with "48," but the embodiment is not limited thereto. Weight assembly 16304 may include slidable cover 16330. Slidable cover 16330 may include cover through hole 16331, fastener 16332, first cover surface 16387, second cover surface 16389, third cover surface 16391, a top end, a bottom end, a heel end, and a toe end. Cover through hole 16331 may be substantially perpendicular to the toe-to-heel direction. In some embodiments, cover through hole 16331 may be substantially perpendicular to the plane of the striking face. Cover through hole 16331 may be located on a toe-end of modular golf club head 16300. Fastener 16332 may be fastened by going through cover through hole 16331. Fastening direction may be substantially perpendicular to the toe-to-heel direction and/or the same, or substantially the same direction as an axis of cover through hole 16331. In some embodiments, cover through hole 16331 may be substantially perpendicular to the plane of the sliding direction of slidable cover 16330. The position of fastener 16332 may allow for security of movable weight 16328 and slidable cover 16330. Slidable cover 16330 may slide into an unlocked configuration by sliding in a diagonal toe-ward and top-ward direction. In some embodiments, this angle may be about 15 degrees from a heel-to-toe axis toward a bottom-to-top axis. The sliding direction angle may be 30 degree, 45 degrees, 60 degrees, or 90 degrees, including any values in between without departing from the spirit and scope of the presently disclosed technology. The sliding direction in combination with the fastener axis may further prevent unwanted movement of movable weight 16328 and slidable cover 16330 in a locked configuration. For example, because the sliding direction and fastener axis may be perpendicular to each other, this may reduce movement in both directions. Since the sliding direction covers both a bottom-to-top direction, and a heel-to-toe direction, together, the sliding direction and fastener axis may cover all directions, including the back-to-front direction. Cover through hole 16331 may be circular, oval, or any other shape without departing from the spirit and scope of the presently disclosed technology. In some embodiments, cover through hole 16331 may have different shape throughout the cover width of cover through hole 16331. The different shapes may be stepped and/or tapered. A face-most shape may be larger or narrower than a back-most shape of cover through hole 16331. In some embodiments, the cover through hole circumference of cover through hole 16331 may be smaller than a head of fastener 16332.

First cover surface 16387 may correspond to at least a part of lower back surface 16352. First cover surface 16387 may be defined based on at least a part of lower back surface 16352. In embodiments, first cover surface 16387 and lower back surface 16352 may be shaped, sized, and/or dimensioned to fit together. First cover surface 16387 may wrap onto parts of sole 16302, lower back surface 16352, and toe 16314 and wrap around fastener 16332 in a locked configuration. As illustrated, first cover surface 16387 may include linear edges and curved edges. The linear edges may run diagonally in a heel-to-top direction and horizontally along a toe-to-heel direction. The curved edge may correspond to a circular curve around fastener 16332. First cover surface 16387 may go top-ward and heel-ward across a toc-ward part of sole 16302, curve around fastener 16332, and go heel-ward horizontally above a top of sole 16302. As illustrated, first cover surface 16387 may provide a uniform appearance to modular golf club head 16300 in a locked configuration. While there may be gaps between slidable cover 16330 and body 16306, the curves and/or lines from body 16306 continue on to slidable cover 16330 as if there was no gap and/or as if the gap continued the curves and/or lines from body 16306. It should be appreciated that slidable cover 16330 and first cover surface 16387 may be differently shaped, sized, and/or dimensioned to provide a different uniform appearance to modular golf club head 16300 when in a locked configuration. For example, in some embodiments, first cover surface 16387 may continue the linear edge on the toe side of fastener 16332 from the heel side of fastener 16332 providing a rectangular-shaped slidable cover 16330. The corresponding parts of lower back surface 16352 may be shaped, sized, and/or dimensioned to receive at least part of slidable cover 16330 corresponding to first cover surface 16387.

Second cover surface 16389 may correspond to at least a part of back 16350. Second cover surface 16389 may be defined based on at least a part of upper back surface 16356. In embodiments, second cover surface 16389 and upper back surface 16356 may be shaped, sized, and/or dimensioned to fit together. Second cover surface 16389 may cover parts of upper back surface 16356 and lower back surface 16352. As illustrated, second cover surface 16389 may include linear edges and curved edges. The linear edges may run in a toe-to-heel direction after cover notches 16338, a vertical direction, a diagonal direction, and then a toe-to-heel direction. The curved edges may run along transitions between the linear edges. Second cover surface 16389 may go vertically up near a bottom heel-ward part of upper back surface 16356, move up-ward and toe-ward diagonally, and curve across horizontally toward toe 16314 at the middle of upper back surface 16356. Second cover surface 16389 may provide a uniform appearance to modular golf club head 16300 in a locked configuration. It should be appreciated that slidable cover 16330 and second cover surface 16389 may be differently shaped, sized, and/or dimensioned to provide a different uniform appearance to modular golf club head 16300 when in a locked configuration. For example, in some embodiments, second cover surface 16389 may go vertically down from a top-left edge of slidable cover 16330 providing a rectangular look to slidable cover 16330. The corresponding parts of back 16350 may be shaped, sized, and/or dimensioned to receive at least part of slidable cover 16330 corresponding to second cover surface 16389.

Third cover surface 16391 may correspond to at least a part of back 16350 and a part of toe 16314. Third cover surface 16391 may be defined based on at least a part of back 16350 and a part of toe 16314. In embodiments, third cover surface 16391, back 16350, and toc 16314 may be shaped, sized, and/or dimensioned to fit together. Third cover surface 16391 may wrap around a back portion of toe 16314 toward the striking face. In some embodiments, third cover surface 16391 may be defined based on at least parts of toe 16314, lower back surface 16352, and upper back surface 16356. As illustrated, third cover surface 16391 may include linear edges and curved edges. The linear edges may run along at least in a toe-to-heel direction on a top between upper back surface 16356 and toe 16314. The curved edges may run along at least parts of toc 16314, lower back surface 16352, and upper back surface 16356. Third cover surface 16391 may cut across a top of toe 16314, and drop along a curved edge of toe 16314, and cut back across a bottom end of toe 16314. As illustrated, third cover surface 16391 may provide a uniform appearance to modular golf club head 16300 in a locked configuration. It should be appreciated that slidable cover 16330 and third cover surface 16391 may be differently shaped, sized, and/or dimensioned to provide a uniform appearance to modular golf club head 16300 when in a locked configuration. For example, in some embodiments, third cover surface 16391 may cut across at a top of sole 16302, providing a rectangular look to slidable cover 16330. The corresponding parts of back 16350 and/or toe 16314 may be shaped, sized, and/or dimensioned to receive at least part of slidable cover 16330 corresponding to third cover surface 16391. In embodiments, slidable cover 16330 may have some features similar to, or the same as, features of other covers disclosed herein.

A top end of slidable cover 16330 may be near upper back surface 16356. The bottom end of slidable cover 16330 may be near lower back surface 16352. The heel end of slidable cover 16330 may be near parts of back 16350 and second cover surface 16389. The toe end of slidable cover 16330 may end near third cover surface 16391 and toc 16314.

Slidable cover 16330 may cover at least part of recessed channel 16326. As illustrated, a gap may be present to view a position of movable weight 16328. In some embodiments, there may be less of a vertical gap between a bottom of slidable cover 16330 and a top of lower back surface 16352, and cover notches 16338 may provide the only gap to see the fixed position of movable weight 16328. Cover notches 16338 may be curved sections of slidable cover 16330 that allow a user to view a position of movable weight 16328. In some embodiments, there may not be cover notches 16338 and there may be no part of recessed channel 16326 exposed. That is slidable cover 16330 may fully cover recessed channel 16326. In such embodiments, slidable cover 16330 may include one or more slots (not shown). These slots may provide visual indication of a position of movable weight 16328 in a locked configuration. A window or other transparent or partially transparent material may be used to cover the slots. In embodiments, slidable cover 16330 may be transparent or partially transparent in certain sections allowing a user to view a position of movable weight 16328 in a locked configuration. Slidable cover 16330 may releasably secure movable weight 16328 within recessed channel 16326. In some examples, slidable cover 16330 may be slidingly engaged with body 16306 such that slidable cover 16330 is slidable over at least part of recessed channel 16326 along a sliding direction. Movable weight 16328 and slidable cover 16330 may be respectively shaped and sized such that slidable cover 16330 can slide past movable weight 16328 positioned in recessed channel 16326. In some examples, the position of movable weight 16328 within recessed channel 16326 may be secured by slidable cover 16330 and/or another mechanism, as discussed herein. Movable weight 16328 and slidable cover 16330 may be shaped and sized such that slidable cover 16330 is slidable past movable weight 16328 when movable weight 16328 is in a fixed position.

In some examples, movement of slidable cover 16330 may be confined to the sliding direction when slidable cover 16330 is slidingly engaged with body 16306. For example, slidable cover 16330 may be slidingly engaged with body 16306 such that it is blocked from moving in any direction substantially perpendicular to the sliding direction. In some examples, slidable cover 16330 may be positioned at least partially inside recessed channel 16326, and may be shaped and sized such that movement of slidable cover 16330 is confined to the sliding direction. For example, slidable cover 16330 may be shaped and sized such that it is blocked from moving out from recessed channel 16326 along a direction perpendicular to the sliding direction.

Body 16306 may include lower back surface 16352 and upper back surface 16356. Toe 16314, heel 16316, top 16303, the striking face, sole 16302, and back 16350 may define at least part of outer surface 16320 of the body 16306. Sole 16302 may extend rearward from the lower leading edge of the striking face to a rearward portion. Back 16350 may be positioned rearward from the striking face and may be coupled between a rearward portion of sole 16302 and the upper topline edge of striking face. Back 16350 may include all surfaces of outer surface 16320 of body 16306 that are both between the rearward portion of sole 16302 and top 16303 and also between toe 16314 and heel 16316. In this example, back 16350 may include lower back surface 16352 and upper back surface 16356. Lower back surface 16352 may extend to at least an edge of sole 16302. Part of upper back surface 16356 may be recessed. For example, a part of the perimeter of this recessed surface may include a curved area that may follow a shape of top 16303 along upper back surface 16356. A part of the perimeter of this recessed surface may include a diagonal edge that cuts across on the heel-ward side of upper back surface 16356, which may form part of recessed channel 16326. A part of the perimeter of this recessed surface may include upper back surface 16356 dropping down vertically and then cutting across in a toe-to-heel direction. A part of the perimeter of this recessed surface may include a circular curve that goes to a diagonal edge near toe 16314 and lower back surface 16352. A part of the perimeter of this recessed surface may include a curved edge that curves upward along toc 16314, following a shape of toe 16314. A part of the perimeter of this recessed surface may include a horizontal surface near upper back surface 16356 and toe 16314 that drops down and then creates a horizontal surface that forms a perimeter of recessed channel 16326. Body 16306 may have some features similar to, or the same as, features of other bodies disclosed herein.

Figure 60:
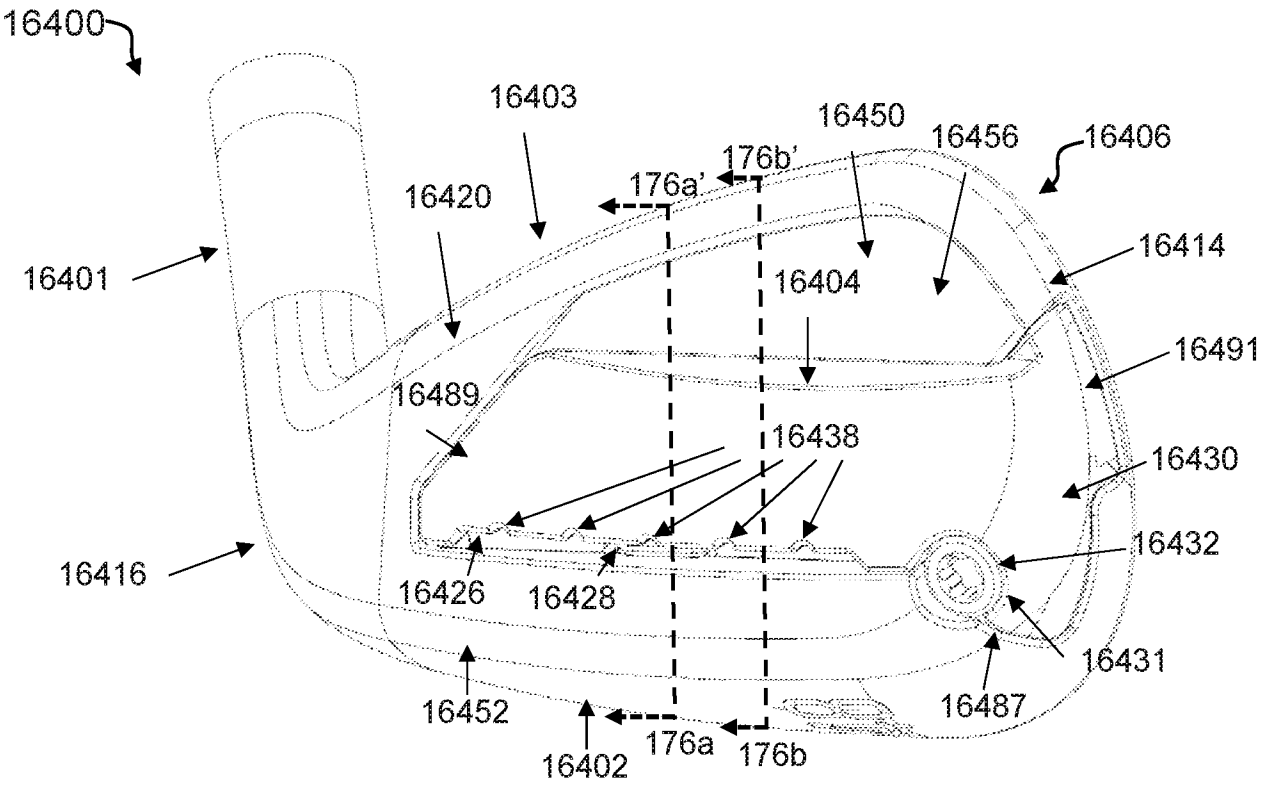
FIG. 60 illustrates a perspective view of a golf club head, in accordance with one or more embodiments of the presently disclosed technology.

FIG. 60 illustrates a perspective view of a golf club head, in accordance with one or more embodiments of the presently disclosed technology. FIG. 60 illustrates components that may be the same or substantially similar to components illustrated in FIG. 59. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, and/or third cover surface 16391 may be the same as or substantially similar to modular golf club head 16400, hosel 16401, sole 16402, top 16403, weight assembly 16404, body 16406, toe 16414, heel 16416, outer surface 16420, recessed channel 16426, movable weight 16428, slidable cover 16430, cover through hole 16431, fastener 16432, cover notches 16438, back 16450, lower back surface 16452, upper back surface 16456, first cover surface 16487, second cover surface 16489, and/or third cover surface 16491. As illustrated, the uniform appearance provided by the weight assembly and/or slidable cover 16430 may be more apparent in this view. For example, it may be more apparent that third cover surface 16491 wraps around a part of toe 16414. Parts of lower back surface 16452 and/or other components may be more apparent in this view, including the cut-out to allow fastener 16432 to be fastened.

Figure 61:
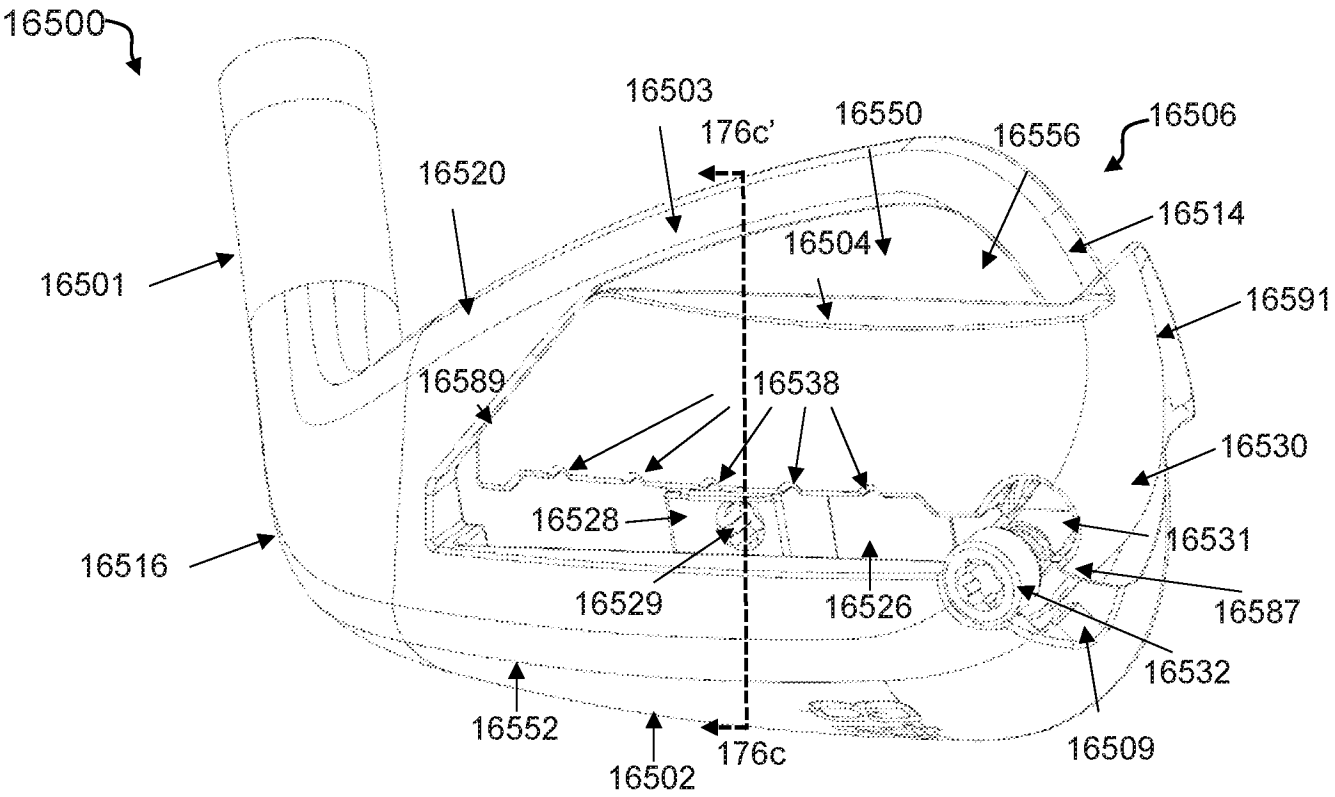
FIG. 61 illustrates a perspective view of a golf club head, in accordance with one or more embodiments of the presently disclosed technology.

FIG. 61 illustrates a perspective view of a golf club head, in accordance with one or more embodiments of the presently disclosed technology. FIG. 61 illustrates components that may be the same or substantially similar to components illustrated in FIG. 59. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, and/or third cover surface 16391 may be the same as or substantially similar to modular golf club head 16500, hosel 16501, sole 16502, top 16503, weight assembly 16504, body 16506, toe 16514, heel 16516, outer surface 16520, recessed channel 16526, movable weight 16528, slidable cover 16530, cover through hole 16531, fastener 16532, cover notches 16538, back 16550, lower back surface 16552, upper back surface 16556, first cover surface 16587, second cover surface 16589, and/or third cover surface 16591. As illustrated, modular golf club head 16500 may be in a partially unlocked configuration. Slidable cover 16530 may slide in a diagonal direction (e.g., upward and toe-ward to be unlocked). Part of cover through hole 16531, fastener 16532, and/or other components may be more apparent in this view. Part of movable weight 16528 may be more apparent in this view. Movable weight 16528 may include weight through hole 16529. Weight through hole 16529 may be shaped, sized, and/or dimensioned to fit a tool to adjust a position of movable weight 16528. In a partially unlocked configuration, weight through hole 16529 may be accessible for the tool to adjust the position of movable weight 16528. For example, part of a tool, such as a screwdriver, may fit in weight through hole 16529 and move movable weight 16528 heel-ward or toe-ward. In some embodiments, movable weight 16528 may need to be lifted and disengaged from a bottom of recessed channel 16526 and/or other mechanisms keeping movable weight 16528 in a fixed position. After being disengaged, screwdriver may be able to slide movable weight 16528 heel-ward or toe-ward along recessed channel 16526. As illustrated, part of recessed channel 16526 may be more apparent. First recessed channel surface 16509 may be more apparent in this view. Slidable cover 16530 may rest on at least part of first recessed channel surface 16509. First recessed channel surface 16509 may be shaped, sized, and/or dimensioned to receive part of slidable cover 16530.

In a locked configuration, third cover surface 16591 may apply face-ward and/or heel-ward pressure to slidable cover 16530 ward. In a locked configuration, second cover surface 16589 may apply heel-ward and/or up-ward pressure to slidable cover 16530. In a locked configuration, first cover surface 16587 may apply bottom-ward and/or heel-ward pressure to slidable cover 16530. Other elements may apply pressure to slidable cover 16530 in a locked configuration which may help secure slidable cover 16530 and prevent unwanted movement and/or rattling.

Figure 62:
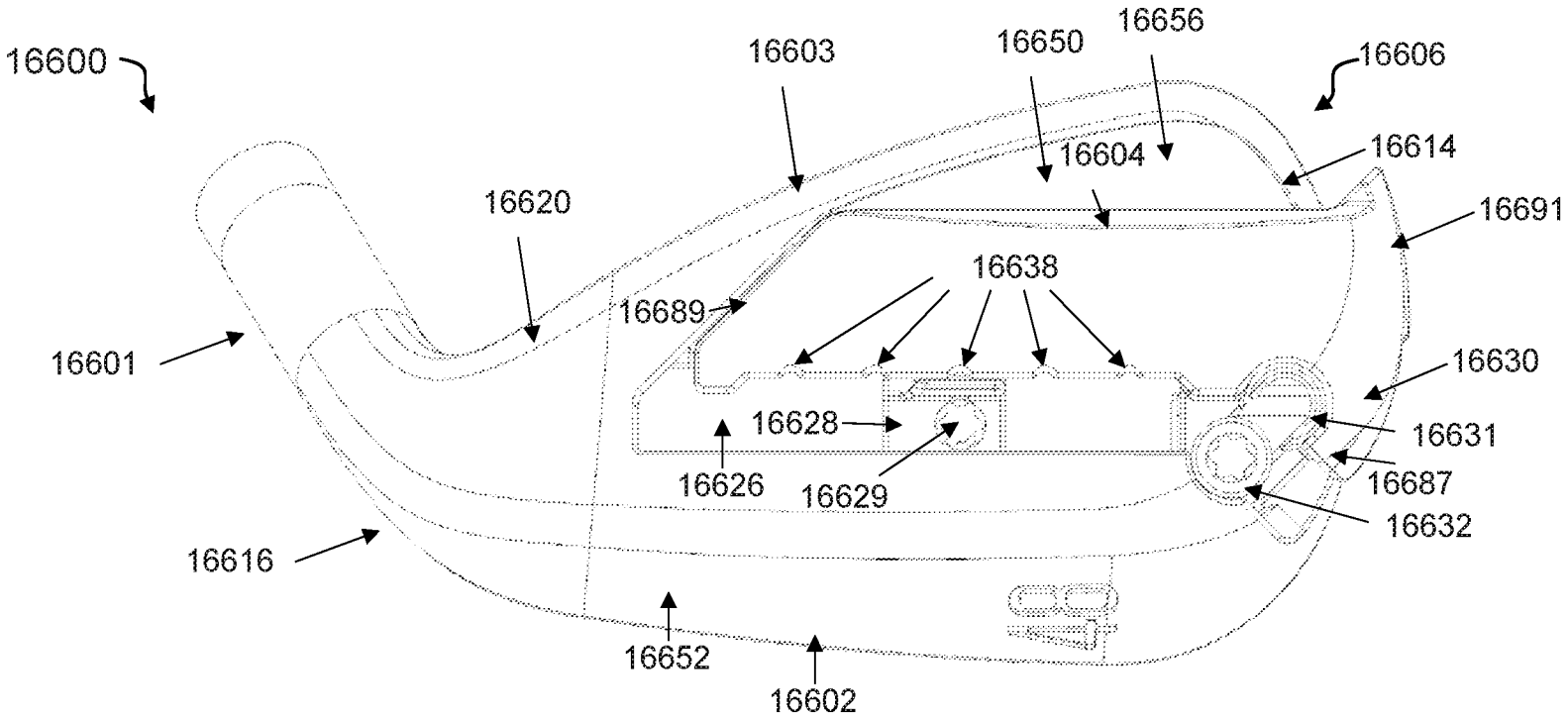
FIG. 62 illustrates a back view of a golf club head, in accordance with one or more embodiments of the presently disclosed technology.

FIG. 62 illustrates a back view of a golf club head, in accordance with one or more embodiments of the presently disclosed technology. FIG. 62 illustrates components that may be the same or substantially similar to components illustrated in FIGS. 59 and 61. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, third cover surface 16391, and/or weight through hole 16529 may be the same as or substantially similar to modular golf club head 16600, hosel 16601, sole 16602, top 16603, weight assembly 16604, body 16606, toe 16614, heel 16616, outer surface 16620, recessed channel 16626, movable weight 16628, slidable cover 16630, cover through hole 16631, fastener 16632, cover notches 16638, back 16650, lower back surface 16652, upper back surface 16656, first cover surface 16687, second cover surface 16689, third cover surface 16691, and/or weight through hole 16629. As illustrated, modular golf club head 16600 may be in the partially unlocked configuration. Part of cover through hole 16631, fastener 16632, and/or other components may be more apparent in this view. Part of movable weight 16628 and weight through hole 16629 may be more apparent in this view. As illustrated, part of recessed channel 16626 may be more apparent.

Figure 63:
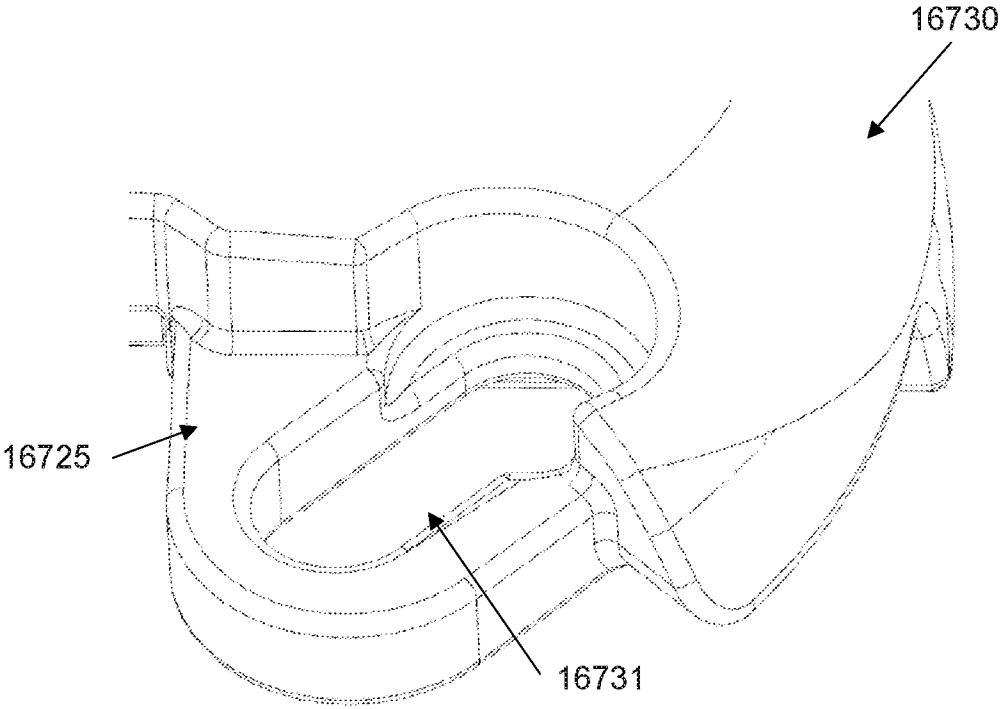
FIG. 63 illustrates a partial perspective view of a cover, in accordance with one or more embodiments of the presently disclosed technology.

FIG. 63 illustrates a partial perspective view of a cover, in accordance with one or more embodiments of the presently disclosed technology. FIG. 63 illustrates components that may be the same or substantially similar to components illustrated in FIG. 59. For example, slidable cover 16330 and/or cover through hole 16331 may be the same as or substantially similar to slidable cover 16730 and/or cover through hole 16731. As illustrated, a part of cover through hole 16731 and/or other components may be more apparent. Cover through hole 16731 may be oval. This may allow for the fastener to be partially unfastened to allow for sliding of slidable cover 16730. In the partially unlocked configuration, the weight may be moved without fully removing cover, as discussed herein. The size of cover through hole 16731 may provide enough access to the recessed channel in the partially unlocked configuration to allow for the weight to be moved using a tool. This may also prevent lost or damaged components, such as, for example, slidable cover 16730, the weight, the fastener, and/or other components.

Cover through hole 16731 may be further recessed where the fastener would fasten slidable cover 16730 to the body in a locked configuration. This may provide a secure fit for slidable cover 16730 to the body. This may help prevent unwanted movement of slidable cover 16730 and the weight in a locked configuration. After sliding slidable cover 16730 into a partially unlocked configuration, the fastener may be refastened in the partially unlocked configuration to allow for a user to adjust a position of the weight without needing to hold up slidable cover 16730. Slidable cover 16730 and/or cover through hole 16731 may include extension 16725. Extension 16725 may be an extension of cover through hole 16731 and/or slidable cover 16730. Extension 16725 may allow for slidable cover 16730 to slide into a partially unlocked configuration. The partially unlocked configuration may allow a user to adjust a position of the weight. An end of cover through hole 16731 opposite of where the fastener would be located in a locked configuration (e.g., the heel-ward and bottom-ward most direction) may not be recessed because a looser fit may be acceptable when adjusting the weight. In embodiments, this opposite end may be recessed. In some embodiments, extension 16725 may be differently shaped, sized, and/or dimensioned without departing from the spirit and scope of the presently disclosed technology. For example, extension 16725 may not exist. Extension 16725 may be rectangular, triangular, may be recessed on both ends to allow for the fastener to be fastened deeper, shorter, and/or other shapes, sizes, and/or dimensions.

Figure 64:
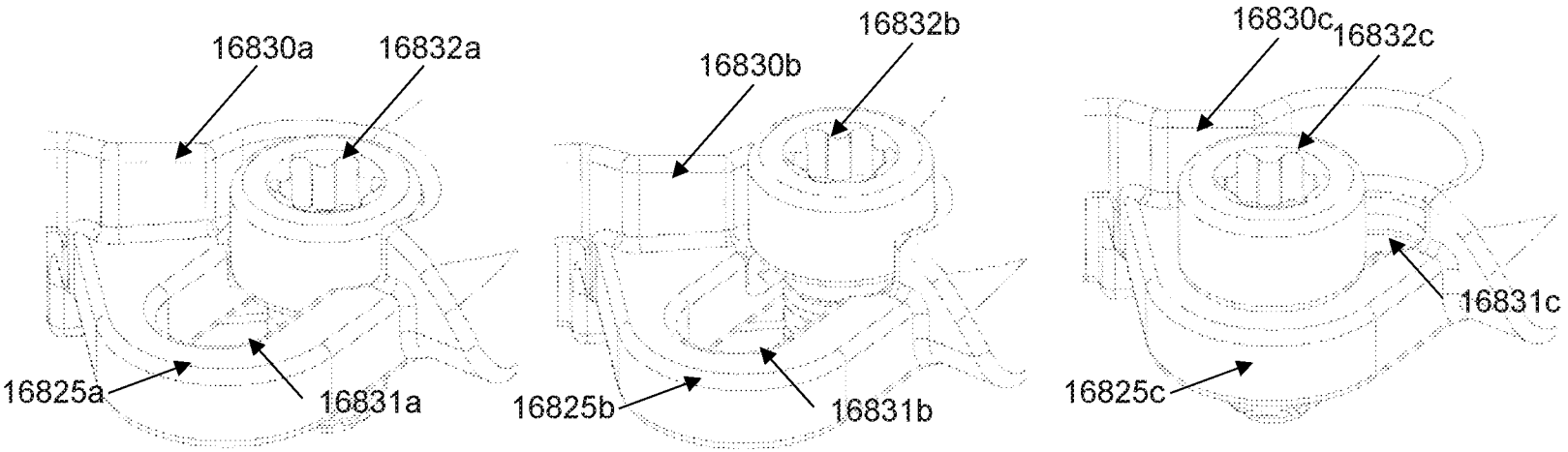
FIG. 64 illustrates partial perspective views of covers, in accordance with one or more embodiments of the presently disclosed technology.

FIG. 64 illustrates partial perspective views of covers, in accordance with one or more embodiments of the presently disclosed technology. FIG. 64 illustrates components that may be the same or substantially similar to components illustrated in FIGS. 59 and 63. For example, slidable cover 16330, cover through hole 16331, fastener 16332, and/or extension 16725 may be the same as or substantially similar to slidable covers 16830*a*, 16830*b*, 16830*c*, cover through holes 16831*a*, 16831*b*, 16831*c*, fasteners 16832*a*, 16832*b*, 16832*c*, and/or extensions 16825*a*, 16825*b*, 16825*c*. Slidable cover 16830*a* may be in a locked configuration. Fastener 16832*a* may be seated in a recessed portion of cover through hole 16831*a*. Fastener 16832*a* may be on a first end of extension 16825*a*. Slidable cover 16830*b* may be in a partially unfastened configuration. Fastener 16832*b* may be unseated from the recessed portion of cover through hole 16831*b*. Fastener 16832*b* may be on a first end of extension 16825*b*. Slidable cover 16830*c* may be in a partially unlocked configuration. Slidable cover 16830*c* may slide diagonally to move into this position. Fastener 16832*c* may be seated on top of a second end of extension 16825*b* in cover through hole 16831*c*.

Figure 65:
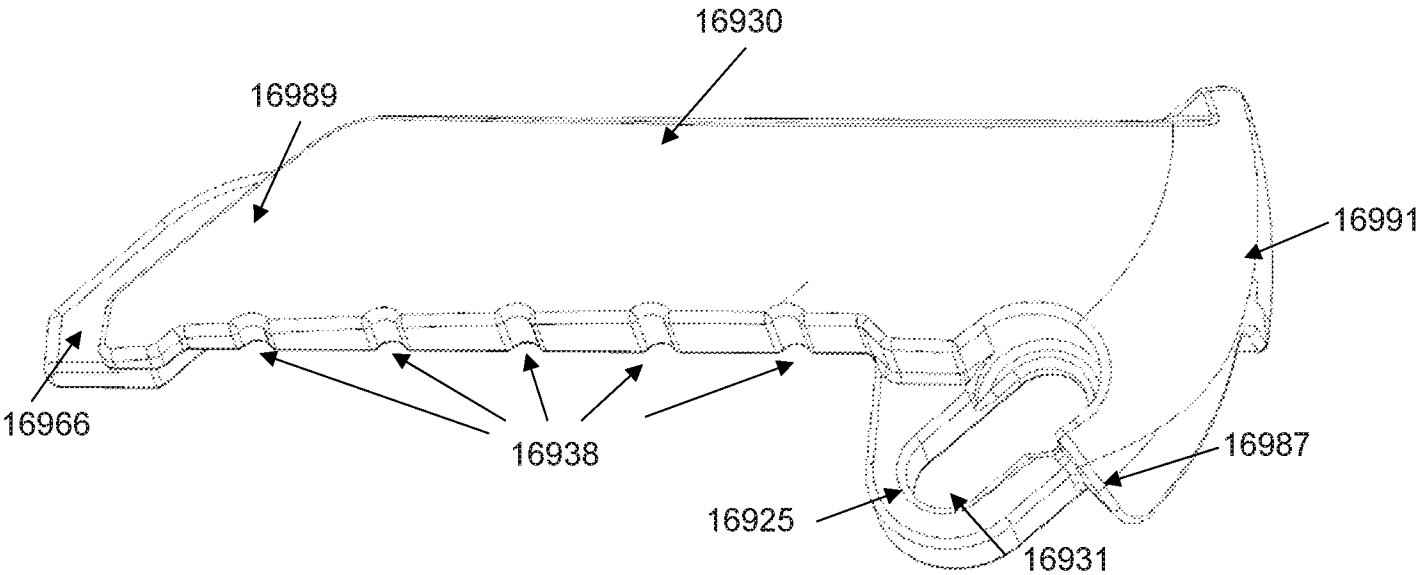
FIG. 65 illustrates a back view of a cover, in accordance with one or more embodiments of the presently disclosed technology.

FIG. 65 illustrates a back view of a cover, in accordance with one or more embodiments of the presently disclosed technology. FIG. 65 illustrates components that may be the same or substantially similar to components illustrated in FIGS. 59 and 63. For example, slidable cover 16330, cover through hole 16331, cover notches 16338, first cover surface 16387, second cover surface 16389, third cover surface 16391, and/or extension 16725 may be the same as or substantially similar to slidable cover 16930, cover through hole 16931, cover notches 16938, first cover surface 16987, second cover surface 16989, third cover surface 16991, and/or extension 16925. A part of slidable cover 16930 and/or other components may be more apparent in this view. Slidable cover 16930 may include stepped protrusion 16966. Stepped protrusion 16966 may be on a heel end of slidable cover 16930. Stepped protrusion 16966 may have smaller dimensions than the part of slidable cover 16930 adjacent to stepped protrusion 16966. For example, stepped protrusion 16966 may have a smaller height and a smaller width. Stepped protrusion 16966 may fit behind a heel-ward end of the upper back surface. In a locked configuration with the fastener on a toe-end of slidable cover 16930, this may cause back-ward movement of a heel-end of slidable cover 16930. Stepped protrusion 16966 may counteract that movement by pushing back-ward against the heel-ward end of the upper back surface, or a top-heel-end of the back wall of the recessed channel. Stepped protrusion 16966 may help secure slidable cover 16930 to the body and prevent or virtually prevent rattling or movement of movable weight and slidable cover 16930 in a locked configuration. Stepped protrusion 16966 may prevent movement in a vertical direction, both upward and downward, and a front-to-back direction in a locked configuration. Stepped protrusion 16966 may not be visible or be virtually invisible in a locked configuration. In some embodiments, stepped protrusion 16966 may be longer or otherwise bigger to help secure slidable cover 16930 to body.

Figure 66:
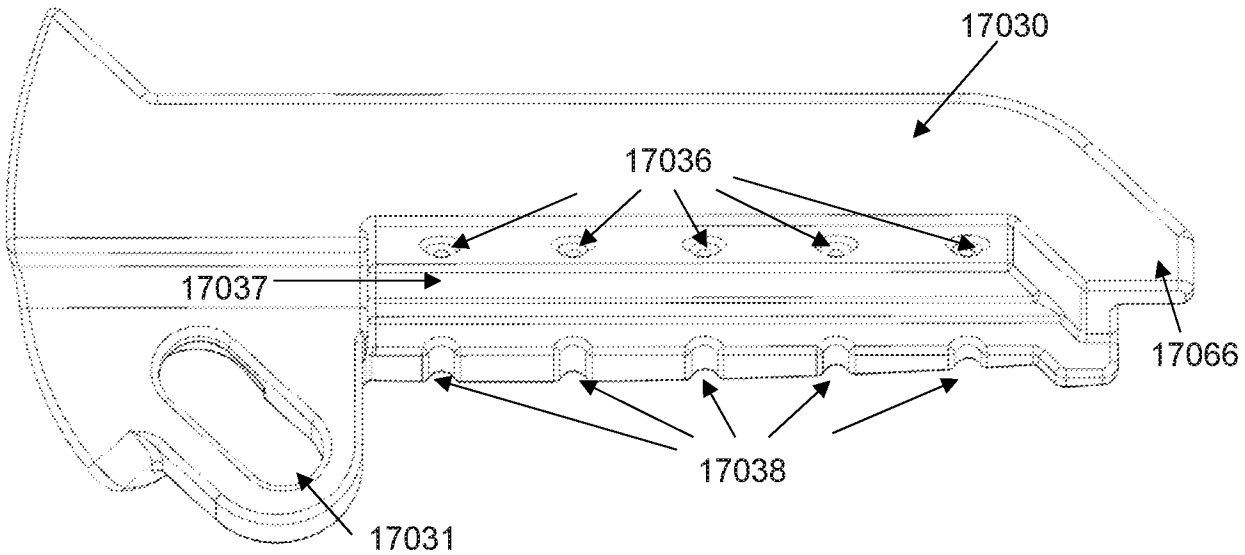
FIG. 66 illustrates an inside view of a cover, in accordance with one or more embodiments of the presently disclosed technology.

FIG. 66 illustrates an inside view of a cover, in accordance with one or more embodiments of the presently disclosed technology. FIG. 66 illustrates components that may be the same or substantially similar to components illustrated in FIGS. 59, 63, and 65. For example, slidable cover 16330, cover through hole 16331, cover notches 16338, first cover surface 16387, second cover surface 16389, third cover surface 16391, extension 16725, and/or stepped protrusion 16966 may be the same as or substantially similar to slidable cover 17030, cover through hole 17031, cover notches 17038, first cover surface, second cover surface, third cover surface, extension, and/or stepped protrusion 17066. Slidable cover 17030 may include cover protrusions 17036 and channel 17037. Cover protrusions 17036 may engage with a part of the weight to help secure the weight into a fixed position in a locked configuration. In some embodiments, the weight may include a groove or recess (at least shown as weight recess 17123 in FIG. 67) that fits with cover protrusions 17036. In embodiments, the weight, slidable cover 17030, and/or the recessed channel may include other mechanisms to help secure the weight in a locked configuration. For example, the weight may include protrusions and slidable cover 17030 may include grooves or recesses. The recessed channel and the weight may include a protrusion-recess system in addition to or without other systems. As illustrated, there may be five cover protrusions 17036, though it should be appreciated that there may be more or fewer cover protrusions 17036 without departing from the spirit and scope of the presently disclosed technology. In some embodiments, cover protrusions 17036 may be spaced more tightly, irregularly, and/or otherwise shaped, sized, and/or dimensioned without departing from the spirit and scope of the presently disclosed technology. The number of cover notches 17038 does not need to match the number of cover protrusions 17036. Cover notches 17038 may be spaced more tightly, irregularly, and/or otherwise shaped, sized, and/or dimensioned without departing from the spirit and scope of the presently disclosed technology. Channel 17037 may receive a part of the weight to slide between fixed positions. Channel 17037 and cover protrusions 17036 may be shaped, sized, and/or dimensioned to allow for slidable cover 17030 to slide away from the golf club head and provide enough room to adjust the weight into various fixed positions. Channel 17037 may match the distance provided by the recessed channel to move the weight. In some embodiments, channel 17037 may be longer or shorter or wider or deeper than a corresponding part of the recessed channel.

Figure 67:
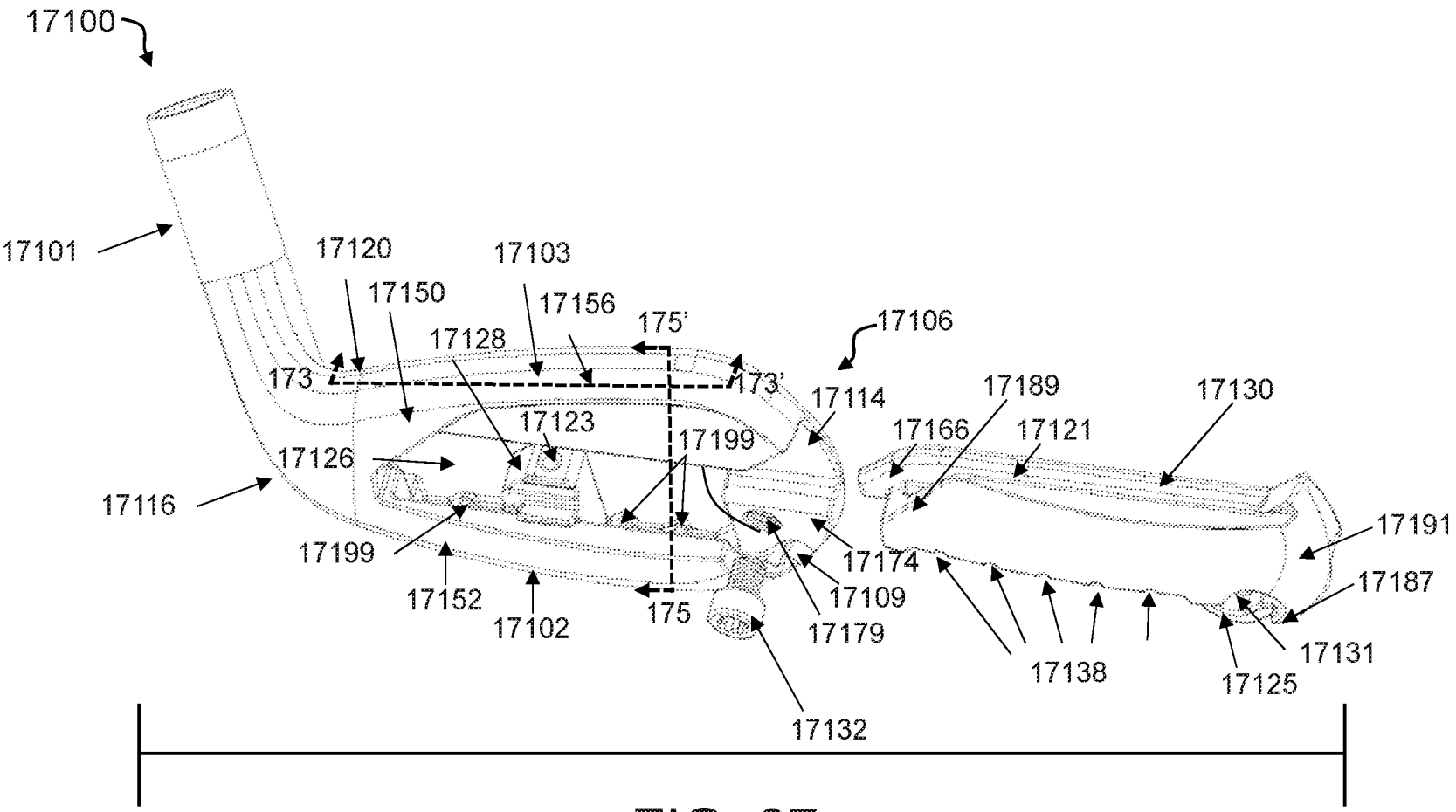
FIG. 67 illustrates an exploded perspective view of a golf club head, in accordance with one or more embodiments of the presently disclosed technology.

FIG. 67 illustrates an exploded perspective view of a golf club head, in accordance with one or more embodiments of the presently disclosed technology. FIG. 67 illustrates components that may be the same or substantially similar to components illustrated in FIGS. 59, 61, and 65. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, third cover surface 16391, weight through hole 16529, and/or stepped protrusion 16966 may be the same as or substantially similar to modular golf club head 17100, hosel 17101, sole 17102, top 17103, weight assembly, body 17106, toe 17114, heel 17116, outer surface 17120, recessed channel 17126, movable weight 17128, slidable cover 17130, cover through hole 17131, fastener 17132, cover notches 17138, back 17150, lower back surface 17152, upper back surface 17156, first cover surface 17187, second cover surface 17189, third cover surface 17191, weight through hole, and/or stepped protrusion 17166. As illustrated, modular golf club head 17100 may be in an unlocked configuration. Body 17106 may include recessed channel 17126. Recessed channel 17126 may include first recessed channel surface 17109, second member 17174, second member blind hole 17179, and recessed channel protrusions 17199. Parts of first recessed channel surface 17109 and/or other components may be more apparent in this view. As discussed herein, first recessed channel surface 17109 may receive and/or fit with slidable cover 17130, including near first cover surface 17187 and extension 17125. In the fully unlocked configuration, more of recessed channel 17126 may be apparent in this view. Recessed channel 17126 may not be part of outer surface 17120, and weight assembly may be removably couplable to body 17106 at recessed channel 17126. In some embodiments, recessed channel 17126 may be formed at least partially in back 17150 of modular golf club head 17100, for example, at least partially in lower back surface 17152 and upper back surface 17156.

Recessed channel 17126 may include a bottom, a top, a heel-side end, a toe-side end, a back wall, and a front wall. In some embodiments, the bottom of recessed channel 17126 may include components that help secure movable weight 17128 into a fixed position. For example, recessed channel protrusions 17199 may help secure movable weight 17128 into a fixed position in a locked configuration. The bottom of recessed channel 17126 may stop at, before, or after second member 17174. Recessed channel 17126 may slope upward before second member 17174. This may prevent movement of movable weight 17128. As illustrated, there is a narrow channel back-ward of second member 17174 that may be part of recessed channel 17126. In some embodiments, the bottom of recessed channel 17126 may include second member 17174 and/or first recessed channel surface 17109. Second member 17174 may include second member blind hole 17179 to allow fastener 17132 to fasten slidable cover 17130 to body 17106. Second member blind hole 17179 may be threaded. Second member blind hole 17179 may not go through the entirety of body 17106. There may be enough width in second member blind hole 17179 to allow fastener 17132 to grip onto second member blind hole 17179 and secure slidable cover 17130 to body 17106. While illustrated as rectangular, it should be appreciated that second member 17174 may be any shape, including, for example, circular, triangular, asymmetrical, and/or other shapes, which allow for second member blind hole 17179. It should also be appreciated that second member 17174 may be variously shaped, sized, and/or dimensioned to fit with movable weight 17128 and slidable cover 17130. A top of second member 17174 may interface with parts of slidable cover 17130. Parts of slidable cover 17130 may sit on a top of second member 17174 in a locked configuration. This may provide support between slidable cover 17130 and body 17106 by providing surface area between these components. The bottom of recessed channel 17126 may be closer to a bottom of modular golf club head 17100 than first recessed channel surface 17109. In embodiments, the bottom of recessed channel 17126 and first recessed channel surface 17109 may be the same height or different heights. The bottom of recessed channel 17126 may be differently shaped, sized, and/or dimensioned to securely interface with movable weight 17128 and slidable cover 17130. First recessed channel surface 17109 may provide structural support for slidable cover 17130 in a locked configuration.

The top of recessed channel 17126 may partially cover the bottom of recessed channel 17126. As illustrated, the top may only cover a small percentage of the bottom of recessed channel 17126. For example, the top may cover a front side of recessed channel 17126 adjacent to parts of upper back surface 17156, a heel side of recessed channel 17126, and a toe side of recessed channel 17126. In embodiments, part of back 17150 between upper back surface 17156 and the striking face may be hollow, such that recessed channel 17126 has extra volume. In some embodiments, the top may fully cover the bottom of recessed channel 17126. The top of recessed channel 17126 may be differently shaped, sized, and/or dimensioned to securely interface with slidable cover 17130. The heel-side end of recessed channel 17126 may be differently shaped, sized, and/or dimensioned to fit with movable weight 17128 and slidable cover 17130. The heel-side end may be recessed, curved, sloped, and/or flush. In embodiments, the heel-side end may include a hollow portion heel-ward of an edge of upper back surface 17156. The toe-side end of recessed channel 17126 may be differently shaped, sized, and/or dimensioned to fit with movable weight 17128 and slidable cover 17130. Edges of toe-side end may be flared outward corresponding to the shape of a toe-end of slidable cover 17130. Recessed channel 17126 may include a distance from the heel-side end to the toe-side end movable weight 17128 may travel along recessed channel 17126. This distance may be up to 150 mm, depending on a size of modular golf club head 17100. In some embodiments, the distance may be up to 100 mm, 200 mm, or 300 mm, including any values in between without departing from the spirit and scope of the presently disclosed technology. The distance that movable weight 17128 travels may allow a CG of modular golf club head 17100 to change up to about 10 mm along a heel-to-toe direction, or x-axis, based on the movement of movable weight 17128 from one end to another end of the distance. In some embodiments, the change in CG along an x-direction may be 5 mm, 15 mm, 25 mm, and so on, including any values in between without departing from the spirit and scope of the presently disclosed technology. It should be appreciated that small CG changes (e.g., 1 mm to 5 mm) may have a significant impact on the ball flight caused by the modular golf club head. Moving movable weight 17128 in a heel-ward most position may cause draws (e.g., right to left for a right-handed player). Moving movable weight 17128 in a toe-ward most position may cause fades (e.g., left to right for a right-handed player). It should be appreciated that CG changes above 5 mm may have more of an impact on ball flight.

Figure 83:
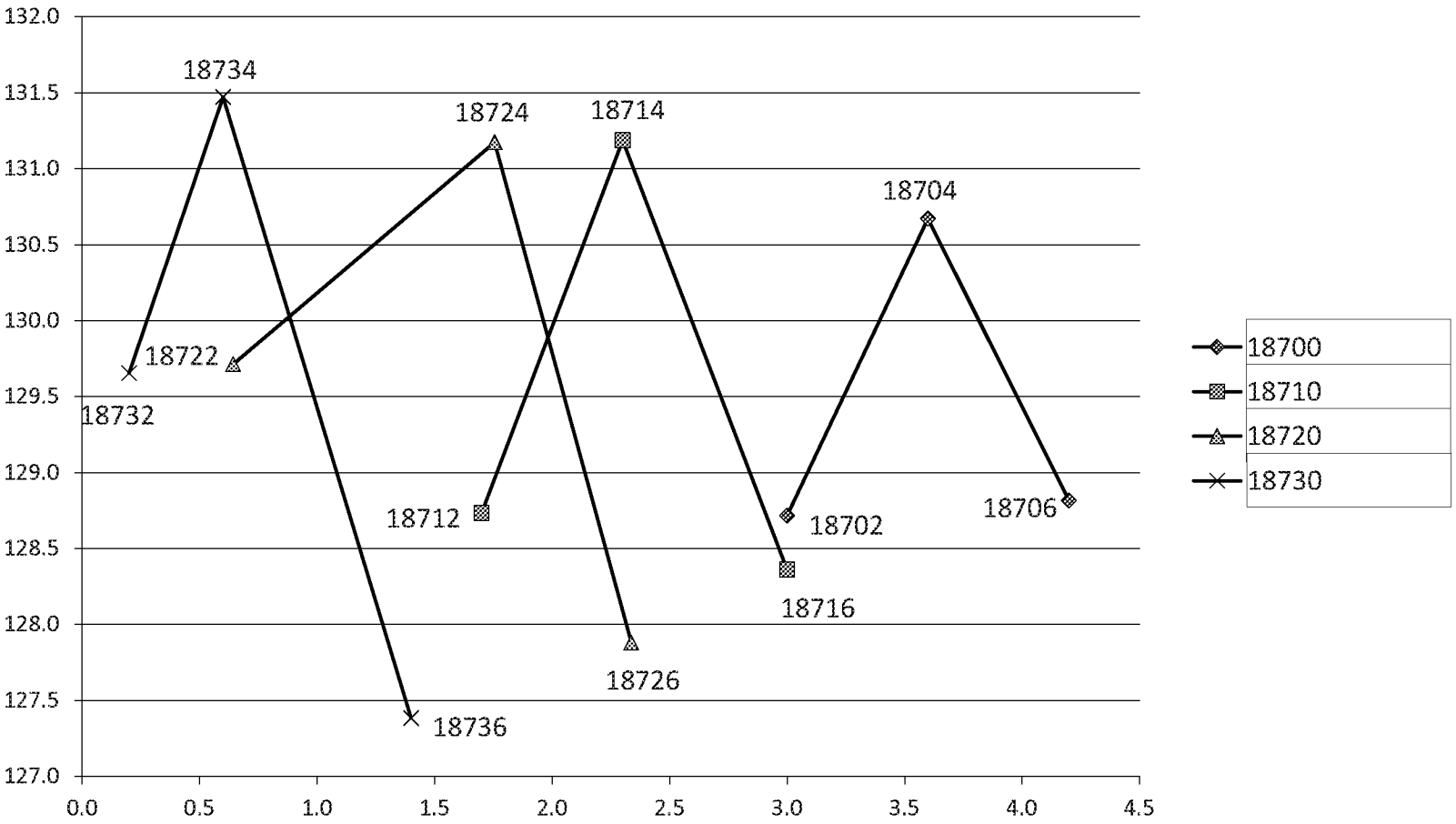
FIG. 83 illustrates the effect of changing CG along an x-axis, in accordance with one or more embodiments of the presently disclosed technology.

Referring to FIGS. 83-190, different lofted clubs were used for each figure, and moveable weight 17128 was moved along four different fixed positions from a toe-ward most point of recessed channel 17126 to a heel-ward most point of recessed channel 17126. The left-most data points for each fixed position (e.g., point 18902 for fixed position 18900) may correspond to a ball hit on a heel of a golf club. The center data point for each fixed position (e.g., point 18904 for fixed position 18900) may correspond to a ball hit in the center of a golf club. The right-most data point for each fixed position (e.g., point 18906 for fixed position 18900) may correspond to a ball hit on the toe of a golf club. Referring to FIG. 83, which illustrates the effect of changing CG along an x-axis, in accordance with one or more embodiments of the presently disclosed technology, data points 18702, 18704, 18706 may correspond to ball strikes with a movable weight in a fixed position 18700. Fixed position 18700 may be the toe-most point of a recessed channel. As illustrated, point 18702 may carry about 128.7 yards and right about 3.0 yards. Point 18704 may carry about 130.6 yards and right about 3.5 yards. Point 18706 may carry about 128.8 yards and right about 4.2 yards. Fixed position 18710 of the movable weight may be heel-ward of the toe-most point of a recessed channel. As illustrated, point 18712 may carry about 128.7 yards and right about 1.7 yards. Point 18714 may carry about 131.2 yards and right about 2.3 yards. Point 18716 may carry about 128.4 yards and right about 3.0 yards. Fixed position 18720 of the movable weight may be toe-ward of the heel-most point of a recessed channel. As illustrated, point 18722 may carry about 129.7 yards and right about 0.5 yards. Point 18724 may carry about 131.2 yards and right about 1.7 yards. Point 18726 may carry about 127.9 yards and right about 2.3 yards. Fixed position 18730 of the movable weight may be the heel-most point of a recessed channel. As illustrated, point 18732 may carry about 129.6 yards and right about 0.2 yards. Point 18734 may carry about 131.5 yards and right about 0.7 yards. Point 18736 may carry about 127.4 yards and right about 1.4 yards. The total CG-x change between fixed position 18700 and fixed position 18730 may be about 2.4 mm. For a strike from the heel of the golf club head between fixed position 18700 and fixed position 18730, the carry changes about 0.9 yards and the left-to-right movement changes about 2.8 yards. For a strike from the center of the golf club head between fixed position 18700 and fixed position 18730, the carry changes about 0.9 yards and the left-to-right movement changes about 2.8 yards. For a strike from the toe of the golf club head between fixed position 18700 and fixed position 18730, the carry changes about 1.4 yards and the left-to-right movement changes about 2.8 yards.

Figure 84:
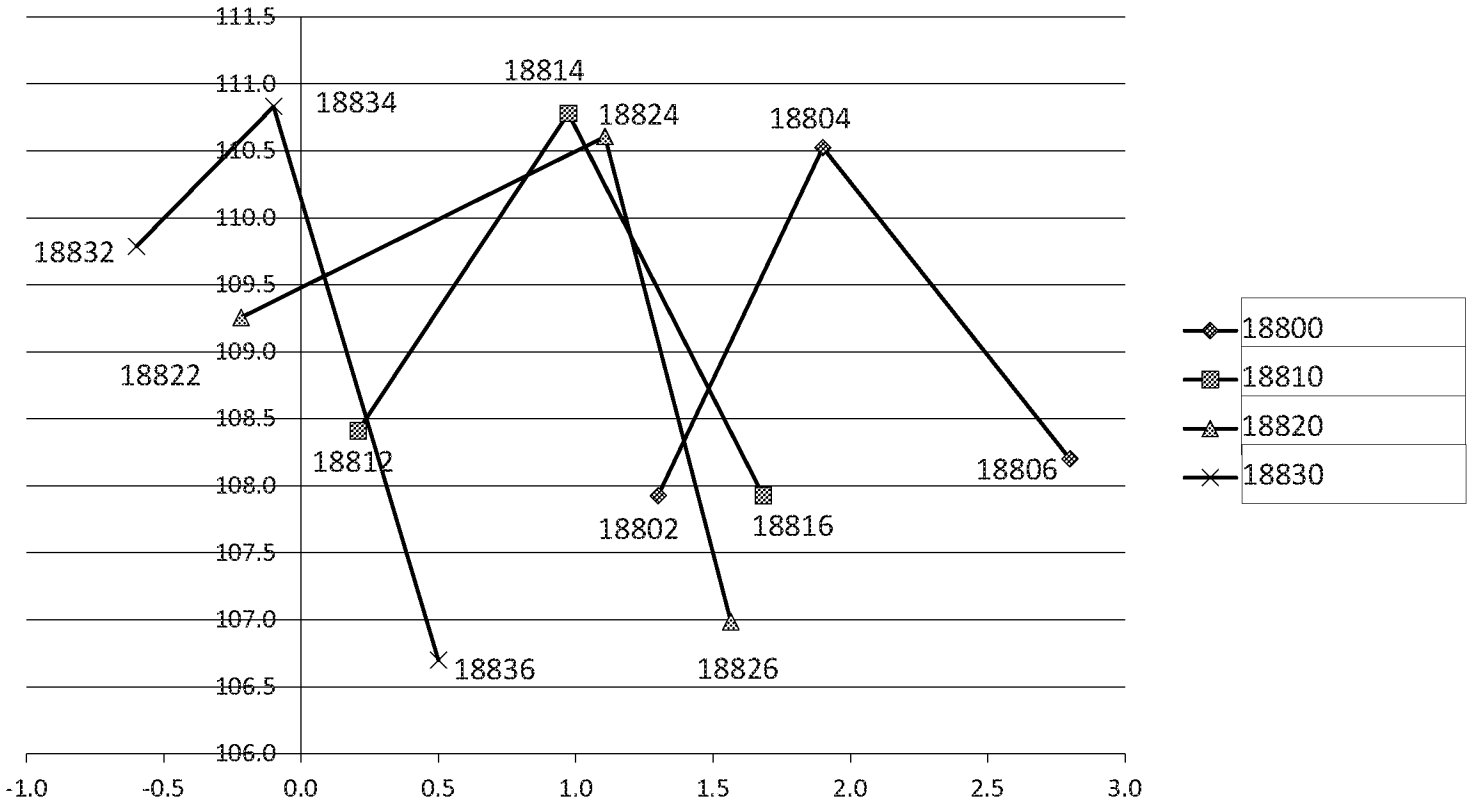
FIG. 84 illustrates the effect of changing CG along an x-axis, in accordance with one or more embodiments of the presently disclosed technology.

FIG. 84 illustrates the effect of changing CG along an x-axis, in accordance with one or more embodiments of the presently disclosed technology. The test golf club head may be lofted higher than the golf club head used to gather data for FIG. 83. Data points 18802, 18804, 18806 may correspond to ball strikes with a movable weight in a fixed position 18800. Fixed position 18800 may be the toe-most point of a recessed channel. As illustrated, point 18802 may carry about 107.9 yards and right about 1.3 yards. Point 18804 may carry about 110.5 yards and right about 1.9 yards. Point 18806 may carry about 108.2 yards and right about 2.7 yards. Fixed position 18810 of the movable weight may be heel-ward of the toe-most point of a recessed channel. As illustrated, point 18812 may carry about 108.4 yards and right about 0.3 yards. Point 18814 may carry about 110.7 yards and right about 0.9 yards. Point 18816 may carry about 107.9 yards and right about 1.4 yards. Fixed position 18820 of the movable weight may be toe-ward of the heel-most point of a recessed channel. As illustrated, point 18822 may carry about 109.2 yards and left about 0.2 yards. Point 18824 may carry about 110.6 yards and right about 1.1 yards. Point 18826 may carry about 107.0 yards and right about 1.6 yards. Fixed position 18830 of the movable weight may be the heel-most point of a recessed channel. As illustrated, point 18832 may carry about 109.7 yards and left about 0.7 yards. Point 18834 may carry about 110.9 yards and left about 0.1 yards. Point 18836 may carry about 106.6 yards and right about 0.5 yards. The total CG-x change between fixed position 18800 and fixed position 18830 may be about 2.4 mm. For a strike from the heel of the golf club head between fixed position 18800 and fixed position 18830, the carry changes about 2.8 yards and the left-to-right movement changes about 0.6 yards. For a strike from the center of the golf club head between fixed position 18800 and fixed position 18830, the carry changes about 0.4 yards and the left-to-right movement changes about 1.8 yards. For a strike from the toe of the golf club head between fixed position 18800 and fixed position 18830, the carry changes about 1.6 yards and the left-to-right movement changes about 2.2 yards.

Figure 85:
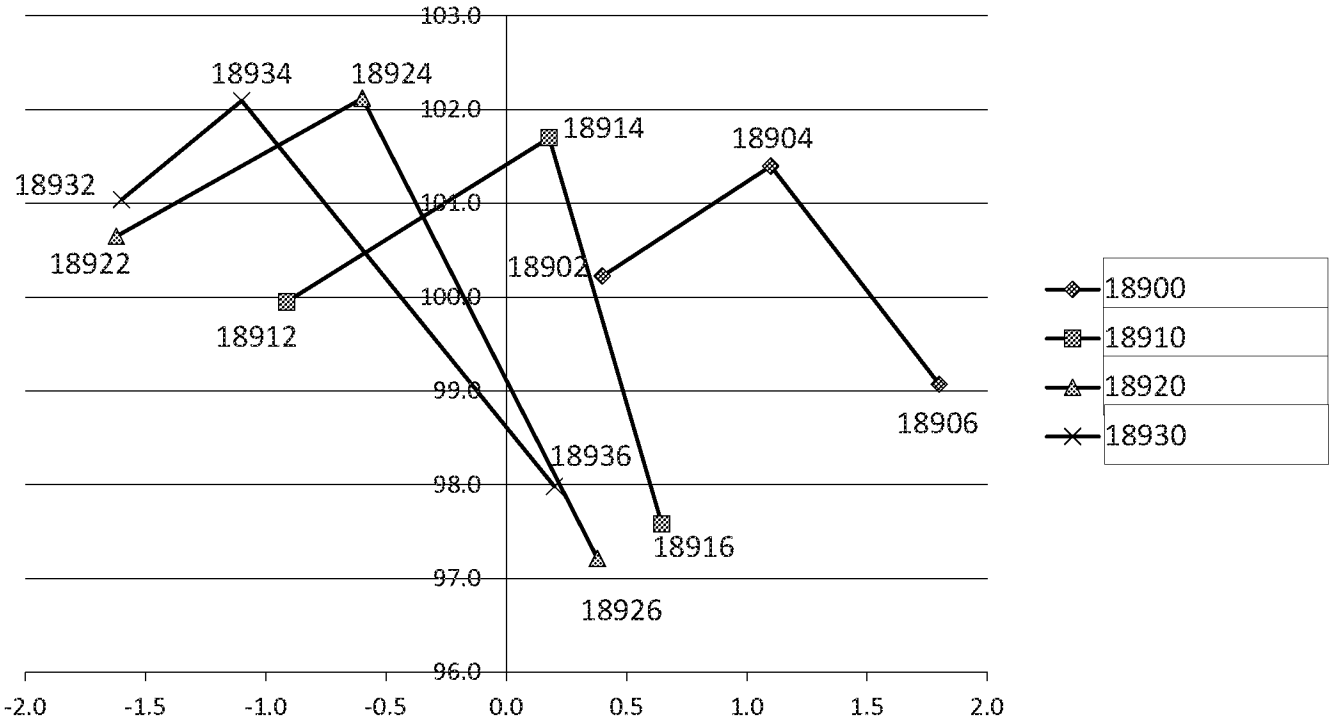
FIG. 85 illustrates the effect of changing CG along an x-axis, in accordance with one or more embodiments of the presently disclosed technology.

FIG. 85 illustrates the effect of changing CG along an x-axis, in accordance with one or more embodiments of the presently disclosed technology. The test golf club head may be lofted higher than the golf club head used to gather data for FIG. 84. Data points 18902, 18904, 18906 may correspond to ball strikes with a movable weight in a fixed position 18900. Fixed position 18900 may be the toe-most point of a recessed channel. As illustrated, point 18902 may carry about 100.2 yards and right about 0.5 yards. Point 18904 may carry about 101.3 yards and right about 1.1 yards. Point 18906 may carry about 99.1 yards and right about 1.8 yards. Fixed position 18910 of the movable weight may be heel-ward of the toe-most point of a recessed channel. As illustrated, point 18912 may carry about 100.0 yards and left about 0.9 yards. Point 18914 may carry about 101.8 yards and right about 0.2 yards. Point 18916 may carry about 97.6 yards and right about 0.6 yards. Fixed position 18920 of the movable weight may be toe-ward of the heel-most point of a recessed channel. As illustrated, point 18922 may carry about 100.6 yards and left about 1.7 yards. Point 18924 may carry about 102.1 yards and left about 0.6 yards. Point 18926 may carry about 97.2 yards and right about 0.4 yards. Fixed position 18930 of the movable weight may be the heel-most point of a recessed channel. As illustrated, point 18932 may carry about 101.1 yards and left about 1.7 yards. Point 18934 may carry about 102.1 yards and left about 1.1 yards. Point 18936 may carry about 98.0 yards and right about 0.2 yards. The total CG-x change between fixed position 18900 and fixed position 18930 may be about 2.4 mm. For a strike from the heel of the golf club head between fixed position 18900 and fixed position 18930, the carry changes about 0.9 yards and the left-to-right movement changes about 1.2 yards. For a strike from the center of the golf club head between fixed position 18900 and fixed position 18930, the carry changes about 0.9 yards and the left-to-right movement may have little change. For a strike from the toe of the golf club head between fixed position 18900 and fixed position 18930, the carry changes about 1.1 yards and the left-to-right movement changes about 1.6 yards.

Figure 86:
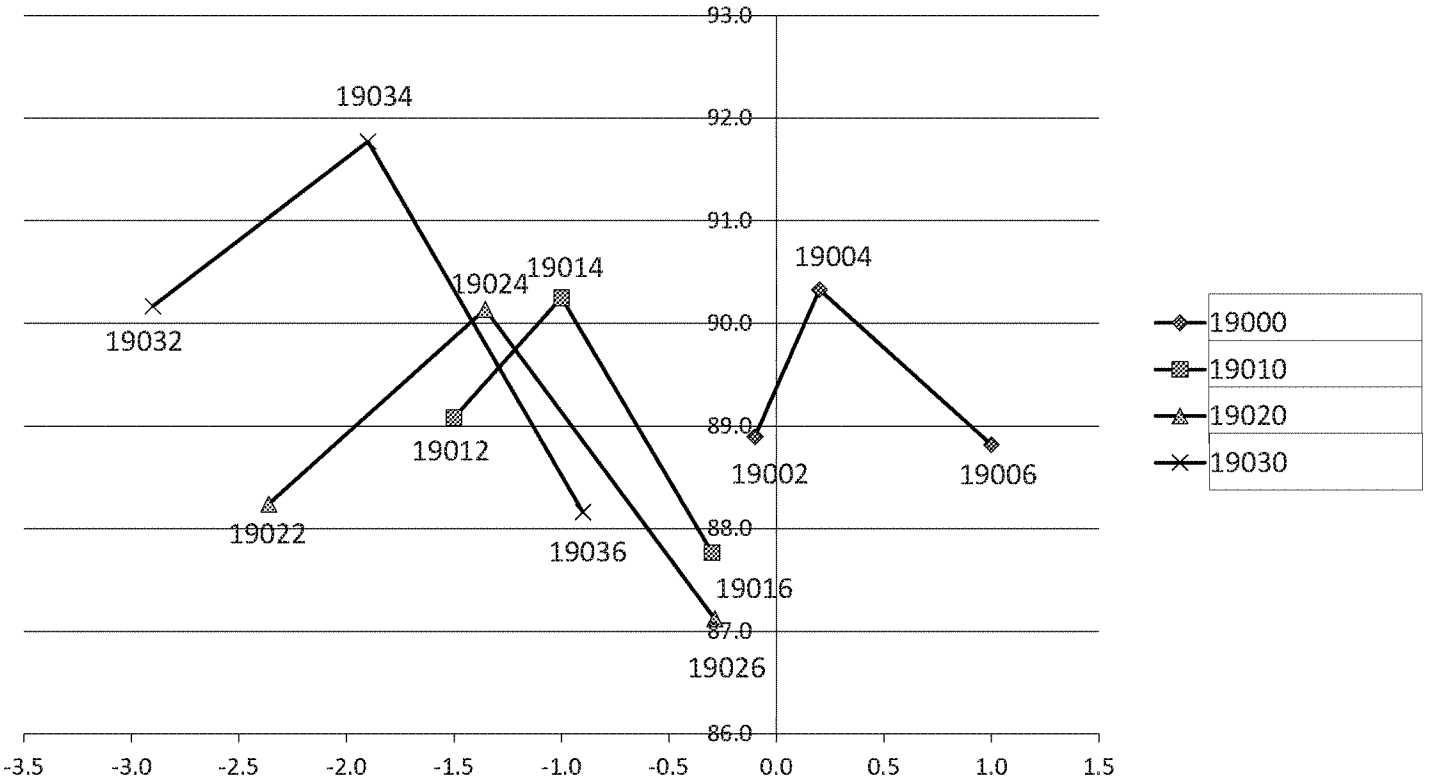
FIG. 86 illustrates the effect of changing CG along an x-axis, in accordance with one or more embodiments of the presently disclosed technology.

FIG. 86 illustrates the effect of changing CG along an x-axis, in accordance with one or more embodiments of the presently disclosed technology. The test golf club head may be lofted higher than the golf club head used to gather data for FIG. 85. Data points 19002, 19004, 19006 may correspond to ball strikes with a movable weight in a fixed position 19000. Fixed position 19000 may be the toe-most point of a recessed channel. As illustrated, point 19002 may carry about 88.9 yards and left about 0.1 yards. Point 19004 may carry about 90.3 yards and right about 0.2 yards. Point 19006 may carry about 88.8 yards and right about 1.0 yard. Fixed position 19010 of the movable weight may be heel-ward of the toe-most point of a recessed channel. As illustrated, point 19012 may carry about 89.1 yards and left about 1.5 yards. Point 19014 may carry about 90.2 yards and left about 1.0 yard. Point 19016 may carry about 87.8 yards and left about 0.3 yards. Fixed position 19020 of the movable weight may be toe-ward of the heel-most point of a recessed channel. As illustrated, point 19022 may carry about 88.2 yards and left about 0.5 yards. Point 19024 may carry about 90.1 yards and left about 1.4 yards. Point 19026 may carry about 87.1 yards and left about 0.3 yards. Fixed position 19030 of the movable weight may be the heel-most point of a recessed channel. As illustrated, point 19032 may carry about 90.2 yards and left about 3.0 yards. Point 19034 may carry about 91.8 yards and left about 1.9 yards. Point 19036 may carry about 88.2 yards and left about 0.9 yards. The total CG-x change between fixed position 19000 and fixed position 19030 may be about 2.4 mm. For a strike from the heel of the golf club head between fixed position 19000 and fixed position 19030, the carry changes about 1.3 yards and the left-to-right movement changes about 2.9 yards. For a strike from the center of the golf club head between fixed position 19000 and fixed position 19030, the carry changes about 1.5 yards and the left-to-right movement changes about 1.7 yards. For a strike from the toe of the golf club head between fixed position 19000 and fixed position 19030, the carry changes about 0.6 yards and the left-to-right movement changes about 0.1 yards.

Second member 17174 may provide a connection point for fastener 17132 via second member through second member blind hole 17179. Second member 17174 may help secure slidable cover 17130 to body 17106 via fastener 17132. The back wall of recessed channel 17126 may be recessed, sloped, curved, and/or flush. In embodiments, the back wall may include a hollow portion in front of lower back surface 17152. In some embodiments, the back wall may include notches (not shown) to help secure movable weight 17128 into a fixed position along recessed channel 17126. The back wall may be differently shaped, sized, and/or dimensioned to fit with movable weight 17128 and/or slidable cover 17130. The front wall may be differently shaped, sized, and/or dimensioned to fit with movable weight 17128 and/or slidable cover 17130. The front wall of recessed channel 17126 may be recessed, sloped, curved, and/or flush. In some embodiments, the front wall may include cover securing element and notches.

Movable weight 17128 may include weight recess 17123. A part of movable weight 17128 and/or other components may be more apparent in this view. Weight recess 17123 may engage with the cover protrusions to fix movable weight 17128 into a fixed position in a locked configuration. In combination with recessed channel protrusions 17199 and the weight protrusions, weight recess 17123 and the cover protrusions may securely fix movable weight 17128 into a fixed position in a locked configuration. In some embodiments, only one of these systems may be used to secure movable weight 17128 into a fixed position in a locked configuration.

Slidable cover 17130 may include a cover channel 17121 between a front surface of slidable cover 17130 and a back surface of slidable cover 17130. Cover channel 17121 may slide in a part of upper back surface 17156. Cover channel 17121 may help secure slidable cover 17130 in a locked configuration. This may prevent unwanted movement in an up and down direction, and a back-to-front direction. Cover channel 17121 may be shaped, sized, and/or dimensioned to fit upper back surface 17156. It should be appreciated that cover channel 17121 may be differently shaped, sized, and/or dimensioned without departing from the spirit and scope of the presently disclosed technology.

Figure 68:
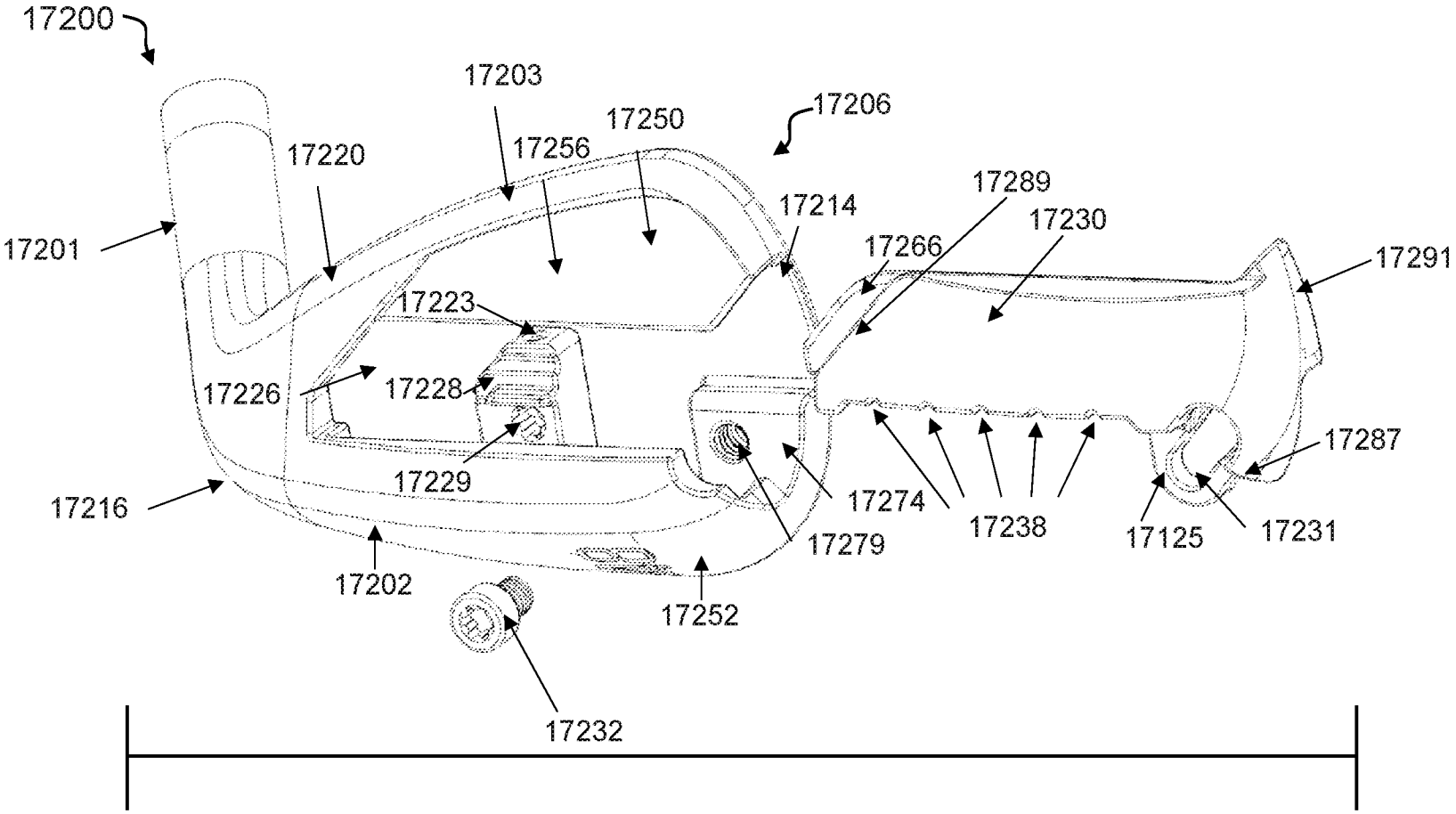
FIG. 68 illustrates an exploded perspective view of a golf club head, in accordance with one or more embodiments of the presently disclosed technology.

FIG. 68 illustrates an exploded perspective view of a golf club head, in accordance with one or more embodiments of the presently disclosed technology. FIG. 68 illustrates components that may be the same or substantially similar to components illustrated in FIGS. 59, 61, 65, and 67. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, third cover surface 16391, weight through hole 16529, stepped protrusion 16966, and/or weight recess 17123 may be the same as or substantially similar to modular golf club head 17200, hosel 17201, sole 17202, top 17203, weight assembly, body 17206, toe 17214, heel 17216, outer surface 17220, recessed channel 17226, movable weight 17228, slidable cover 17230, cover through hole 17231, fastener 17232, cover notches 17238, back 17250, lower back surface 17252, upper back surface 17256, first cover surface 17287, second cover surface 17289, third cover surface 17291, weight through hole 17229, stepped protrusion 17266, and/or weight recess 17223. A part of movable weight 17228 and/or other components may be more apparent in this view. Movable weight 17228 may be stepped along a back side. The shape of movable weight 17228 may correspond to a shape of an inside of slidable cover 17230. The shape of movable weight 17228 may help prevent rattling or unwanted movement of movable weight 17228 in a locked configuration. Parts of second member 17274, second member blind hole 17279, and/or other components may be more apparent in this view.

Figure 69:
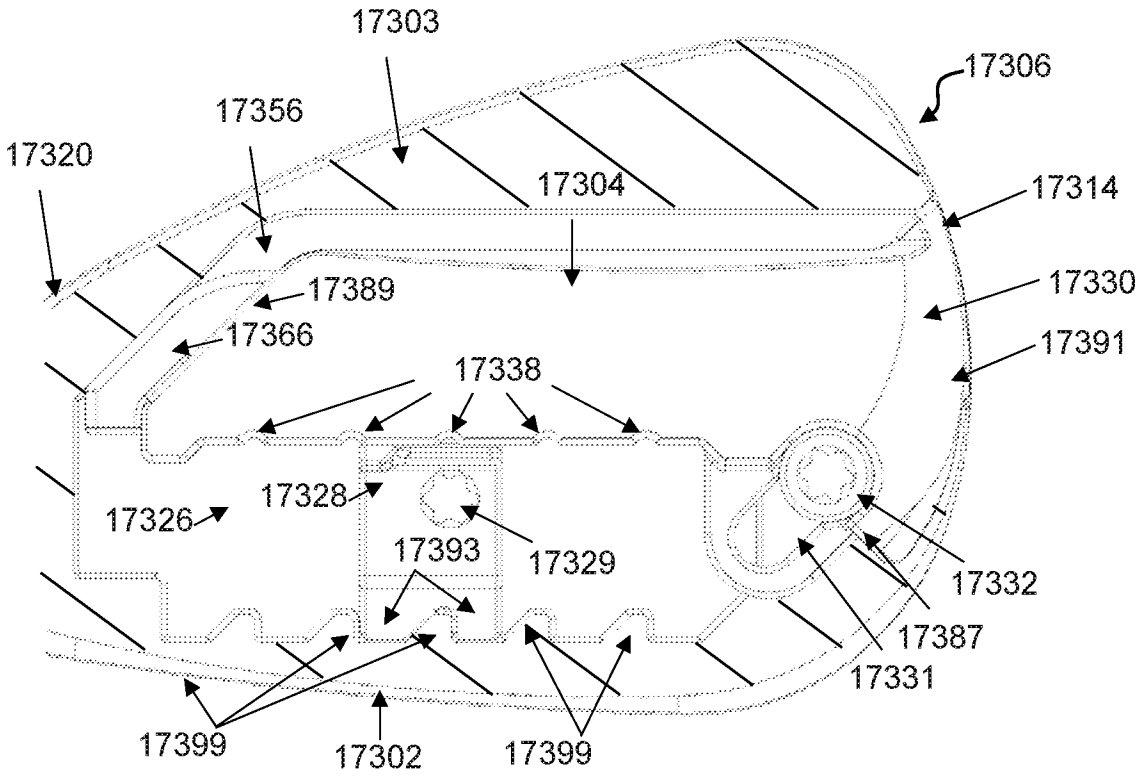
FIG. 69 illustrates a partial cross-sectional view of a golf club head taken substantially along line 173-173' in FIG. 67, in accordance with one or more embodiments of the presently disclosed technology.

FIG. 69 illustrates a partial cross-sectional view of a golf club head taken substantially along line 173-173' in FIG. 67, in accordance with one or more embodiments of the presently disclosed technology. FIG. 69 illustrates components that may be the same or substantially similar to components illustrated in FIGS. 59 and 61. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, third cover surface 16391, and/or weight through hole 16529 may be the same as or substantially similar to modular golf club head, hosel, sole 17302, top 17303, weight assembly 17304, body 17306, toe 17314, heel, outer surface 17320, recessed channel 17326, movable weight 17328, slidable cover 17330, cover through hole 17331, fastener 17332, cover notches 17338, back 17350, lower back surface, upper back surface 17356, first cover surface 17387, second cover surface 17389, third cover surface 17391, and/or weight through hole 17329. A part of recessed channel 17326 and/or other components may be more apparent in this view. As illustrated, stepped protrusion 17366 may be in contact with upper back surface 17356 in a locked configuration. Parts of weight protrusions 17393 and recessed channel protrusions 17399 may be more apparent in this view. While the protrusions are illustrated as triangular, it should be appreciated that other shapes may work, including, rounded protrusions, square protrusions, and so on. As illustrated, there may be a ramped edge, a horizontal edge, and a vertical edge for each protrusion, including weight protrusions 17393 and recessed channel protrusions 17399. Any of the protrusions may be differently shaped, sized, and/or dimensioned without departing from the spirit and scope of the presently disclosed technology. The distance may be more apparent in this view. Heel-ward of the heel-most recessed channel protrusion 17399, there may be a vertical edge then horizontal edge that may mark a first end of the distance movable weight 17328 can travel along recessed channel 17326. Toe-ward of the toe-most recessed channel protrusion 17399, there may be a diagonal edge that may mark a second end of the distance movable weight 17328 can travel along recessed channel 17326. A part of movable weight 17328 may be more apparent in this view.

Figure 70:
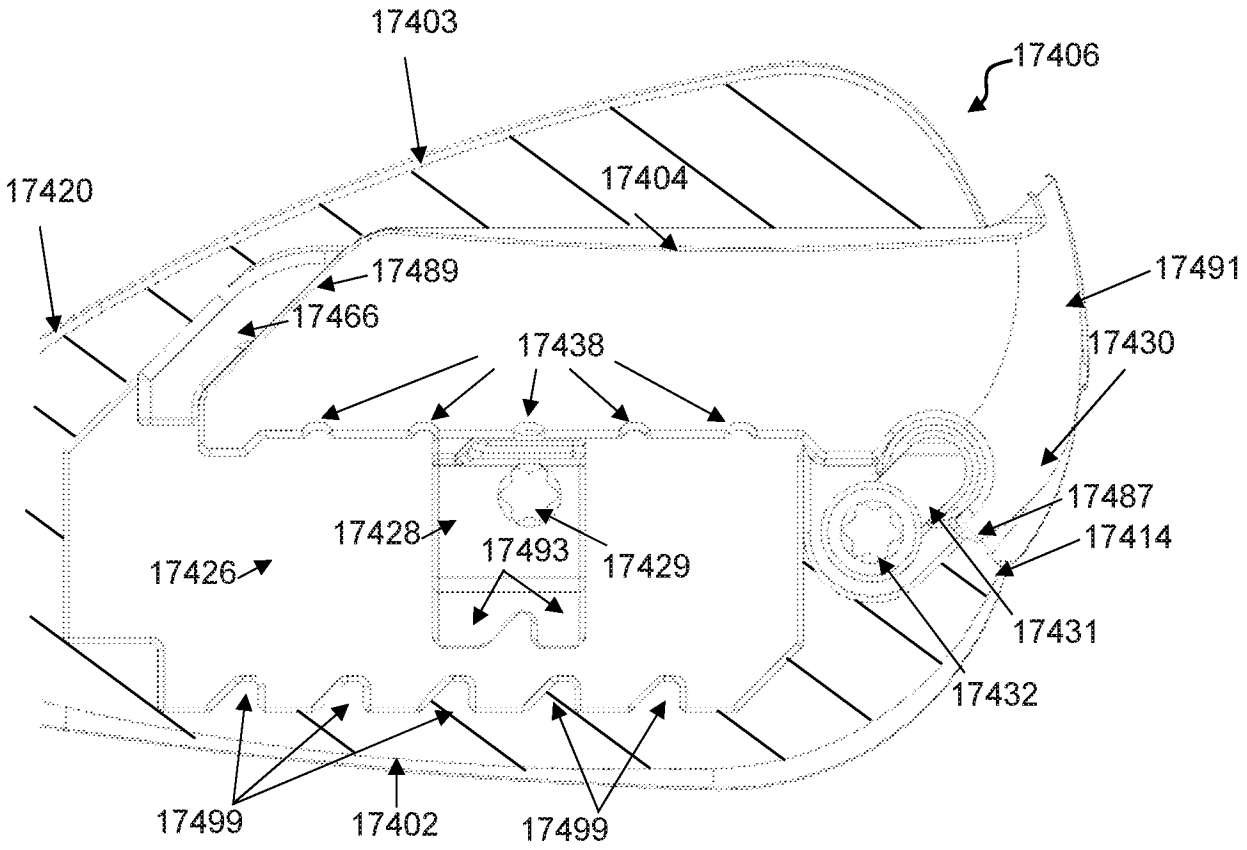
FIG. 70 illustrates a partial cross-sectional view of a golf club head taken substantially along line 173-173' in FIG. 67, in accordance with one or more embodiments of the presently disclosed technology.

FIG. 70 illustrates a partial cross-sectional view of a golf club head taken substantially along line 173-173' in FIG. 67, in accordance with one or more embodiments of the presently disclosed technology. FIG. 70 illustrates components that may be the same or substantially similar to components illustrated in FIGS. 59 and 69. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, cover notches 16338, back 16350, lower back surface 16352, upper back surface 16356, first cover surface 16387, second cover surface 16389, third cover surface 16391, weight through hole 17329, weight protrusions 17393, and/or recessed channel protrusions 17399 may be the same as or substantially similar to modular golf club head, hosel, sole 17402, top 17403, weight assembly 17404, body 17406, toe 17414, heel, outer surface 17420, recessed channel 17426, movable weight 17428, slidable cover 17430, cover through hole 17431, fastener 17432, cover notches 17438, back, lower back surface, upper back surface, first cover surface 17487, second cover surface 17489, third cover surface 17491, weight through hole 17429, weight protrusions 17493, and/or recessed channel protrusions 17499. As illustrated, components and parts of the golf club head may be more apparent in this view in a partially unlocked configuration. Weight protrusions 17493 may be unengaged from recessed channel protrusions 17499. In the partially unlocked configuration, recessed procession 17466 may be touching or near a heel-ward edge of upper back surface. The upper back surface may be shaped, sized, and/or dimensioned to provide enough clearance for slidable cover 17430 in the partially unlocked configuration. A shape of recessed channel 17426 may be more apparent in this view. In some embodiments, cover protrusions on a bottom of the channel formed in slidable cover 17430 may be pressure fit into the recess on top of movable weight 17428. This may fix movable weight 17428 into a fixed position relative to slidable cover 17430.

Figure 71:
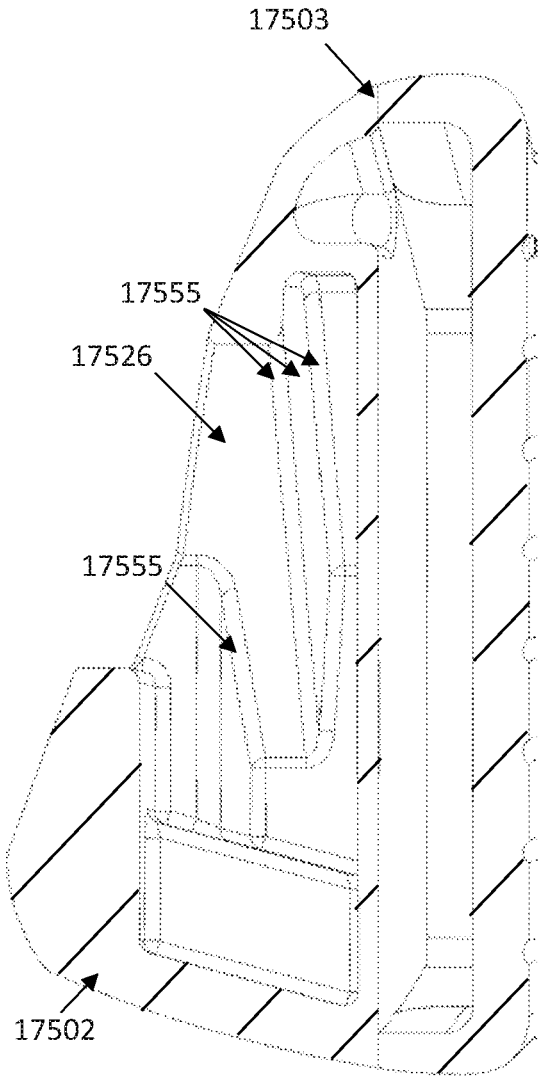
FIG. 71 illustrates a partial cross-sectional view of a golf club head taken substantially along line 175-175' in FIG. 67, in accordance with one or more embodiments of the presently disclosed technology.

FIG. 71 illustrates a partial cross-sectional view of a golf club head taken substantially along line 175-175' in FIG. 67, in accordance with one or more embodiments of the presently disclosed technology. FIG. 71 illustrates components that may be the same or substantially similar to components illustrated in FIGS. 59 and 69. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, back 16350, lower back surface 16352, upper back surface 16356, first cover surface 16387, second cover surface 16389, third cover surface 16391, weight through hole 17329, weight protrusions 17393, and/or recessed channel protrusions 17399 may be the same as or substantially similar to modular golf club head, hosel, sole 17502, top 17503, weight assembly, body, toe, heel, outer surface, recessed channel 17526, movable weight, slidable cover, cover through hole, fastener, back, lower back surface, upper back surface, first cover surface, second cover surface, third cover surface, weight through hole, weight protrusions, and/or recessed channel protrusions. Parts of recessed channel 17526 and/or other components may be more apparent in this view. For example, the heel-side end of recessed channel 17526 may include tapered elements 17555 that may help press against the cover in a locked configuration preventing unintentional loosening of the cover and/or the weight in a locked configuration. This may apply pressure to the cover not only from a back end of recessed channel 17526, but also a front end of recessed channel 17526 and at other angles providing top and bottom pressure on the cover in a locked configuration. Tapered elements 17555 may be at different points from a heel-to-toe direction. For example a front-most tapered element 17555 may be closer than the adjacent tapered element 17555. These tapered elements 17555 may be shaped, sized, and/or dimensioned to fit with parts of the cover to apply additional pressure between cover and the body in a locked configuration. It should be appreciated that that tapered elements 17555 may be differently shaped, sized, and/or dimensioned to apply more or less pressure in different areas on the cover.

Figure 72:
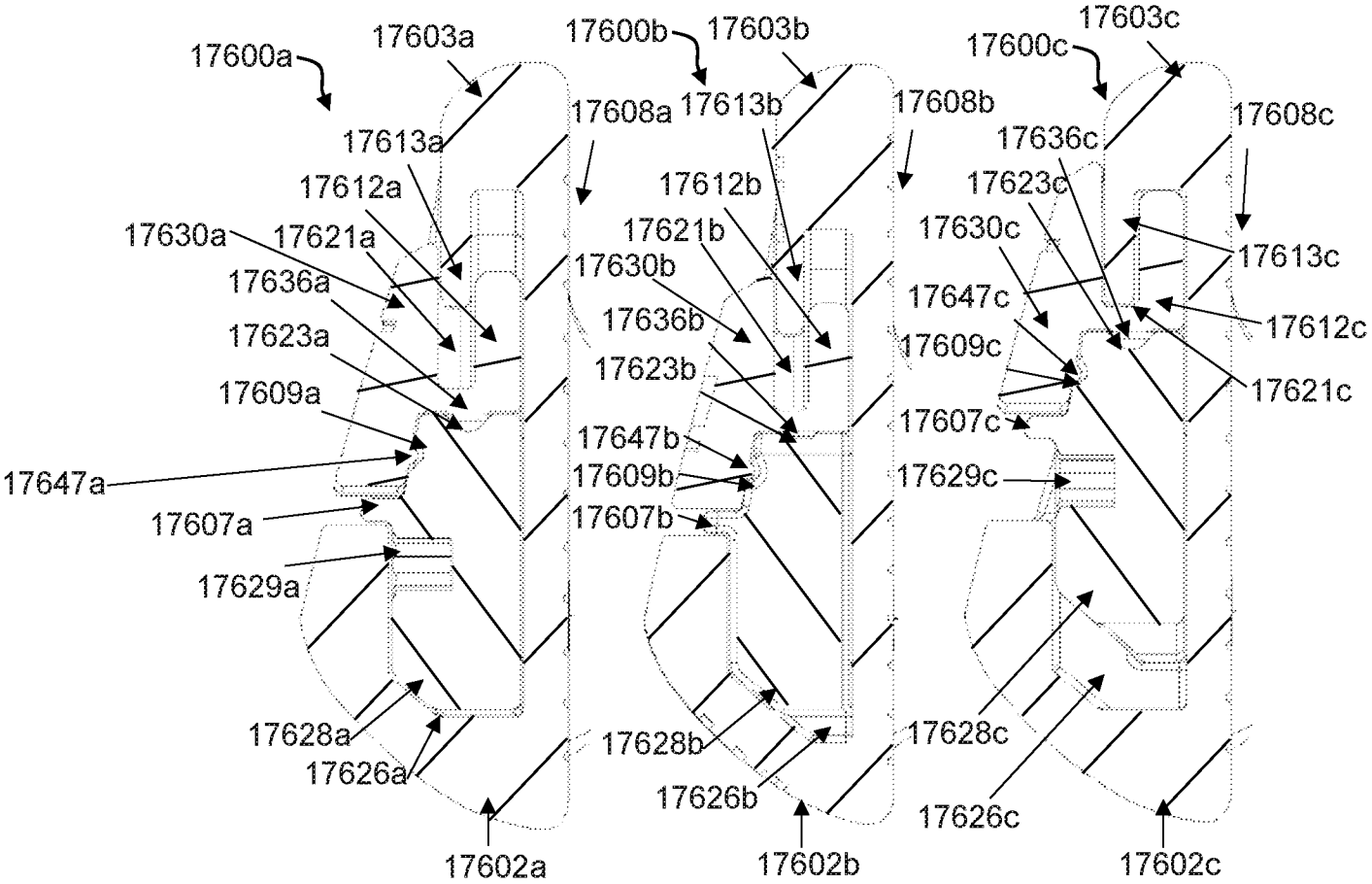
FIG. 72 illustrates partial cross-sectional views of golf club heads taken substantially along line 175-175' in FIG. 67, in accordance with one or more embodiments of the presently disclosed technology.

FIG. 72 illustrates partial cross-sectional views of golf club heads taken substantially along line 175-175' in FIG. 67, in accordance with one or more embodiments of the presently disclosed technology. FIG. 72 illustrates components that may be the same or substantially similar to components illustrated in FIGS. 59 and 69. For example, modular golf club head 16300, hosel 16301, sole 16302, top 16303, weight assembly 16304, body 16306, toe 16314, heel 16316, outer surface 16320, recessed channel 16326, movable weight 16328, slidable cover 16330, cover through hole 16331, fastener 16332, back 16350, lower back surface 16352, upper back surface 16356, first cover surface 16387, second cover surface 16389, third cover surface 16391, weight through hole 17329, weight protrusions 17393, and/or recessed channel protrusions 17399 may be the same as or substantially similar to golf club heads, hosels, soles 17602*a*, 17602*b*, 17602*c*, tops 17603*a*, 17603*b*, 17603*c*, weight assemblies, bodies, toes, heels, outer surfaces, recessed channels 17626*a*, 17626*b*, 17626*c*, movable weights 17628*a*, 17628*b*, 17628*c*, slidable covers 17630*a*, 17630*b*, 17630*c*, cover through holes, fasteners, backs, lower back surfaces, upper back surfaces, first cover surfaces, second cover surfaces, third cover surfaces, weight through holes 17629*a*, 17629*c*, weight protrusions, and/or recessed channel protrusions. As illustrated, modular golf club head 17600*a* may be in a locked configuration, modular golf club head 17600*b* may be in a locked configuration with a cross-sectional area that is slightly closer to the toe compared to the cross-sectional area shown of modular golf club head 17600*a*, and modular golf club head 17600*c* may be in a partially unlocked configuration. Movable weights 17628*a*, 17628*b*, 17628*c* may include weight bumps 17607*a*, 17607*b*, 17607*c*, back weight indents 17609*a*, 17609*b*, 17609*c*, and top weight recesses 17623*a*, 17623*b*, 17623*c*. Slidable covers 17630*a*, 17630*b*, 17630*c* may include front bumps 17647*a*, 17647*b*, 17647*c*, cover protrusions 17636*a*, 17636*b*, 17636*c*, cover rails 17612*a*, 17612*b*, 17612*c*, and cover channels 17621*a*, 17621*b*, 17621*c*. The body may include back rails 17613*a*, 17613*b*, 17613*c*.

Weight bumps 17607*a*, 17607*b*, 17607*c* may go between slidable covers 17630*a*, 17630*b*, 17630*c* and the outer surface of the back in a locked configuration. This may prevent rattling and unwanted movement of movable weights 17628*a*, 17628*b*, 17628*c*. Weight bumps 17607*a*, 17607*b*, 17607*c* may also indicate a fixed position of movable weights 17628*a*, 17628*b*, 17628*c* in a locked configuration. In some embodiments, weight bumps 17607*a*, 17607*b*, 17607*c* may be unnecessary and be removed. Weight bumps 17607*a*, 17607*b*, 17607*c* may be differently shaped, sized, and/or dimensioned without departing from the spirit and scope of the presently disclosed technology. Back weight indents 17609*a*, 17609*b*, 17609*c* may engage, or fit with, front bumps 17647*a*, 17647*b*, 17647*c*. Back weight indents 17609*a*, 17609*b*, 17609*c* and front bumps 17647*a*, 17647*b*, 17647*c* may help align, secure, and/or fix movable weights 17628*a*, 17628*b*, 17628*c* in a locked configuration. Top weight recesses 17623*a*, 17623*b*, 17623*c* may correspond with, engage, or fit with, cover protrusions 17636*a*, 17636*b*, 17636*c*. Top weight recesses 17623*a*, 17623*b*, 17623*c* and cover protrusions 17636*a*, 17636*b*, 17636*c* may correspond with, help align, help secure, and/or help fix movable weights 17628*a*, 17628*b*, 17628*c* in a locked configuration.

Cover rails 17612*a*, 17612*b*, 17612*c* may correspond to, fit with, and/or engage with an upper portion of the recessed channels. For example, the recessed channels may include a region in front of back rails 17613*a*, 17613*b*, 17613*c* and behind an upper portion of striking faces 17608*a*, 17608*b*, 17608*c*. Cover rails 17612*a*, 17612*b*, 17612*c* and these regions of the recessed channels may be differently shaped, sized, and/or dimensioned without departing from the spirit and scope of the presently disclosed technology. Cover rails 17612*a*, 17612*b*, 17612*c* may help prevent unwanted movement of movable weights 17628*a*, 17628*b*, 17628*c* and slidable covers 17630*a*, 17630*b*, 17630*c* in a locked configuration. Cover channels 17621*a*, 17621*b*, 17621*c* may correspond to, fit with, and/or engage with back rails 17613*a*, 17613*b*, 17613*c*. Cover channels 17621*a*, 17621*b*, 17621*c* and back rails 17613*a*, 17613*b*, 17613*c* may help prevent unwanted movement of movable weights 17628*a*, 17628*b*, 17628*c* and slidable covers 17630*a*, 17630*b*, 17630*c* in a locked configuration. Cover channels 17621*a*, 17621*b*, 17621*c* and back rails 17613*a*, 17613*b*, 17613*c* may be differently shaped, sized, and/or dimensioned without departing from the spirit and scope of the presently disclosed technology.

Figure 73:
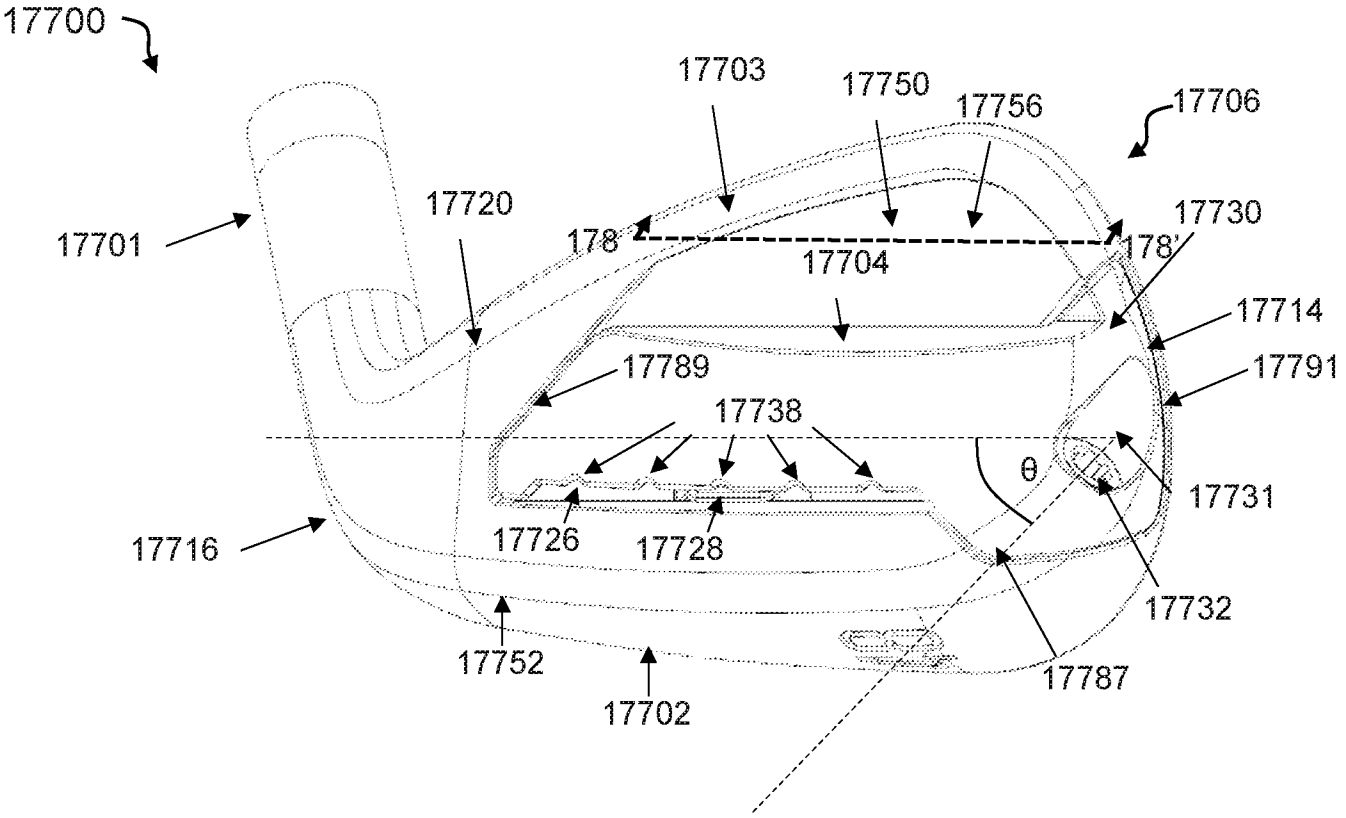
FIG. 73 illustrates a perspective view of a golf club head, in accordance with one or more embodiments of the presently disclosed technology.

FIG. 73 illustrates a perspective view of a golf club head, in accordance with one or more embodiments of the presently disclosed technology. FIG. 73 illustrates components that may be the same or substantially similar to components illustrated in FIG. 59. For example, modular golf club head 16300, hosel 16301, sole 16302, top 16303, weight assembly 16304, body 16306, toe 16314, heel 16316, outer surface 16320, movable weight 16328, lower back surface 16352, cover notches 16338, second cover surface 16389, and/or third cover surface 16391 may be the same as or substantially similar to modular golf club head 17700, hosel 17701, sole 17702, top 17703, weight assembly 17704, body 17706, toe 17714, heel 17716, outer surface 17720, movable weight 17728, lower back surface 17752, cover notches 17738, second cover surface 17789, and/or third cover surface 17791. Slidable cover 17730 may include a cover through hole 17731, fastener 17732, and first cover surface 17787. Cover through hole 17731 may be at angle theta θ compared to an x-axis, a toe-to-heel direction, or a ground plane. Angle theta θ may be about 5 degrees, about 10 degrees, about 15 degrees, about 20 degrees, and so on until about 90 degrees, including any values in between without departing from the spirit and scope of the presently disclosed technology. In a locked configuration at angle theta θ, slidable cover 17730 may be pushed in both a downward and heel-ward direction. In some embodiments, angle theta θ may be compared to a striking face plane or another plane without departing from the spirit and scope of the presently disclosed technology. Fastener 17732 may cause a down-ward and heel-ward pressure in a locked configuration. This may cause slidable cover 17730 to exert pressure toward a sloped edge of upper back surface 17756 adjacent to second cover surface 17789 in a locked configuration. Based on the sloped edge and/or the vertical edge below the sloped edge, the pressure exerted by slidable cover 17730 may help lock slidable cover 17730 into the locked configuration. For example, this may help secure a heel-end of slidable cover 17730 based on this pressure in addition to the toe-end which is secured by fastener 17732 in a locked configuration. In some embodiments, fastener 17732 may cause slidable cover 17730 to apply pressure or force in different directions, including front-ward, back-ward, top-ward, and/or toe-ward. This may help lock slidable cover 17730 into place based on the shape, size, and/or dimension of slidable cover 17730 and body 17306. For example, second cover surface 17789 may be securely locked into the locked configuration because of the forces exerted heel-ward and down-ward by fastener 17732. Fastener 17732 may have a fastener axis at angle theta θ, as discussed herein. Fastener 17732 may otherwise be the same as, or substantially similar to, fastener 16332. First cover surface 17787 may include more linear edges than first cover surface 16387 because there is no through hole or fastener at the bottom left edge of the toe portion of slidable cover 17730 to design around. For example, first cover surface 17787 may include a horizontal linear edge that curves into a diagonal linear edge that curves into a horizontal linear edge that leads to cover notches 17738.

Body 17706 may include recessed channel 17726, back 17750, lower back surface 17752, and upper back surface 17756. Recessed channel 17726 may be visible in this view. Back 17750, lower back surface 17752, and upper back surface 17756 may not have a cut-out design for a through hole along an edge of back 17750, lower back surface 17752, and upper back surface 17756. Though it should be appreciated that back 17750, lower back surface 17752, and upper back surface 17756 may be the same as, or substantially similar to, back 16350, lower back surface 16352, and upper back surface 16356.

Figure 74:
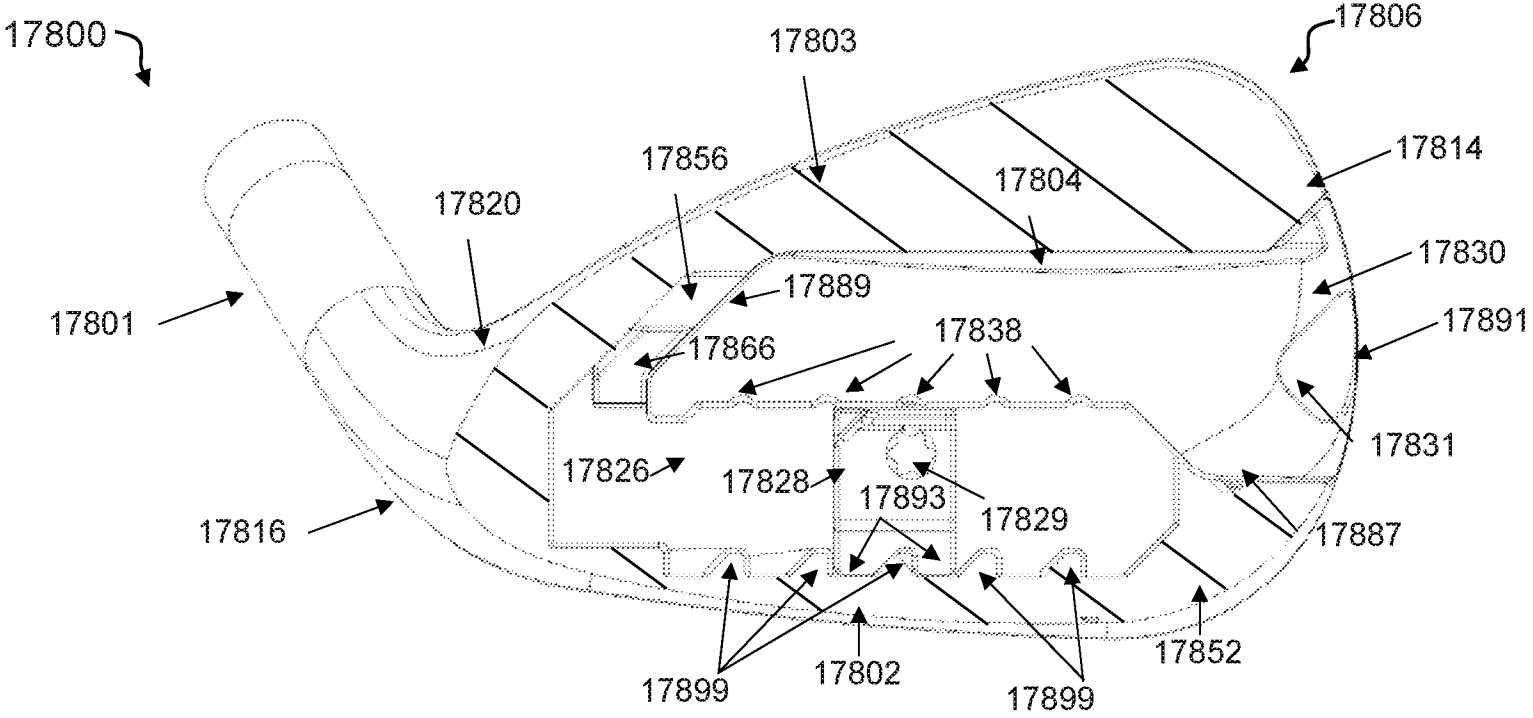
FIG. 74 illustrates a cross-sectional view of a golf club head taken substantially along line 178-178' in FIG. 73, in accordance with one or more embodiments of the presently disclosed technology.

FIG. 74 illustrates a cross-sectional view of a golf club head taken substantially along line 178-178' in FIG. 73, in accordance with one or more embodiments of the presently disclosed technology. FIG. 74 illustrates components that may be the same or substantially similar to components illustrated in FIGS. 59, 65, 69, and 73. For example, modular golf club head 16300, hosel 16301, sole 16302, top 16303, weight assembly 16304, body 16306, toe 16314, heel 16316, outer surface 16320, recessed channel 16326, movable weight 16328, cover surface 16389, third cover surface 16391, stepped protrusion 16966, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, and/or first cover surface 17787 may be the same as or substantially similar to modular golf club head 17800, hosel 17801, sole 17802, top 17803, weight assembly 17804, body 17806, toe 17814, heel 17816, outer surface 17820, recessed channel 17826, movable weight 17828, second cover surface 17889, third cover surface 17891, weight through hole 17829, stepped protrusion 17866, weight protrusions 17893, recessed channel protrusions 17899, recessed channel 17826, slidable cover 17830, cover through hole 17831, fastener, cover notches 17838, back 17850, lower back surface 17852, upper back surface 17856, and/or first cover surface 17887. As illustrated, parts of recessed channel 17826 and/or other components may be more apparent in this view. Recessed channel 17826 may include the same protrusion system (e.g., weight protrusions 17893 and recessed channel protrusions 17899) to fix movable weight 17828 into a fixed position. Stepped protrusion 17866 may be the same as or substantially similar to stepped protrusion 17066. In a locked configuration, stepped protrusion 17866 may press back-ward on a part of recessed channel 17826 to help secure slidable cover 17830 and/or movable weight 17828 and/or prevent unwanted movement from these components.

Figure 75:
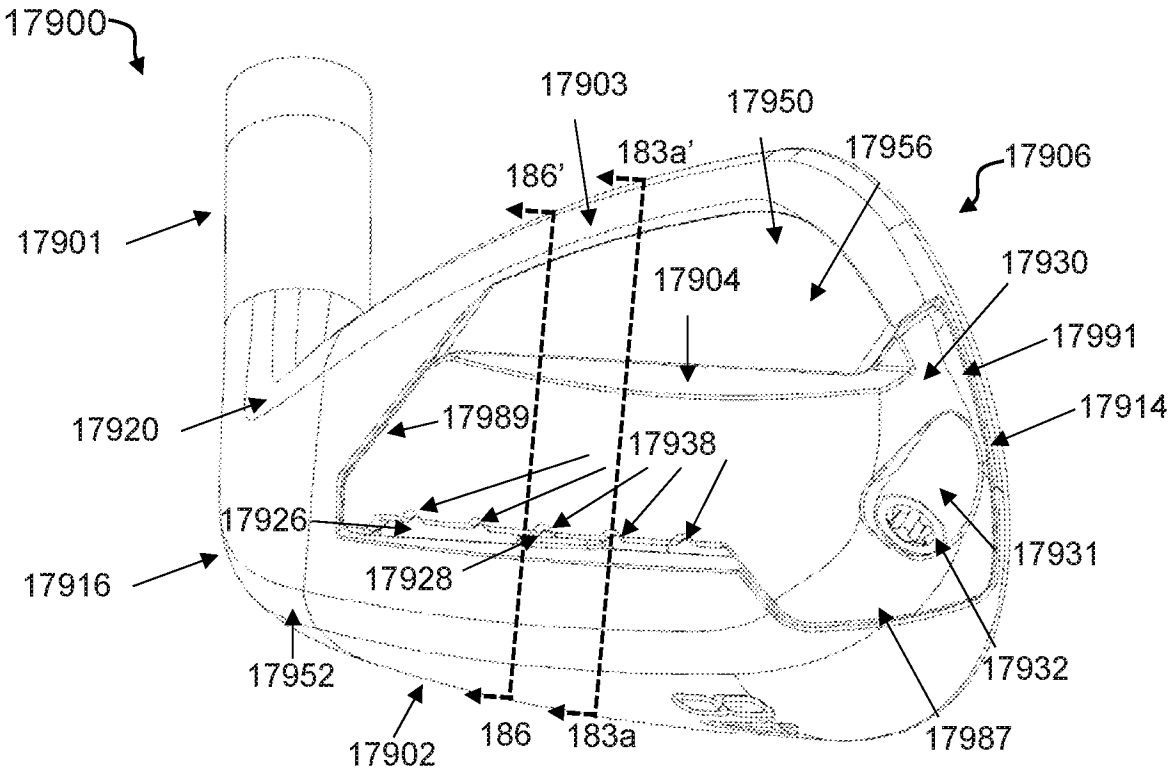
FIG. 75 illustrates a perspective view of a golf club head, in accordance with one or more embodiments of the presently disclosed technology.

FIG. 75 illustrates a perspective view of a golf club head, in accordance with one or more embodiments of the presently disclosed technology. FIG. 75 illustrates components that may be the same or substantially similar to components illustrated in FIGS. 59, 69, and 73. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, and/or first cover surface 17787 may be the same as or substantially similar to modular golf club head 17900, hosel 17901, sole 17902, top 17903, weight assembly 17904, body 17906, toe 17914, heel 17916, outer surface 17920, recessed channel 17926, movable weight 17928, second cover surface 17989, third cover surface 17991, weight through hole, weight protrusions, recessed channel protrusions, recessed channel 17926, slidable cover 17930, cover through hole 17931, fastener 17932, cover notches 17938, back 17950, lower back surface 17952, upper back surface 17956, and/or first cover surface 17987. As illustrated, parts of toe 17914, cover through hole 17931, fastener 17932, third cover surface 17991, and/or other components may be more apparent in this view.

Figure 76:
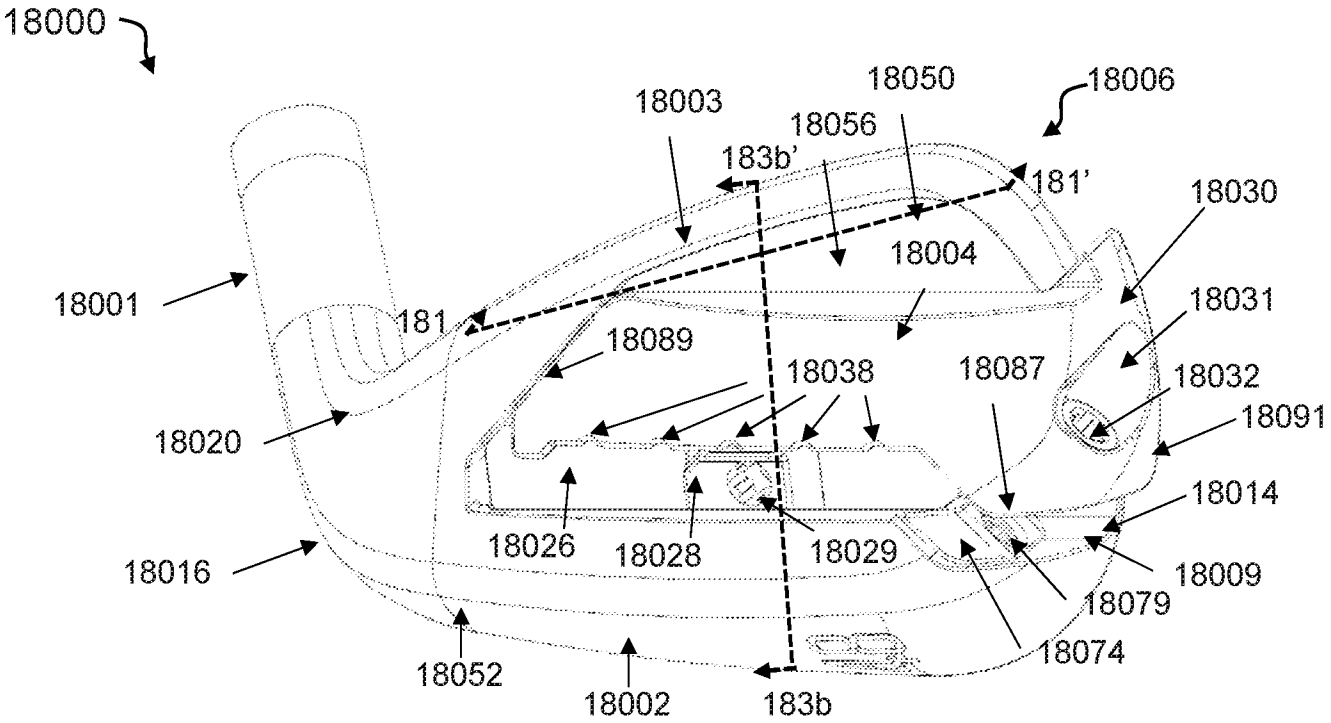
FIG. 76 illustrates a perspective view of a golf club head, in accordance with one or more embodiments of the presently disclosed technology.

FIG. 76 illustrates a perspective view of a golf club head, in accordance with one or more embodiments of the presently disclosed technology. FIG. 76 illustrates components that may be the same or substantially similar to components illustrated in FIGS. 59, 69, 73, and 74. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, first cover surface 17787, and/or weight through hole 17829 may be the same as or substantially similar to modular golf club head 18000, hosel 18001, sole 18002, top 18003, weight assembly 18004, body 18006, toe 18014, heel 18016, outer surface 18020, recessed channel 18026, movable weight 18028, second cover surface 18089, third cover surface 18091, weight through hole 18029, weight protrusions, recessed channel protrusions, recessed channel 18026, slidable cover 18030, cover through hole 18031, fastener 18032, cover notches 18038, back 18050, lower back surface 18052, upper back surface 18056, first cover surface 18087, and/or weight through hole 18029. As illustrated in a partially unlocked configuration, parts of recessed channel 18026, first cover surface 18087, third cover surface 18091, and/or other components may be more apparent in this view. In this partially unlocked configuration, a user may be able to adjust a position of movable weight 18028. Recessed channel 18026 may include first recessed channel surface 18009. First recessed channel surface 18009 may be shaped, sized, and/or dimensioned to receive parts of slidable cover 18030, including parts of first cover surface 18087. This may provide a secure fit between slidable cover 18030 and body 18006. This may help prevent unwanted movement, including rattling, of slidable cover 18030 or movable weight 18028. Body 18006 may include second member 18074 and second member blind hole 18079. Second member 18074 may include a surface to receive parts of first cover surface 18087. This may provide a secure fit between slidable cover 18030 and body 18006. This may prevent unwanted movement, including rattling, of slidable cover 18030 or movable weight 18028. Second member blind hole 18079 may be cut into second member 18074. Second member blind hole 18079 may not go through the entirety of second member 18074. In some embodiments, second member blind hole 18079 may go through second member and into recessed channel 18026. Second member blind hole 18079 may be threaded. Second member blind hole 18079 may be shaped, sized, and/or dimensioned to receive fastener 18032. An axis of second member blind hole 18079 may be the same as angle theta θ discussed herein.

Figure 77:
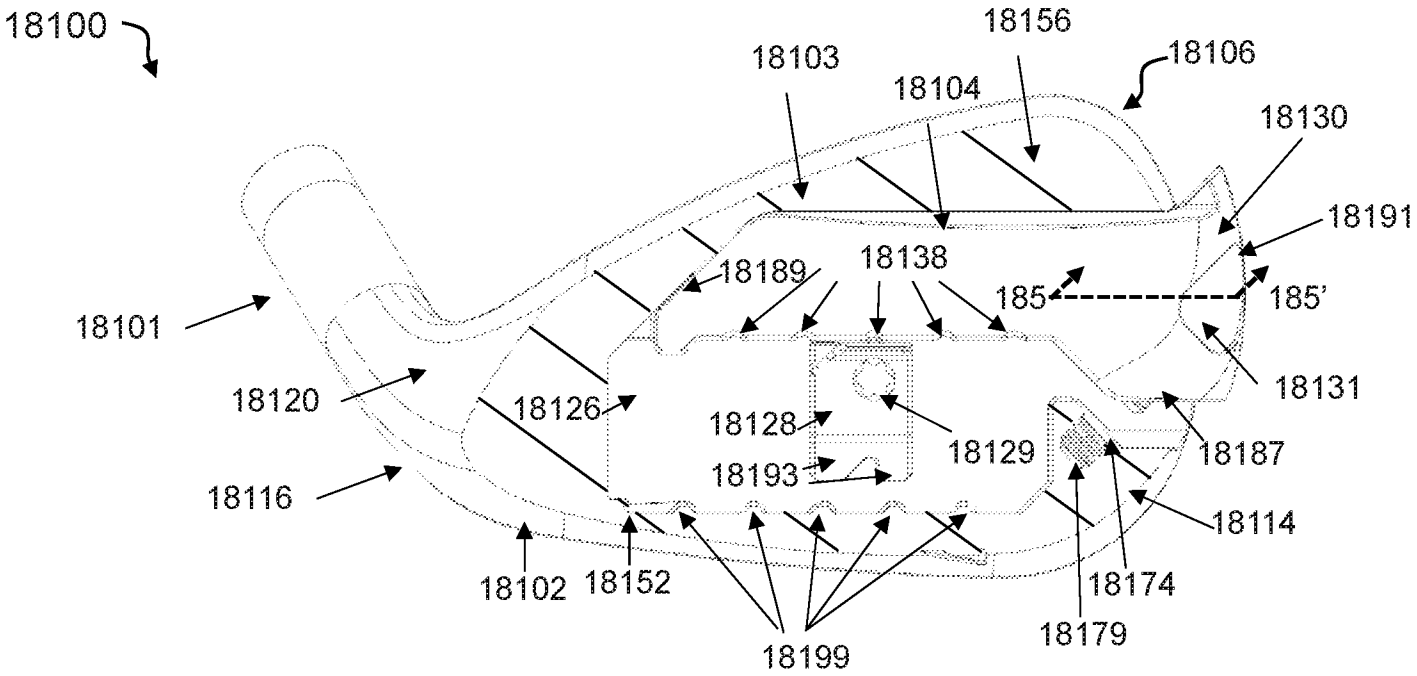
FIG. 77 illustrates a cross-sectional view of a golf club head taken substantially along line 181-181' in FIG. 76, in accordance with one or more embodiments of the presently disclosed technology.

FIG. 77 illustrates a cross-sectional view of a golf club head taken substantially along line 181-181' in FIG. 76, in accordance with one or more embodiments of the presently disclosed technology. FIG. 77 illustrates components that may be the same or substantially similar to components illustrated in FIGS. 59, 69, 73, 74, and 76. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, first cover surface 17787, weight through hole 17829, first recessed channel surface 18009, second member 18074, and/or second member blind hole 18079 may be the same as or substantially similar to modular golf club head 18100, hosel 18101, sole 18102, top 18103, weight assembly 18104, body 18106, toe 18114, heel 18116, outer surface 18120, recessed channel 18126, movable weight 18128, second cover surface 18189, third cover surface 18191, weight through hole 18129, weight protrusions 18193, recessed channel protrusions 18199, recessed channel 18126, slidable cover 18130, cover through hole 18131, fastener, cover notches 18138, back 18150, lower back surface 18152, upper back surface 18156, first cover surface 18187, weight through hole 18129, first recessed channel surface, second member 18174, and/or second member blind hole 18179. As illustrated in an unlocked configuration, parts of recessed channel 18126, second member 18174, second member blind hole 18179, first cover surface 18187, second cover surface 18189, third cover surface 18191, and/or other components may be more apparent in this view. As discussed herein, the protrusion and recess system between a top of movable weight 18128 and a bottom of slidable cover 18130 may secure movable weight 18128 into a fixed position relative to slidable cover 18130.

Figure 78:
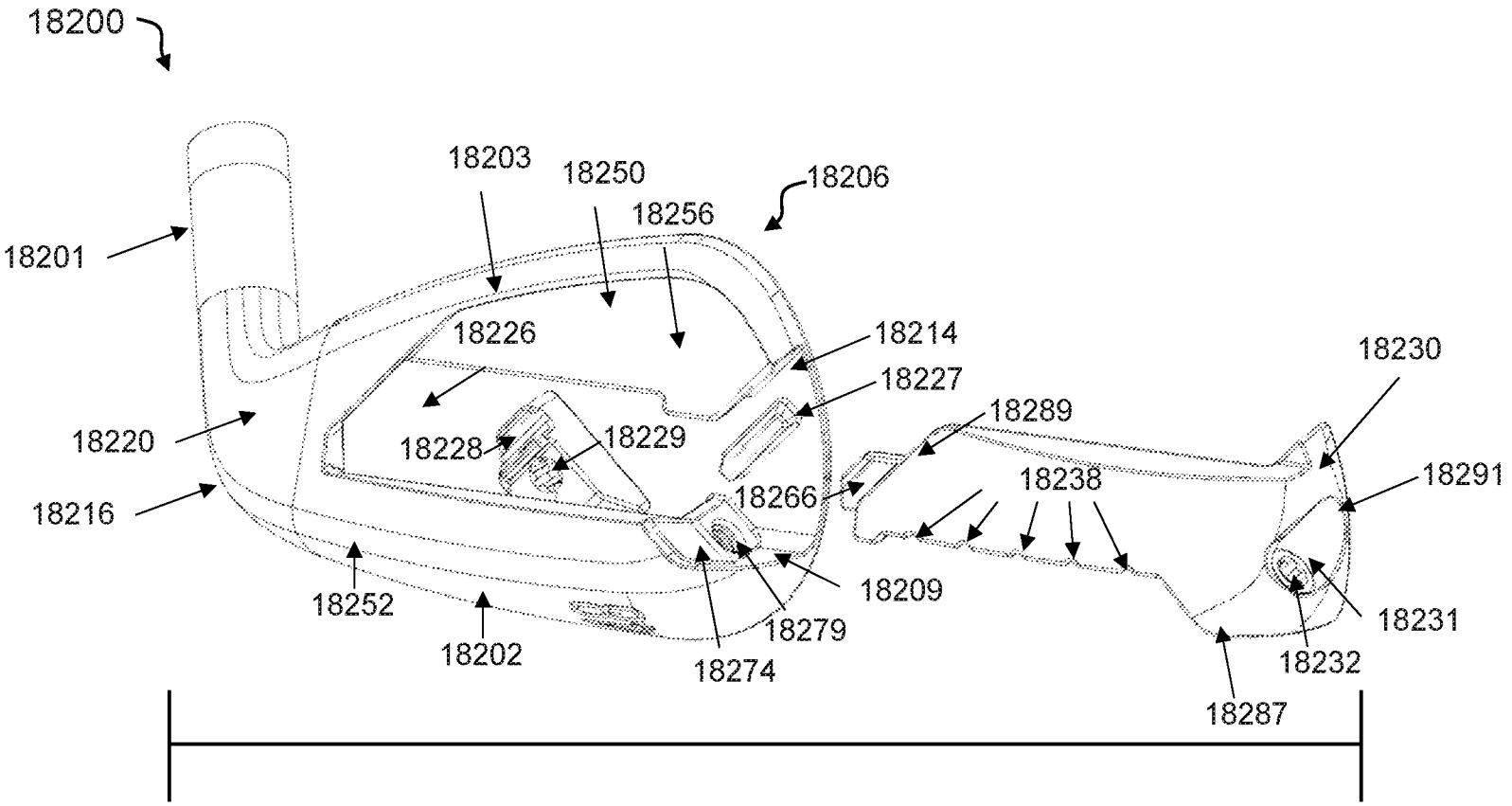
FIG. 78 illustrates an exploded perspective view of a golf club head, in accordance with one or more embodiments of the presently disclosed technology.

FIG. 78 illustrates an exploded perspective view of a golf club head, in accordance with one or more embodiments of the presently disclosed technology. FIG. 78 illustrates components that may be the same or substantially similar to components illustrated in FIGS. 59, 69, 73, 74, and 76. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, first cover surface 17787, weight through hole 17829, first recessed channel surface 18009, second member 18074, and/or second member blind hole 18079 may be the same as or substantially similar to modular golf club head 18200, hosel 18201, sole 18202, top 18203, weight assembly, body 18206, toe 18214, heel 18216, outer surface 18220, recessed channel 18226, movable weight 18228, second cover surface 18289, third cover surface 18291, weight through hole 18229, weight protrusions, recessed channel protrusions, recessed channel 18226, slidable cover 18230, cover through hole 18231, fastener 18232, cover notches 18238, back 18250, lower back surface 18252, upper back surface 18256, first cover surface 18287, weight through hole 18229, first recessed channel surface 18209, second member 18274, and/or second member blind hole 18279. As illustrated, parts of toe 18214, slidable cover 18230, lower back surface 18252, upper back surface 18256, and/or other components may be more apparent in this view. Slidable cover 18230 may include a stepped protrusion 18266. As discussed herein, stepped protrusion 18266 may fit in a heel-ward part of recessed channel 18226 behind a heel-ward part of back 18250. Stepped protrusion 18266 may help prevent unwanted movement of slidable cover 18230 and movable weight 18228. Stepped protrusion 18266 may help prevent unwanted back-ward, top-ward, and/or bottom-ward movement of slidable cover 18230.

Body 18206 may include securing element 18227. Securing element 18227 may help align slidable cover 18230. Securing element 18227 may help secure slidable cover 18230 in a locked configuration. In a locked configuration, securing element 18227 may help prevent movement in a bottom and top direction and a heel-to-toe direction. In some embodiments, securing element 18227 may include an undercut. Slidable cover 18230 may include a corresponding cover recess (at least shown as cover recess 18437 in FIG. 80) to fit with securing element 18227. Securing element 18227 may be positioned diagonally. In embodiments, securing element 18227 may hold slidable cover 18230 in a partially unlocked configuration. In some embodiments, securing element 18227 may be at angle theta θ, as discussed herein. In some embodiments, movable weight 18228 may be rotated to insert or install weight into recessed channel 18226.

Figure 79:
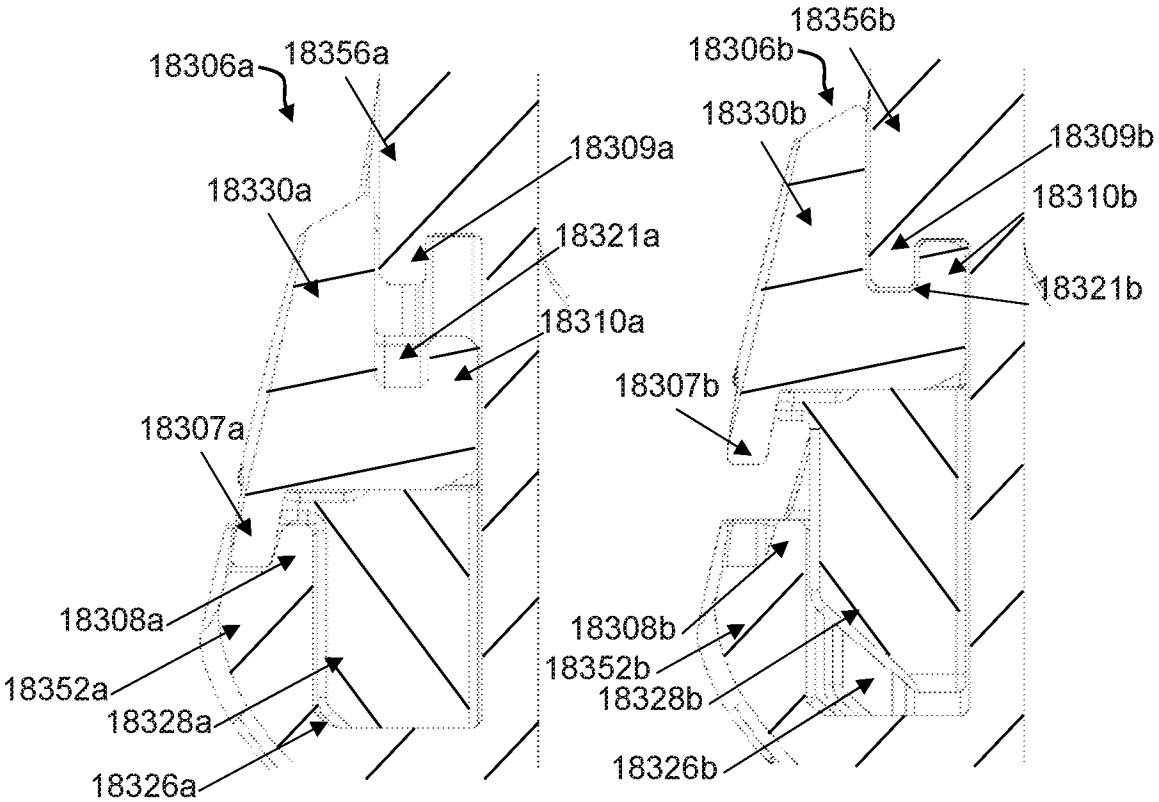
FIG. 79 illustrates cross-sectional views of golf club heads taken substantially along line 183*a*-183*a*' in FIG. 75 and line 183*b*-183*b*' in FIG. 76, in accordance with one or more embodiments of the presently disclosed technology.

FIG. 79 illustrates cross-sectional views of golf club heads taken substantially along line **183*a*-183*a*' in FIG. 75 and line 183*b*-183*b*' in FIG. 76, in accordance with one or more embodiments of the presently disclosed technology. FIG. 79 illustrates components that may be the same or substantially similar to components illustrated in FIGS. 59, 69, 73, 74, and 76. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, slidable cover 17730, cover through hole 17731, fastener 17732, cover notches 17738, back 17750, lower back surface 17752, upper back surface 17756, first cover surface 17787, weight through hole 17829, first recessed channel surface 18009, second member 18074, and/or second member blind hole 18079 may be the same as or substantially similar to modular golf club head, hosel, sole, top, weight assembly, bodies 18306***a*, 18306*b*, toe, heel, outer surface, recessed channel 18326*a*, 18326*b*, movable weight 18328*a*, 18328*b*, second cover surface, third cover surface, weight through hole, weight protrusions, recessed channel protrusions, slidable cover 18330*a*, 18330*b*, cover through hole, fastener, cover notches, back, lower back surface 18352*a*, 18352*b*, upper back surface 18356*a*, 18356*b*, first cover surface, weight through hole, first recessed channel surface, second member, and/or second member blind hole. As illustrated, golf club head may be in a locked configuration, and golf club head may be in a unlocked configuration. In the unlocked configuration, a tool may be able to access movable weights 18328*a*, 18328*b* and move them into another fixed position. Slidable covers 18330*a*, 18330*b* may include back cover protrusions 18307*a*, 18307*b*, cover rails 18310*a*, 18310*b*, and cover channels 18321*a*, 18321*b*. Bodes 18306*a*, 18306*b* may include recessed channel rails 18308*a*, 18308*b* and back rails 18309*a*, 18309*b*.

Back cover protrusions 18307*a*, 18307*b* may correspond to, fit with, and/or engage with recessed channel rails 18308*a*, 18308*b*. Back cover protrusions 18307*a*, 18307*b* and recessed channel rails 18308*a*, 18308*b* may include ramps or angled edges that allow back cover protrusions 18307*a*, 18307*b* to sit on bodies 18306*a*, 18306*b* as slidable covers 18330*a*, 18330*b* slide into a locked configuration. Back cover protrusions 18307*a*, 18307*b* and recessed channel rails 18308*a*, 18308*b* may be angled to provide a secure fit between these components in a locked configuration which may help prevent unwanted movement. The angled walls may be able to apply pressure against each other along multiple axes, which may improve the secure fit between components compared to if they were vertical or horizontal. Back cover protrusions 18307*a*, 18307*b* and recessed channel rails 18308*a*, 18308*b* may be differently shaped, sized, and/or dimensioned without departing from the spirit and scope of the presently disclosed technology. Cover rails 18310*a*, 18310*b* may correspond to, fit with, and/or engage with an upper portion of the recessed channels, including recessed channel 18326*b*. For example, the recessed channels may include a region in front of back rails 18309*a*, 18309*b* and behind an upper portion of the striking faces. Cover rails 18310*a*, 18310*b* and these regions of the recessed channels may be differently shaped, sized, and/or dimensioned without departing from the spirit and scope of the presently disclosed technology. Cover rails 18310*a*. 18310*b* may help prevent unwanted movement of movable weights 18328*a*, 18328*b* and slidable covers 18330*a*, 18330*b* in a locked configuration. Cover channels 18321*a*, 18321*b* may correspond to, fit with, and/or engage with back rails 18309*a*, 18309*b*. Cover channels 18321*a*, 18321*b* and back rails 18309*a*, 18309*b* may help prevent unwanted movement of movable weights 18328*a*, 18328*b* and slidable covers 18330*a*, 18330*b* in a locked configuration. Cover channels 18321*a*, 18321*b* and back rails 18309*a*, 18309*b* may be differently shaped, sized, and/or dimensioned without departing from the spirit and scope of the presently disclosed technology. As illustrated a back wall of recessed channel 18326*a*, 18326*b* may be vertical. As illustrated, movable weights 18328*a*, 18328*b* may be angled at a bottom to fit into the bottom of recessed channel 18326*a*, 18326*b*. A lower portion of the back wall, not visible here, may be angled or sloped to match the shape of the bottom of movable weights 18328*a*, 18328*b*.

Figure 80:
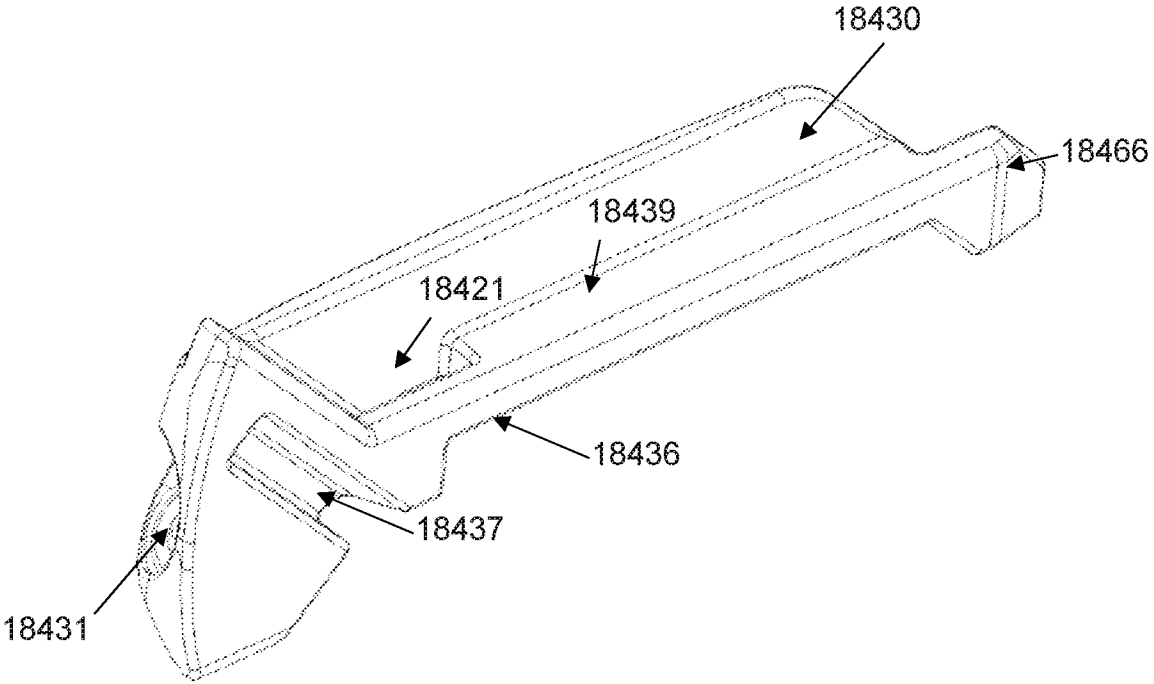
FIG. 80 illustrates a perspective view of a cover, in accordance with one or more embodiments of the presently disclosed technology.

FIG. 80 illustrates a perspective view of a cover, in accordance with one or more embodiments of the presently disclosed technology. FIG. 80 illustrates components that may be the same or substantially similar to components illustrated in FIGS. 73 and 78. For example, slidable cover 17730, cover through hole 17731, fastener, second cover surface, third cover surface, and/or stepped protrusion 18266 may be the same as or substantially similar to slidable cover 18430, cover through hole 18431, fastener, second cover surface, third cover surface, and/or stepped protrusion 18466. As illustrated, parts of slidable cover 18430, cover through hole 18431, stepped protrusion 18466, and/or other components may be more apparent in this view. Slidable cover 18430 may include cover recess 18437, notched cover recess 18436, cover channel 18421, lowered cover member 18439, and stepped protrusion 18466. Cover recess 18437 may receive the securing element as discussed herein. Cover recess 18437 may be shaped, sized, and/or dimensioned to fit the securing element. An axis of cover recess 18437 may be the same as angle theta θ. It should be appreciated that cover recess 18437 may be differently shaped, sized, and/or dimensioned without departing from the spirit and scope of the presently disclosed technology. For example, cover recess 18437 may not be a blind hole and go through the end of slidable cover 18430, similar to cover through hole 18431. Cover recess 18437 may prevent unwanted movement of slidable cover 18430 in a partially unlocked configuration and in a locked configuration. Cover recess 18437 may also be an alignment aid to fit slidable cover 18430 into a slidable position. Cover recess 18437 may provide pressure near the fastener to help reduce bowing near cover recess 18437 that may be caused by having a single point at which slidable cover 18430 may be fastened.

Notched cover recess 18436 may engage a back wall of the recessed channel. Notched cover recess 18436 may be ramped on one or more ends. The ramped ends may be shaped, sized, and/or dimensioned to fit with the second member and/or the first recessed channel surface. One of the ramped ends may rest on a part of the body in a locked configuration. This may provide structural support for these components. It should be appreciated that notched cover recess 18436 may be differently shaped, sized, and/or dimensioned without departing from the spirit and scope of the presently disclosed technology. Cover channel 18421 may be shaped to receive a lower toe-ward part of the upper back surface. This may help secure slidable cover 18430 into a locked configuration. This may prevent unwanted movement in a heel-to-toe direction. In some embodiments, cover channel 18421 may receive the lower toe-ward part of the upper back surface to allow for vertical movement of slidable cover 18430. In embodiments, cover channel 18421 may allow for slidable cover 18430 to be secured in an unlocked configuration. This may be accomplished, for example, by pressure fitting or snapping cover channel 18421 onto the lower toe-ward part of the upper back surface. The vertical movement may allow for a user to adjust movable weight without fully removing slidable cover 18430 along an x-axis or a heel-to-toe direction to affect the CG of the golf club head. Lowered cover member 18439 may allow for slidable cover 18430 to slide along a bottom of the upper back surface in the recessed channel. In some embodiments, stepped protrusion 18466 may be an extension of lowered cover member 18439.

Figure 81:
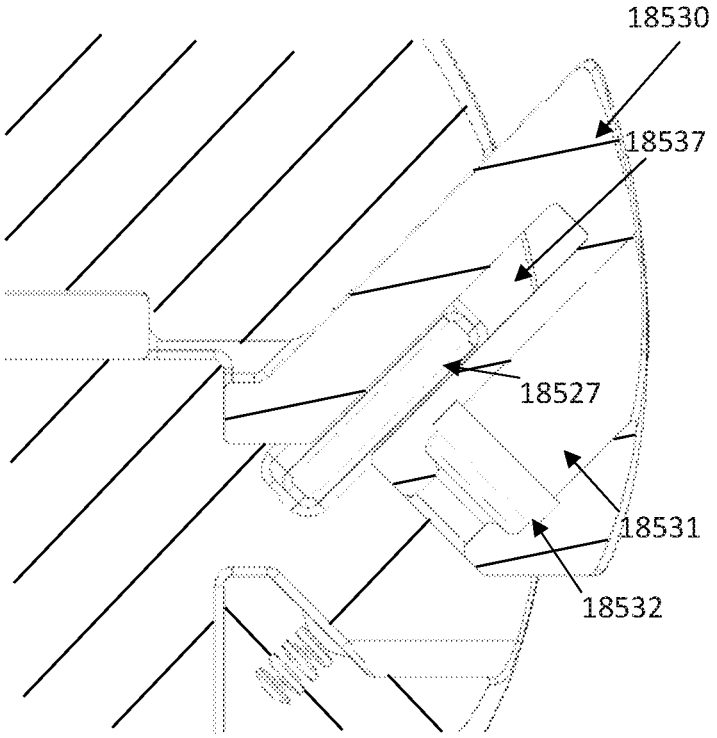
FIG. 81 illustrates a partial cross-sectional view of a golf club head taken substantially along line 185-185' in FIG. 77, in accordance with one or more embodiments of the presently disclosed technology.

FIG. 81 illustrates a partial cross-sectional view of a golf club head taken substantially along line 185-185' in FIG. 77, in accordance with one or more embodiments of the presently disclosed technology. FIG. 81 illustrates components that may be the same or substantially similar to components illustrated in FIGS. 59, 69, 73, 74, 76, 78, and 80. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, first cover surface 17787, weight through hole 17829, first recessed channel surface 18009, second member 18074, second member blind hole 18079, securing element 18227, and/or cover recess 18437 may be the same as or substantially similar to modular golf club head, hosel, sole, top, weight assembly, body, toc, heel, outer surface, recessed channel, movable weight, second cover surface, third cover surface, weight through hole, weight protrusions, recessed channel protrusions, recessed channel, slidable cover 18530, cover through hole 18531, fastener 18532, cover notches, back 18550, lower back surface, upper back surface, first cover surface, weight through hole, first recessed channel surface, second member, second member blind hole, securing element 18527, and/or cover recess 18537. In this cross-sectional view of a golf club head in a partially unlocked configuration, parts of securing element 18527, cover recess 18537, slidable cover 18530, cover through hole 18531, fastener 18532, and/or other components may be more apparent in this view. Securing element 18527 may be illustrated interfacing and or partially engaging with cover recess 18537. In the diagonal position, securing element 18527 and cover recess 18537 may prevent movement about a vertical axis and a horizontal axis.

Figure 82:
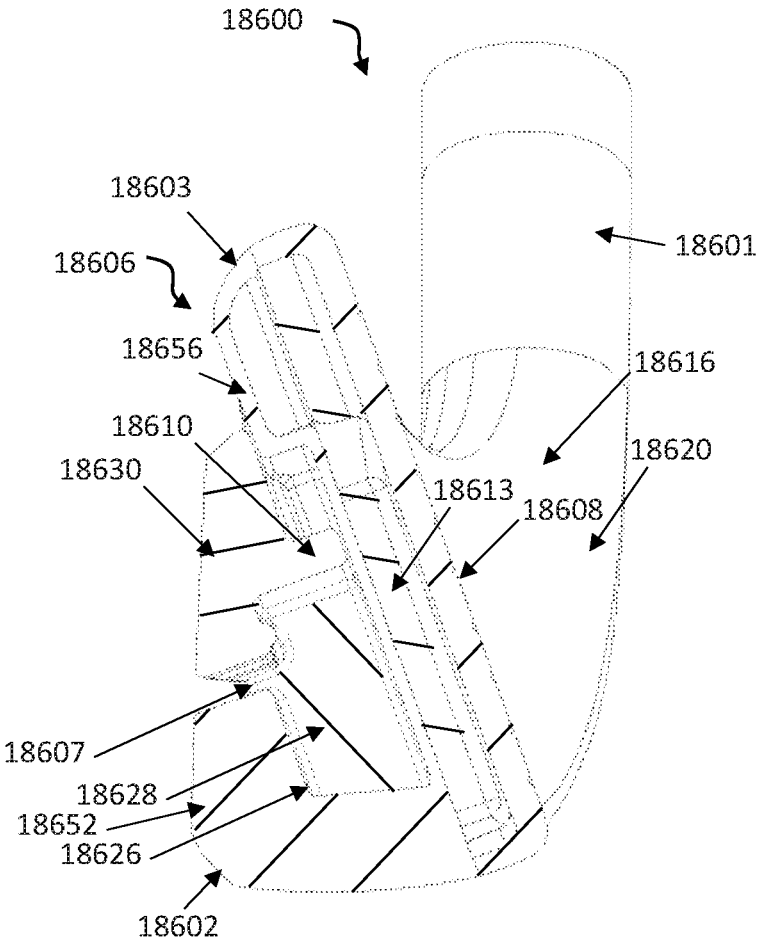
FIG. 82 illustrates a cross-sectional view of a golf club head taken substantially along line 186-186' in FIG. 75, in accordance with one or more embodiments of the presently disclosed technology.

FIG. 82 illustrates a cross-sectional view of a golf club head taken substantially along line 186-186' in FIG. 75, in accordance with one or more embodiments of the presently disclosed technology. FIG. 82 illustrates components that may be the same or substantially similar to components illustrated in FIGS. 59, 69, 73, 74, 76, 78, and 80. For example, modular golf club head 16300, hosel 16301, sole 16302, top 16303, weight assembly 16304, body 16306, toe 16314, heel 16316, outer surface 16320, recessed channel 16326, movable weight 16328, second cover surface 16389, third cover surface 16391, weight through hole 17329, weight protrusions 17393, recessed channel protrusions 17399, recessed channel 17726, slidable cover 17730, cover through hole 17731, fastener 17732, cover notches 17738, back 17750, lower back surface 17752, upper back surface 17756, first cover surface 17787, weight through hole 17829, first recessed channel surface 18009, second member 18074, second member blind hole 18079, securing element 18227, and/or cover recess 18437 may be the same as or substantially similar to modular golf club head 18600, hosel 18601, sole 18602, top 18603, weight assembly, body 18606, toc, heel 18616, outer surface 18620, recessed channel 18626, movable weight 18628, second cover surface, third cover surface, weight through hole, weight protrusions, recessed channel protrusions, recessed channel 18626, slidable cover 18630, cover through hole, fastener, cover notches, back 18650, lower back surface 18652, upper back surface 18656, first cover surface, weight through hole, first recessed channel surface, second member, second member blind hole, securing element, and/or cover recess. In this cross-sectional view of a golf club head in a partially unlocked configuration, parts of modular golf club head 18600, sole 18602, top 18603, body 18606, slidable cover 18630, and/or other components may be more apparent in this view. Movable weight 18628 may include a weight bump 18607. Weight bump 18607 may provide a secure fit with surface area between slidable cover 18630 and movable weight 18628. Weight bump 18607 may provide a visual indication of a fixed position of movable weight 18628 in a locked configuration. Body 18606 may include material 18613 between a front of recessed channel 18626 and a striking face 18608. Material 18613 may include a polymer, a metal, a plastic, a composite, and/or other materials. Material 18613 may extend across the entire striking face. Material 18613 may provide a user with a solid feel. Material 18613 may improve sound clamping and feel. For example, material 18613 may produce a blade-like feel for a user. Material 18613 may improve rebound characteristics of striking face 18608. Rebound characteristics may include the feel of striking face 18608 of modular golf club head 18600 on impact, the longevity of modular golf club head 18600, how much striking face 18608 warps or bends on impact, and/or other rebound characteristics. In embodiments, material 18613 may be in a cavity separate from recessed channel 18626 or the rest of modular golf club head 18600. In some embodiments, material 18613 may only cover parts of the striking face. This may cause more forgiveness across the striking face resulting in more consistent shots throughout the striking face.

Slidable cover 18630 may include a cover rail 18610. Cover rail 18610 may engage with movable weight 18628. Cover rail 18610 may help secure movable weight 18628 in a locked configuration and may help prevent unwanted movement of movable weight 18628. Cover rail 18610 may limit a vertical clearance of slidable cover 18630. As illustrated, cover rail 18610 may be perpendicular from striking face 18608. In some embodiments, cover rail 18610 may be differently shaped, sized, and/or dimensioned without departing from the spirit and scope of the presently disclosed technology.

Other than in at least some of the operating examples, or unless otherwise expressly specified, all of the numerical ranges, amounts, values and percentages such as those for amounts of materials, moment of inertias, center of gravity locations, loft, angles, various ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and appended claims are approximations that may vary depending upon the desired properties sought to be obtained by the presently disclosed technology. At the very least, and not as an attempt to limit the application of the doctrine of equivalents to the scope of the claims, each numerical parameter should at least be construed in light of the number of reported significant digits and by applying ordinary rounding techniques.

The numerical ranges and parameters setting forth the broad scope of the presently disclosed technology are approximations. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

While various embodiments of the disclosed technology have been described above, it should be appreciated these are examples only, and not limiting. Likewise, the various figures may depict an example configuration or structure to aid in understanding the features and functionality that can be included in the disclosed technology. The presently disclosed technology is not intended to be restricted to the illustrated example configurations and structures, and the desired features can be implemented with a variety of alternative configurations and structures. It may be apparent to one of skill in the art how alternative embodiments can be implemented to impart the desired features of the presently disclosed technology. Therefore, it will be understood that the appended claims are intended to cover all such modifications and embodiments, which would come within the spirit and scope of the presently disclosed technology.

While the presently disclosed technology may be described herein in terms of various exemplary embodiments, it should be understood that the various features described in any individual embodiment is not limited to its particular embodiment, and can be applied, whether alone or in combinations with features of other embodiments, to another embodiment, whether or not such an embodiment is described herein or described as part of a single embodiment. Thus, the breadth and scope of the presently disclosed technology should not be limited to any of the above-described exemplary embodiments.

Words, phrases, and their variations that are used herein, unless otherwise expressly stated, should be construed as open ended, not as limiting. For example, the term "include" should be read to mean "include, without limitation"; the term "example" should be read to mean the following provides exemplary instances, not an exhaustive or limiting list thereof; "a" or "an" should be read as meaning "at least one," "one or more" etc.; and "traditional," "normal," and similar terms should not be construed as limiting to a given time period, but should be read to encompass traditional, normal, like technologies that may be known now or at any future point. In addition, references herein to technologies that would be apparent or known to one of ordinary skill in the art includes such technologies that are apparent or known to one of ordinary skill in the art now or at any time in the future.

The presence of words and phrases such as "one or more," "at least," "not limited to," or other similar phrases shall not be read to necessarily mean that the narrower case is intended in instances where such broadening phrases may be absent. The presence of words such as "first," "second," or other similar words shall not be read to mean that there can only be one or two elements.

Although specific embodiments and aspects were described herein and specific examples were provided, the scope of the technology is not limited to those specific embodiments and examples. For instance, while many of the present examples have been depicted particularly for use with a driver, a fairway metal, and an iron, any the present technology may be applied to any metal wood, fairway metal or wood, iron, or hybrid golf club. Further, each of the above examples may be combined with another and/or one or more features of some examples may be combined with other examples. One skilled in the art will recognize other embodiments or improvements that are within the scope and spirit of the present technology. Therefore, the specific structure, acts, or media are disclosed only as illustrative embodiments. In addition, if the limits of the terms "about," "substantially," or "approximately" as used in the following claims are unclear from the foregoing specification to one having skill in the art, those terms shall mean within ten percent of the value described. The scope of the technology is defined by the following claims and any equivalents therein.

What is claimed is:

1. A modular golf club head comprising:
a body comprising:
a striking face; and
a back extending rearward from at least a part of the striking face, wherein the back comprises:
a recessed channel; and
a weight assembly comprising:
a movable weight installable within the recessed channel and movable therein;
a slidable cover to engage at least part of the recessed channel, wherein the slidable cover comprises a cover through hole, wherein the cover through hole is on a toe end of the cover, wherein an axis of the cover through hole is substantially parallel to a toe-to-heel axis, wherein the slidable cover engages the at least part of the recessed channel in a sliding direction, and wherein the sliding direction comprises a toe-to-heel direction; and
a fastener to secure the slidable cover to the body.

2. The modular golf club head of claim 1, wherein an axis of the cover through hole is at an angle theta θ, and wherein the angle theta θ is measured from a heel-to-toe axis toward a bottom-to-top axis.

3. The modular golf club head of claim 1, wherein the cover through hole is substantially parallel to a back-to-front axis.

4. The modular golf club head of claim 1, wherein the sliding direction is at an angle theta θ, and wherein the angle theta θ is measured from a heel-to-toe axis toward a bottom-to-top axis.

5. The modular golf club head of claim 1, wherein the sliding direction further comprises a bottom-to-top direction, such that the sliding direction is diagonal.

6. The modular golf club head of claim 1, wherein installing the weight assembly provides a uniform appearance to the modular golf club head.

7. The modular golf club head of claim 1, wherein the slidable cover comprises a first cover portion and a second cover portion, wherein the first cover portion comprises a first material and a second cover portion comprises a second material, and wherein the first material is denser than the second material.

8. The modular golf club head of claim 1, wherein the movable weight comprises a first weight portion and a second weight portion, wherein the first weight portion comprises a third material and a second weight portion comprises a fourth material, and wherein the third material is denser than the fourth material.

9. A modular golf club head comprising:
a body comprising:
a striking face; and
a back extending rearward from at least a part of the striking face, wherein the back comprises:
a recessed channel; and
a weight assembly comprising:
a movable weight installable within the recessed channel and movable therein;
a slidable cover to engage at least part of the recessed channel, wherein the slidable cover comprises:
a cover through hole, wherein the cover through hole is on a toe end of the cover, and wherein an axis of the cover through hole runs substantially parallel to a heel-to-toe axis; and a fastener to secure the slidable cover to the body, wherein the fastener is insertable into the cover through hole.

10. The modular golf club head of claim 9, wherein the cover comprises a first cover portion and a second cover portion, wherein the first cover portion comprises a first material and a second cover portion comprises a second material, and wherein the first material is denser than the second material.

11. The modular golf club head of claim 9, wherein the movable weight comprises a first weight portion and a second weight portion, wherein the first weight portion comprises a third material and a second weight portion comprises a fourth material, and wherein the third material is denser than the fourth material.

12. A modular golf club head comprising:

a body comprising:

a striking face; and a back extending rearward from at least a part of the striking face, wherein the back comprises:

a recessed channel; and an weight assembly comprising:

a movable weight installable within the recessed channel and movable therein;

a slidable cover to engage at least part of the recessed channel, wherein the slidable cover at least partially covers the recessed channel and the movable weight, and wherein the slidable cover comprises:

a cover through hole, wherein the cover through hole is on a toe end of the cover, and wherein an axis of the cover through hole is substantially parallel to a toe-to-heel axis; and a fastener to secure the slidable cover to the body, wherein the fastener is insertable into the cover through hole.

13. The modular golf club head of claim 12, wherein a vertical gap is provided between a bottom of slidable cover and a top of the recessed channel in a locked configuration, providing a visual indication of a position of the movable weight along the recessed channel.

14. The modular golf club head of claim 13, wherein an axis of the cover through hole is at an angle theta θ, wherein the angle theta θ is measured from a heel-to-toe axis toward a bottom-to-top axis.

15. The modular golf club head of claim 13, wherein an axis of the cover through hole is substantially parallel to a back-to-front axis.

16. The modular golf club head of claim 13, wherein an axis of the cover through hole is substantially perpendicular to the striking face.

17. The modular golf club head of claim 12, wherein the cover comprises a first cover portion and a second cover portion, wherein the first cover portion comprises a first material and a second cover portion comprises a second material, and wherein the first material is denser than the second material.

18. The modular golf club head of claim 12, wherein the movable weight comprises a first weight portion and a second weight portion, wherein the first weight portion comprises a third material and a second weight portion comprises a fourth material, and wherein the third material is denser than the fourth material.

19. The modular golf club head of claim 12, wherein installing the weight assembly provides a uniform appearance to the modular golf club head.

* * * * *